US011627781B2

(12) United States Patent
Chechile

(10) Patent No.: US 11,627,781 B2
(45) **Date of Patent: *Apr. 18, 2023**

(54) SPORT SHOE OF THE SELF-CLEANING VARIETY WITH A COMPRESSIBLE CLEANING STRUCTURE

(71) Applicant: Anthony Louis Chechile, Hicksville, NY (US)

(72) Inventor: Anthony Louis Chechile, Hicksville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/547,149

(22) Filed: Dec. 9, 2021

(65) Prior Publication Data

US 2022/0095746 A1 Mar. 31, 2022

Related U.S. Application Data

(60) Continuation of application No. 17/362,991, filed on Jun. 30, 2021, now Pat. No. 11,517,076, which is a division of application No. 16/247,440, filed on Jan. 14, 2019, now Pat. No. 11,089,839.

(60) Provisional application No. 62/617,535, filed on Jan. 15, 2018.

(51) Int. Cl.
*A43C 15/16* (2006.01)
*A43B 13/26* (2006.01)

(52) U.S. Cl.
CPC ..... *A43C 15/165* (2013.01); *A43B 13/26* (2013.01); *A43C 15/168* (2013.01)

(58) Field of Classification Search
CPC ..... A43B 13/26; A43B 13/22; A43C 15/165; A43C 15/168
See application file for complete search history.

(56) References Cited

U.S. PATENT DOCUMENTS 1,313,118 A * 8/1919 Santacroce ..... A43B 13/223 36/59 C
4,146,979 A * 4/1979 Fabbrie ..... A43C 15/167 36/67 D
4,466,205 A * 8/1984 Corbari ..... A43C 15/161 36/62
5,768,802 A * 6/1998 Bramani ..... A43B 7/146 36/35 R (Continued)

FOREIGN PATENT DOCUMENTS

GB 2313999 A 12/1997
NO PCT/US2021/039728 A 10/2021

*Primary Examiner* — Ted Kavanaugh
(74) *Attorney, Agent, or Firm* — Alfred M. Walker

(57) ABSTRACT

A self-cleaning sport shoe includes a traction member or plurality thereof, extending downward from the bottom of the shoe to traction the playing field surface below upon contact. The self-cleaning sport shoe incorporates a compressible cleaning structure, smaller in size and less cumbersome than existing cleaning type cushions and which is symbiotically mated, when applicable, to a concave reservoir located in the sport shoe outer sole, and in certain instances of design both the outer sole and accommodatingly shaped mid sole as well. As the structure is compressed and expanded, debris that might otherwise remain attached is discarded. This concave reservoir appreciably enhances the cleaning ability of its compressible cleaning structure and the shoe as a whole.

7 Claims, 84 Drawing Sheets

(56) References Cited

U.S. PATENT DOCUMENTS

| | | | | |
|---|---|---|---|---|
| 6,029,377 | A * | 2/2000 | Niikura | A43B 13/223 36/67 R |
| 9,439,474 | B2 * | 9/2016 | Braunschweiler | A43B 13/186 |
| 11,089,839 | B1 * | 8/2021 | Chechile | A43B 13/14 |
| 11,517,076 | B2 * | 12/2022 | Chechile | A43C 15/161 |
| 2016/0278484 | A1 * | 9/2016 | Aslani | A43B 13/223 |
| 2016/0286904 | A1 * | 10/2016 | Bauduin | A43C 15/161 |

* cited by examiner

SPORT SHOE OF THE SELF-CLEANING VARIETY WITH A COMPRESSIBLE CLEANING STRUCTURE

RELATED APPLICATIONS

This application is a continuation of application Ser. No. 17/362,991 filed on Jun. 30, 2021, which '991 application is a division of application Ser. No. 16/247,440, filed Jan. 14, 2019, now U.S. Pat. No. 11,089,839 dated Aug. 17, 2021, which '440 application claims benefit under 35 USC § 119 (e) of provisional application No. 62/617,535 filed on Jan. 15, 2018. The '991, '440 and '535 applications are incorporated by reference herein. This application claims benefit under 35 USC § 120 from the '991, 440 and '535 applications. This application also claims priority from Patent Cooperation Treaty (PCT) international application number PCT/US21/39728, filed Jun. 29, 2021.

FIELD OF THE INVENTION

The present invention relates to self-cleaning footwear.

BACKGROUND OF THE INVENTION

It should be pointed out and made universally clear to all those reading this text that the term traction member refers to and is inclusive of non-metal and metal cleats and/or spikes, both of the removable and/or permanently fixated types, and that regardless of those particular instances in which one traction member type rather than another may be duly noted and explained in the text to follow, the conceptual basis for this patent remains the same and is applicable to any and all those traction member types.

It is the essence of this invention that its self-cleaning ability of its traction member bottom will provide the wearer of the shoe optimal traction between the cleaned shoe bottom and playing field surface with each and every step, affording the wearer excellent footing, thereby enhancing their athletic performance and reducing their susceptibility to a fall or a twist of their leg and the various types of potential bodily injuries, e.g., strains, sprains, fractures, etc., which may otherwise result. This self-cleaning mechanism by design will act to inhibit the adhesion to and clogging of the shoe bottom traction members with various forms of debris, as well as those elements associated with poor weather conditions found on both natural grass and artificial synthetic playing field surfaces, including, but not limited to, grass, sticks, dirt, water, rocks, mud, gravel, sand, ice, sleet, snow, etc., by greatly reducing the likely ill effects various debris and elements may present to the wearer on such playing field surfaces via its self-cleaning ability, this invention would be in sharp contrast to the comparative compromise in traction ability and footing provided by any and all sport shoes not of the self-cleaning type. Due to its ability to provide a cleaned traction member shoe bottom, this invention of a self-cleaning sport shoe is able to ensure optimal traction, footing, stability, and safety for the wearer with each and every step on the playing field surface.

Prior to this invention sport shoes of the self-cleaning type were provided with metal spikes attached to the bottom of the shoe for the purpose of securing the wearer's footing to the ground. One previously proposed invention is U.S. Pat. No. 6,698,110, by Robbins, granted on Mar. 2, 2004, for a spiked shoe having a spike cleaning cushion. In the description by Robbins of the background of the invention, his discussion of the related art is specific in designating the proposed invention as a spiked shoe that retains its ability to create traction and in which the spikes are continuously cleaned.

Robbins, whose invention's conceptual basis of a spiked sport shoe to be specifically intended for use on natural grass field playing surfaces is made clear by his statement in his discussion of the related art in which he refers to "games that are played out of doors or on grass-type playing fields," as the type of playing field surface his spiked shoe is appropriate for. He further clarifies his intentions for his invention's use to be specific and limited to only natural grass playing field surfaces with his explicit referral to "mud" and "muddy" field conditions, which solely being confined to natural grass playing field surfaces, is the basis for his reasoning that, "there is a need for a spiked shoe that retains its ability to create traction and in which the spikes are continuously cleaned." Therefore, it should be apparent to all those familiar in the art that such a spike structure, by definition, infers being of such a specific spike shape, which leaves an unfulfilled need, which Robbins neither conceives, intends, or presents in his patent, for a self-cleaning cleat sport shoe of any type, metal and/or non-metal, as presented in the patent of the present invention, whose comparative advantages over other sport shoes will become apparent in the following patent literature.

Additional prior patent designs, lacking in an accommodating type of concave reservoir space as conceived and to be presented in the present invention, include U.S. Pat. No. 4,146,979 of Fabbrie, U.S. Pat. No. 4,271,608 of Tomura, U.S. Pat. No. 4,466,205 of Corbari, in addition to that of the aforementioned U.S. Pat. No. 6,698,110 of Robbins.

Another previously proposed invention of WO 2015/073645 A1 of Nike Innovate C.V. discloses shoes with a self-cleaning surface including grooves and/or indentations which support resilient members near the cleats that spring back against mud. However, Nike Innovate C.V. '645 A1 does not provide any enabling evidence of how the resilient members actually occupy the grooves and/or indentations below the sole plate of the shoe. Another prior art, also of Nike Innovate C.V., in WO 2015/073636 A1 describes self-cleaning shoes but uses complicated resilient springs of varying shapes, which do not surround the cleats, and which also require an extensive protective web between the bottom of the spring and the ground surface.

OBJECTS OF THE INVENTION

One object of the present invention is to provide a self-cleaning cleat sport shoe, which by design in its ability to clean itself enhances athletic performance and reduces risks of injury to individuals who participate in field sports. It is widely known that the wearing/use of a spiked sport shoe, of the metal and/or non-metal type, has no place in many field sports, particularly team sports, and the wearing/use of such is strictly prohibited by these sports governing bodies, e.g., associations, clubs, leagues, organizations, etc., as mandated by their adopted rules and protocols dictating as such, regardless of the playing field surface type, due to the direct and often common result of injury to participants upon bodily contact with said spikes. Such team sports as, but not limited to, soccer, football, lacrosse, rugby, etc., in which physical contact is not only inherent but encouraged of the participants in order to achieve individual success and ultimately team victory, to an overwhelming degree have all but eliminated the wearing/use of spiked sport shoes of all types due to their clearly heightened risk of injury to the participants. It is also worth noting that those individuals participating in playground type leisure sports tend to make the voluntary choice to wear/use a cleat sport shoe versus a spiked sport shoe of any type in order to avoid such injury risks.

Another paramount need for this invention is brought about by the universal reality that the wearing/use of a spiked sport shoe, of any type, and particularly those of the metal type, is strictly prohibited on any and all synthetic field playing surfaces, regardless if of the self-cleaning type or not, due to the increased likelihood of said spikes causing certain physical damage and costly financial repairs if worn on such synthetic playing field surfaces. Such risk of damage is minimized, and all but avoided, by compliance with the prohibitory rules forbidding the wearing/use of spiked sport shoes, be they self-cleaning or not, and of the metal and/or non-metal type, on synthetic field playing surfaces. This leaves the cleat sport shoe of the non-metal type as the only suitable choice for wear/use on synthetic field playing surfaces, with only a negligible, if any at all, risk of surface damage. Thus, it could be reasoned that a self-cleaning non-metal cleat sport shoe may be worn by participants in field team sports on both synthetic and natural grass field playing surfaces alike, opposed to all those spiked type sport shoes which are strictly prohibited for a number of the aforementioned reasons, and metal cleat sport shoes of any type, being self-cleaning or not, which can only be worn/used on natural grass.

In addition, with the self-cleaning non-metal cleat sport shoes qualities equally adaptable to both natural grass and synthetic field playing surfaces alike, even if one denies the clear heightened risks of bodily harm and injury to the participants directly related to the wearing/use of any type of metal and/or non-metal spiked sport shoe, there still remains a fiscal advantage for the purchaser/consumer in them choosing the non-metal cleat sport shoe of the self-cleaning type over any and all types of spiked and metal cleat sport shoes, regardless if they are self-cleaning or not. That advantage is, if an individual did wear any type of a spiked or metal cleat sport shoe, be it self-cleaning or not, on a grass field playing surface, they would be prohibited to do so on a synthetic field playing surface, requiring an additional purchase of a non-metal cleat sport shoe. Thus, the self-cleaning non-metal cleat sport shoe would be the only sport shoe one would be required to purchase, it being allowed for wear/use on any and all sport playing field surfaces, affording the purchaser/consumer both cost effectiveness and its self-cleaning ability all in the same one shoe.

The literature thus far explaining this invention, its attributes, and abilities, serves as a proclamation to the superiority of a self-cleaning cleat sport shoe, especially of the non-metal type, in comparison to all cleat sport shoes not of the self-cleaning type, and any and all metal spiked sport shoe types.

SUMMARY OF THE INVENTION

The conception of the present invention remains the same regardless of the materials used in the construction of a sport shoe of the self-cleaning type regarding an upper, an inner sole, a mid sole, a mobile layer, an outer sole, a traction member, a compressible cleaning structure, etc., and how many layers these aforementioned entities and those to be described which follow may consist of and where located when they perform and carry out their respectively described functions which they are true to. The compressible material of the compressible cleaning structure, regardless of materials of construction, will be of a lesser durometer relative to that of the traction member it surrounds/is associated with, so to still be compressible relative to that pressure applied to itself and the shoe bottom/outer sole, so that the compressible cleaning structures may be compressed as need be and carry out its intended conceived functions as described during play/wear of the shoe. The materials used in construction of the compressible material of the compressible cleaning structure may be of a particular choice due to factors such as the characteristics associated with the wearer of the shoe and/or the playing field surface. For instance, those wearers of such a shoe of a lighter body weight may be provided with a compressible cleaning structure constructed of a softer compressible material relative to those wearers of a heavier body weight, and in regard to the playing field surface, a compressible cleaning structure to be employed on a soft and damp surface may be constructed of a softer compressible material relative to a compressible cleaning structure to be employed on a hard and dry surface. The compressible cleaning structure plantar surface may be slightly distal, even with, or proximal to the most distal point of that traction member it is associated with when expanded/non-compressed in the non-weight bearing mode, however, when fully compressed at some point in the weight bearing mode, the compressible cleaning structure will be proximal to the most distal point of the traction member, with that traction member fully exposed/extended/protruded. The compressible cleaning structure may be constructed of one and/or more layers and materials, integrated as one cushion/compressible cleaning structure and/or more than one structure consisting of several segments which surround and serve to clean that traction member, with these compressible cleaning structures surrounding none, one, and/or more traction members. The compressible cleaning structure, constructed of any suitable material, may be separate from and/or integrated to the shoe bottom/outer sole surface of the shoe by any suitable manufacturing process so to be permanently attached to the sport shoe of the self-cleaning type, be it if such a shoe is with traction members of the permanent and/or removable type. The compressible cleaning structure and the traction member may both rotate about a central axis, or the compressible cleaning structure may only rotate about the central axis exclusively of the traction member, or the traction member may only rotate about the central axis exclusively of the compressible cleaning structure, or the compressible cleaning structure and traction member may rotate simultaneously or be connected to rotate as one about a central axis, or neither may rotate at all about a central axis.

A unique concept in design of the present invention is its incorporation of a compressible cleaning structure, smaller in size and less cumbersome than that cleaning type cushion offered by Robbins, symbiotically mated, when applicable, to a concave reservoir located in the sport shoe outer sole, and in certain instances of design both the outer sole and an accommodatingly shaped mid sole as well. This concave reservoir, to be explained later in this text, appreciably enhances the cleaning ability of its compressible cleaning structure and the shoe as a whole, to a level superior to those whose invention designs lack such a concave reservoir, such as Robbins.

In an embodiment, the invention provides a self-cleaning sport shoe. The self-cleaning sports shoe comprises a sole having an outer sole surface, an upper shoe body attached to the sole and configured with an opening for receiving a user's foot, at least one compressible cleaning structure contacting at one end to the outer sole surface and a traction member attached to the outer sole surface. During intended use, the at least one compressible cleaning structure is pressed by some part of the user's weight against a surface, and compressed thereby. Upon releasing the weight pressing the at least one compressible cleaning structure against the surface, the at least one compressible cleaning structure expands to its original shape. As such, a cycle of compression and then expansion back to its original, non-compressed shape effects the cleaning of each of said at least one traction member.

Preferably, the at least one compressible cleaning structure is shaped like a dome. For that matter, the at least one compressible cleaning structure is hollow. The at least one compressible cleaning structure also may comprise a sleeve surrounding the traction member. The outer sole surface may include a concave reservoir, wherein an adjacent end of the sleeve is positioned within the concave reservoir.

Preferably, the upper shoe body comprises leather and/or any other suitable material. An inner sole that is removably connected or attached to an inner sole surface of the sole. The sole comprises one or more of rubber, resin, plastic, foam, polyurethane and elastomers, resin, plastic, carbon fiber and KEVLAR®, or any other suitable material. The traction members include a base of origin, and wherein the traction members extend and protrude downwards from a place of attachment of the base of origin to the outer sole. The traction members are elongated unibody extensions of the outer sole material itself, and/or may comprise any of metal members, non-metal cleats, or non-metal spikes, of the permanent and/or removable type. The compressible cleaning structures provide kinetic means for physically cleaning the traction members. For that matter, the compressible cleaning structures are removable or temporarily fixated to be replaceable as the wearer sees fit using any suitable means such as VELCRO® or an adhesive strip.

In one form, the inventive self-cleaning shoe further comprises a concave reservoir. Alternatively, or additionally, the shoe comprises a mounting plate component. The mounting plate component provides a platform for the respective compressible cleaning structure to sit upon and attach, with a hole through a flat side center, referred to as a plate hole. The mounting plate component is incorporated in the compressible cleaning structures. For that matter, the inventive shoe may include that each of the compressible cleaning structures are formed with a central recess, and/or traction body hole, which is that central internal void in the compressible cleaning structure body, accommodatingly shaped to and in which the traction member is located, so the compressible cleaning structure may surround/clean that adjacent surface of the respective traction member as it sits in and occupies that central recess. In an alternative embodiment, the base of the traction members attach to a mobile layer and then extend through a complementarily shaped female hole, which cleans the surface of the traction member.

In the foregoing previous embodiments, the invention includes a self-cleaning sport shoe with a sole having an outer sole surface, an upper shoe body attached to the sole and configured with an opening for receiving a user's foot, at least one compressible cleaning structure attached to, and/or contacting, at one end to the outer sole surface and/or a mobile layer surface, and a traction member attached to a bottom surface of the outer sole, or mobile layer surface. The at least one compressible cleaning structure compresses in a weight bearing mode when a user's weight is applied, and returns to a non-compressed state when the weight is no longer applied, thereby allowing any debris attached to the structure or traction member to be released.

BRIEF DESCRIPTION OF THE DRAWINGS

The present invention can best be understood in connection with the accompanying drawings. The drawings may be diagrammatic and proportions may vary. It is noted that the invention is not limited to the precise embodiments shown in drawings, in which.

DETAILED DESCRIPTION OF THE INVENTION

Figure 1:
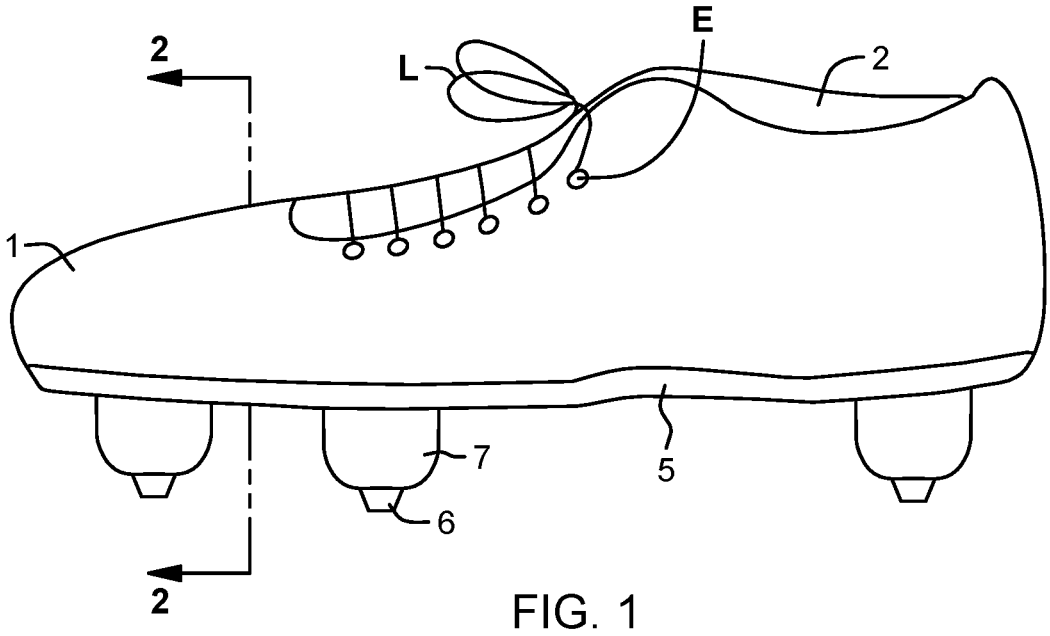
FIG. 1 shows a side view of a self-cleaning sport shoe of the preferred embodiment.
Figure 2:
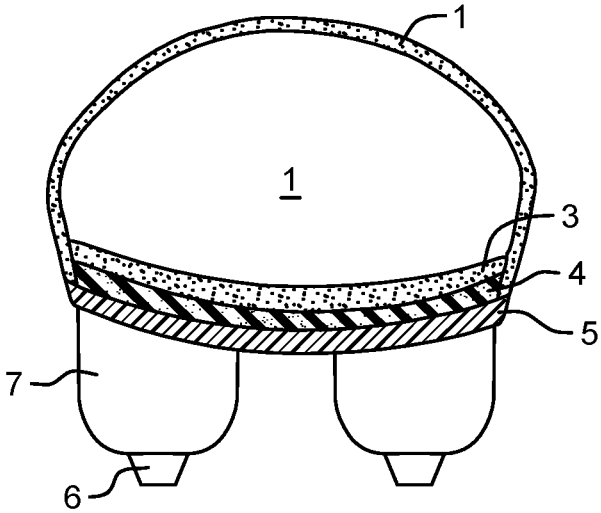
FIG. 2 shows a top to bottom frontal view in cross-section of FIG. 1 taken along the viewer's view line "2-2" of FIG. 1 of the shoe chamber cavity.
Figure 3:
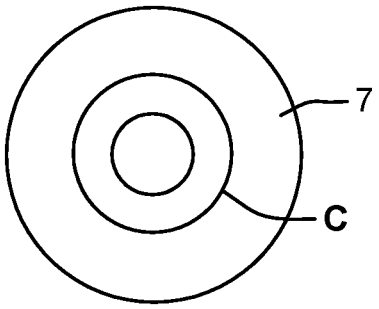
FIGS. 3, 4, 5, and 6, show a top plan, bottom, side, and left to right frontal view taken along an arbitrary mid line cross-section, respectively, of a compressible cleaning structure design lacking a mounting plate component, which may be applicable to/surrounding of a temporarily and/or permanently fixated cleat type traction member.
Figure 4:
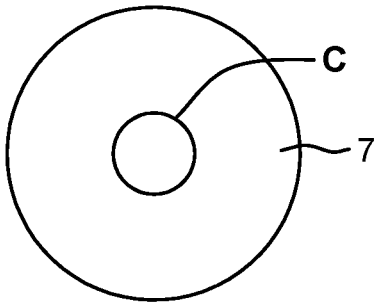
Figure 5:
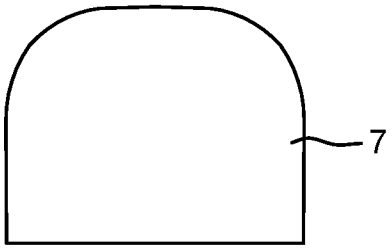
Figure 6:
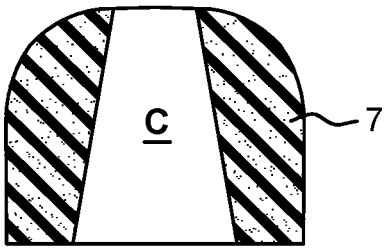
Figure 7:
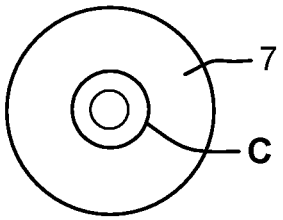
FIGS. 7, 8, 9, and 10, show a top plan, bottom, side, and left to right frontal view taken along an arbitrary mid line cross-section, respectively, of a compressible cleaning structure design lacking a mounting plate component, which may be applicable to/surrounding of a temporarily and/or permanently fixated spike type traction member.
Figure 8:
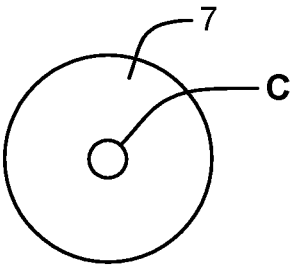
Figure 9:
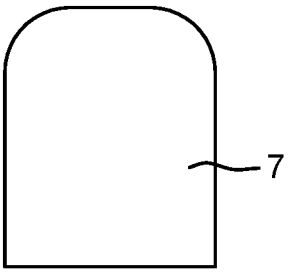
Figure 10:
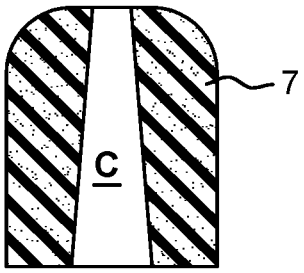

As shown in FIG. 1 and FIG. 2, this self-cleaning sport shoe of the present invention in its preferred embodiment forms would be constructed of an upper 1 of leather and/or any other suitable material, with an opening 2 provided to allow the wearer to insert their foot into the shoe which may be secured about the foot by the threading and tightening of a lace (L) through a plurality of eyelets (E), an inner sole 3 upon which that foot will rest, which sits atop a mid sole 4, serving as the bottom of the shoe chamber cavity, comprised, as a whole, of the upper 1, opening 2, inner sole 3, and the mid sole 4, along with any appropriate and/or additional padding, e.g., tongue, arch support, etc., all of which sit atop a shoe bottom/outer sole 5, from which a plurality of traction members 6 will attach to/originate from the shoe bottom/outer sole 5 plantar surface, where they will be surrounded/mated to a compressible cleaning structure 7, with such a self-cleaning sport shoe illustrated from a side view in FIG. 1, and in FIG. 2 from a top to bottom frontal view in cross-section of FIG. 1 taken along the viewer's view line of "2-2" of FIG. 1, with the volume of such a shoe chamber cavity about the foot of the wearer relatively constant when the foot is secured within that chamber, in this case, via laces (L), and/or any other suitable means, thus decreasing the potential of the foot to shift in the chamber cavity when worn, thereby reducing potential friction, abrasion, and associated discomfort, which may otherwise be created between the foot of the wearer and shoe chamber surfaces, ensuring a proper and comfortable fit.

That aforementioned mid sole 4, being permanently secured to the shoe upper 1 and/or outer sole 5 via stitching, adhesive, and/or combination of any suitable means is constructed of those suitable materials, e.g., rubber, resin, plastic, foam, polyurethane, elastomers, etc., and/or any other materials, which would enable its function to disperse weight and provide comfort and stability to the foot upon impact with the playing field surface. Below the mid sole 4, and secured to it and/or the upper 1, is the outer sole 5, which may be secured to either via stitching, adhesive, and/or any other suitable means, with the outer sole 5 constructed of durable materials, e.g., rubber, polyurethane, elastomers, resin, plastic, carbon fiber, KEVLAR®, etc., and/or any other suitable materials of the like used in outer sole 5 construction, which will ensure it maintains its designed form and function when subjected to those normally encountered forces during wear, whereby as it repeatedly impacts the ground it will continue to provide a vehicle by which its attached structures, and to some degree itself, will traction the playing field surface when doing so. It should be clear that in the present inventions referral to the outer sole 5, its particular function in any of its configurations is recognizable and not limited by the term "outer sole", which describes this layer as such, regardless if the outer sole 5 itself may, or may not contact the playing field surface as in those configurations in which a cleaning structure type, with or without a protective membrane layer 10 as to be described, covers the entirety of that shoe bottom/outer sole 5 and traction the playing field surface along with those traction members 6, whose bases emerge from the described layer referred to as the "outer sole", with such an outer sole 5 itself void of any contact with the playing field surface for the duration in which the shoe as a whole is contacting that playing field surface. In short, the assignment of the term "outer sole", as with all terms of the present invention, is used to refer to a particular design entity whose function and location is just as conceived and described in the text of the present invention, and does not allow others to disagree or dispute the appropriateness of the terms chosen on the mere basis of any preconceived notions as to what terms may be agreeable or appropriate when referring to, as done so, those respective entities in and of the present invention, particularly in the case of the "outer sole", nor does it allow them to refer to any such described entities using the same terminology employed in the present invention and assign such to different entities of the same like configurations, or assign different terminology altogether to those entities of these same like configurations, in an attempt to claim that which is the intellectual property of the present invention as their own.

The traction members 6 of the sport shoe, emerging from their base of origin and protruding downwards from the outer sole 5 so as to be positioned to traction the playing field surface upon contact, may be elongated unibody extensions of the outer sole 5 material itself, metal and/or non-metal cleat and/or spike type traction members 6, either permanently fixated/integrally attached, and/or removable/temporarily fixated to the outer sole 5 from which they protrude by any design means chosen, e.g., screws, rivets, adhesives, etc., with those temporary types affording the wearer the option to remove, repair, replace, etc., such as they see fit in order to achieve the peak functional performance of the shoe on the applicable playing field surface.

This invention's described ability particular to the self-cleaning of its traction members 6 is primarily achieved through the application of its compressible cleaning structures 7, which is that entity that provides the kinetic means by which these traction members 6 are physically cleaned. The compressible cleaning structures 7 materials of construction would be those best suited for a degree of compression and/or retraction with an accompanying physical reduction from its non-weight bearing girth/thickness directly related to those forces applied to the bottom of the shoe as it contacts the playing field surface, with the compressible cleaning structure 7 at this moment providing comfort by cushioning the impact with that playing field surface so to dampen the force ultimately applied to the foot of the wearer, until the compressible cleaning structure 7 is maximally compressed, as is most likely to occur at some point in the weight bearing mode of the shoe, and extension with an accompanying return in girth/thickness, proceeding gradually to its non-weight bearing level, directly related to the removal of those compressible forces applied to the shoe bottom/outer sole 5 as it gradually breaks contact with the playing field surface. The compression of the compressible cleaning structure 7 upon entering the weight bearing mode also serves to lessen the impact of that force applied to the shoe when contacting the playing field surface, providing cushioning, and ultimately comfort to the foot of the wearer. Springs, foam, silicone, rubber, polyurethane, a bladder filled with air, liquids, and/or gel, or any other suitable materials of a compressible nature, or combination thereof, may be employed in the construction of such compressible cleaning structures 7 of an adaptable girth/thickness with the required described traits, and be attached to the shoe bottom/outer sole 5 by any suitable means, either permanently, e.g., adhesive, stitching, molded body construction, etc., or temporarily, e.g., VELCRO® (V), an adhesive strip (AS), etc.

The text of the present invention refers to the compressible cleaning structure 7 configurations and the incorporation of such in sport shoes of the self-cleaning varieties as being of the preferred and/or alternative embodiments of the present invention. The present invention defines the sport shoes of the self-cleaning variety being of the preferred and/or alternative embodiments based on certain criteria which differentiates between the two. The preferred embodiments of the present invention are those self-cleaning sport shoe configurations incorporating those earlier described components in some form with their respective compressible cleaning structures 7 specifically, unless for reasons otherwise noted, attaching to/originating from their shoe bottom/outer sole 5, and not incorporating of a mobile layer 14 or a complementarily shaped female hole (I) in their configurations, as do those embodiments of the present invention, which in doing so, are described as being of the alternative embodiments. The compressible cleaning structures 7 of the preferred embodiments may be of the removable/temporarily fixated type, replaceable as the wearer sees fit, and secured/affixed to the shoe bottom/outer sole 5 by any suitable means, e.g., VELCRO® (V), an adhesive strip (AS), etc., or may be of the permanently fixated type, affixed to and/or originated from the shoe bottom/outer sole 5 by any suitable means, e.g., adhesive, molded body construction, stitching, etc.

The compressible cleaning structures 7 in the preferred embodiments of the present invention are conceived, except in those cases when otherwise noted, to be fully surrounding of the adjacent surfaces of those respective traction members 6 which they are mated to. The present invention also conceives, as to be presented and explained later in its alternative embodiment designs, of those compressible cleaning structures 7 which may fully, partially, and/or not at all surround the surfaces of the male shaped traction members 6 which attach to/originate from the mobile layer 14 in these respective alternative embodiments and extend through their complementary shaped female holes (I) which exit their shoe bottom/outer sole 5 plantar surface. These complementary shaped female holes (I), regardless of the respective compressible cleaning structures 7 of the alternative embodiments being fully, partially, and/or not at all surrounding of the surfaces of the male shaped traction members 6 which attach to/originate from the mobile layer 14, will serve to fully surround these male shaped traction members 6 when such extend through the complementary shaped female holes (I) exiting the shoe bottom/outer soles 5 plantar surface of these alternative embodiments. There are those instances in the alternative embodiments, to be explained later in this text, in which additional traction members 6 may be incorporated that attach to/originate from the plantar surface of the shoe bottom/outer sole 5, and may incorporate compressible cleaning structures 7 attached to/originated from the shoe bottom/outer sole 5 as well, with or without a concave reservoir 9 in the plantar surface of the shoe bottom/outer sole 5, with the compressible cleaning structures 7 fitted in the accommodatingly shaped concave reservoirs 9, when present, and fully surrounding of those respective traction members 6 attached to/originated from the shoe bottom/outer sole 5 in these alternative embodiments.

Upon full compression of the present invention's preferred and alternative embodiments respective compressible cleaning structures 7, the preferred embodiments compressible cleaning structures 7 and the alternative embodiments complementary shaped female holes (I), as well as when incorporated in the alternative embodiments, their compressible cleaning structures 7 which attach to/originate from the plantar surface of their shoe bottom/outer sole 5, regardless of their respective most distal plantar surfaces being proximal and/or distal to the most distal plantar surfaces of the traction members 6 they respectively surround when they themselves are fully extended in the non-weight bearing mode, will all coincidingly, upon full compression in the weight bearing mode the compressible cleaning structure 7, have their most distal plantar surfaces proximal to the most distal plantar surfaces of the respective fraction members 6 which they surround, thereby exposing these traction members 6 in order to traction the playing field surface upon contact.

The compressible cleaning structures 7 of the preferred embodiments, and those of the alternative embodiments which attach to/originate from the plantar surface of their shoe bottom/outer sole 5, as well as the complementary shaped female holes (I) of the alternative embodiments in their entirety, are all specifically designed to be in such close proximity to the adjacent surfaces of the respective fraction members 6 which they surround/are mated to, whereby during these embodiments transitions from the weight bearing to the non-weight bearing modes, the coinciding extension of the respective compressible cleaning structures 7 of the preferred embodiments and those of the alternative embodiments which attach to/originate from the plantar surface of their shoe bottom/outer sole 5 about those fraction members 6 which they respectively surround, as well as the relative extension of the respective complementary shaped female holes (I) coinciding with the actual retraction of the male shaped fraction members 6 which they respectively surround in the alternative embodiments, may result in contact/removal of any debris and/or materials from the adjacent surfaces of these embodiments respective fraction members 6, when present, due to the only minimal, if any space at all, available to be occupied between the adjacent surfaces by such debris and/or materials, thus providing all these embodiments with relatively clean fraction members 6, ready to traction the playing field surface during the ensuing weight bearing mode. In addition, it should be appreciated that any actual physical contact, by design or otherwise, between the adjacent surfaces of the compressible cleaning structures 7 of the preferred embodiments, and those of the alternative embodiments which attach to/originate from the plantar surface of their shoe bottom/outer sole 5, as well as the complementary shaped female holes (I) of the alternative embodiments in their entirety, and those traction members 6 which they all respectively surround/are mated to, would be beneficial, with such physical contact between the adjacent surfaces furthering the removal/cleaning of any debris and/or materials from their respective traction members 6 surfaces. The likelihood of such beneficial physical contact between these adjacent surfaces may be increased in certain instances of design in which the inner diameters of those compressible cleaning structures 7 of the preferred embodiments, and those of the alternative embodiments which attach to/originate from the plantar surface of their shoe bottom/outer sole 5, as well as the complementary shaped female holes (I) of the alternative embodiments in their entirety, at some or any point along their respective surfaces, are equal to or slightly smaller than the corresponding outer diameters of those traction members 6 surfaces which they respectively surround, thereby ensuring that at least at some moment while transitioning back and forth, and vice versa, between the extremes of the weight bearing and non-weight bearing modes, those structures will behave accordingly so as to perform their respective functions, and these respective adjacent surfaces will be certain to physically contact each other, thereby cleaning the traction member 6 surfaces.

The compressible cleaning structure 7 is generally a hollow, dome-shaped cushioning material surrounding the traction member (i.e. spike or cleat). When compressed by the ground, it compresses down, but rebounds back outward (down) when the foot is pulled up from the ground, for example, while running. In rebounding back, the compressible dome-shaped member releases or pushes mud and debris away from the spike or cleat, i.e., the traction member at the particular compressible cleaning structure.

Figure 120:
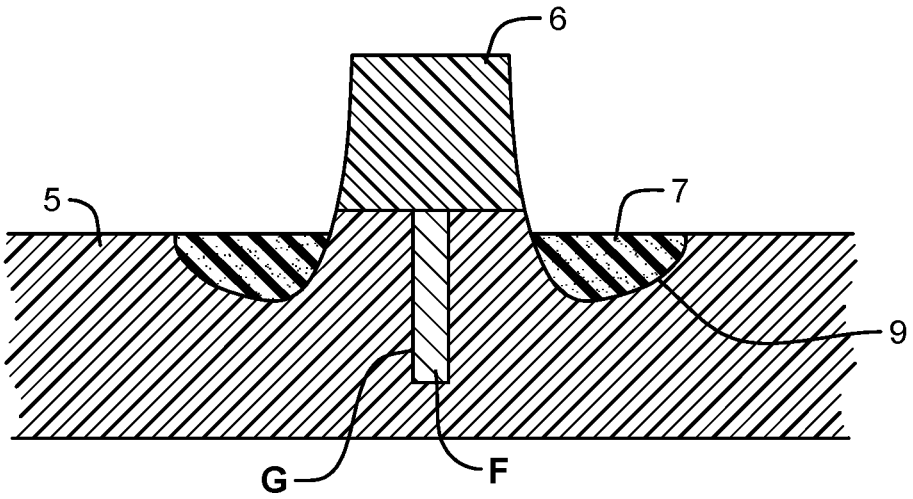

Preferably, the domed compressible cleaning structure embodies a "sleeve" surrounding the cleat or spike. The sleeve rests at its proximal (shoe sole contacting bottom) end within a "concave reservoir" 9 cut out of the outer shoe sole. (See drawing FIGS. 108, 109, 110 and 111). Compare the squeezed, compressed state of domed cushioned cleaning structure 7 in concave reservoir 9 of FIG. 120 to that of the domed cushioned cleaning structure 7 shown expanded and uncompressed above concave reservoir 9 in FIG. 121. See also optional fasteners in detail view on the right side of FIG. 173 and optional negative space "flying saucer" flattened elliptical void in space 44 of FIG. 174, or the concave "bowl shaped" void in space 44 of FIG. 176, that help to disperse or distribute ground reactive forces of the turf exerted against the bottom of the wearer's foot. Other geometric configurations may be provided for the void in space 44, other than the flattened elliptical flying saucer shaped void in space 44 of FIG. 174 or the concave bowl-shaped void in space 44, of FIG. 176.

In some instances of the present invention, the construction of the compressible cleaning structure 7 as a whole may be comprised of a configuration in which it is fixated, either temporarily or permanently, by any suitable means, to a mounting plate component (A) constructed of rubber, nylon, KEVLAR® (i.e. polyparaphenylene terephthalamide), carbon fiber, TEFLON® (i.e. polytetrafluoroethylene), polyurethane, elastomers, plastic, resin, or any other suitable materials, which will serve as a stable surface upon which the compressible cleaning structure 7 will sit and attach, with the opposite side of that mounting plate component (A) to which the compressible cleaning structure 7 attaches serving as a stable surface area which will interface and attach, by any suitable means of fixation, e.g., VELCRO® (V), an adhesive strip (AS), a screw-notch lock mechanism, etc., to the plantar surface of the shoe bottom/outer sole 5, be it if the shoe does or does not incorporate a concave reservoir 9 in its configuration. This mounting plate component (A), in addition to all those already mentioned materials of construction, may be constructed of malleable shape conforming materials such as various thermoplastics, moisture-curing polymers, light-curing polymers, and other materials of the like to be utilized, when chosen, primarily in those mounting plate components (A) particular to compressible cleaning structure 7 configurations intended as an aftermarket item, offering their self-cleaning ability to the wearer of those manufactured/production sport shoe designs lacking in such a conceived self-cleaning ability, to be installed/attached on such sport shoes by the wearer. These materials would allow the wearer to fit and shape the mounting plate component (A) accordingly, with it eventually hardening in shape so as to conform to the shoe bottom/outer sole 5 to which it is fitted and will attach. This conforming shape of the mounting plate component (A) would ensure ideal surface area contact, along with a tight and close fit between its own surface and that of the shoe bottom/outer sole 5, when fixated by whatever suitable means chosen, e.g., VELCRO® (V), an adhesive strip (AS), etc. Such malleable shape conforming materials are less likely to be used in the construction of those mounting plate components (A) incorporated in those compressible cleaning structures 7 specifically designed and provided for those already manufactured/production forms of sport shoes of the self-cleaning variety, primarily because those compressible cleaning structures 7 would be readily available with mounting plate components (A) in a manufactured/production form of an ideal exact fitting shape, already conforming to that shape of the self-cleaning sport shoe bottom/outer sole 5. Such manufactured/production forms of compressible cleaning structures 7 may be lacking in or incorporating of a mounting plate component (A) in their respective configurations, and of an ideal exact fitting and conforming shape, which would either be initially included in the original purchase of such self-cleaning varieties of sport shoes in their entirety, available as an aftermarket replacement for a worn and/or damaged compressible cleaning structure 7, or as an aftermarket item capable of having such a compressible cleaning structure 7 added whenever the wearer sees fit, but for whatever reason did not possess such a compressible cleaning structure 7 when originally purchased.

The present invention offers the following examples of compressible cleaning structure 7 configurations which do or do not incorporate a mounting plate component (A) in their respective designs as a whole, with the conception that such a mounting plate component (A) may be transposed upon any of the examples of compressible cleaning structures 7 lacking in, or removed from any of those configurations possessing of a mounting plate component (A), in all respective compressible cleaning structure 7 configurations of the present invention. Consideration for any alterations/modifications required will be made in these compressible cleaning structure 7 configurations for the presence and/or removal of the respective mounting plate component (A) in terms of how they are physically accounted for in the construction of the compressible cleaning structure 7 configurations as a whole, and regardless of varying physically to some degree in terms of size, shape, and any other issues due to the now present or absent mounting plate component (A), will still be considered compressible cleaning structure 7 configurations as a whole of the present invention. In fact, all the respective figures and descriptions of the designs in the text to follow are presented for the purpose of illustrating examples of such and not for the purpose of limiting the conceptions of the present invention to the same, with it understood that any and all respective designs as illustrated in those respective figures and descriptions may vary to a degree in terms of size, shape, materials of construction, etc., and still remain as a design conceived and the intellectual property of the present invention.

The present invention conceives of its intellectual properties/entities/components to be incorporated in fully manufactured/fabricated sport shoe designs of the self-cleaning variety in their entirety, with any and all these of the removable/temporarily fixated type offered as an aftermarket item separately and/or together, to the wearer so as to allow them to remove, install, repair, replace, etc., any and all such items at their discretion. The following components from the present invention are conceived to be available separately and/or together, to be retrofitted, when applicable, as an aftermarket item(s) to those cleat and/or spiked sport shoes alike whose inventors' conceptions and designs lacked the foresight of such a compressible cleaning structure 7 application and its accompanying self-cleaning abilities in their own sport shoe designs. The compressible cleaning structures 7, mounting plate components (A), and/or traction members 6 of these types would allow the wearer the ability to attach such components at their discretion, by any suitable means, e.g., VELCRO® (V), an adhesive strip (AS), etc., providing those previously lacking self-cleaning abilities to such respective shoe designs.

Figure 11:
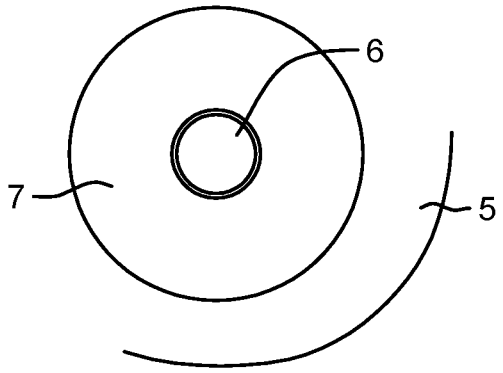
FIG. 11 shows a bottom view and FIG. 12 shows a left to right frontal view taken along an arbitrary mid line cross-section of that compressible cleaning structure design shown in FIGS. 3, 4, 5, and 6, fixated via VELCRO® to the shoe bottom/outer sole, non-compressed, in the non-weight bearing mode, with a cleat type traction member protruding through the fraction body hole.
Figure 12:
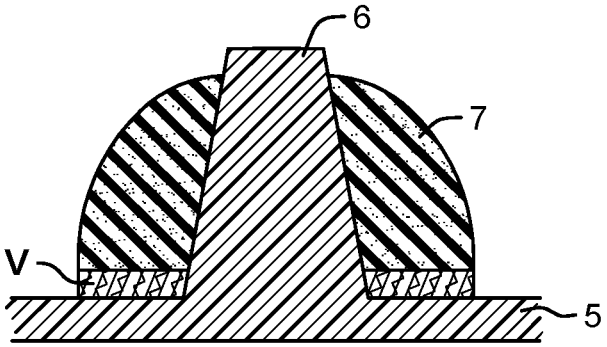
Figure 13:
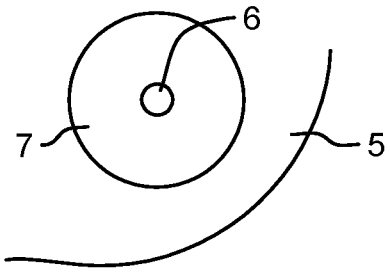
FIG. 13 shows a bottom view and FIG. 14 shows a left to right frontal view taken along an arbitrary mid line cross-section of that compressible cleaning structure design shown in FIGS. 7, 8, 9, and 10, fixated via VELCRO® to the shoe bottom/outer sole, non-compressed, in the non-weight bearing mode, with a spike type fraction member protruding through the fraction body hole.
Figure 14:
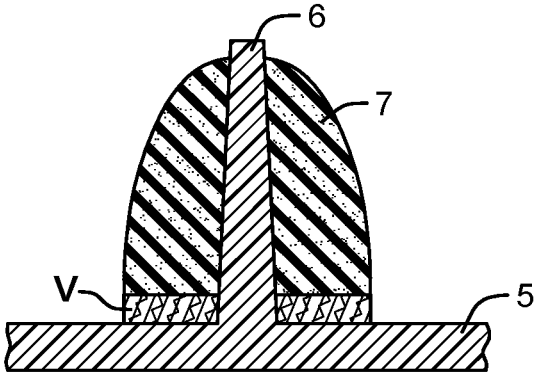
Figure 15:
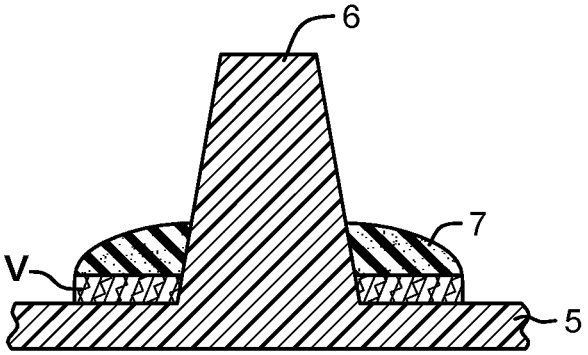
FIG. 15 shows the same view as FIG. 12 of that compressible cleaning structure design fixated via VELCRO® with a cleat type traction member, now compressed, in the weight bearing mode.
Figure 16:
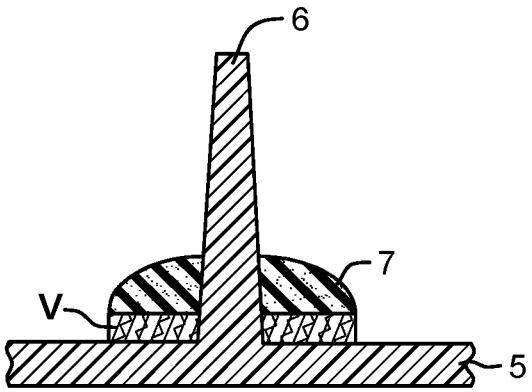
FIG. 16 shows the same view as FIG. 14 of that compressible cleaning structure design fixated via VELCRO® with a spike type fraction member, now compressed, in the weight bearing mode.

FIGS. 3, 4, 5, and 6, show a top plan, bottom, side, and left to right frontal view taken along an arbitrary mid line cross-section, respectively, of a compressible cleaning structure 7 design lacking a mounting plate component (A), which may be applicable to/surrounding of a temporarily and/or permanently fixated cleat type traction member 6, and FIGS. 7, 8, 9, and 10, show a top plan, bottom, side, and left to right frontal view taken along an arbitrary mid line cross-section, of a compressible cleaning structure 7 design lacking a mounting plate component (A), which may be applicable to/surrounding of a temporarily and/or permanently fixated spike type traction member 6, with both these compressible cleaning structure 7 designs constructed with a traction body hole (C), which is that central proximal to distal void in these designs, accommodatingly shaped to surround/clean that adjacent surface of the respective traction member 6 which will occupy and traverse that traction body hole (C) when the compressible cleaning structure 7 is temporarily fixated to the shoe bottom/outer sole 5 by any suitable means, e.g., VELCRO® (V), an adhesive strip (AS), etc., as shown in FIG. 11 from a bottom view and in FIG. 12 from a left to right frontal view taken along an arbitrary mid line cross-section with a cleat type traction member 6, temporarily fixated via VELCRO® (V), non-compressed in the non-weight bearing mode, and as shown in FIG. 13 from a bottom view and in FIG. 14 from a left to right frontal view taken along an arbitrary mid line cross-section, with a spike type traction member 6, temporarily fixated via VELCRO® (V), non-compressed in the non-weight bearing mode, so as to allow, as shown in FIGS. 15 and 16, from a left to right frontal view taken along an arbitrary mid line cross-section, with a permanently fixated/integrally attached cleat type traction member 6 and a permanently fixated/integrally attached spike type traction member 6, respectively, the respective traction member 6 to protrude through the distal opening of the traction body hole (C), so to be able to contact and traction the playing field surface upon compression of the compressible cleaning structure 7 during the weight bearing mode of the shoe.

Figure 17:
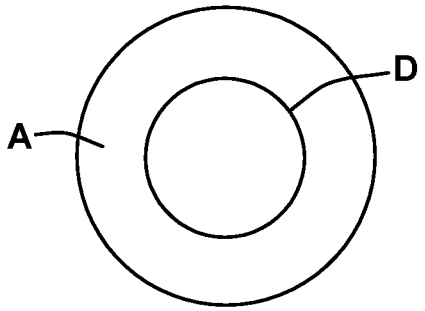
FIGS. 17, 18, and 19, show a top plan, bottom, and side view, respectively, of a mounting plate component to be incorporated in a compressible cleaning structure design as a whole, applicable to/surrounding of a temporarily and/or permanently fixated cleat type fraction member.
Figure 18:
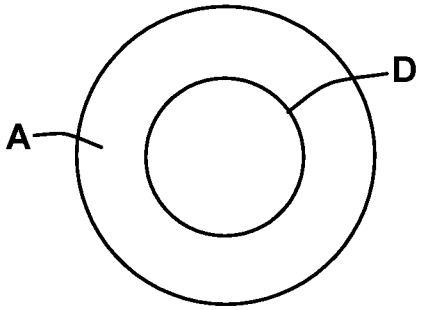
Figure 19:
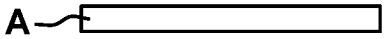
Figure 20:
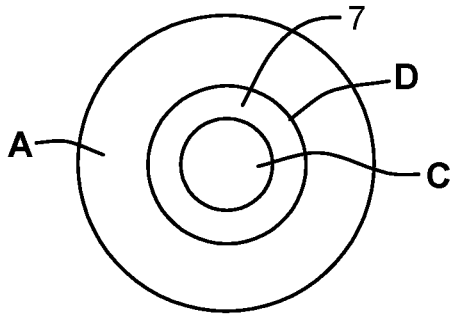
FIGS. 20, 21, 22, and 23, show a top plan, bottom, side, and left to right frontal view taken along an arbitrary mid line cross-section, respectively, of a compressible cleaning structure design as a whole incorporating that mounting plate component shown in FIGS. 17, 18, and 19, applicable to/surrounding of a temporarily and/or permanently fixated cleat type fraction member.
Figure 21:
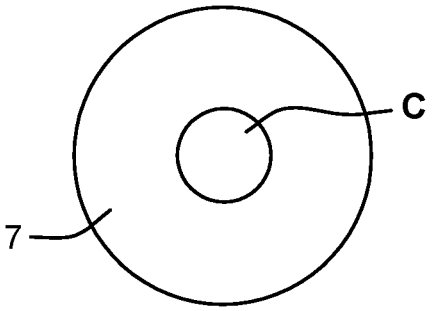
Figure 22:
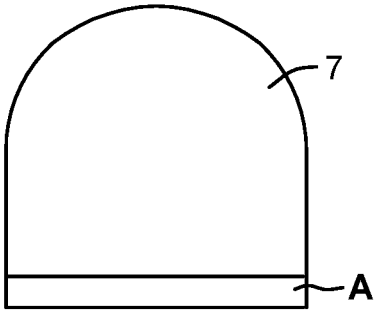
Figure 23:
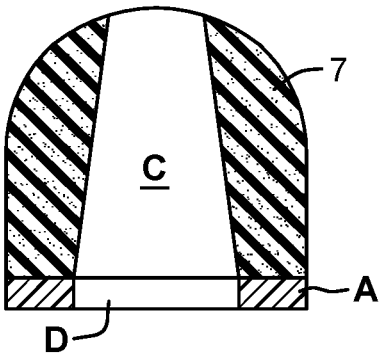
Figure 24:
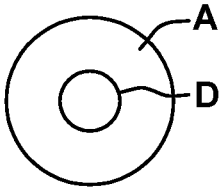
FIGS. 24, 25, and 26, show a top plan, bottom, and side view, respectively, of a mounting plate component to be incorporated in a compressible cleaning structure design as a whole, applicable to/surrounding of a temporarily and/or permanently fixated spike type fraction member.
Figure 25:
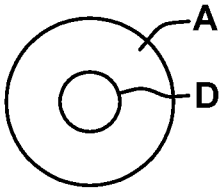
Figure 26:
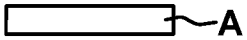
Figure 27:
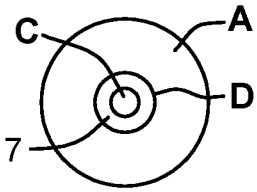
FIGS. 27, 28, 29, and 30, show a top plan, bottom, side, and left to right frontal view taken along an arbitrary mid line cross-section, respectively, of a compressible cleaning structure design as a whole incorporating that mounting plate component shown in FIGS. 24, 25, and 26, applicable to/surrounding of a temporarily and/or permanently fixated spike type traction member.
Figure 28:
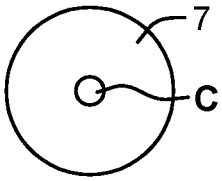
Figure 29:
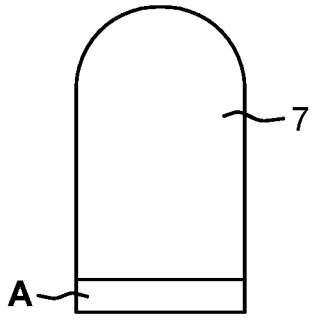
Figure 30:
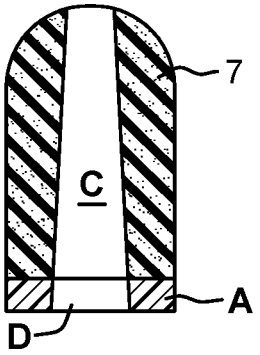
Figure 31:
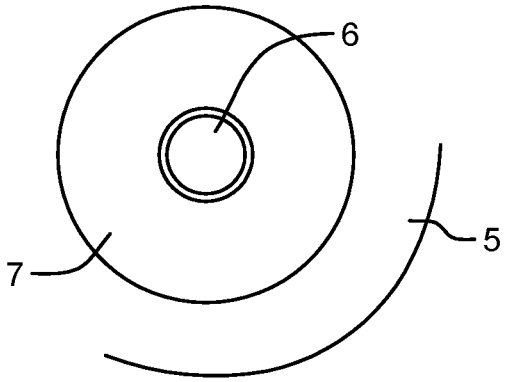
FIGS. 31 and 32 show a bottom view and a left to right frontal view taken along an arbitrary mid line cross-section, respectively, of that compressible cleaning structure design as a whole shown in FIGS. 20, 21, 22, and 23, temporarily fixated to the shoe bottom/outer sole via VELCRO®, surrounding of a permanently fixated cleat type traction member, non-compressed, in the non-weight bearing mode.
Figure 32:
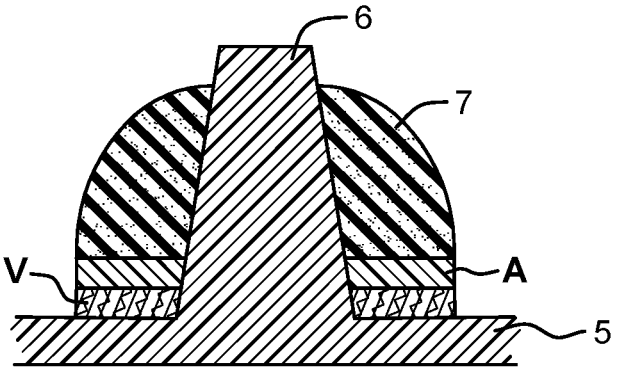
Figure 33:
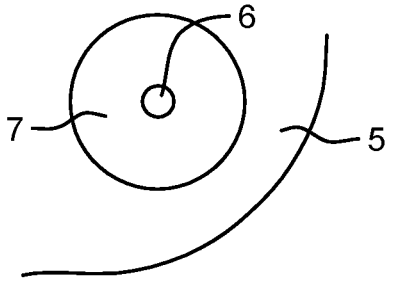
FIGS. 33 and 34 show a bottom view and a left to right frontal view taken along an arbitrary mid line cross-section, respectively, of that compressible cleaning structure design as a whole shown in FIGS. 27, 28, 29, and 30, temporarily fixated to the shoe bottom/outer sole via VELCRO®, surrounding of a permanently fixated spike type traction member, non-compressed, in the non-weight bearing mode.
Figure 34:
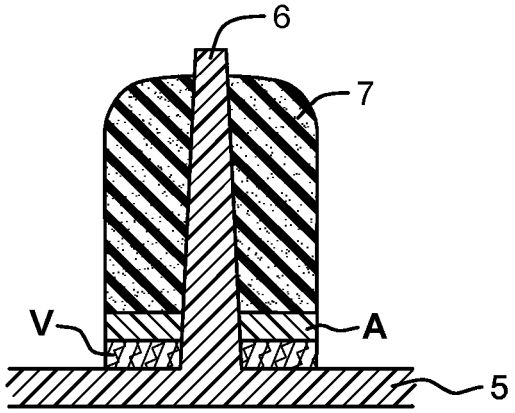
Figure 35:
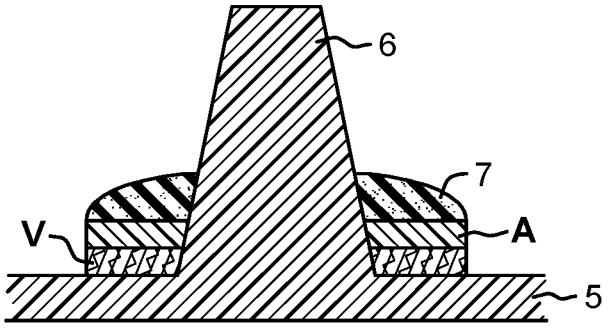
FIGS. 35 and 36 show the same view, respectively, of those embodiments shown in FIGS. 32 and 34, now compressed, in the weight bearing mode.
Figure 36:
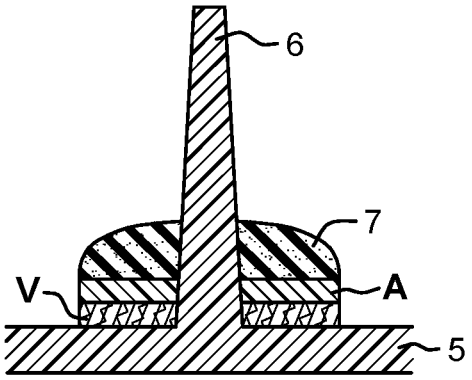
Figure 37:
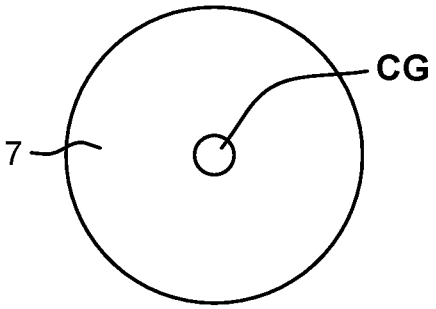
FIGS. 37, 38, 39, and 40, show a top plan, bottom, side, and left to right frontal view taken along an arbitrary mid line cross-section, respectively, of a compressible cleaning structure design lacking a mounting plate component, which may be applicable to/surrounding of a removable/temporarily fixated cleat type traction member.
Figure 38:
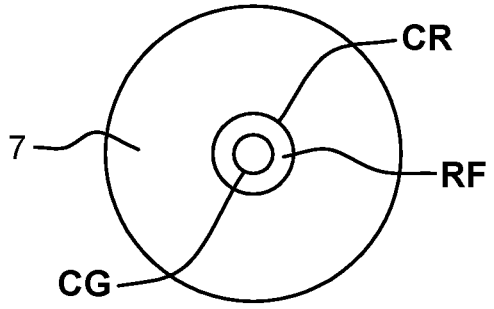
Figure 39:
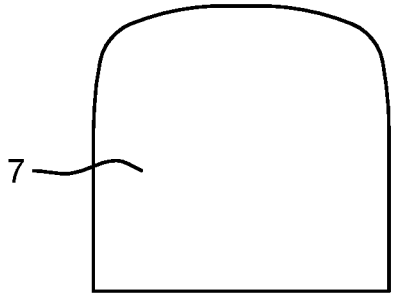
Figure 40:
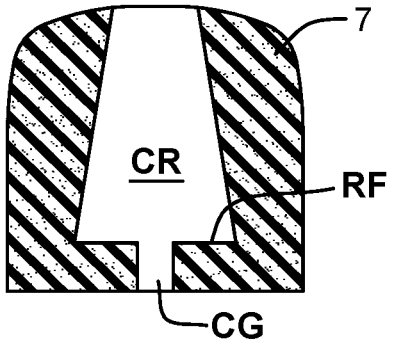
Figure 41:
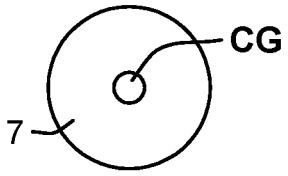
FIGS. 41, 42, 43, and 44, show a top plan, bottom, side, and left to right frontal view taken along an arbitrary mid line cross-section, respectively, of a compressible cleaning structure design lacking a mounting plate component, which may be applicable to/surrounding of a removable/temporarily fixated spike type traction member.
Figure 42:
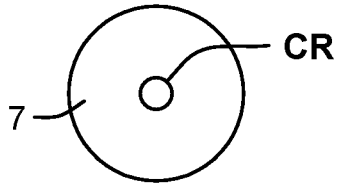
Figure 43:
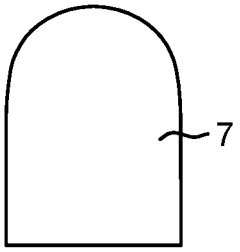
Figure 44:
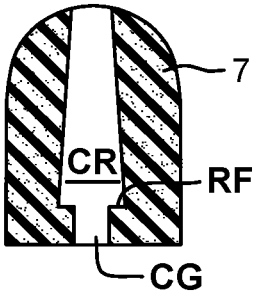

It should be understood that the just described and illustrated respective compressible cleaning structure 7 designs lacking in a mounting plate component (A) as a whole are still of the same structural configuration when incorporated with a mounting plate component (A), except in regard to the mounting plate component (A) itself and any alterations/modifications which may be required, as shown in the next compressible cleaning structure 7 designs which follow. FIGS. 17, 18, and 19, show a top plan, bottom, and side view, respectively, of such a mounting plate component (A), to be transposed on the previously presented compressible cleaning structure 7 designs lacking a mounting plate component (A) in FIGS. 3, 4, 5, and 6, shown from a top plan, bottom, side, and left to right frontal view taken along an arbitrary mid line cross-section, respectively, with a combination of such shown in FIGS. 20, 21, 22, and 23, from a top plan, bottom, side, and left to right frontal view taken along an arbitrary mid line cross-section, resulting in the compressible cleaning structure 7 designs as a whole which is applicable to/surrounding of a removable/temporarily fixated and/or permanently fixated/integrally attached cleat type traction member 6, which will exercise the ability to clean the respective traction member 6 which it surrounds, with the traction member 6 still performing with the same functional ability as when without the incorporated mounting plate component (A). FIGS. 24, 25, and 26, show a top plan, bottom, and side view, respectively, of another such mounting plate component (A), to be transposed on the previously presented compressible cleaning structure 7 design lacking a mounting plate component (A) in FIGS. 7, 8, 9, and 10, shown from a top plan, bottom, side, and left to right frontal view taken along an arbitrary mid line cross-section, respectively, with such a combination shown in FIGS. 27, 28, 29 and 30, from a top plan, bottom, side, and left to right frontal view taken along an arbitrary mid line cross-section, respectively, resulting in a compressible cleaning structure 7 design as a whole which is applicable to/surrounding of a removable/temporarily fixated and/or permanently fixated/integrally attached spike type traction member 6. The mounting plate component (A) in these two previous designs, may be secured permanently, via adhesive, or any other suitable means, etc., to the respective compressible cleaning structure 7. The mounting plate component (A) provides a platform for the respective compressible cleaning structure 7 to sit upon and attach, with a hole through its flat side center, referred to as a plate hole (D), with the diameter of this plate hole (D), at a minimum, large enough for the respective traction member 6 type to fully pass through so as to allow the mounting plate component (A) to be lowered onto that traction member 6, so to lie flat against and be temporarily secured to the adjacent surface of the shoe bottom/outer sole 5 by any suitable means, e.g., Velcro (V), adhesive strip (AS), etc., with that accommodating continuous opening formed by the alignment of the traction body hole (C) of the compressible cleaning structure 7 and the conjoined plate hole (D) of the mounting plate component (A), occupied by that traction member 6 when the compressible cleaning structure 7 is secured temporarily, via any suitable means, to the shoe bottom/outer sole 5. FIG. 31 shows a bottom view and FIG. 32 a left to right frontal view taken along an arbitrary mid line cross-section, of a removable/temporarily fixated compressible cleaning structure 7 of this such design, with its incorporated mounting plate component (A) and compressible cleaning structure 7 design as a whole, fixated via VELCRO® (V) to the shoe bottom/outer sole 5, surrounding a permanently fixated/integrally attached cleat type traction member 6, non-compressed in the non-weight bearing mode, FIG. 33 shows a bottom view and FIG. 34 a left to right frontal view taken along an arbitrary mid line cross-section, of a removable/temporarily fixated compressible cleaning structure 7 of the same design, with its incorporated mounting plate component (A) and the compressible cleaning structure 7 design as a whole, fixated via VELCRO® (V) to the shoe bottom/outer sole 5, surrounding a permanently fixated/integrally attached spike type traction member 6, non-compressed in the non-weight bearing mode, and FIGS. 35 and 36 both show a left to right frontal view taken along an arbitrary mid line cross-section, of these removable/temporarily fixated compressible cleaning structure 7 designs as a whole, surrounding a permanently fixated/integrally attached cleat type traction member 6 and a permanently fixated/integrally attached spike type traction member 6, respectively, so to allow the respective traction member 6 to protrude through that one accommodating continuous opening, in order to be able to contact and traction the playing field surface upon compression of the compressible cleaning structure 7 during the ensuing weight bearing mode of the shoe.

Figure 45:
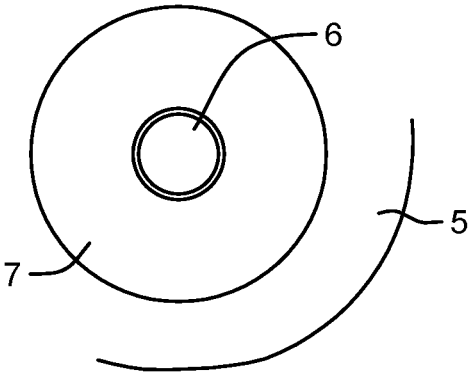
FIGS. 45 and 46 show a bottom view and a left to right frontal view taken along an arbitrary mid line cross-section, respectively, of that compressible cleaning structure design shown in FIGS. 37, 38, 39, and 40, surrounding a removable/temporarily fixated cleat type traction member, with adhesive strips further securing the compressible cleaning structure to the shoe bottom/outer sole, non-compressed, in the non-weight bearing mode.
Figure 46:
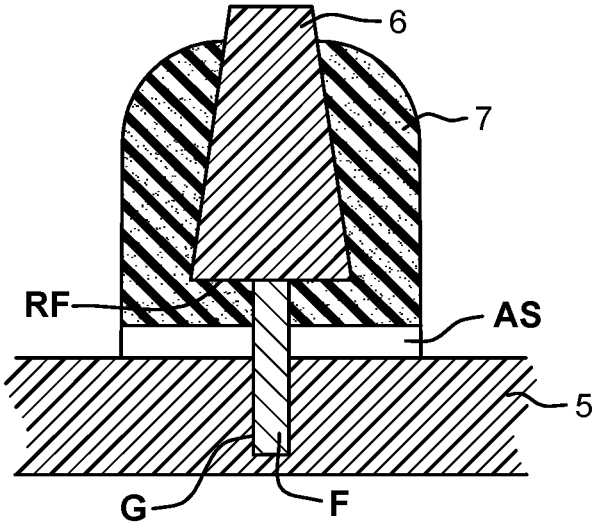
Figure 47:
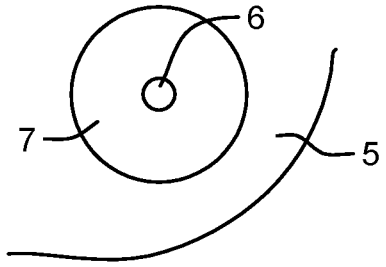
FIGS. 47 and 48 show a bottom view and a left to right frontal view taken along an arbitrary mid line cross-section, respectively, of that compressible cleaning structure design shown in FIGS. 41, 42, 43, and 44, surrounding a removable/temporarily fixated spike type fraction member, with adhesive strips further securing the compressible cleaning structure to the shoe bottom/outer sole, non-compressed, in the non-weight bearing mode.
Figure 48:
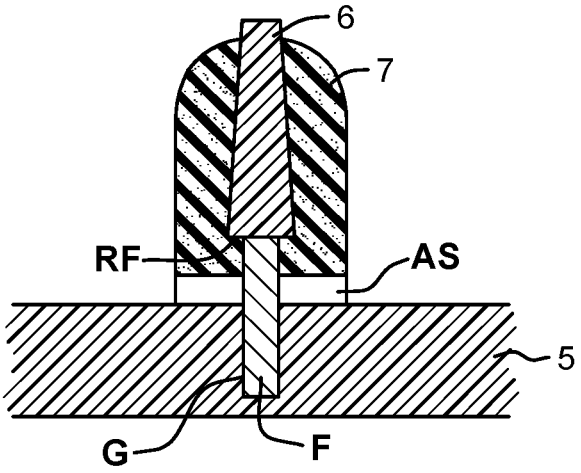
Figure 49:
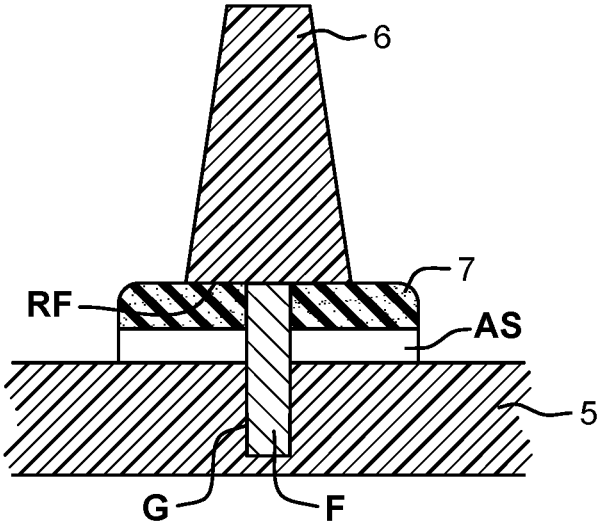
FIGS. 49 and 50 show the same view, respectively, of those embodiments shown in FIGS. 46 and 48, now compressed, in the weight bearing mode.
Figure 50:
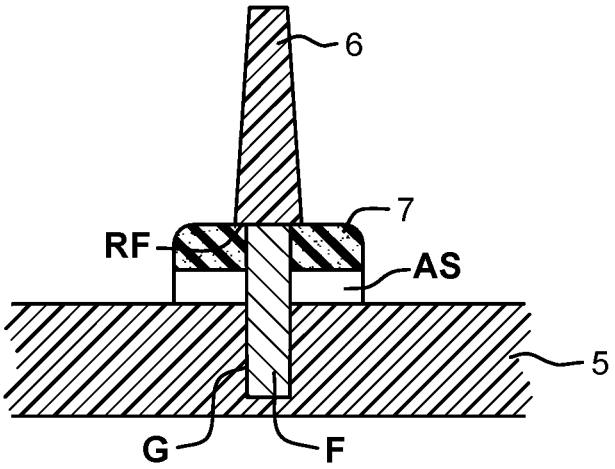

FIGS. 37, 38, 39 and 40, show a top plan, bottom, side, and left to right frontal view taken along an arbitrary mid line cross-section, respectively, of a compressible cleaning structure 7 design lacking a mounting plate component (A), which may be applicable to/surrounding of a removable/temporarily fixated cleat type traction member 6, and FIGS. 41, 42, 43 and 44, show a top plan, bottom, side, and left to right frontal view taken along an arbitrary mid line cross-section, respectively, of a compressible cleaning structure 7 design lacking a mounting plate component (A) which may be applicable to/surrounding of a removable/temporarily fixated spike type traction member 6, with each of these compressible cleaning structure 7 designs constructed with a central recess (CR), which is that central internal void in the compressible cleaning structure 7 body, accommodatingly shaped to and in which the traction member 6 is located, so the compressible cleaning structure 7 may surround/clean that adjacent surface of the respective traction member 6 as it sits in and occupies that central recess (CR), with the dorsal aspect of the base of that respective traction member 6 to sit on the adjacent abutting horizontal plantar aspect of the central recess (CR) referred to as a recess floor (RF), which contains a hole through its center referred to as a central grommet (CG), of a diameter at least large enough so as to allow a threaded longitudinal stud (F) protruding from the dorsal base aspect of the removable/temporarily fixated traction member 6 to pass through in order to be tightened into a complementary threaded boss (G) in the shoe bottom/outer sole 5, thereby fixating the compressible cleaning structure 7 and the traction member 6 to the shoe bottom/outer sole 5, with their respective adjacent surfaces appropriately positioned and in such close proximity to one another so as to enable them to best perform their respective functions, with the compressible cleaning structure 7, if need be, further secured to the shoe bottom/outer sole 5 by any suitable means, e.g., VELCRO® (V), an adhesive strip (AS), etc., as shown in FIG. 45 from a bottom view and FIG. 46 from a left to right frontal view taken along an arbitrary mid line cross-section, with a removable/temporarily fixated cleat type traction member 6, with adhesive strips (AS) used to further secure the compressible cleaning structure 7 to the shoe bottom/outer sole 5, non-compressed in the non-weight bearing mode, and as shown in FIG. 47 from a bottom view and FIG. 48 from a left to right frontal view taken along an arbitrary mid line cross-section, with a removable/temporarily fixated spike type traction member 6, with adhesive strips (AS) used to further secure the compressible cleaning structure 7 to the shoe bottom/outer sole 5, non-compressed in the non-weight bearing mode, so as to allow that traction member 6 to protrude through the distal opening of that central recess (CR), as shown in FIGS. 49 and 50, from a left to right frontal view taken along an arbitrary mid line cross-section, with a removable/temporarily fixated cleat type traction member 6 and a removable/temporarily fixated spike type traction member 6, respectively, upon compression of the compressible cleaning structure 7 during the ensuing weight bearing mode of the shoe.

Figure 51:
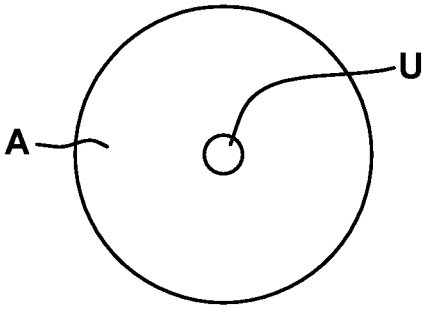
FIGS. 51, 52, and 53, show a top plan, bottom, and side view, respectively, of a mounting plate component to be incorporated in that compressible cleaning structure design shown in FIGS. 37, 38, 39, and 40, applicable to/surrounding of a removable/temporarily fixated cleat type fraction member, with that compressible cleaning structure design as a whole incorporating that mounting plate component shown in FIGS. 54, 55, 56, and 57, from a top plan, bottom, side, and left to right frontal view taken along an arbitrary mid line cross-section, respectively.
Figure 52:
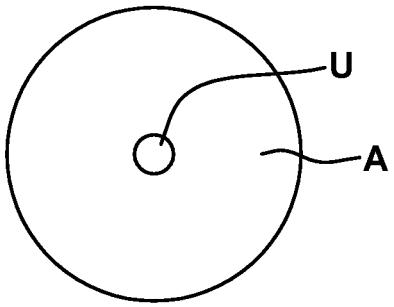
Figure 53:
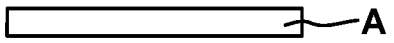
Figure 54:
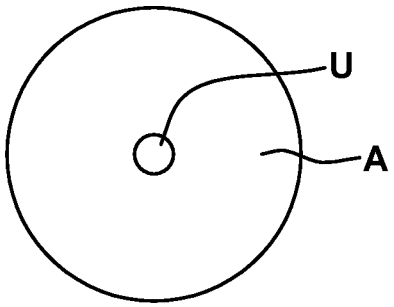
Figure 55:
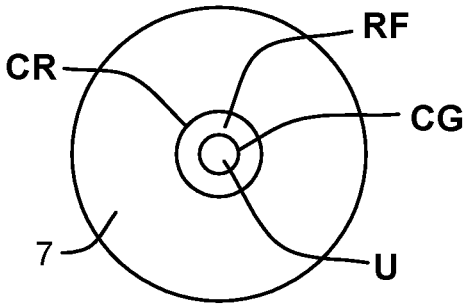
Figure 56:
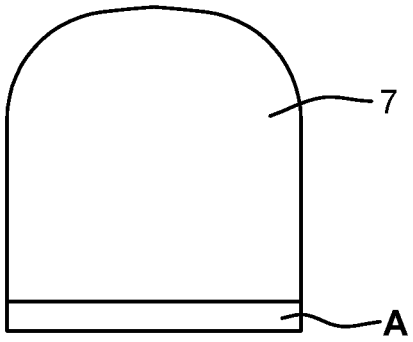
Figure 57:
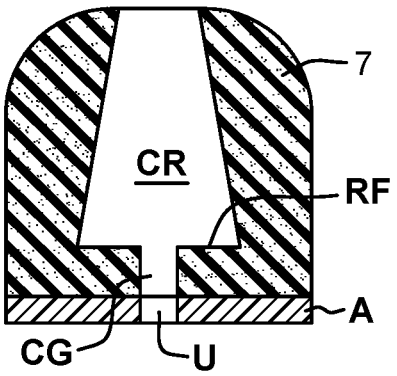
Figure 58:
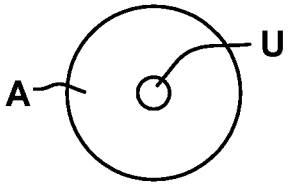
FIGS. 58, 59, and 60, show a top plan, bottom, and side view, respectively, of a mounting plate component to be incorporated in that compressible cleaning structure design shown in FIGS. 41, 42, 43, and 44, applicable to/surrounding of a removable/temporarily fixated spike type traction member, with that compressible cleaning structure design as a whole incorporating that mounting plate component shown in FIGS. 61, 62, 63, and 64, from a top plan, bottom, side, and left to right frontal view taken along an arbitrary mid line cross-section, respectively.
Figure 59:
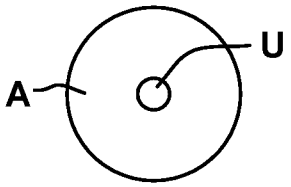
Figure 60:
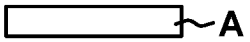
Figure 61:
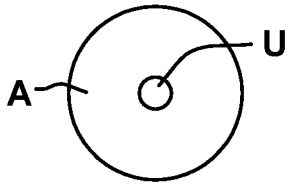
Figure 62:
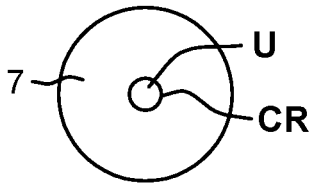
Figure 63:
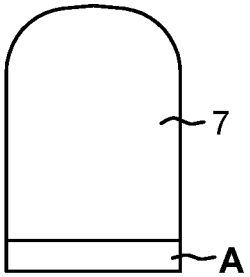
Figure 64:
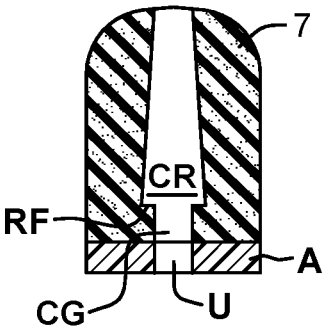
Figure 65:
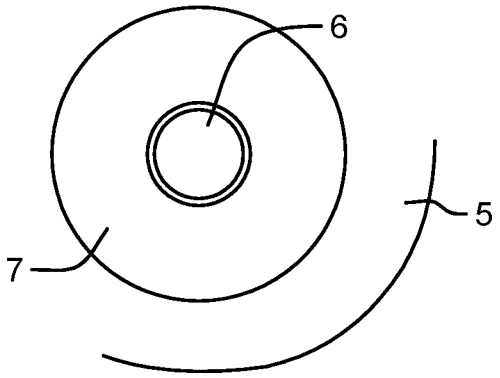
FIGS. 65 and 66 show a bottom view and a left to right frontal view taken along an arbitrary mid line cross-section, respectively, of that compressible cleaning structure design as a whole shown in FIGS. 54, 55, 56, and 57, surrounding a removable/temporarily fixated cleat type traction member, with adhesive strips further securing the compressible cleaning structure to the shoe bottom/outer sole, non-compressed, in the non-weight bearing mode.
Figure 66:
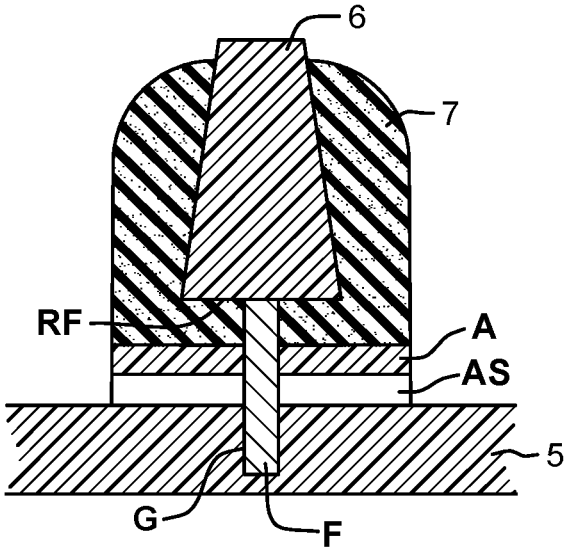
Figure 67:
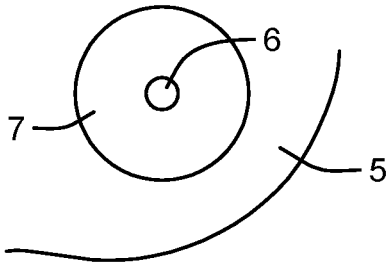
FIGS. 67 and 68 show a bottom view and a left to right frontal view taken along an arbitrary mid line cross-section, respectively, of that compressible cleaning structure design as a whole shown in FIGS. 61, 62, 63, and 64, surrounding a removable/temporarily fixated spike type traction member, with adhesive strips further securing the compressible cleaning structure to the shoe bottom/outer sole, non-compressed, in the non-weight bearing mode.
Figure 68:
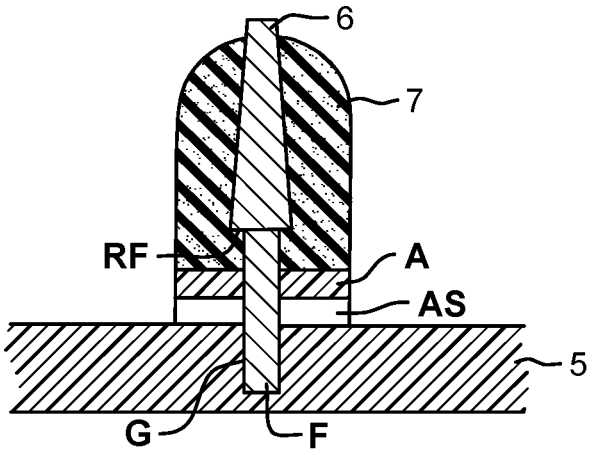
Figure 69:
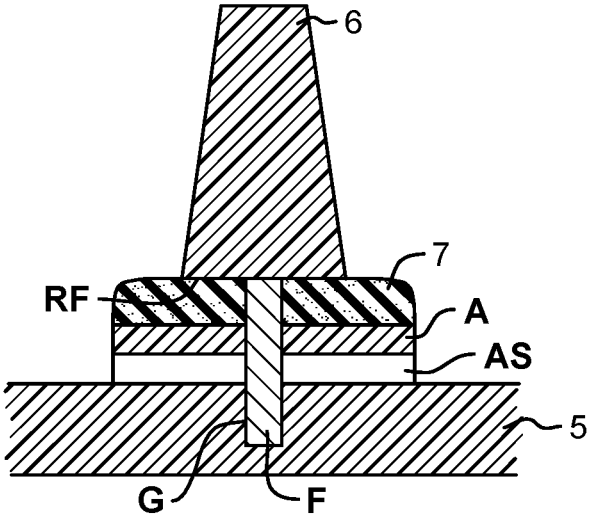
FIGS. 69 and 70 show the same view, respectively, of those embodiments shown in FIGS. 66 and 68, now compressed, in the weight bearing mode.
Figure 70:
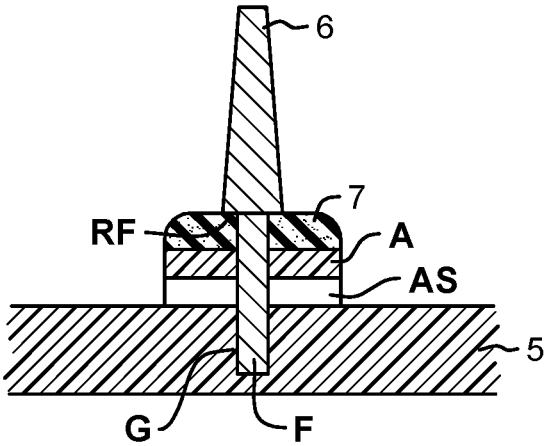
Figure 71:
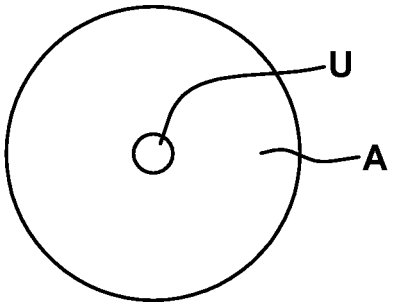
FIGS. 71, 72, 73, and 74, show a top plan, bottom, side, and left to right frontal view taken along an arbitrary mid line cross-section, respectively, of that mounting plate component shown in FIGS. 51, 52, and 53, incorporated with that compressible cleaning structure design shown in FIGS. 3, 4, 5, and 6, applicable to/surrounding of a removable/temporarily fixated cleat type traction member.
Figure 72:
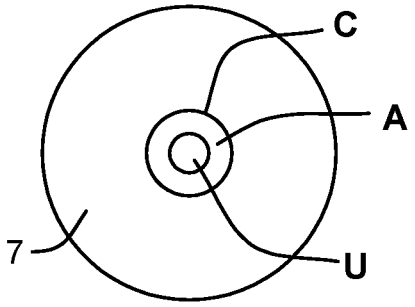
Figure 73:
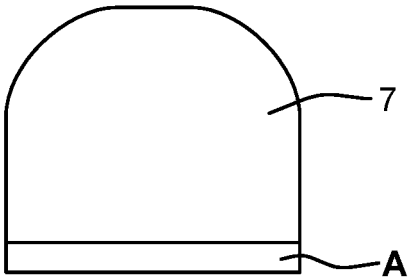
Figure 74:
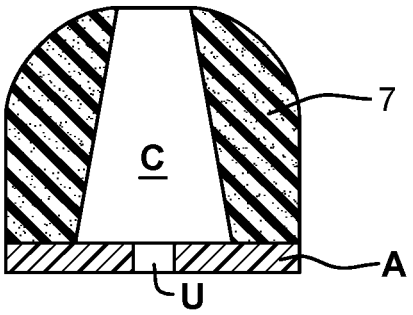

It should be understood that the just described and illustrated compressible cleaning structure 7 designs lacking in a mounting plate component (A) as a whole, which may be applicable to/surrounding of a removable/temporarily fixated traction member 6 of the cleat and/or spike type, when incorporated with a mounting plate component (A), are still for the most part of the same structural designs when incorporated with a mounting plate component (A), except, as earlier stated, in regard to the respective mounting plate component (A) itself and any alterations/modifications which may be required for such an incorporation, with such a mounting plate component (A) conceived so to be transposed on the previously presented compressible cleaning structure 7 designs lacking in such, and the resulting respective compressible cleaning structure 7 designs as a whole able to clean the respective traction members 6 which they surround as intended. FIGS. 51, 52, and 53, show a top plan, bottom, and side view, respectively, of such a mounting plate component (A) incorporated, as shown in FIGS. 54, 55, 56, and 57, from a top plan, bottom, side, and left to right frontal view taken along an arbitrary mid line cross-section, respectively, in a compressible cleaning structure 7 design as a whole, which may be applicable to/surrounding of a removable/temporarily fixated cleat type traction member 6, and FIGS. 58, 59, and 60, show a top plan, bottom, and side view, respectively, of such a mounting plate component (A) incorporated, as shown in FIGS. 61, 62, 63, and 64, from a top plan, bottom, side, and left to right frontal view taken along an arbitrary mid line cross-section, respectively, in a compressible cleaning structure 7 design as a whole, which may be applicable to/surrounding of a removable/temporarily fixated spike type traction member 6, with the mounting plate component (A) in these designs secured permanently via adhesive to the respective compressible cleaning structure 7, providing a platform for the compressible cleaning structure 7 to sit upon and attach, with this mounting plate component (A) constructed with a hole in its center, referred to as a stud hole (U), which is of a diameter equal to and aligned with that central grommet (CG) in the recess floor (RF) of the attached compressible cleaning structure 7 so as to allow the threaded longitudinal stud (F) to pass through that opening formed by the conjoined central grommet (CG) and stud hole (U) in order to be tightened in the complementary threaded boss (G) in the shoe bottom/outer sole 5, thereby fixating the compressible cleaning structure 7 as a whole and traction member 6 to the shoe bottom/outer sole 5, with their respective adjacent surfaces appropriately positioned and in such close proximity to one another so as to best perform their respective functions, with the mounting plate component (A) and compressible cleaning structure 7 as a whole, if need be, further secured to the shoe bottom/outer sole 5 by any suitable means, e.g., VELCRO® (V), an adhesive strip (AS), etc., as shown in FIG. 65 from a bottom view and FIG. 66 from a left to right frontal view taken along an arbitrary mid line cross-section, with a removable/temporarily fixated compressible cleaning structure 7 design incorporating a mounting plate component (A), applicable to/surrounding of a removable/temporarily fixated cleat type traction member 6, with adhesive strips (AS) used to further secure the mounting plate component (A) and compressible cleaning structure 7 design as a whole to the shoe bottom/outer sole 5, non-compressed in the non-weight bearing mode, and as shown in FIG. 67 from a bottom view and FIG. 68 from a left to right frontal view taken along an arbitrary mid line cross-section, with a removable/temporarily fixated compressible cleaning structure 7 design incorporating a mounting plate component (A), applicable to/surrounding of a removable/temporarily fixated spike type traction member 6, with adhesive strips (AS) used to further secure the mounting plate component (A) and compressible cleaning structure 7 design as a whole to the shoe bottom/outer sole 5, non-compressed in the non-weight bearing mode, so as to allow that traction member 6 to protrude through the distal opening of that central recess (CR) as shown in FIGS. 69 and 70, from a left to right frontal view taken along an arbitrary mid line cross-section, with the respective compressible cleaning structure 7 and its incorporated mounting plate component (A) surrounding a removable/temporarily fixated cleat type traction member 6 and a removable/temporarily fixated spike type traction member 6, respectively, with the respective traction members 6 fully protruded, upon compression of the compressible cleaning structure 7 during the ensuing weight bearing mode of the shoe.

Figure 75:
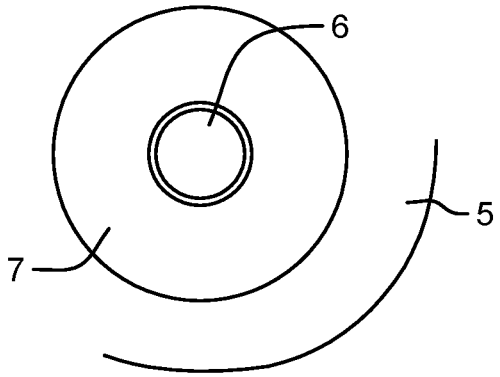
FIG. 75 shows a bottom view.
Figure 76:
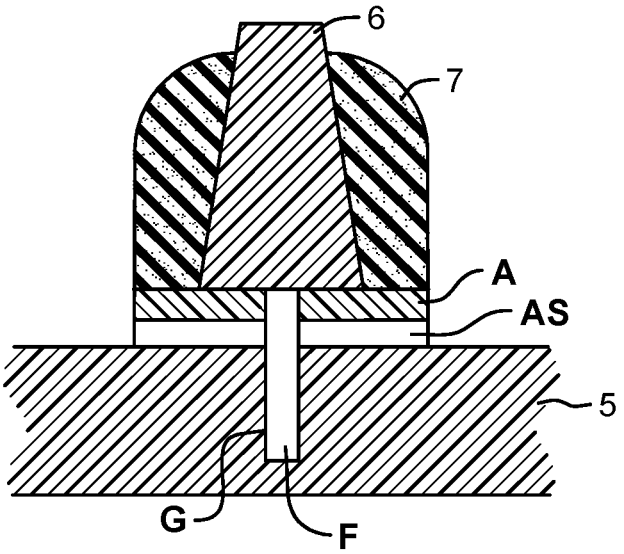
FIGS. 76 and 77 show a left to right frontal view taken along an arbitrary mid line cross-section, non-compressed in the non-weight bearing mode and compressed in the weight bearing mode, respectively, of that compressible cleaning structure design as a whole shown in FIGS. 71, 72, 73, and 74, surrounding a removable/temporarily fixated cleat type traction member, with adhesive strips further securing the compressible cleaning structure as a whole to the shoe bottom/outer sole.
Figure 77:
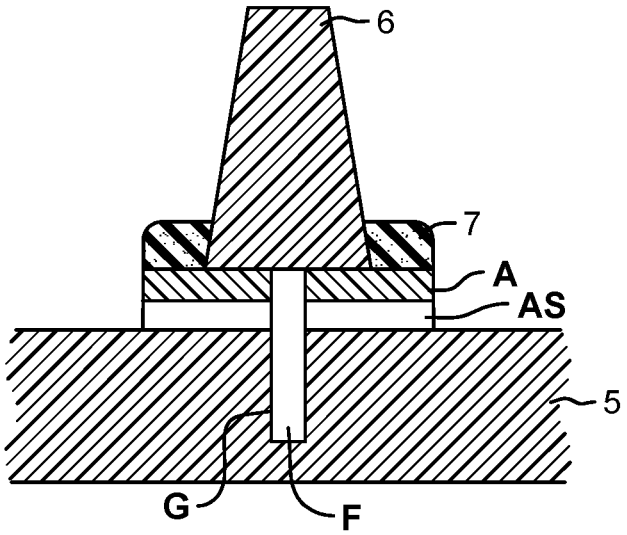
Figure 78:
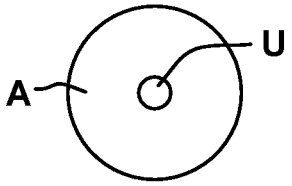
FIGS. 78, 79, 80, and 81, show a top plan, bottom, side, and left to right frontal view taken along an arbitrary mid line cross-section, respectively, of that mounting plate component shown in FIGS. 58, 59, and 60, incorporated with that compressible cleaning structure design shown in FIGS. 7, 8, 9, and 10, applicable to/surrounding of a removable/temporarily fixated spike type traction member.
Figure 79:
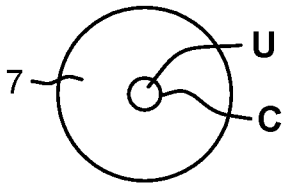
Figure 80:
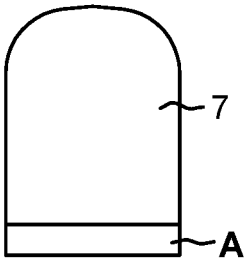
Figure 81:
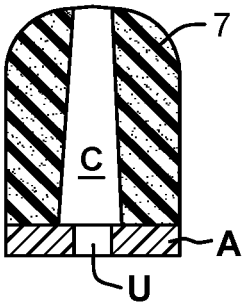
Figure 82:
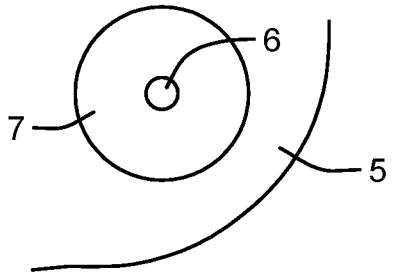
FIG. 82 shows a bottom view.
Figure 83:
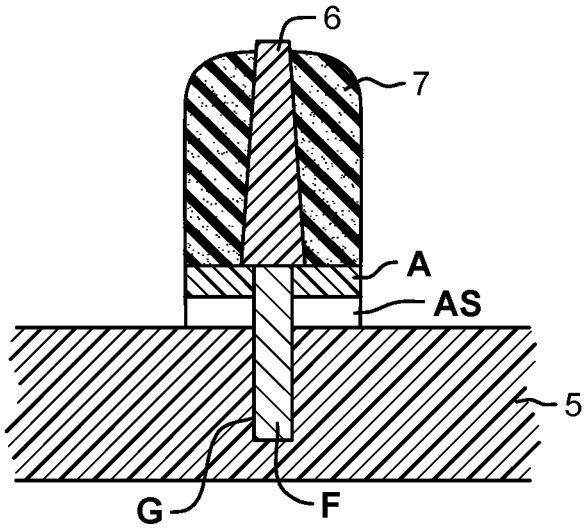
FIGS. 83 and 84 show a left to right frontal view taken along an arbitrary mid line cross-section, non-compressed in the non-weight bearing mode and compressed in the weight bearing mode, respectively, of that compressible cleaning structure design as a whole shown in FIGS. 78, 79, 80, and 81, surrounding a removable/temporarily fixated spike type traction member, with adhesive strips further securing the compressible cleaning structure design as a whole to the shoe bottom/outer sole.
Figure 84:
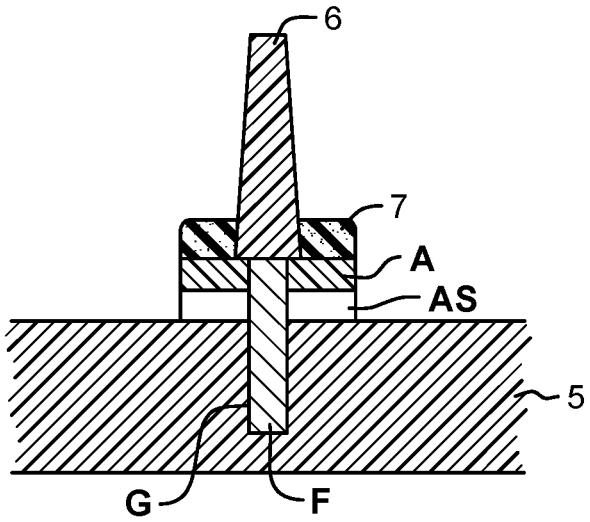
Figure 85:
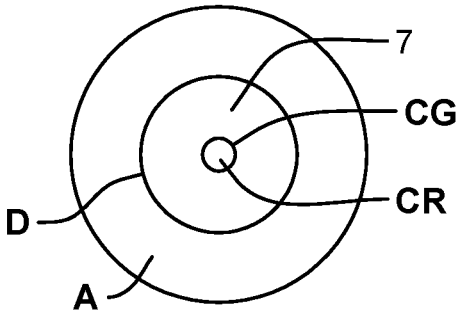
FIGS. 85, 86, 87, and 88, show a top plan, bottom, side, and left to right frontal view taken along an arbitrary mid line cross-section, respectively, of that mounting plate component shown in FIGS. 17, 18, and 19, incorporated with that compressible cleaning structure design shown in FIGS. 37, 38, 39, and 40, applicable to/surrounding of a removable/temporarily fixated cleat type traction member.
Figure 86:
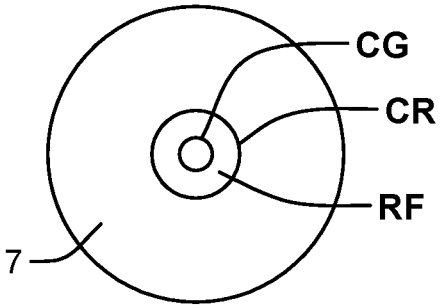
Figure 87:
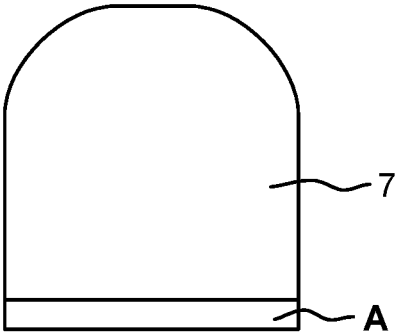
Figure 88:
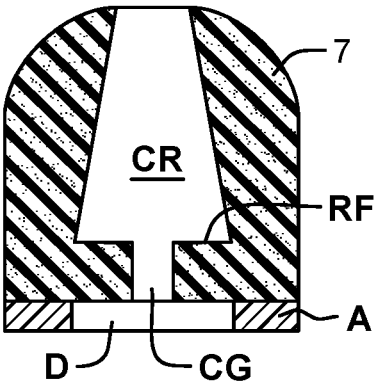
Figure 89:
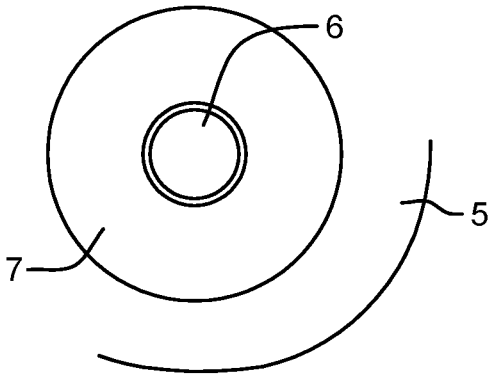
FIG. 89 shows a bottom view.
Figure 90:
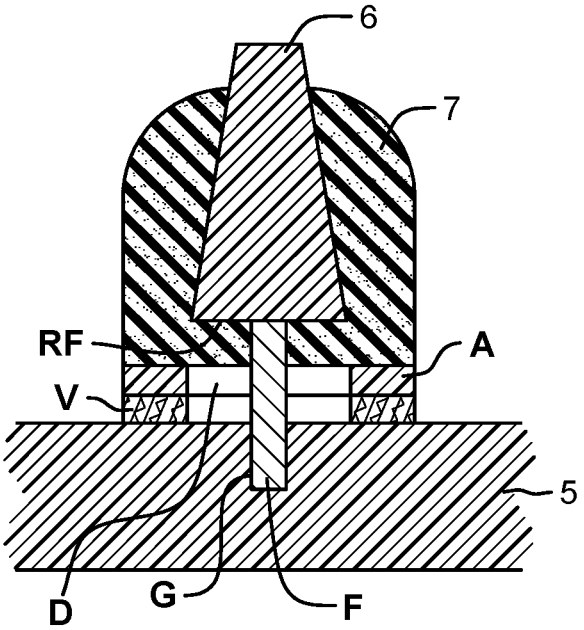
FIGS. 90 and 91 show a left to right frontal view taken along an arbitrary mid line cross-section, non-compressed in the non-weight bearing mode and compressed in the weight bearing mode, respectively, of that compressible cleaning structure design as a whole shown in FIGS. 85, 86, 87, and 88, surrounding a removable/temporarily fixated cleat type traction member, with VELCRO® further securing the compressible cleaning structure design as a whole to the shoe bottom/outer sole.
Figure 91:
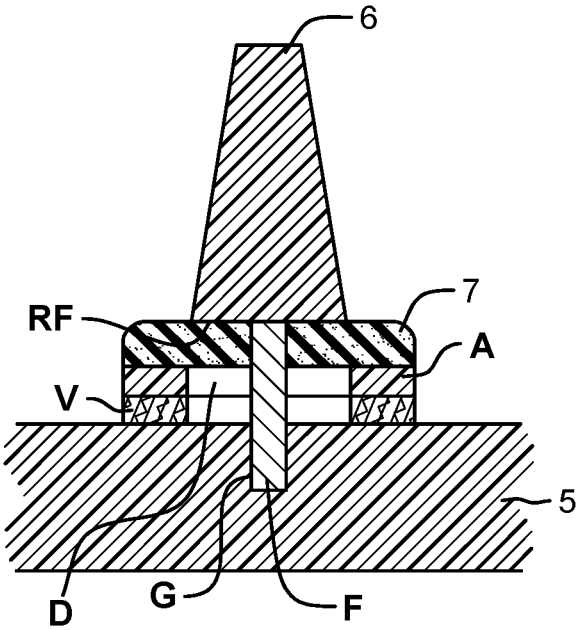
Figure 92:
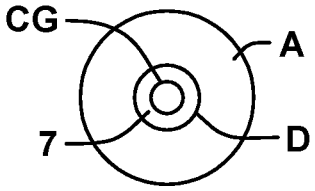
FIGS. 92, 93, 94, and 95, show a top plan, bottom, side, and left to right frontal view taken along an arbitrary mid line cross-section, respectively, of that mounting plate component shown in FIGS. 24, 25, and 26, incorporated with that compressible cleaning structure design shown in FIGS. 41, 42, 43, and 44, applicable to/surrounding of a removable/temporarily fixated spike type traction member.
Figure 93:
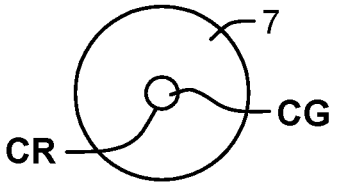
Figure 94:
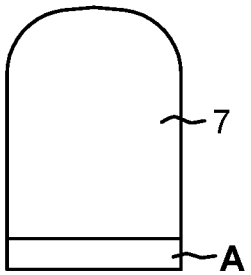
Figure 95:
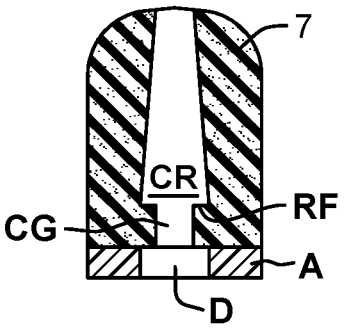
Figure 96:
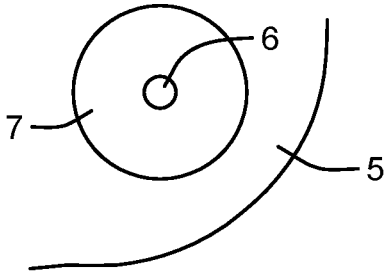
FIG. 96 shows a bottom view.
Figure 97:
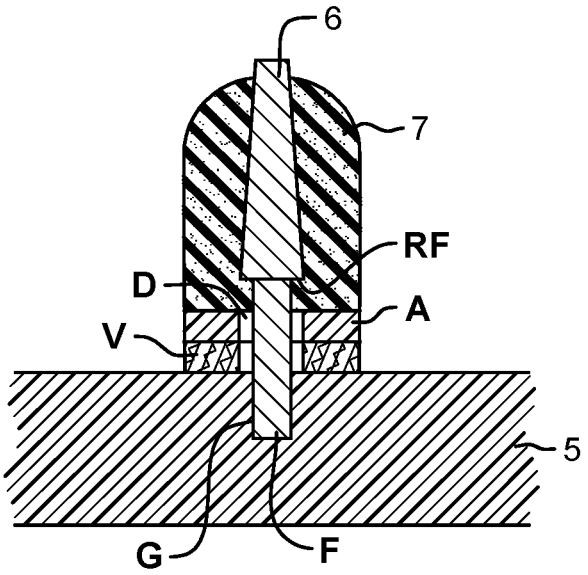
FIGS. 97 and 98 show a left to right frontal view taken along an arbitrary mid line cross-section, non-compressed in the non-weight bearing mode and compressed in the weight bearing mode, respectively, of that compressible cleaning structure design as a whole shown in FIGS. 92, 93, 94, and 95, surrounding a removable/temporarily fixated spike type traction member, with VELCRO® further securing the compressible cleaning structure design as a whole to the shoe bottom/outer sole.
Figure 98:
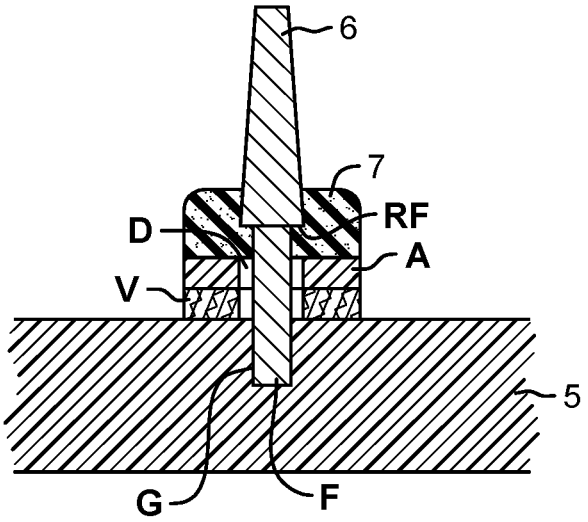

It should be understood by those familiar in the present art upon review of the previous descriptions and illustrations in the examples of the compressible cleaning structures 7, mounting plate components (A), and any and all their respectively incorporated combinations provided thus far, that the present invention conceives of all such compressible cleaning structure 7 designs and mounting plate components (A) as being interchangeable, if and when appropriate, with such incorporation conceived as occurring in any and all combinations of such despite such conceived combinations not already being described and illustrated. Thus, it may be easily extrapolated how such compressible cleaning structure 7 designs, mounting plate components (A), and their conceived combinations will function accordingly from the weight bearing to the non-weight bearing mode, and vice versa, and their respective applicability to those traction member 6 types they would be appropriately suited for by referencing all applicable previous examples. For example, FIGS. 71, 72, 73, and 74, from a top plan, bottom, side, and left to right frontal view taken along an arbitrary mid line cross-section, respectively, show a compressible cleaning structure 7 design as a whole which is of a combination incorporating that mounting plate component (A) previously illustrated in FIGS. 51, 52, and 53, from a top plan, bottom, and side view, respectively, with that compressible cleaning structure 7 design previously illustrated in FIGS. 3, 4, 5, and 6, from a top plan, bottom, side, and left to right frontal view taken along an arbitrary mid line cross-section, respectively. This combination, in which the compressible cleaning structure 7 and mounting plate component (A) are permanently fixated to each other via adhesive, would result in a compressible cleaning structure 7 design as a whole, which due to the understandable inability of a permanently fixated cleat type traction member 6 to be accommodated in/pass through the stud hole (U) of the respectively incorporated mounting plate component (A), may only be applicable to/surrounding of a removable/temporarily fixated cleat type traction member 6, with the mounting plate component (A) and compressible cleaning structure 7 design as a whole, if need be, further secured to the shoe bottom/outer sole 5 by any suitable means, e.g., VELCRO® (V), an adhesive strip (AS), etc., as shown in FIG. 75 from a bottom view, and FIGS. 76 and 77 from a left to right frontal view taken along an arbitrary mid line cross-section, non-compressed in the non-weight bearing mode and compressed in the weight bearing mode, respectively, with the compressible cleaning structure 7 and its incorporated mounting plate component (A) surrounding of a removable/temporarily fixated cleat type traction member 6, and adhesive strips (AS) used to further secure the mounting plate component (A) and compressible cleaning structure 7 design as a whole to the shoe bottom/outer sole 5. Also conceived in the present invention, as shown in FIGS. 78, 79, 80, and 81, from a top plan, bottom, side, and left to right frontal view taken along an arbitrary mid line cross-section, respectively, is that compressible cleaning structure 7 design as a whole which is of a combination incorporating that mounting plate component (A) previously illustrated in FIGS. 58, 59, and 60, from a top plan, bottom, and side view, respectively, with that compressible cleaning structure 7 design previously illustrated in FIGS. 7, 8, 9, and 10, from a top plan, bottom, side, and a left to right frontal view taken along an arbitrary mid line cross-section, respectively. This combination, in which the compressible cleaning structure 7 and mounting plate component (A) are permanently fixated to each other via adhesive, would result in a compressible cleaning structure 7 design as a whole, which due to the understandable inability of a permanently fixated spike type traction member 6 to be accommodated in/pass through the stud hole (U) of the respectively incorporated mounting plate component (A), may only be applicable to/surrounding of a removable/temporarily fixated spike type traction member 6, with the mounting plate component (A) and compressible cleaning structure 7 design as a whole, if need be, further secured to the shoe bottom/outer sole 5 by any suitable means, e.g., VELCRO® (V), an adhesive strip (AS), etc., as shown in FIG. 82 from a bottom view, and FIGS. 83 and 84 from a left to right frontal view taken along an arbitrary mid line cross-section, non-compressed in the non-weight bearing mode and compressed in the weight bearing mode, respectively, with the compressible cleaning structure 7 and its incorporated mounting plate component (A) surrounding of a removable/temporarily fixated spike type traction member 6, and adhesive strips (AS) used to further secure the mounting plate component (A) and compressible cleaning structure 7 design as a whole to the shoe bottom/outer sole 5. FIGS. 85, 86, 87, and 88 show a top plan, bottom, side, and left to right frontal view taken along an arbitrary mid line cross-section, respectively, of a compressible cleaning structure 7 design as a whole which is of a combination incorporating that mounting plate component (A) previously illustrated in FIGS. 17, 18, and 19, from a top plan, bottom, and side view, respectively, with that compressible cleaning structure 7 design previously illustrated in FIGS. 37, 38, 39, and 40, from a top plan, bottom, side, and a left to right frontal view taken along an arbitrary mid line cross-section, respectively. This combination in which the compressible cleaning structure 7 and mounting plate component (A) are permanently fixated to each other via adhesive, would result in a compressible cleaning structure 7 design as a whole, which due to the understandable inability of a permanently fixated cleat type traction member 6 to be accommodated in/pass through the central grommet (CG) of the respectively incorporated compressible cleaning structure 7, may only be applicable to/surrounding of a removable/temporarily fixated cleat type traction member 6, with the mounting plate component (A) and compressible cleaning structure 7 design as a whole, if need be, further secured to the shoe bottom/outer sole 5 by any suitable means, e.g., VELCRO® (V), an adhesive strip (AS), etc., as shown in FIG. 89 from a bottom view, and FIGS. 90 and 91 from a left to right frontal view taken along an arbitrary mid line cross section, non-compressed in the non-weight bearing mode and compressed in the weight bearing mode, respectively, with the compressible cleaning structure 7 and its incorporated mounting plate component (A) surrounding of a removable/temporarily fixated cleat type traction member 6, and VELCRO® (V) used to further secure the mounting plate component (A) and compressible cleaning structure 7 design as a whole to the shoe bottom/outer sole 5. Further conceived in the present invention, as shown in FIGS. 92, 93, 94, and 95, from a top plan, bottom, side, and left to right frontal view taken along an arbitrary mid line cross-section, respectively, is a compressible cleaning structure 7 design as a whole which is of a combination incorporating that mounting plate component (A) previously illustrated in FIGS. 24, 25, and 26, from a top plan, bottom, and side view, respectively, with that compressible cleaning structure 7 design previously illustrated in FIGS. 41, 42, 43, and 44, from a top plan, bottom, side, and left to right frontal view taken along an arbitrary mid line cross-section, respectively. This combination in which the compressible cleaning structure 7 and mounting plate component (A) are permanently fixated via adhesive, would result in a compressible cleaning structure 7 design as a whole, which due to the understandable inability of a permanently fixated spike type traction member 6 to be accommodated in/pass through the central grommet (CG) of the respectively incorporated compressible cleaning structure 7, may only be applicable to/surrounding of a removable/temporarily fixated spike type traction member 6, with the mounting plate component (A) and compressible cleaning structure 7 design as a whole, if need be, further secured to the shoe bottom/outer sole 5 by any suitable means, e.g., VELCRO® (V), an adhesive strip (AS), etc., as shown in FIG. 96 from a bottom view, and FIGS. 97 and 98 from a left to right frontal view taken along an arbitrary mid line cross-section, non-compressed in the non-weight bearing mode and compressed in the weight bearing mode, respectively, with the compressible cleaning structure 7 and its incorporated mounting plate component (A) surrounding of a removable/temporarily fixated spike type traction member 6, with VELCRO® (V) used to further secure the mounting plate component (A) and the compressible cleaning structure 7 design as a whole to the shoe bottom/outer sole 5. Thus, it should be understood from the examples just presented, that all compressible cleaning structure 7 designs, mounting plate components (A), and any incorporated combinations thereof, are only examples of such, and in no way limit the conceptions and the intellectual property of the present invention to the same, with any and all necessary modifications to such combinations of their respective compressible cleaning structures 7 and mounting plate components (A) made in accordance with each and all, and the shoe as a whole, to best perform their intended designed functions in a most efficient manner.

Figure 99:
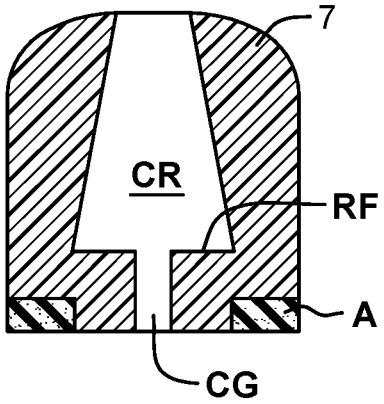
FIG. 99 shows a left to right frontal view taken along an arbitrary mid line cross-section of a compressible cleaning structure design, which is altered/modified from that compressible cleaning structure design shown in FIG. 88, applicable to a removable/temporarily fixated cleat type traction member.
Figure 100:
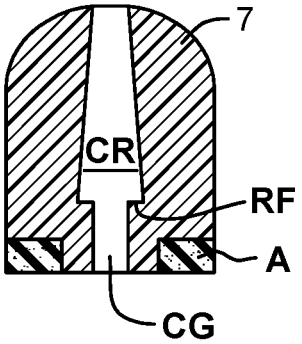
FIG. 100 shows a left to right frontal view taken along an arbitrary mid line cross-section of a compressible cleaning structure design, which is altered/modified from that compressible cleaning structure design shown in FIG. 95, applicable to a removable/temporarily fixated spike type traction member.

Regardless of the previous examples, and for that matter, any examples of the present invention which follow, of compressible cleaning structure 7 designs being solely presented with or without a mounting plate component (A) incorporated in their respective designs, it should be understood, that in no way limits the conception by which a mounting plate component (A) may either be applied to or removed from these same respective designs, with any alterations/modifications required to be made in tunas of the compressible cleaning structure 7 itself and/or a mounting plate component (A) being incorporated and/or removed done so with the resulting compressible cleaning structure 7 design as a whole still being considered as that of the conceived intellectual property of the present invention. Such alterations/modifications as alluded to of compressible cleaning structure 7 designs may be exemplified and illustrated in FIGS. 99 and 100, both of which are shown from a left to right frontal view taken along an arbitrary mid line cross-section, and are altered/modified from those previous designs, respectively, shown in FIGS. 88 and 95 from a left to right frontal view taken along an arbitrary mid line cross-section, with FIGS. 99 and 100 illustrating, just as in FIGS. 88 and 95, compressible cleaning structure 7 designs incorporating a mounting plate component (A), which are applicable to/surrounding of, respectively, a removable/temporarily fixated cleat type traction member 6 and a removable/temporarily fixated spike type traction member 6, with the designs in FIGS. 99 and 100 differing, respectively, from those designs in FIGS. 88 and 95, in that the compressible material in both these compressible cleaning structure 7 designs extends proximally so to occupy the plate hole (D) in each of their respectively incorporated mounting plate components (A), with the most proximal dorsal surface of their compressible material being continuous with and at the same horizontal level of that mounting plate component (A) dorsal surface, which is adjacent and attaches to the shoe bottom/outer sole 5 plantar surface. Furthermore, upon the review of these just presented examples, it should be understood that all the different compressible cleaning structure 7 designs, fraction member 6 types, mounting plate components (A), and means of fixation of any and all such entities of the present invention are conceived to be offered in any and all combinations of such, with the appropriate alterations/modifications respectively made for the inclusion, removal, interchanging of, and/or substitutions for each and all to function as conceived in any and all those respective combinations, with any and all combinations remaining the intellectual property of the present inventor or assignee.

Figure 101:
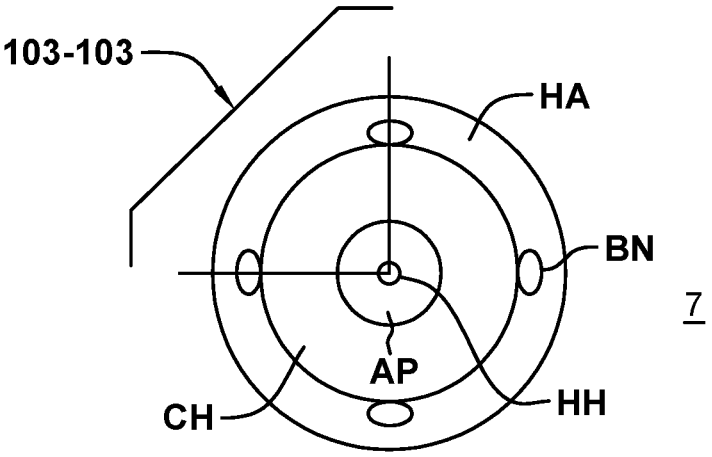
FIG. 101 shows a bottom view of a removable/temporarily fixated compressible cleaning structure, to be fitted together as a pair, with a complementary shaped removable/temporarily fixated cleat type traction member shown in FIG. 102 from a top plan view.
Figure 102:
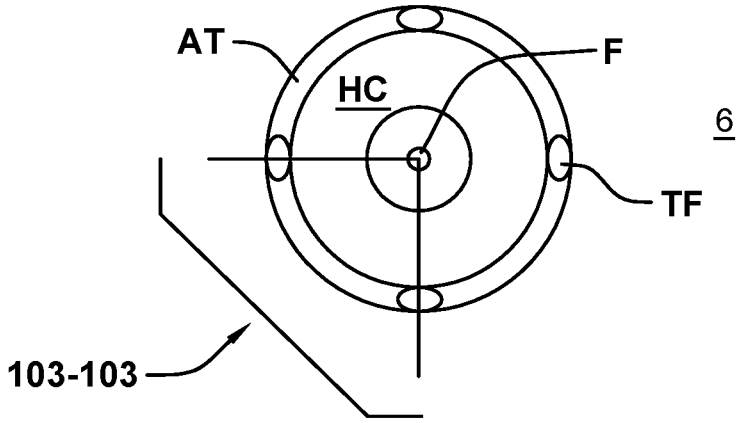
Figure 103:
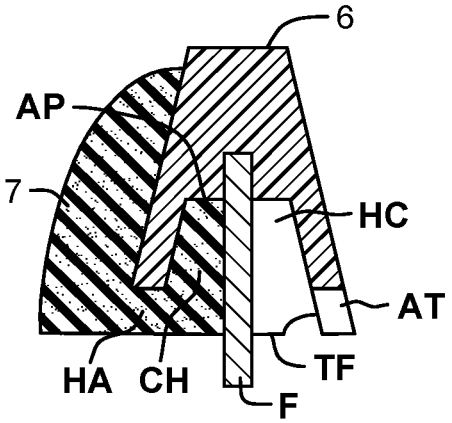
FIG. 103 shows a partial cross-section of quadrant "103-103" in FIG. 101 of the respectively paired combination of the removable/temporarily fixated compressible cleaning structure design shown in FIG. 101 and its complementary shaped removable/temporarily fixated cleat type traction member in FIG. 102.
Figure 104:
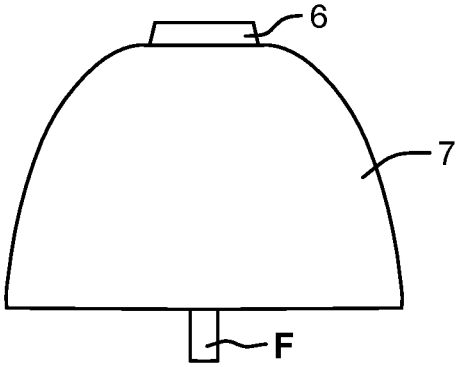
FIG. 104 shows a side view of the same paired and complementary shaped combination in FIG. 103, now completely illustrated.
Figure 105:
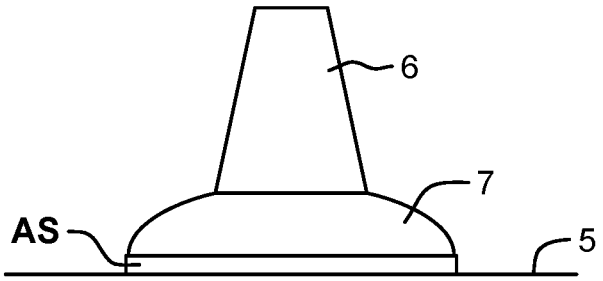
FIG. 105 shows a side view of that same paired and complementary shaped combination shown in FIG. 104, now fixated via the threaded longitudinal stud being tightened in the complementary threaded boss in the shoe bottom/outer sole, in the weight bearing mode, with the compressible cleaning structure compressed, and adhesive strips used to further secure/fixate that portion of the compressible cleaning structure surrounding of the traction member base to the shoe bottom/outer sole.

FIG. 101 shows a bottom view of a removable/temporarily fixated compressible cleaning structure 7 of a design which is complementary shaped to a removable/temporarily fixated cleat type fraction member 6 (not shown in FIG. 101), both of which are of a paired combination specifically fitted together, with the respective traction member 6 maintaining the compressible cleaning structure 7 and itself, when attached/fixated to the shoe bottom/outer sole 5, as a unit in order to best carry out their respective intended functions. A compressible cleaning structure 7 of this such design is constructed with a central hub (CH) of a conical form which distally comes to an apical portion (AP) of a flat circular shape, possessing of a center hole from top to bottom, referred to as a hub hole (HH), through which the threaded longitudinal stud (F) of the complementary shaped fraction member 6 will pass so to be tightened in the threaded boss (G) of the shoe bottom/outer sole 5, with the central hub (CH) designed with a plurality of hub arms (HA), which are four equidistant spoke like projections of an arch shape extending peripherally from the periphery of the base of the central hub (CH), that connect to the base of the surrounding inner aspect of the compressible cleaning structure 7 opposite and adjacent to the base of the perimeter of the central hub (CH), both of which when connected by the hub arms (HA) have a plurality of base notches (BN), they being the four equidistant oval voids/spaces between each of the hub arms (HA), in the floor of the base of the compressible cleaning structure 7 design as a whole in which a portion of the base of the complementary shaped fraction member 6 of a mirroring shape and location, through which the hub arms (HA) do not pass, will be fitted in and fit through these base notches (BN) so to contact the shoe bottom/outer sole 5 plantar surface when the paired combination is secured/fixated to the same. FIG. 102 shows a top plan view of a removable/temporarily fixated cleat type traction member 6, complementary shaped to and to be paired in combination with the just described compressible cleaning structure 7 illustrated in FIG. 101, with a plurality of arm tunnels (AT), which are four equidistant arch shaped openings about the perimeter of the base of this traction member 6, with the openings of each of these arm tunnels (AT) bordered on each side by a traction pod (TF), that aforementioned portion of the base of the complementary shaped traction member 7, which mirror the shape and location of those base notches (BN) of the compressible cleaning structure 7 shown in FIG. 101, so to fit in those base notches (BN) as previously described. The arm tunnels (AT), complementary in shape to the hub arms (HA) of the compressible cleaning structure 7, so to allow the hub arms (HA) to entirely fit in and pass through, are constructed with an open floor, which is continuous with a hub cavity (HC), which is that complete central opening in the bottom aspect/floor of the base of the traction member 6, bordered peripherally by the inner wall of the base of that traction member 6, and continues to and throughout that void in space located within the body walls of the traction member 6. The hub cavity (HC) is of a complementary shape to the central hub (CH), which will be entirely fitted in the hub cavity (HC), with the threaded longitudinal stud (F) of the traction member 6 centrally located and axially oriented in the hub cavity (HC) so to pass through the hub hole (HH) of the central hub (CH) entirely so it may be fixated in the complementary threaded boss (G) of the shoe bottom/outer sole 5. FIG. 103 shows a partial cross-section view of quadrant "103-103" in FIGS. 101 and 102 of the respectively described removable/temporarily fixated compressible cleaning structure 7 and its complementary shaped removable/temporarily fixated cleat type traction member 6 paired and fitted together in combination, unattached to the shoe bottom/outer sole 5. The quadrant shown in bottom view of FIG. 101 is a mirror image of the quadrant shown in top plan view of FIG. 102. FIG. 104 shows a side view of the pair fitted to one another and completely illustrated, and FIG. 105 shows a side view of the same, now fixated to the shoe bottom/outer sole 5, in the weight bearing mode with the compressible cleaning structure 7 fully compressed, via the tightening of the threaded longitudinal stud (F) of the traction member 6, which passes through the central hub (CH) of the compressible cleaning structure 7, in the threaded boss (G) of the shoe bottom/outer sole 5, ensuring a tight and close fit of all to the shoe bottom/outer sole 5, with the base portion of the compressible cleaning structure 7 emerging from the arm tunnels (AT) and beyond, so to surround the traction member 6 base, which may be further secured, if and when chosen, to the shoe bottom/outer sole 5, by an adhesive strip (AS) as shown, or any other suitable means, e.g., VELCRO® (V), etc. This paired combination of a removable/temporarily fixated compressible cleaning structure 7 with the complementary shaped removable/temporarily fixated cleat type traction member 6 may also be combined in a "complete set" form in which the pair is permanently fixated to one another and/or integrally, fabricated, by any suitable means of production, so to be available as a one piece off-the-shelf item which may be retrofitted to those sport shoe designs whose inventors lacked the conception of their such designs being of the self-cleaning sport shoe variety, available to the wearer so to allow them to install, repair, replace, etc., this one piece item quickly and easily at their discretion, while providing all the respective desired abilities of both components in this single structure.

Figure 106:
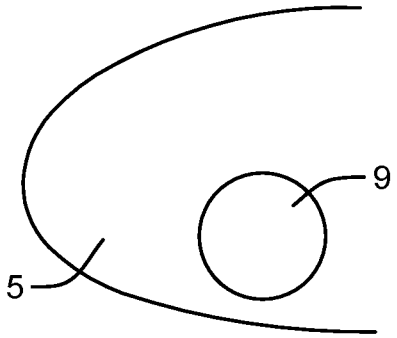
FIG. 106 shows a bottom view of a concave reservoir located in the plantar surface of the shoe bottom/outer sole.
Figure 107:
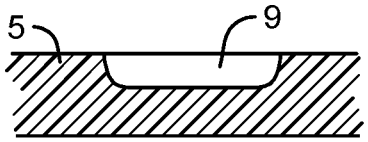
FIG. 107 shows a left to right frontal view taken along an arbitrary mid line cross-section of that concave reservoir located in the plantar surface of the shoe bottom/outer sole shown in FIG. 106.
Figure 108:
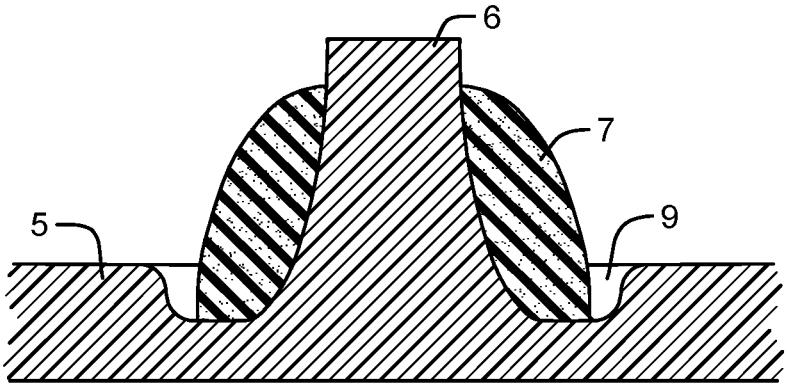
FIGS. 108, 109, 110, and 111 show a left to right frontal view taken along an arbitrary mid line cross-section of compressible cleaning structure designs, non-compressed in the non-weight bearing mode, permanently/integrally attached to their accommodatingly shaped concave reservoir in which they attach to/originate from in the shoe bottom/outer sole, surrounding of a permanently fixated cleat type traction member in FIG. 108, a permanently fixated spike type traction member in FIG. 109, a removable/temporarily fixated cleat type traction member in FIG. 110, and a removable/temporarily fixated spike type traction member in FIG. 111.
Figure 109:
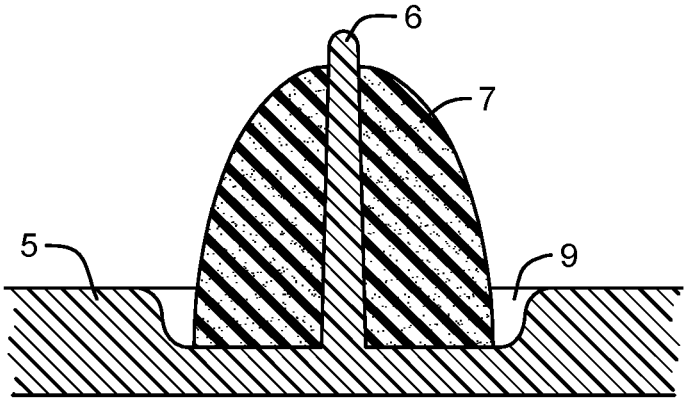
Figure 110:
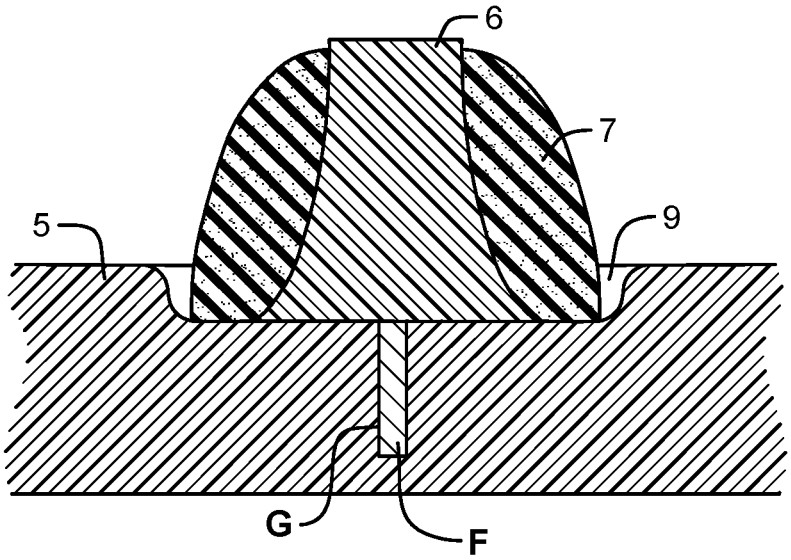
Figure 111:
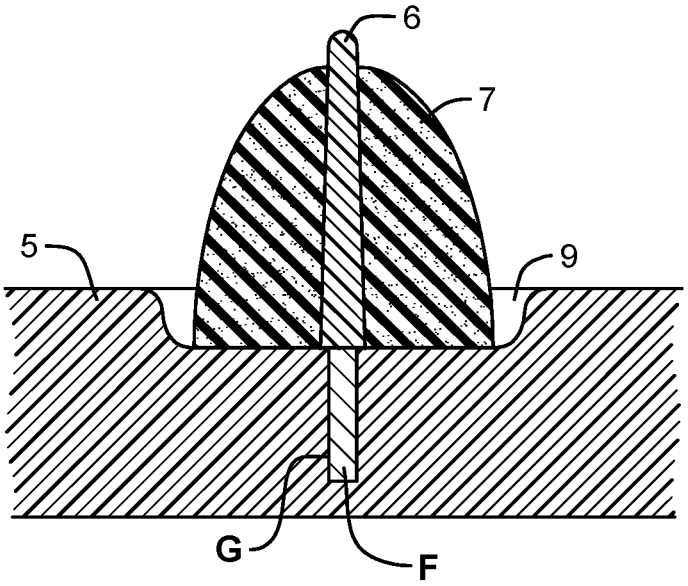

The conceived self-cleaning provisions of the compressible cleaning structure 7 of the present invention remain as already described in those designs without a concave reservoir 9, but are further improved in those designs in which the compressible cleaning structure 7 (not shown in FIGS. 106 and 107), may be fitted in the uniquely conceived concave reservoir 9 of the present invention located in the plantar surface of the shoe bottom/outer sole 5, shown in FIG. 106 from a bottom view and FIG. 107 from a left to right frontal view taken along an arbitrary mid line cross-section. The traction member 6 (not shown in FIGS. 106 and 107), which attaches to/originates from a point in the shoe bottom/outer sole 5 within the concave reservoir 9, is surrounded by the compressible cleaning structure 7, which is located within that same concave reservoir 9 which is of an accommodating complementary shape for that adjacent surface of the compressible cleaning structure 7 design as a whole to attach to/originate from, whereby, being located in that concavity of the concave reservoir 9, the compressible cleaning structure 7 is provided with ample room to expand when fully compressed, as when in the weight bearing mode, and in occupying the allotted space is essentially allowed to fully flatten within the concave reservoir 9, thereby maintaining a relatively flat shoe bottom/outer sole 5, with the concave reservoir 9 providing a physical barrier to those lateral and shearing type forces encountered during play by having the compressible cleaning structure 7 avoid such forces during play by being fully compressed and protected in the concave reservoir 9, opposed to those shoes of prior patent designs lacking in such an accommodating type of concave reservoir 9 space, as U.S. Pat. No. 4,146,979 of Fabbrie, U.S. Pat. No. 4,271,608 of Tomura, U.S. Pat. No. 4,466,205 of Corbari, and that of the aforementioned U.S. Pat. No. 6,698,110 of Robbins. This void of such an accommodating space, otherwise provided by the concave reservoir 9 of the present invention, would result in a downward protrusion of the compressible cleaning structure 7 to some degree, even when fully compressed, relative to the plantar surface of the shoe bottom/outer sole 5 from which the traction member 6 of the cleat and/or spike type extends. Thus, it should be duly understood that the presence of any such protrusion formed about the traction member 6 by the compressible cleaning structure 7 ultimately decreases the exposure of that traction member 6 it surrounds to less than its maximum level, and/or the lacking of a concave reservoir 9 would result in a greater degree of exposure of the compressible cleaning structure 7 surface area to those lateral and shearing forces, and their accompanying ill effects encountered during wear/play, which in contrast may be avoided and/or greatly reduced in the present invention, when incorporating its unique concave reservoir 9.

The aforementioned prior art of Nike Innovate C.V. '645 A1, describes a shoe with a self-cleaning surface in the peripheral area of a cleat located on the bottom of a sole plate, which states "In some embodiments, for example as shown in FIG. 26, the cleats may include a groove around the sidewall of the cleats that corresponds in shape to the resilient members. Such a groove may receive and retain the resilient members." This respective embodiment shown in FIG. 26 of the previously proposed invention of Nike Innovate C.V. '645 A1, provides no explicit description or illustration of this groove being other than a surface located below the outer surface of the sole plate of the shoe, for which the resilient members may attach to, which is unlike the accommodatingly shaped concave reservoir 9 located within the shoe bottom/outer sole 5 of the present invention, which in addition to being thoroughly described and illustrated as providing a surface for the compressible cleaning structure 7 to be integrated/fixated/attached to, also is specifically designed to provide an area of volume for the compressible cleaning structure 7 surrounding the traction member 6, which is distal to both the horizontal level of the accommodatingly shaped concave reservoir 9 within the shoe bottom/outer sole 5 and the shoe bottom/outer sole 5 itself when in the non-weight bearing mode, to be completely flush with and fitted in the accommodatingly shaped concave reservoir 9 upon full compression in the weight bearing mode, so to be at the same horizontal level of the shoe bottom/outer sole 5 in which the accommodatingly shaped concave reservoir 9 is located, thereby allowing full exposure of the surrounded traction member 6. In returning to the non-weight bearing mode, the compressible cleaning structure 7 will coincidingly expand/extend distally to that horizontal level of the accommodatingly shaped concave reservoir 9 within the shoe bottom/outer sole 5, and will function to clean the shaft of the traction member 6 it surrounds of any debris which may have accumulated on such during ground contact in the prior weight bearing mode. The previously proposed invention of Nike Innovate C. V. '645 A1, in its text also states "Article of footwear 2600 may include a first indentation 2611, a second indentation 2613, a third indentation 2615, a fourth indentation 2616, a fifth indentation 2619, a sixth indentation 2621, a seventh indentation 2623, an eighth indentation 2625, a ninth indentation 2637, and a tenth indentation 2639 disposed on forefoot region 2640 of sole plate 2602. Article of footwear 2600 may include an eleventh indentation 2643 disposed on the heel region 2642. The indentations may be sized and shaped to receive the corresponding resilient members. In some embodiments, the indentations may be sized and shaped such that the resilient members are flush with bottom surface 2608 of sole plate 2602. In some embodiments, the indentations may be sized and shaped such that the resilient members are recessed below bottom surface 2608 of sole plate 2602. In some embodiments, the indentations may be sized and shaped such that the resilient members still slightly protrude from bottom surface 2608 of sole plate 2602. The indentations may facilitate holding the resilient members in place." The aforementioned description of Nike Innovate C.V. '645 A1 provides no description and/or illustration of the three mentioned embodiments and their respectively sized and shaped indentations which allegedly may facilitate holding the resilient members in place, in transition from the non-weight bearing to weight bearing mode, and vice versa, of its resilient members in each of its one of the three respectively sized and shaped indentations in the bottom surface of the sole plate, and while Nike Innovate C.V. '645 A1 allegedly cleans cleats by using resilient members that compress against a surface of the ground and then spring back, preventing mud from sticking to the resilient member in the vicinity of a cleat, there are no additional details of how this occurs.

For example, Nike Innovate C.V. '645 A1 fails to provide evidence that any and/or all resilient members may be of a design by which any one of such are to transition from and/or at any time be recessed below the bottom surface of the sole plate, flush with the bottom surface of the sole plate, and protrude from the bottom surface of the sole plate. Thus, the indentations/grooves of Nike Innovate C.V. '645 A1 fail to share the design configuration function of the present invention and its accommodatingly shaped concave reservoir 9 in allowing a transitory movement coinciding with the shift from the non-weight bearing mode to the weight bearing mode, and vice versa, to allow the one and the same compressible cleaning structure 7 integrated/attached/fixated in its respective accommodatingly shaped concave reservoir 9 to be above, at, and/or below, the bottom surface/horizontal level of the shoe bottom/outer sole 5, to allow for both full exposure and cleaning of the shaft of the same respective traction member 6, and the traction member 6 as a whole, in the present invention.

While incorporating a concave reservoir 9 in the designs of the present invention will be clearly preferable and advantageous in regard to the compressible cleaning structure 7 in comparison to those designs lacking in such for the reasons presented in this text, it should still be understood that the compressible cleaning structure 7 is both conceived and intended not only as a permanently fixated and/or an integral structural component in the concave reservoirs 9 in designs in which such is incorporated, but the same in those self-cleaning sport shoe designs lacking in a concave reservoir 9

FIGS. 108, 109, 110, and 111, all show a left to right frontal view taken along an arbitrary mid line cross-section of compressible cleaning structure 7 designs, non-compressed in the non-weight bearing mode, which are permanently fixated/integrally attached to their accommodatingly shaped concave reservoir 9 in the shoe bottom/outer sole 5, and surrounding of their respective traction member 6, those being a permanently fixated/integrally attached cleat type, a permanently fixated/integrally attached spike type, a removable/temporarily fixated cleat type, and a removable/temporarily fixated spike type.

Figure 112:
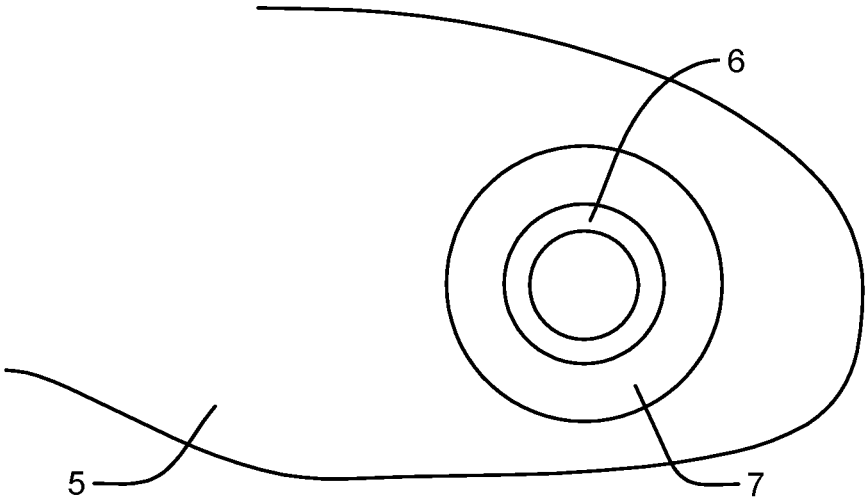
FIG. 112 shows a bottom view.
Figure 113:
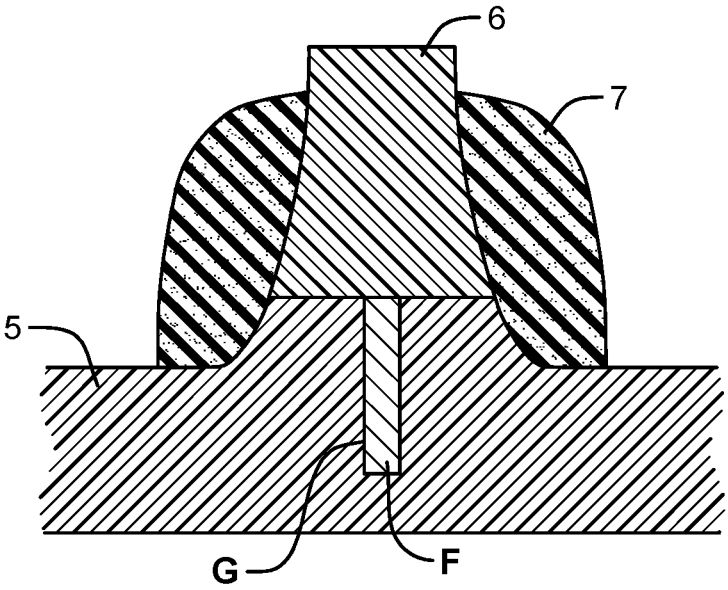
FIGS. 113 and 114 show a left to right frontal view taken along an arbitrary mid line cross-section, non-compressed in the non-weight bearing mode and compressed in the weight bearing mode, respectively, of a permanently fixated/integrally attached compressible cleaning structure design incorporated in the shoe bottom/outer sole of a self-cleaning sport shoe design in which that shoe bottom/outer sole extends distally from its most proximal aspect, with the base of its respective traction member, a removable/temporarily fixated cleat type traction member, originating/beginning from not the most proximal, but rather a more distal, and as shown, the most distal aspect of that shoe bottom/outer sole, surrounded by that compressible cleaning structure.
Figure 114:
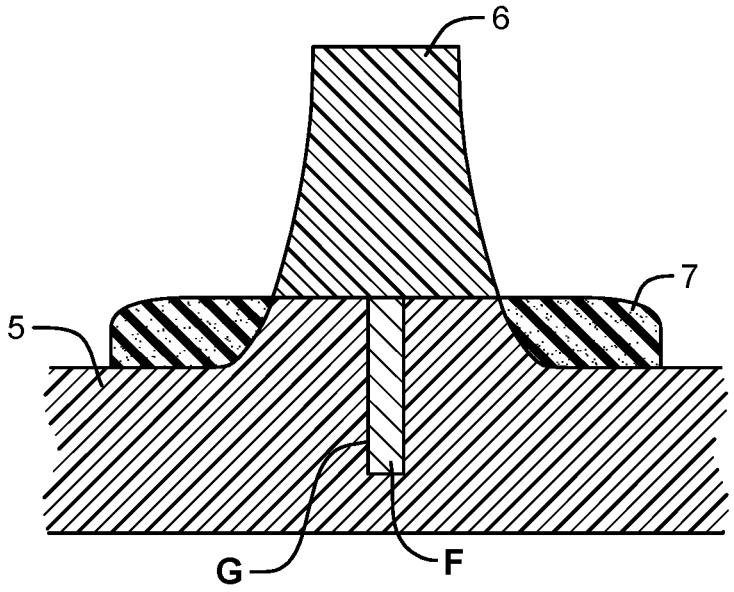

A sport shoe of the self-cleaning variety, lacking in a concave reservoir 9, is shown in FIG. 112 from a bottom view, and FIGS. 113 and 114 from a left to right frontal view taken along an arbitrary mid line cross-section, non-compressed in the non-weight bearing mode and compressed in the weight bearing mode, respectively, with a permanently fixated/integrally attached compressible cleaning structure 7 design and the removable/temporarily fixated cleat type traction member 6 it surrounds fixated/attached to a shoe bottom/outer sole 5 which is contoured to extend distally from its most proximal aspect, with the base of the respectively fixated/attached traction members 6 originating/beginning from the not most proximal, but rather a more distal aspect of the shoe bottom/outer sole 5, with the traction members 6 extending distally in length to their most distal plantar aspect which traction the playing field surface. Self-cleaning sport shoe designs of this particular variety upon full compression of the compressible cleaning structure 7 in the weight bearing mode, as illustrated in the aforementioned FIG. 114, will allow for what has already described in the present invention as full exposure of the traction member 6 to which they are mated to/surround. It is conceived in the present invention, and should be easily understood, how any compressible cleaning structures 7 and/or traction members 6, of the permanent and/or temporarily fixated/removable type, may be transposed in any combination upon this such self-cleaning sport shoe design, with such removable/temporarily fixated items also conceived to be available as an aftermarket item, so to be incorporated by the wearers of such sport shoe designs, providing such with a self-cleaning ability.

Figure 115:
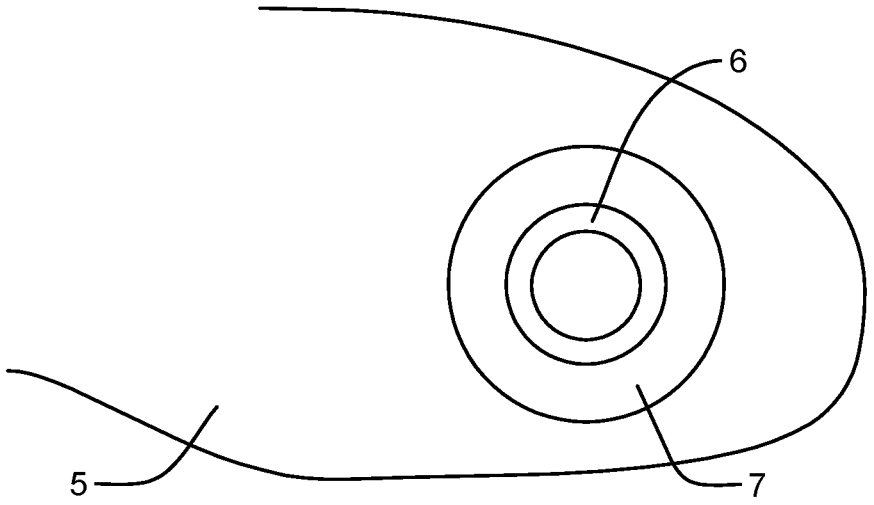
FIG. 115 shows a bottom view and FIG. 116 a side view, non-compressed in the non-weight bearing mode, and FIG. 117 a left to right frontal view taken along an arbitrary mid line cross-section, compressed in the weight bearing mode, of a permanently/integrally attached compressible cleaning structure design surrounding of a removable/temporarily fixated cleat type traction member fixated via the tightening of its threaded longitudinal stud in the complementary threaded boss in the shoe bottom/outer sole, incorporated within an accommodatingly shaped concave reservoir which has an outermost periphery of a height equal to that level of the most distal aspect of the shoe bottom/outer sole at which the base of, and the respective traction member itself, are considered to originate/begin, with the most proximal/deepest aspect of the concave reservoir at the same level as the most proximal aspect of the shoe bottom/outer sole plantar surface surrounding of the entire concave reservoir.
Figure 116:
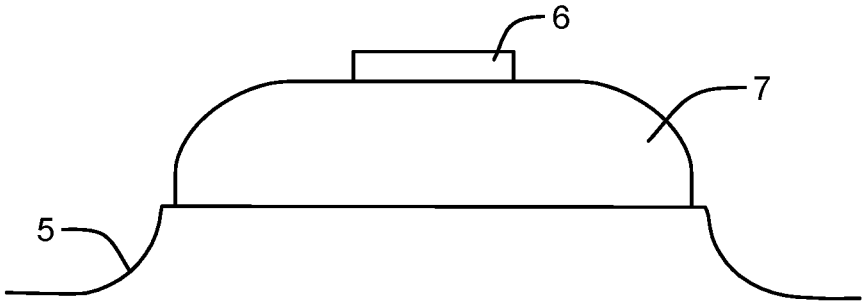
Figure 117:
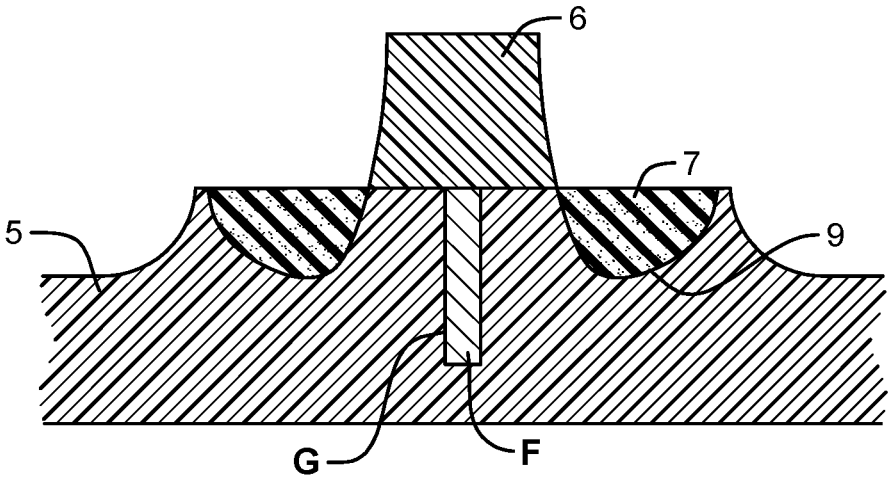
Figure 118:
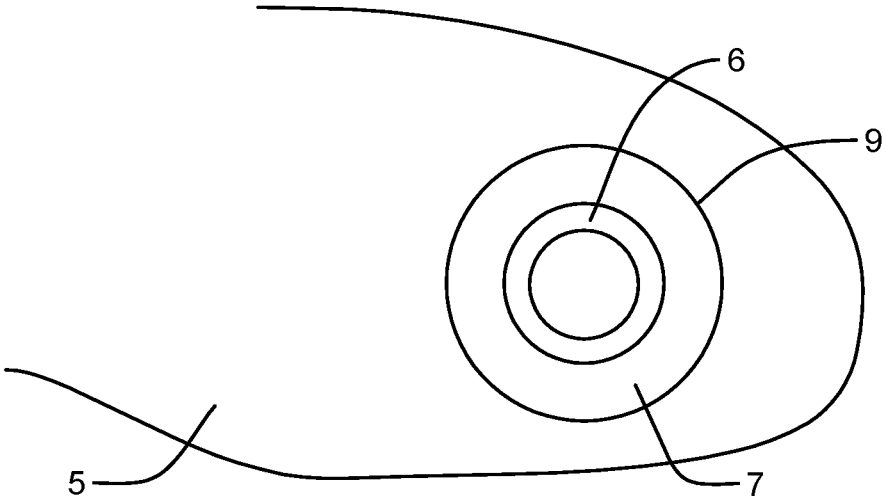
FIG. 118 shows a bottom view and FIG. 119 a side view, non-compressed in the non-weight bearing mode, and FIG. 120 a left to right frontal view taken along an arbitrary mid line cross-section, compressed in the weight bearing mode, of a permanently/integrally attached compressible cleaning structure design surrounding of a removable/temporarily fixated cleat type traction member fixated via the tightening of its threaded longitudinal stud in the complementary threaded boss in the shoe bottom/outer sole, incorporated within an accommodatingly shaped concave reservoir which has an outermost periphery of a height more proximal to that level of the most distal aspect of the shoe bottom/outer sole at which the base of, and the respective traction member itself, are considered to begin/originate, with the outermost periphery equal in height to the most proximal aspect of the shoe bottom/outer sole plantar surface other than the more proximal concave aspect of the shoe bottom/outer sole it surrounds, which itself is the concave reservoir.
Figure 119:
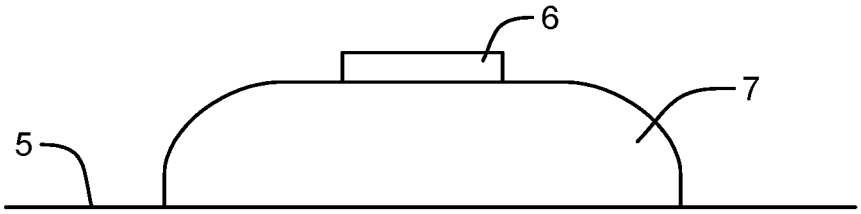

It is also conceived in the present invention how the self-cleaning sport shoe design just previously illustrated in FIGS. 112, 113 and 114, lacking in a concave reservoir 9, may be incorporated with a concave reservoir 9. In one such design, as shown in FIGS. 115 and 116, from a bottom and side view, respectively, non-compressed in the non-weight bearing mode, and FIG. 117 from a left to right frontal view taken along an arbitrary mid line cross-section, compressed in the weight bearing mode, is a permanently fixated/integrally attached compressible cleaning structure 7 design surrounding of a removable/temporarily fixated cleat type traction member 6, fixated via the tightening of its threaded longitudinal stud (F) (not shown in FIGS. 115 and 116, but shown in FIG. 117) in its complementary threaded boss (G) (not shown in FIGS. 115 and 116, but shown in FIG. 117) in the shoe bottom/outer sole 5, with this respective compressible cleaning structure design 7 fixated within the accommodatingly shaped concave reservoir 9, which is constructed with the height of its outermost periphery not at the most proximal level of the shoe bottom/outer sole 5, but rather a more distal level, and/or as in the case of this respective design, at that same level at which the origin of the base of that removable/temporarily fixated cleat type traction member 6 it surrounds begins, which is the most distal aspect of the outer sole 5, with the most proximal aspect of that concavity which comprises the concave reservoir 9 itself, at that same level of the more and/or, as in the case of this respective design, the most proximal aspect of the shoe bottom/outer sole 5. Shown in FIGS. 118 and 119, from a bottom and side view, respectively, non-compressed in the non-weight bearing mode, and FIG. 120 from a left to right frontal view taken along an arbitrary mid line cross-section, compressed in the weight bearing mode, is another conceived design of a permanently fixated/integrally attached compressible cleaning structure 7 surrounding of a removable/temporarily fixated cleat type traction member 6, fixated via the tightening of its threaded longitudinal stud (F) (not shown in FIGS. 118 and 119, but shown in FIG. 120) in its complementary threaded boss (G) (not shown in FIGS. 118 and 119, but shown in FIG. 120) in the shoe bottom/outer sole 5, with this respective compressible cleaning structure 7 fixated in the accommodatingly shaped concave reservoir 9, which is constructed with its outermost periphery at a level more proximal than that level of the most distal aspect of the shoe bottom/outer sole 5 from which the origin of the base of the respective traction member 6 it surrounds originates/begins from, and as in the case of this respective design, the outermost periphery of the concave reservoir 9 will be at the same level as that most proximal aspect of the shoe bottom/outer sole 5 itself, other than that more proximal concavity in the shoe bottom/outer sole 5 the outermost periphery surrounds, which itself is the concave reservoir 9.

Figure 121:
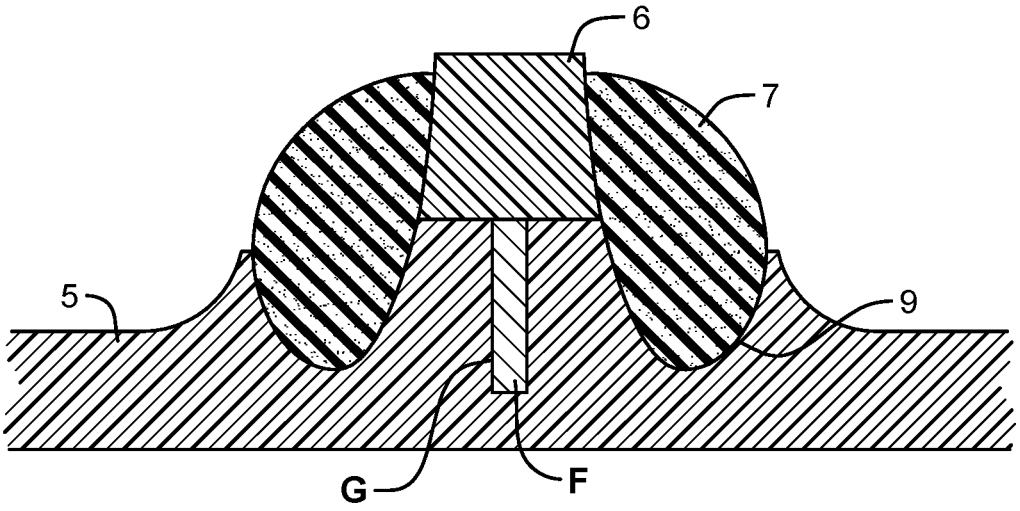
FIGS. 121 and 122 show a left to right frontal view taken along an arbitrary mid line cross-section, non-compressed in the non-weight bearing mode and compressed in the weight bearing mode, respectively, of a permanently/integrally attached compressible cleaning structure design surrounding of a removable/temporarily fixated cleat type traction member fixated via the tightening of its threaded longitudinal stud in the complementary threaded boss in the shoe bottom/outer sole, incorporated within an accommodatingly shaped concave reservoir which has an outermost periphery of a height proximal to that level of the most distal aspect of the shoe bottom/outer sole at which the base of, and the respective traction member itself, are considered to begin/originate, with the most proximal aspect of the concave reservoir more proximal and deeper than all other aspects of the shoe bottom/outer sole plantar surface.
Figure 122:
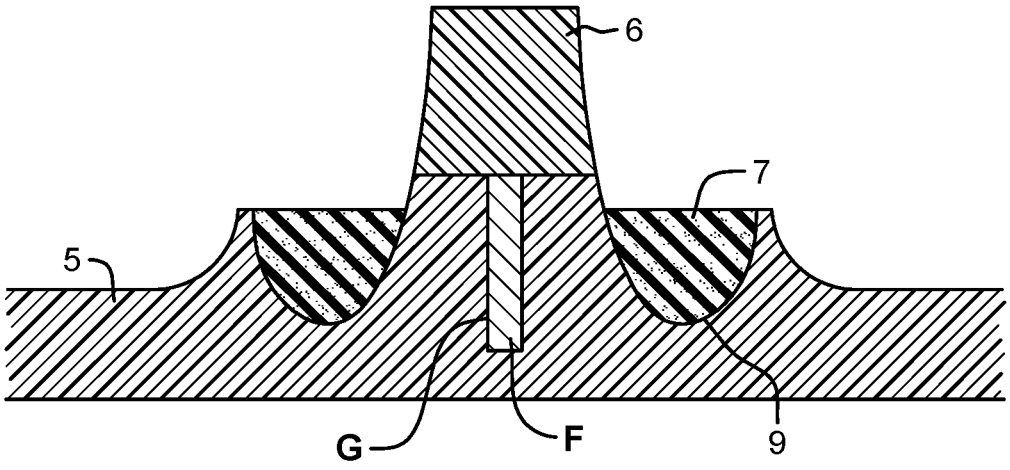

It should be understood upon reviewing the two previously described concave reservoirs 9 in each of their respective self-cleaning sport shoe designs in which the traction members 6 they surround originate/begin not from the most proximal, but rather a more, and in these cases as described, the most distal aspect of the shoe bottom/outer sole 5, that the physical characteristics of these concave reservoirs 9 have been conceived to be incorporated to some degree with each other so to result in a concave reservoir 9 design which will allow the respective traction member 6 to be fully exposed, as defined by the present invention, just as the two previously described concave reservoirs 9 will ably do in their respective designs, upon full compression of the compressible cleaning structure 7 within the said resulting concave reservoir 9 designs when in the weight bearing mode. For example, FIGS. 121 and 122 show a left to right frontal view taken along an arbitrary mid line cross-section, non-compressed in the non-weight bearing mode and compressed in the weight bearing mode, respectively, of a permanently fixated/integrally attached compressible cleaning structure 7 within an accommodatingly shaped concave reservoir 9 with an outer most periphery at a level proximal to the origin of the base of the removable/temporarily fixated cleat type traction member 6 fixated via its tightened threaded longitudinal stud (F) in the complementary threaded boss (G), which is an altered/modified design of that shown in FIGS. 115, 116, and 117, in which the outermost periphery in that concave reservoir 9 design is constructed at that same level of origin as the base of the respectively incorporated traction member 6, and may be combined in construction with the most proximal aspect of the concave reservoir 9 itself in this respective design being more proximal and deeper in the shoe bottom/outer sole 5 than that concave reservoir 9 in FIGS. 118, 119, and 120, whereby such a combination will allow for full exposure of the removable/temporarily fixated cleat type traction member 6 upon full compression of the compressible cleaning structure 7 within the accommodatingly shaped concave reservoir 9 during the weight bearing mode.

Figure 123:
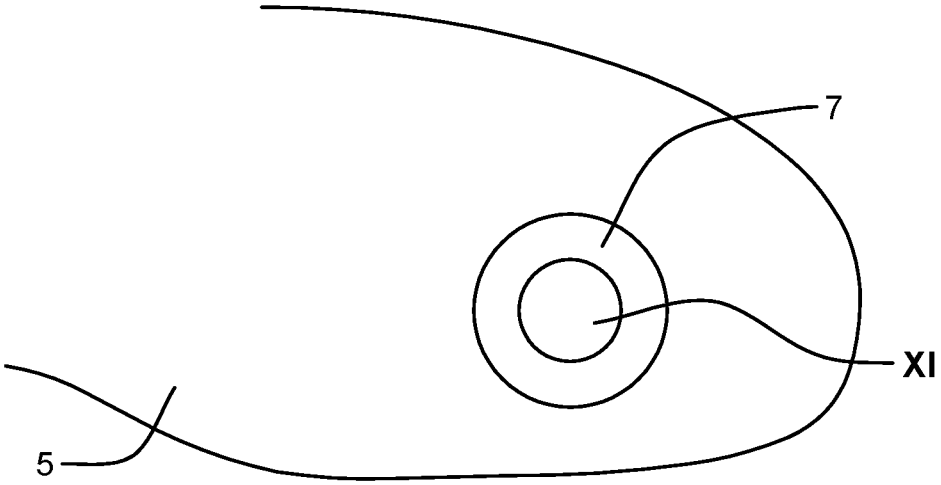
FIGS. 123, 124, and 125, show a bottom, side, and left to right frontal view taken along an arbitrary mid line cross-section, respectively, of a removable/temporarily fixated cleat type traction member fixated via the tightening of its threaded longitudinal stud in the complementary threaded boss in the shoe bottom/outer sole, constructed with its distal aspect with a capped end of a larger diameter than the adjacent distal end of the traction body hole of the compressible cleaning structure it is surrounded by, which prevents the compressible cleaning structure, which is non-compressed in the non-weight bearing mode, and free and unattached to the shoe bottom/outer sole and traction member, from moving beyond the capped end of the traction member when such is fixated to the shoe bottom/outer sole.
Figure 124:
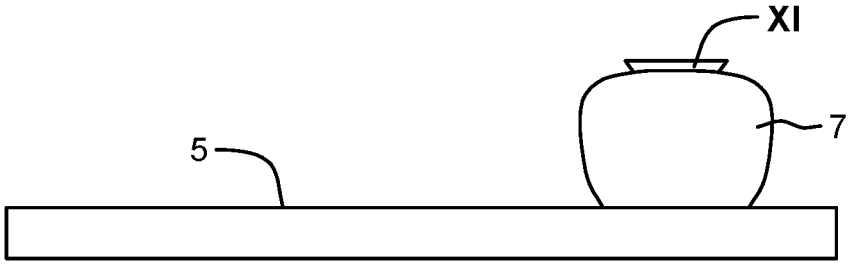
Figure 125:
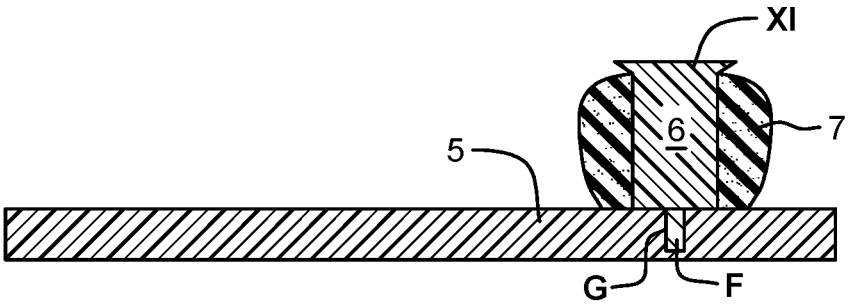

The present invention conceives of a cleat type traction member 6 design, which may be of the permanently fixated and/or temporarily fixated/removable type, shown in FIGS. 123, 124, and 125, from a bottom, side, and left to right frontal view taken along an arbitrary mid line cross-section, respectively, of the removable/temporarily fixated cleat type, fixated via its tightened threaded longitudinal stud (F) (not shown in FIGS. 123 and 124, but shown in FIG. 125) in the complementary threaded boss (G) (not shown in FIGS. 123 and 124, but shown in FIG. 125) in the shoe bottom/outer sole 5, constructed with the distal aspect of the fraction member 6 with a capped end (XI) of a diameter greater than that of the most distal end of the traction body hole (C) (not shown in FIGS. 123 and 124, but shown in FIG. 125) of the compressible cleaning structure 7, which is non-compressed in the non-weight bearing mode, and surrounding of the traction member 6. The compressible cleaning structure 7 incorporated in this such design will not be attached/fixated to the outer sole 6 and/or the fraction member 6 it is mated to/surrounding of, but rather maintained in that such position so to surround the respective traction member 6 via its capped end (XI) being of a larger diameter, as explained, than the most distal end of the fraction body hole (C) of the compressible cleaning structure 7, thereby preventing the compressible cleaning structure 7 plantar aspect, which is adjacent to the dorsal aspect of the capped end (XI) of the fraction member 6, and the compressible cleaning structure 7 as a whole, from moving distally from that position in which it is surrounding of the fraction member 6, by preventing the most distal aspect of the traction body hole (C) from moving beyond the point at which it contacts the adjacent proximal dorsal aspect of the capped end (XI) of the fraction member 6. Thus, regardless of the compressible cleaning structure 7 being free and not attached/fixated to the shoe bottom/outer sole 5 and/or fraction member 6, the compressible cleaning structure 7, with the fraction member 6 fixated to the shoe bottom/outer sole 5, will be maintained in such a position so as to surround the traction member 6 and perform its already thoroughly described function by which it cleans the fraction member 6. Both the temporarily fixated/removable cleats of this such design and their surrounding complementary compressible cleaning structures 7 would be readily available to the wearer as aftermarket items to remove, repair, replace, etc., either of these structures when seen fit. It should also be easily understood from viewing the previous figures how this such design may be incorporated with cleat fraction members 6 of the permanently fixated type, as well as any and all those fraction members 6 of the permanently and/or temporarily fixated/removable type, be they incorporated with and/or without a concave reservoir 9.

Figure 126:
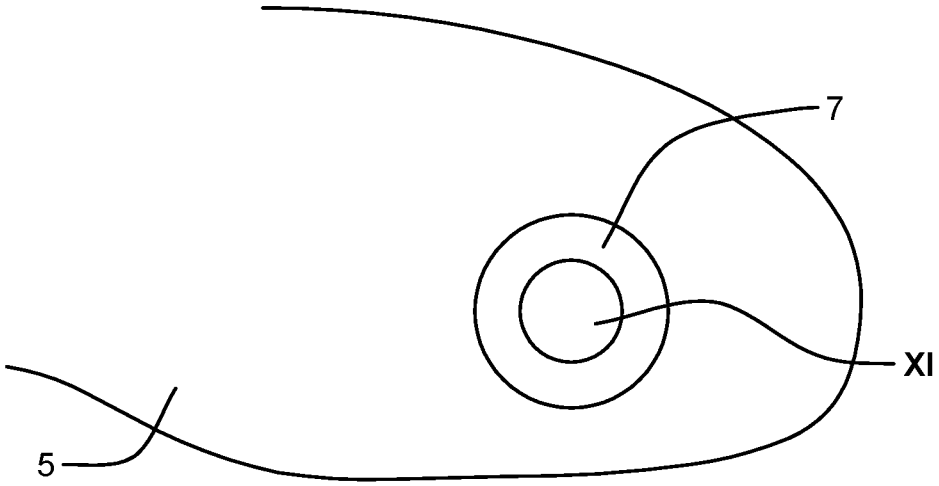
FIGS. 126, 127, and 128, show a bottom, side, and left to right frontal view taken along an arbitrary mid line cross-section, respectively, of a removable/temporarily fixated cleat type traction member fixated via the tightening of its threaded longitudinal stud in the complementary threaded boss in the shoe bottom/outer sole, constructed with a distal capped end and proximal base, both with diameters greater than the openings of the distal and proximal extremes of the traction body hole they are respectively adjacent to of the respectively surrounding compressible cleaning structure, which is non-compressed in the non-weight bearing mode, with those comparatively larger diameters of the distal capped end and proximal base of the fraction member prohibitive of the movement of the compressible cleaning structure beyond these two points and maintaining it in such a position even when unattached to the shoe bottom/outer sole.
Figure 127:
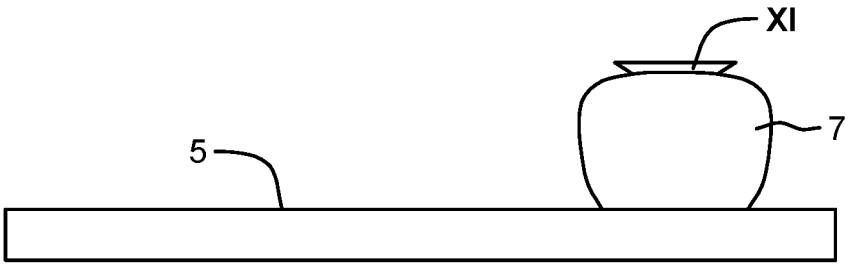
Figure 128:
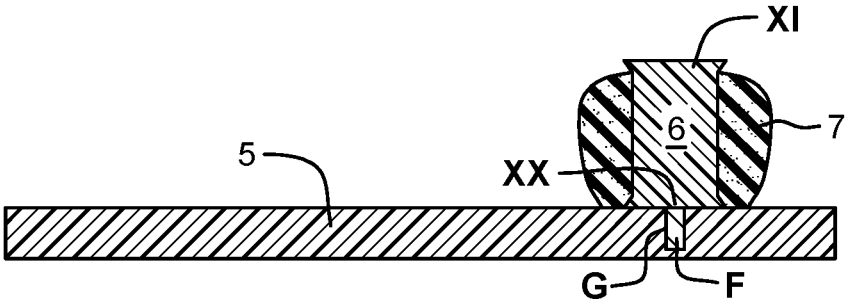

Shown in FIGS. 126, 127, and 128, from a bottom, side, and left to right frontal view taken along an arbitrary mid line cross-section, respectively, is a design incorporating a fraction member 6 of the removable/temporarily fixated cleat type traction member 6 in combination with an accompanying compressible cleaning structure 7 to which it is mated to/surrounded by, with the respective fraction member 6 in such a design constructed with a distal capped end (XI) and a proximal base (XX), in which the dorsal aspect of its proximal base is adjacent to the shoe bottom/outer sole 5 plantar surface this fraction member 6 is attached/fixated to via the tightening of its threaded longitudinal stud (F) (not shown in FIGS. 126 and 127, but shown in FIG. 128) in the complementary threaded boss (G) (not shown in FIGS. 126 and 127, but shown in FIG. 128) in the shoe bottom/outer sole 5. In this design the diameters of the distal capped end (XI) and the proximal base (XX) of the fraction member 6 are of a diameter greater than the openings of the distal aspect of the traction body hole (C) and the proximal aspect of the fraction body hole (C) of the surrounding compressible cleaning structure 7, which is non-compressed in the non-weight bearing mode, they are respectively adjacent to. It should be easily understood upon viewing these illustrations how the compressible cleaning structure 7, while not being fixated to the fraction member 6, shoe bottom/outer sole 5, and/or any other structure, is maintained in that position in which it remains surrounding of the fraction member 6 by the already explained comparatively larger diameters of the distal capped end (XI) and proximal base (XX) of the fraction member 6. Such a compressible cleaning structure 7, in combination with a fraction member 6 in this such design, will be maintained in the appropriate position about the traction member 6 by the described means, so to allow both to perform their designed functions effectively and appropriately throughout wear/play, with the wearer able to remove, repair, replace, etc., this combination of both the compressible cleaning structure 7 and fraction member 6 together as a single unit, with it easily understood by those familiar in the present art how this combination will be maintained in such a single unit even when removed from the shoe bottom/outer sole 5.

Figure 129:
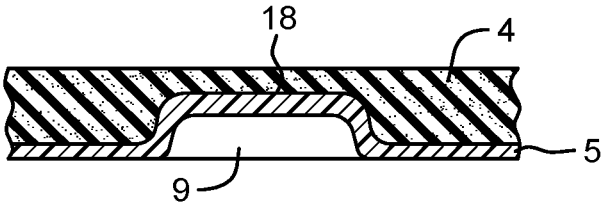
FIG. 129 shows a left to right frontal view taken along an arbitrary mid line cross-section of a concave reservoir which is contained in and enclosed by the shoe bottom/outer sole itself, with the convex protrusion of the dorsal surface side of the shoe bottom/outer sole, which is directly opposite the concave reservoir, fitted into the abutting concavity of a complementary shape in the above mid sole plantar surface.
Figure 130:
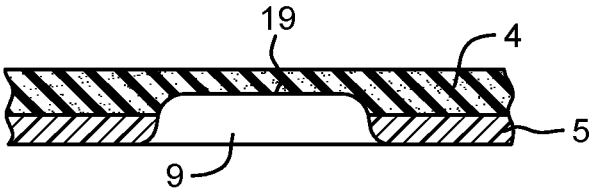
FIG. 130 shows a left to right frontal view taken along an arbitrary mid line cross-section of a concave reservoir in which the most distal portion of the concave reservoir begins as a void at the same horizontal level of the plantar surface of the shoe bottom/outer sole, and continues proximally to completely traverse the most distal to proximal aspects of the shoe bottom/outer sole so to be continuous with the adjoining concavity in the above abutting mid sole plantar surface, with these continuous voids in the shoe bottom/outer sole and mid sole together forming the concave reservoir in its entirety.

In some instances of design of the present invention, as shown in FIG. 129 from a left to right frontal view taken along an arbitrary mid line cross-section, the concave reservoir 9 is enclosed by the outer sole 5 itself, with the convex protrusion of the dorsal surface side of the outer sole 5, which is that side directly opposite the concave reservoir 9 located in the plantar surface of the outer sole 5, protruding and fitting into an abutting concavity 18 of a complementary shape in the above mid sole 4 plantar surface. Also conceived, as shown in FIG. 130 from a left to right frontal view taken along an arbitrary mid line cross-section, is a concave reservoir 9 located in both the outer sole 5 and mid sole 4, in which the most distal portion of the concave reservoir 9 begins as a void at the same horizontal level of the plantar surface of the shoe bottom/outer sole 5, and continues proximally to completely traverse the most distal to proximal aspects of the shoe bottom/outer sole 5 so to be continuous with the adjoining concavity 19 in the above abutting mid sole 4 plantar surface, with these voids in the shoe bottom/outer sole 5 and mid sole 4 together forming the concave reservoir 9 of this particular design in its entirety.

The two prior concave reservoir 9 designs may be incorporated for their provisions of greater depth and greater overall accommodating space, if and when such may be so required, for those compressible cleaning structures 7 to which they are mated, relative to instances of the same shoe in which its design differs in respect to that shoe's concave reservoir 9 being only of a depth of its outer sole 5. These designs in which the concave reservoir 9 is located in both the outer sole 5 and mid sole 4, as well as any consideration for the concave reservoir 9 to be located by design in the shoe bottom/outer sole 5 and/or any additional structural layers proximal thereto, are conceived and may be easily and understandably transposed to, and not limited by those illustrated and described designs of the present invention located only in the outer sole 5, when appropriate.

It should be noted that in those designs lacking any of the described concave reservoirs 9, a construction of greater overall traction member 6 length may be required to compensate for their lesser traction member 6 length exposure due to the aforementioned downward protrusion of the compressible cleaning structure 7, in order to equal that overall exposure length as provided by the present invention when it incorporates its respective concave reservoir 9. This compensatory added length may result in an overall length that exceeds the amount allowed for those traction members 6 to be worn by the various sports respective governing bodies. In those cases in which such compensations of greater overall traction member 6 length were made in a fashion not found prohibitive by such governing bodies, one could still not deny that those invention designs lacking such a concave reservoir 9 as explained, would ultimately require a traction member 6 of excessive compensatory length, making them more cumbersome than those afforded by the present invention due to the provisions of its concave reservoir 9, thus impairing of both the kinesthetic awareness and proprioceptive sense of the wearer, as well as their overall comfort and feel for the game.

Figure 131:
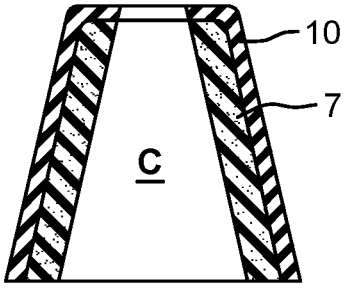
FIGS. 131 and 132 show a left to right frontal view taken along an arbitrary mid line cross-section of a compressible cleaning structure covered by a protective membrane layer with an outermost surface of a smooth texture and nub texture, respectively.
Figure 132:
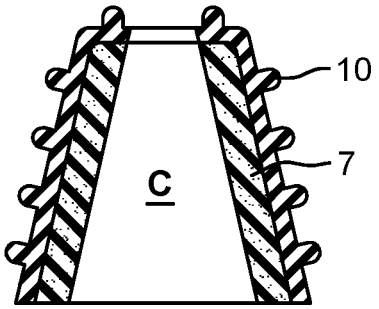

The compressible cleaning structures 7, shown in FIGS. 131 and 132 from a left to right frontal view taken along an arbitrary mid line cross-section, constructed with a traction body hole (C) which may be fitted with a temporarily and/or permanently fixated cleat type traction member 6, are covered by a protective membrane layer 10 of a smooth and nub texture, respectively, mated to their outermost surface, functioning to both protect and preserve their physical integrity from the forces encountered when contacting the playing field surface with each and every step, thus maintaining its ability to continue to perform its intended function. The friction between those contacting surfaces of the shoe and playing field, when chosen by design, may be increased by that protective membrane layer 10 outermost surface being of a nub texture, thereby enhancing the overall traction ability of the respective shoe. These are only examples of the protective membrane layer 10 surface textures, and in no way limit their conceived scope in any way.

It is to be understood that while the protective membrane layer 10 may not possess the same degree of compression-extension quality as that of the compressible cleaning structure 7 to which it is mated to and covering, it will provide a complementary physical means to that of the compressible cleaning structure 7 by which the traction member 6 is cleaned due to its proximity to that traction member 6 surface and its direct physical contact with that debris/material to be removed, and by its own physical attachment to the compressible cleaning structure 7 so to move as the compressible cleaning structure 7 does, through its stages of compression and extension. The protective membrane layer 10 materials of construction would be of qualities which ensure it remains durable, resilient, flexible, as well as abrasion and tear resistant, protective of the compressible cleaning structure 7 as aforementioned, and intrinsically protecting and preserving itself and its own surface, which along with the traction members 6, will contact the playing field surface when the shoe is entered into the weight bearing mode. Any choice in, or combination of, but not limited to, rubber, silicone, polyurethanes, elastomers, etc., which possess such protective properties may be employed in the construction of such a protective membrane layer 10.

Materials to be used to construct the outer sole 5, traction member 6, compressible cleaning structure 7, protective membrane layer 10, and all surfaces for that matter intended to contact the playing field surface, would best serve to be highly resistant to the attraction of those elements, e.g., snow, rain, ice, mud, grass, water, gravel, sand, etc., commonly found on a majority of playing field surface venues along with their accompanying climate conditions, thus minimizing the adhesion of such elements. The protective membrane layer 10, being free and clean/clear of such materials, would enable maximum traction member 6 length exposure upon contact of the shoe with the playing field surface. By design objectives, exposure of the maximum fraction member 6 length enables its maximum potential for penetrating as well as its maximum ability to fraction the playing field surface, as when the distance between the most distal plantar surface of the fraction member 6 and the most distal plantar surface of the protective membrane layer 10 is greatest. Such is attained when the protective membrane layer 10 is free and clean/clear at the instant the shoe contacts the playing field surface and the compressible cleaning structure 7 is then fully compressed when the shoe is in the weight bearing mode.

Figure 133:
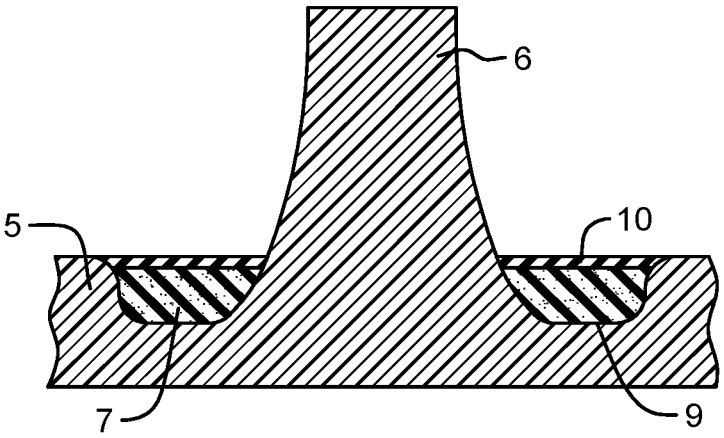
FIG. 133 shows a left to right frontal view taken along an arbitrary mid line cross-section of a compressible cleaning structure design with a protective membrane layer surrounding the respective traction member, with all fully compressed and able to be accommodated for so to fully flatten in the accommodatingly shaped concave reservoir in the shoe bottom/outer sole, and be level with the shoe bottom/outer sole plantar surface during the weight bearing mode.

It should be noted, as shown in FIG. 133 from a left to right frontal view taken along an arbitrary mid line cross-section, that the girth of a protective membrane layer 10, being additional to that of the compressible cleaning structure 7, would be taken into account in those shoe designs which incorporate a concave reservoir 9, with such a concave reservoir 9 providing adequate volume to allot for that additional girth of the protective membrane layer 10 along with that of the respective compressible cleaning structure 7, allowing all of which to compress and fully flatten within the accommodatingly shaped concave reservoir 9, if and when so chosen by design, so to be level with the shoe bottom/outer sole 5 plantar surface during the weight bearing mode, thereby maintaining a relatively flat shoe bottom/outer sole 5, with such a provision as has already been presented in this inventions earlier discussions regarding the concave reservoir 9 and all of its described advantages remaining the same and applicable when such a protective membrane layer 10 is incorporated as well, as in this such instance.

It is within the concept of this patent's rendering to combine both the compressible cleaning structure 7 and the protective membrane layer 10 into one and the same entity. This one such entity would satisfy all the requirements, and possess all the physical abilities of both the compressible cleaning structure 7 and the protective membrane layer 10, itself performing all of their combined functions. In addition, it is the intellectual right of the present invention to combine any and all of its described structures and components, being of the preferred embodiment and/or otherwise, by any means and/or fashion in order to create an embodiment of optimal design and performance ability. It should be clearly understood that these structures and components of the present invention, regardless of being referred to by their respective nomenclature, are all in fact designed and located accordingly as to best perform their respective functional abilities. Therefore, it should be clear that regardless of their assigned nomenclature, each of these structures and components respective designs and functions may be particular to this invention and remain so, and that their accompanying functions cannot be claimed in the embodiments of other inventions by other individuals simply by their assigning of different nomenclature to the same and/or similar items.

As expressed earlier in the text of the present invention, it is fully intended that its conceptual designs and abilities be ably transposed to any and all traction member 6 types, including those which are molded unibody extensions of the shoe bottom/outer sole 5 material itself, as well as those metal and/or non-metal cleat and/or spike type traction members 6 permanently and/or temporarily fixated to the shoe bottom/outer sole 5 from which they protrude/extend. In addition, as to be presented and discussed later in this text, the present invention also offers its conceived self-cleaning ability for application in the designs of any and all shoes and their tread types beyond just the sport shoe type.

The following descriptions and illustrations are of compressible cleaning structure 7 designs of the permanent and/or removable/temporarily fixated type to be fitted in their accommodatingly shaped concave reservoir 9 of the shoe bottom/outer sole 5 by any of their respective means, with those traction members 6 they surround being of the permanent and/or removable/temporarily fixated cleat and/or spike type, with any and all accommodations/alterations in regard to any and all such combinations of structures conceived and/or made in regard to their respective size and shape so to allow all such structures and combinations thereof to best carryout their intended functions and abilities, if and when such are substituted for/transposed upon any of these combinations, regardless if any such combinations are not described and/or illustrated in the examples provided.

Figure 134:
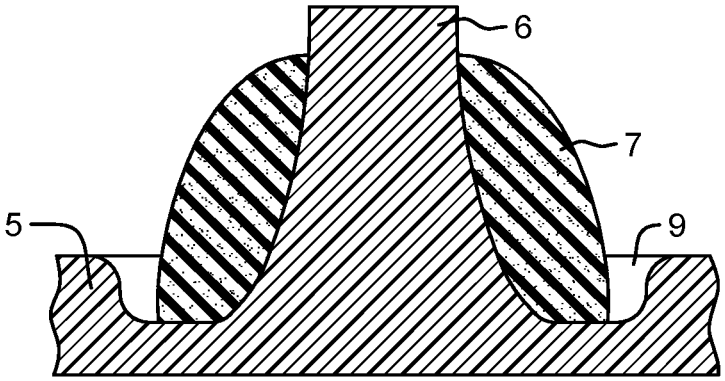
FIGS. 134 and 135 show a left to right frontal view taken along an arbitrary mid line cross-section, non-compressed in the non-weight bearing mode and compressed in the weight bearing mode, respectively, of an integrally attached compressible cleaning structure within its accommodatingly shaped concave reservoir in the shoe bottom/outer sole, surrounding of a permanently/integrally attached cleat type traction member.
Figure 135:
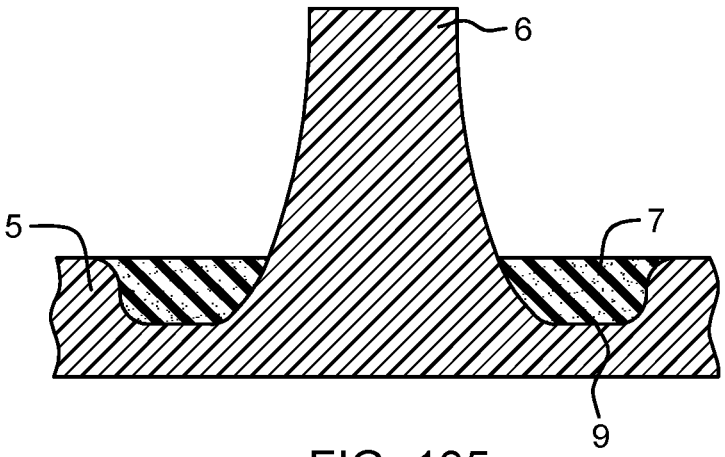
Figure 136:
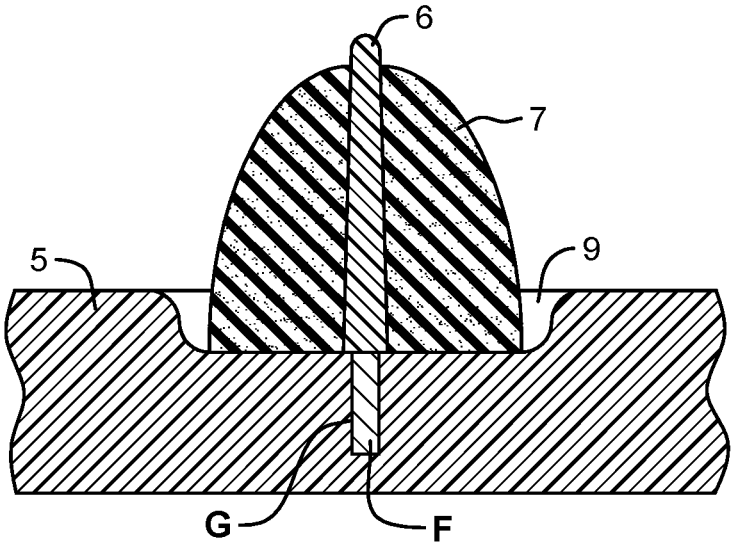
FIGS. 136 and 137 show a left to right frontal view taken along an arbitrary mid line cross-section, non-compressed in the non-weight bearing mode and compressed in the weight bearing mode, respectively, of a compressible cleaning structure permanently fixated via adhesive within its accommodatingly shaped concave reservoir in the shoe bottom/outer sole, surrounding of a removable/temporarily fixated spike type traction member.
Figure 137:
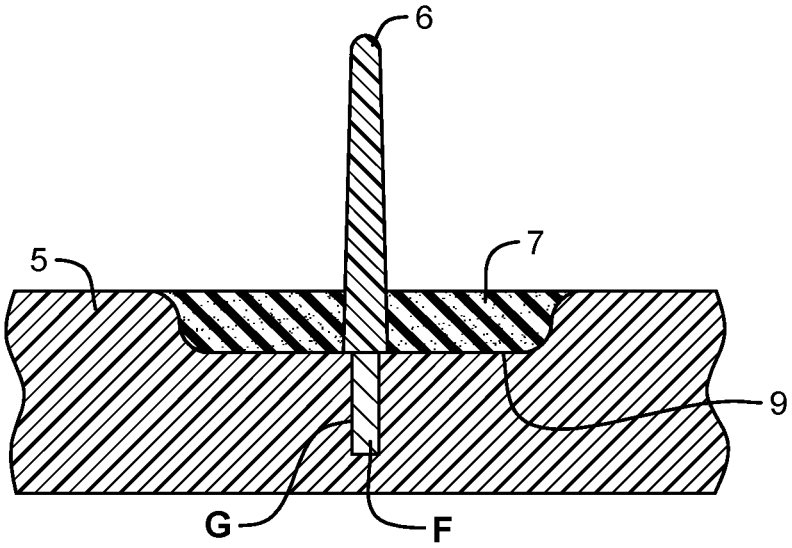

An integrally attached compressible cleaning structure 7 design is shown in FIGS. 134 and 135 from a left to right frontal view taken along arbitrary mid line cross-section, non-compressed in the non-weight bearing mode and compressed in the weight bearing mode, respectively, within its accommodatingly shaped concave reservoir 9 in the shoe bottom/outer sole 5, with a permanently fixated/integrally incorporated cleat type traction member 6, and FIGS. 136 and 137 show a left to right frontal view taken along an arbitrary mid line cross-section, non-compressed in the non-weight bearing mode and compressed in the weight bearing mode, respectively, of a compressible cleaning structure 7 design permanently fixated via adhesive within its accommodatingly shaped concave reservoir 9 in the shoe bottom/outer sole 5, with a removable/temporarily fixated spike type traction member 6.

Figure 138:
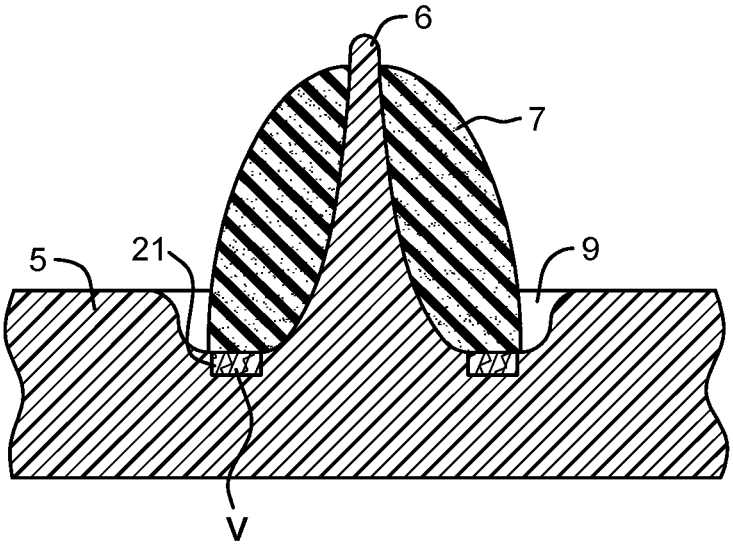
FIGS. 138 and 139 show a left to right frontal view taken along an arbitrary mid line cross-section, non-compressed in the non-weight bearing mode and compressed in the weight bearing mode, respectively, of a removable/temporarily fixated compressible cleaning structure design fixated via VELCRO® within its accommodatingly shaped concave reservoir in the shoe bottom/outer sole, surrounding of a permanently fixated spike type traction member, with the incorporation of a receptive channel in the plantar surface of the concave reservoir, which serves as an accommodating space for, and mirrors the protruding convex shape of the VELCRO®, for it to occupy.
Figure 139:
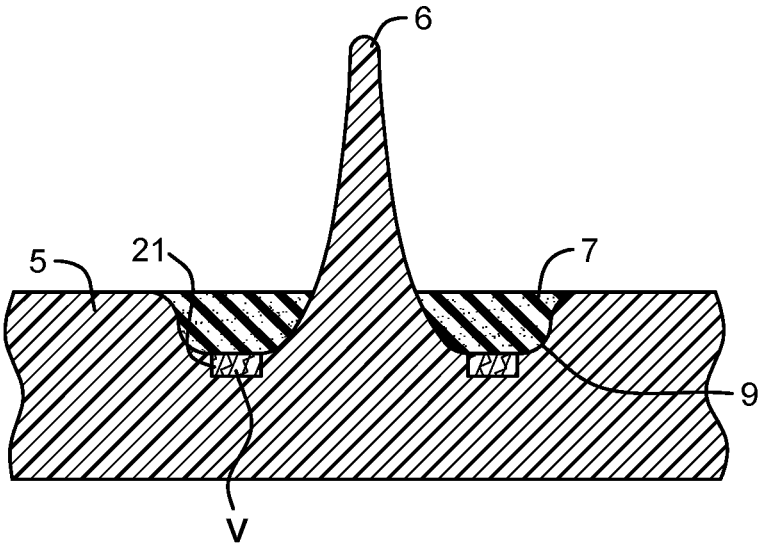
Figure 140:
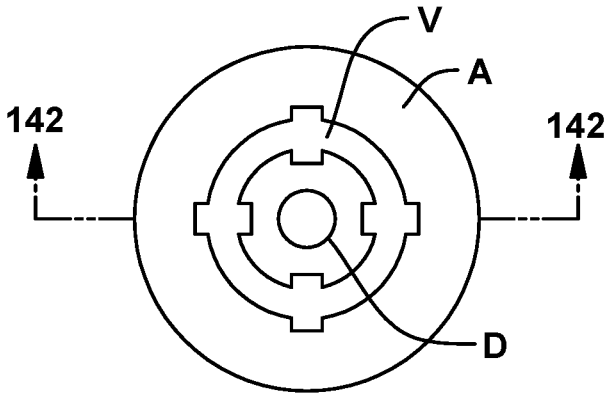
FIGS. 140, 141, and 142, show a top plan, side, and left to right frontal view in cross-section of FIG. 140 taken along the viewer's view line "142-142" of FIG. 140, respectively, of the compressible cleaning structure design shown in FIGS. 138 and 139, altered/modified so to now incorporate a mounting plate component in this respective design, unattached to the shoe bottom/outer sole, and still applicable to/surrounding of a permanently/integrally attached spike type traction member.
Figure 141:
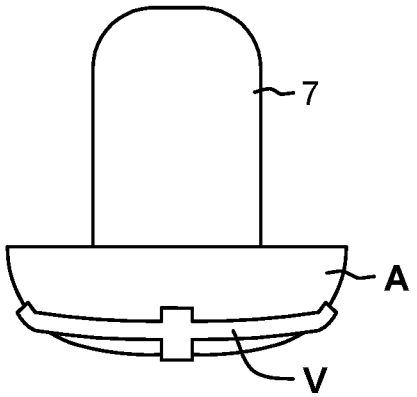
Figure 142:
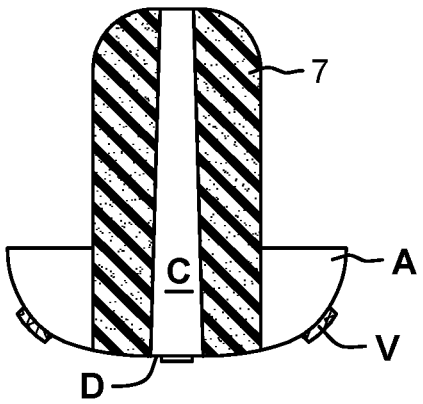
Figure 143:
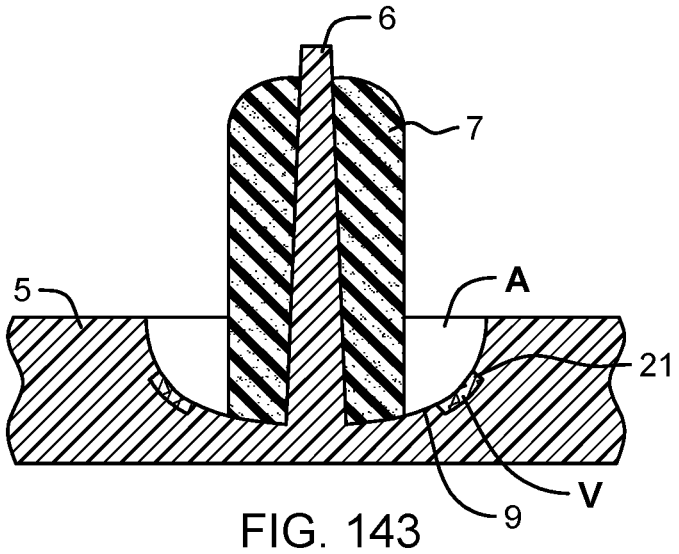
FIG. 143 shows the same view of that compressible cleaning structure design shown in FIG. 142, now fitted in the accommodatingly shaped concave reservoir and surrounding of a permanently/integrally attached spike type traction member, fixated to the shoe bottom/outer sole via VELCRO® fitted in the receptive channels in the concave reservoir plantar surface, in the non-weight bearing mode, with the compressible cleaning structure 7 non-compressed.
Figure 144:
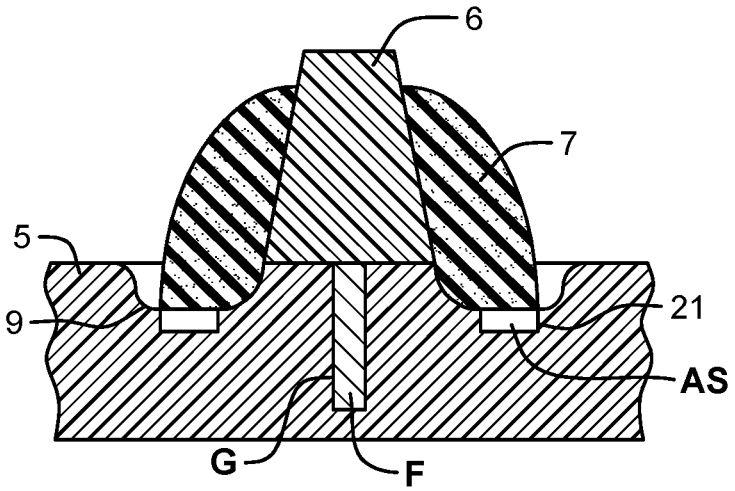
FIGS. 144 and 145 show a left to right frontal view taken along an arbitrary mid line cross-section, non-compressed in the non-weight bearing mode and compressed in the weight bearing mode, respectively, of a removable/temporarily fixated compressible cleaning structure design fitted in the accommodatingly shaped concave reservoir and fixated to the shoe bottom/outer sole via adhesive strips fitted in the receptive channels in the concave reservoir plantar surface, surrounding of a removable/temporarily fixated cleat type traction member, which is fixated to the shoe bottom/outer sole via the tightening of its threaded longitudinal stud in the complementary threaded boss.
Figure 145:
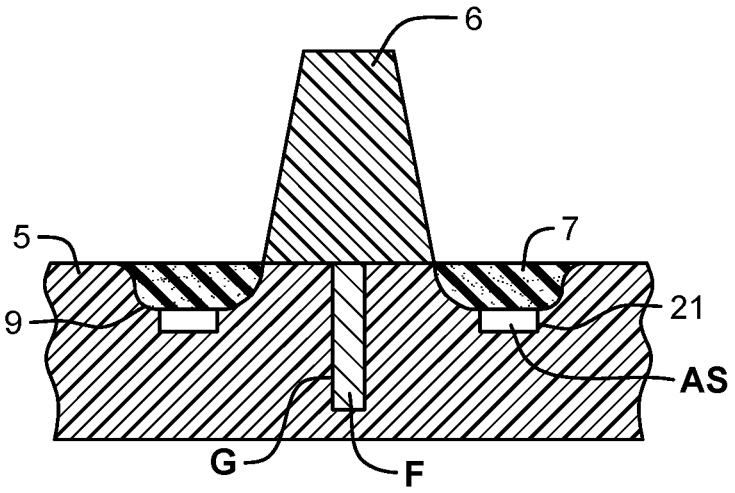
Figure 146:
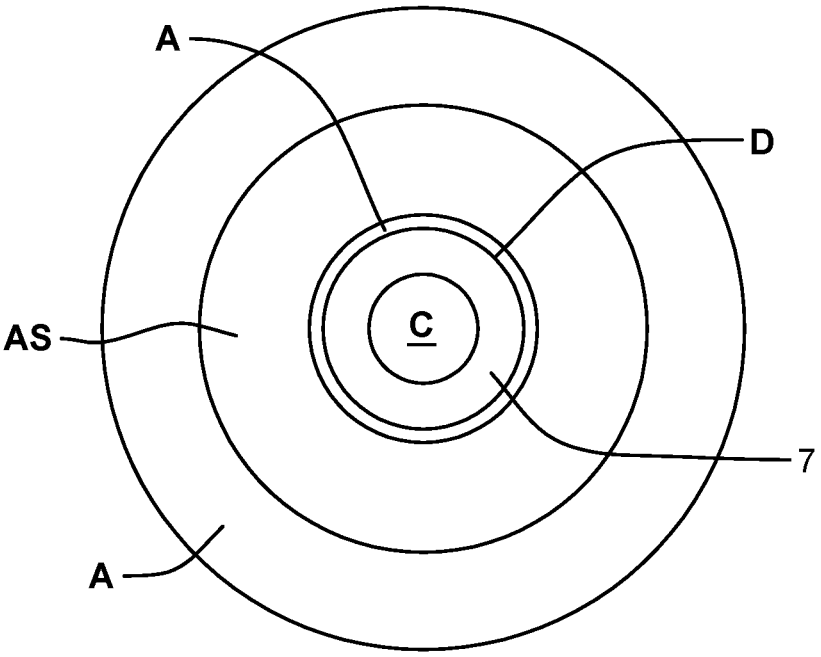
FIGS. 146, 147, and 148, show a top plan, side, and left to right frontal view taken along an arbitrary mid line cross-section, respectively, of the compressible cleaning structure design shown in FIGS. 144 and 145, altered/modified so to now incorporate a mounting plate component in this respective design, unattached to the shoe bottom/outer sole, and still applicable to/surrounding of a removable/temporarily fixated cleat type traction member.
Figure 147:
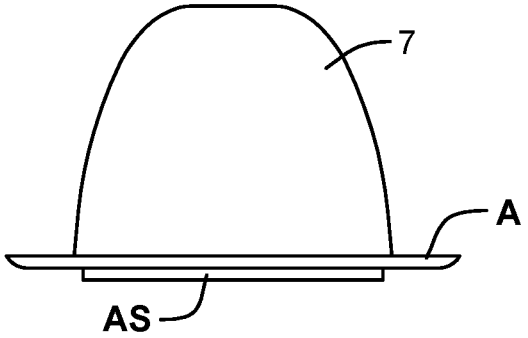
Figure 148:
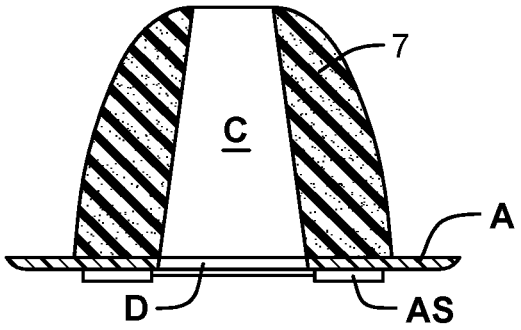
Figure 149:
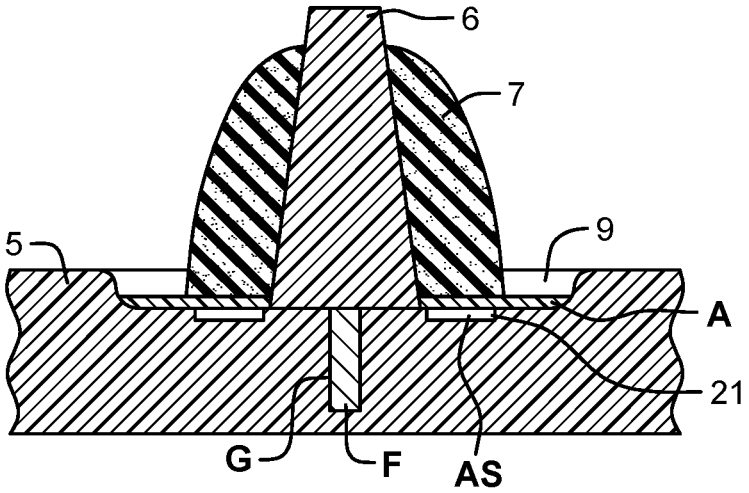
FIG. 149 shows the same view of the same compressible cleaning structure design shown in FIG. 148, now fitted in an accommodatingly shaped concave reservoir and fixated to the shoe bottom/outer sole via adhesive strips fitted in the receptive channels in the concave reservoir plantar surface, non-compressed in the non-weight bearing mode, and surrounding of a removable/temporarily fixated cleat type traction member, which is fixated to the shoe bottom/outer sole via the tightening of its threaded longitudinal stud in the complementary threaded boss.

A removable/temporarily fixated compressible cleaning structure 7 design shown in FIGS. 138 and 139 from a left to right frontal view taken along an arbitrary mid line cross-section, non-compressed in the non-weight bearing mode and compressed in the weight bearing mode, respectively, is fixated via VELCRO® (V) within its accommodatingly shaped concave reservoir 9 in the shoe bottom/outer sole 5, and surrounding of a permanently fixated/integrally attached spike type traction member 6, with the incorporation of a receptive channel 21 in the plantar surface of the concave reservoir 9, to serve as an accommodating space which mirrors the convex shape of the protruded VELCRO® (V), for the VELCRO® to occupy, so to allow for a close and secure fit between both these adjacent surfaces when fixated. The compressible cleaning structure 6 design shown in FIGS. 138 and 139 may be altered/modified to be incorporated with a mounting plate component (A), as shown in FIG. 140 from a top plan view, FIG. 141 from a side view, and FIG. 142 from a left to right frontal view in cross-section of FIG. 140 taken along the viewer's view line "142-142" of FIG. 140, with this removable/temporarily fixated compressible cleaning structure 7 design, shown unattached to the shoe bottom/outer sole 5, applicable to/surrounding of a permanently/integrally attached spike type traction member 6. This removable/temporarily fixated compressible cleaning structure 7 design as a whole, shown in FIG. 143 from the same view as FIG. 142, non-compressed in the non-weight bearing mode, is now attached to/fixated in the accommodatingly shaped concave reservoir 9 in the shoe bottom/outer sole 5 and surrounding of a permanently fixated/integrally attached spike type traction member 6, with the incorporated mounting plate component (A) constructed with a concave plantar surface that is adjacent to the dorsal surface of the compressible material of the compressible cleaning structure 7 to which it will permanently attach, by any suitable means, and the opposite convex dorsal surface of the mounting plate component (A) constructed of a complementary shape to the concavity of the accommodatingly shaped concave reservoir 9, and when incorporated, as in this particular design, those receptive channels 21 in the concave reservoir 9 plantar surface are accommodatingly shaped to fit that chosen means of fixation of these two adjacent surfaces, be it VELCRO® (V) as illustrated, and/or adhesive strip (AS), etc., such that the convex dorsal surface of the mounting plate component (A) and the compressible cleaning structure 7 design as a whole, are fixated in a close and secure manner in the accommodatingly shaped concave reservoir 9 in shoe bottom/outer sole 5. A removable/temporarily fixated compressible cleaning structure 7 design is shown in FIGS. 144 and 145 from a left to right frontal view taken along an arbitrary mid line cross-section, non-compressed in the non-weight bearing mode and compressed in the weight bearing mode, respectively, fixated via an adhesive strip (AS) within its accommodatingly shaped concave reservoir 9 in the shoe bottom/outer sole 5, with receptive channels 21 constructed in the concave reservoir 9 plantar surface so to accommodate for and allow the convex protrusion of the adhesive strip (AS) to occupy for a close and secure fit between both these fixated adjacent surfaces, with the compressible cleaning structure design 7 as a whole surrounding of a removable/temporarily fixated cleat type traction member 6 fixated in the shoe bottom/outer sole 5 via the tightening of its threaded longitudinal stud (F) in the complementary threaded boss (G). The compressible cleaning structure 7 design in FIGS. 144 and 145 may be altered/modified to be incorporated with a mounting plate component (A), as shown in FIG. 146 from a top plan view, FIG. 147 from a side view, and FIG. 148 from a left to right frontal view taken along an arbitrary mid line cross-section, with this removable/temporarily fixated compressible cleaning structure 7 design, shown unattached to the shoe bottom/outer sole 5, applicable to/surrounding of a removable/temporarily fixated cleat type traction member 7. This removable/temporarily fixated compressible cleaning structure 7 design as a whole, is shown in FIG. 149 from the same view as FIG. 148, now attached to/fixated in the accommodatingly shaped concave reservoir 9 in the shoe bottom/outer sole 5, non-compressed in the non-weight bearing mode, and surrounding of a removable/temporarily fixated cleat type traction member 6, with the incorporated mounting plate component (A) constructed with a plantar surface that is adjacent to the dorsal surface of the compressible material of the compressible cleaning structure 7 to which it will permanently attach, by any suitable means, and the opposite dorsal surface of the mounting plate component (A) constructed of a convex complementary shape to the concavity of the accommodatingly shaped concave reservoir 9, and when incorporated, as in this particular design, those receptive channels 21 in the concave reservoir 9 plantar surface are accommodatingly shaped to fit that chosen means of fixation of these two adjacent surfaces, be it adhesive strips (AS) as illustrated, and/or VELCRO® (V), etc., such that the dorsal surface of the mounting plate component 5 and the compressible cleaning structure 7 design as a whole is fixated in a close and secure manner in the accommodatingly shaped concave reservoir 9 in the shoe bottom/outer sole 5.

Figure 150:
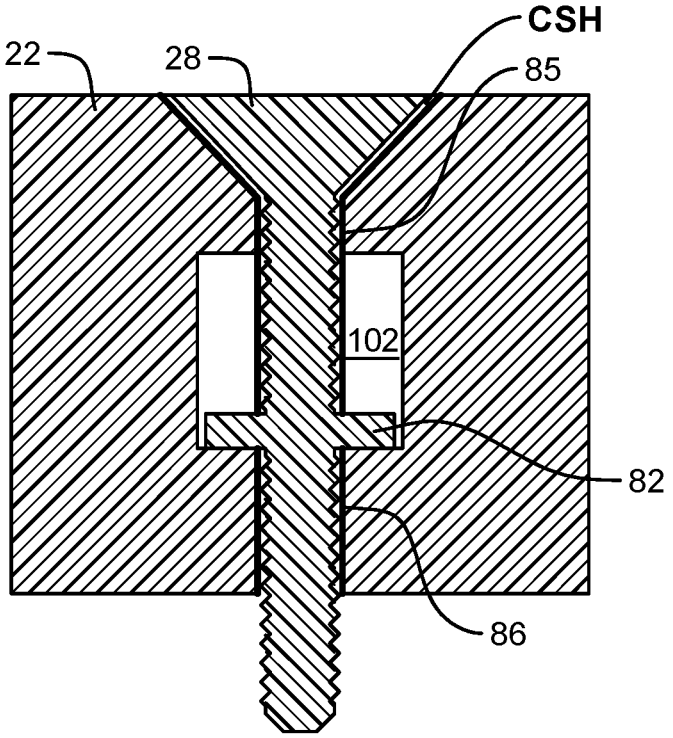
FIGS. 150 and 151 show a left to right frontal view taken along an arbitrary mid line cross-section of the stayed screw component of the screw-notch lock mechanism incorporated as the means by which several removable/temporarily fixated compressible cleaning structure designs of the present invention are fixated in their respective accommodatingly shaped concave reservoir in the shoe bottom/outer sole, with the stayed screw in FIG. 150 occupying the countersunk through hole and its integrally incorporated disk shaped stay located in the inner cylindrical chamber in the outer collar, showing the stayed screw fully tightened in the countersunk through hole, and the stayed screw in FIG. 151 still maintained in the countersunk through hole by the disk shaped stay even when fully loosened.
Figure 151:
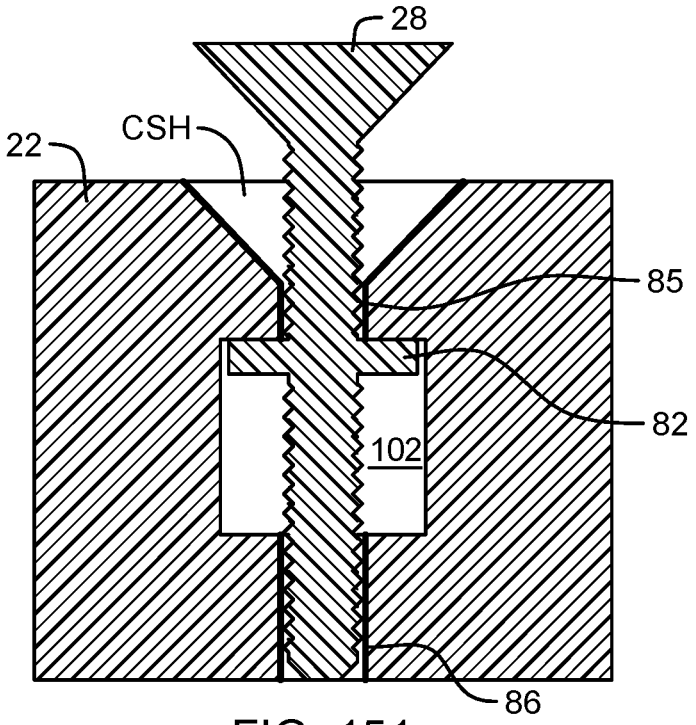

A removable/temporarily fixated compressible cleaning structure 7 design may be fixated by a screw-notch lock mechanism, as shown in FIGS. 150 to 175, within its accommodatingly shaped concave reservoir 9 in the shoe bottom/outer sole 5. The screw-notch lock mechanism means of fixation may be accomplished in an embodiment which coincidingly coordinates the orientation of an outer collar 22, and an inner collar 23, both of which may be constructed of polyurethane, plastic, elastomers, TEFLON®, KEVLAR®, or any other suitable material, with the outer collar 22 attached/secured to the periphery of the compressible cleaning structure 7, by any suitable means, at that level at which the outer collar 22 plantar surface is of an equal level to the plantar surface of the shoe bottom/outer sole 5, and the inner collar 23 attached to/secured to the proximal opening of the traction body hole (C) of the compressible cleaning structure 7, by any suitable means, so the compressible cleaning structure 7, as a whole, may be appropriately fitted within and occupy the accommodatingly shaped concave reservoir 9, as it should when it is secured and locked via the screw-notch lock mechanism to be described. The outer collar 22 is constructed with a plurality of male shaped headed clips 25 which extend proximally from its dorsal surface which are to be aligned and fitted respectively into a plurality of complementary shaped female notches 26 in the plantar surface of a shoulder 27 surrounding the outer periphery of the concave reservoir 9, with that shoulder 27 being the abutting surface the dorsal surface of the outer collar 22 is to be fixated to. A stayed screw 28, which may be constructed of non-metal, metal, and/or any suitable material, with a head of a flat and complementary shape to that opening of a countersunk through hole (CSH) located in the plantar surface of the outer collar 22 it will occupy, so to sit flat when fully tightened, is maintained in and unable to be removed from that countersunk through hole (CSH) in the outer collar 22, even when fully loosened, by design, due to a disk shaped stay 82 integrally incorporated on the stayed screw 28. Such a stayed screw 28 will be fabricated by any suitable means, and during the manufacturing process will be enclosed in the countersunk through hole (CSH) of the outer collar 22 and maintained in a physical orientation whereby the complementary threads of both the stayed screw 28 and countersunk through hole (CSH) will be fitted to each other so to allow the turning of the stayed screw 28 in that countersunk through hole (CSH) as when tightening and/or loosening the stayed screw 28 so it may best carryout its function to secure and lock the compressible cleaning structure 7 as a whole in the accommodatingly shaped concave reservoir 9 in the shoe bottom/outer sole 5, and still be maintained in, and unremovable from, the countersunk through hole (CSH) even when the compressible cleaning structure 7 design as a whole is removed from the shoe bottom/outer sole 5. The stayed screw 28, in occupying the countersunk through hole (CSH), is axially oriented and located through the center of the flat side of a disk shaped stay 82, with that disk shaped stay 82 an integral fixed part of and circumferentially located on the thread of the stayed screw 28, which by design functions to be maintained in an inner cylindrical chamber 102 of the countersunk through hole (CSH), thereby making the stayed screw 28 itself unremovable from the countersunk through hole (CSH). The inner cylindrical chamber 102, of a cylinder shape, is oriented with its round ends being at the most proximal and distal extremes of the inner cylindrical chamber 102, located between a distal threaded portion 85 and a proximal threaded portion 86 of the axially oriented countersunk through hole (CSH). The distal threaded portion 85 of the countersunk through hole (CSH) is that area just proximal to the complementary space to be occupied by the head of the stayed screw 28, when fully tightened, and continues proximally to that point at which it ends and opens in the center of the round end at the most distal extreme of the inner cylindrical chamber 102. The proximal threaded portion 86 of the countersunk through hole (CSH) begins at the most extreme point proximally of the countersunk through hole (CSH), which is that opening in the dorsal surface of the outer collar 22, and continues distally to that point at which it ends and opens in the center of the round end at the most proximal extreme of the inner cylindrical chamber 102. The thread lining the distal threaded portion 85 and proximal threaded portion 86 of the countersunk through hole (CSH) comprises that threaded element of the countersunk through hole (CSH) which is complementary to that thread of the stayed screw 28 and in which the stayed screw 28 will be fitted and located in, so to be tightened and/or loosened, and when the compressible cleaning structure 7 as a whole is to be fixated in the accommodatingly shaped concave reservoir 9, the stayed screw 28 then will be simultaneously tightened and/or loosened in a complementary threaded receptacle 29, located in the shoulder 27 plantar surface of the concave reservoir 9, in order for the stayed screw 28 to perform its desired function and fixate the compressible cleaning structure 7 as a whole to the shoe bottom/outer sole 5. As shown in FIG. 150, from a left to right frontal view taken along an arbitrary mid line cross-section of the stayed screw 28 fully tightened as it occupies the countersunk through hole (CSH) in the outer collar 22, the disk shaped stay 82 is of a diameter larger than both those equal in diameter openings where the proximal threaded portion 86 and distal threaded portion 85 of the countersunk through hole (CSH) end and open, respectively, into the center of the round ends at the most proximal and most distal extremes of the inner cylindrical chamber 102, thereby inhibiting the disk shaped stay 82 from moving, at any time, beyond those most proximal and distal extremes of the inner cylindrical chamber 102, and as shown in FIG. 150, inhibiting movement beyond that most proximal extreme. The disk shaped stay 82 is of a flat round shape and just slightly narrower in diameter than the inner cylindrical chamber 102 it occupies in order to provide ample room for the disk shaped stay 82, along with the stayed screw 28 to which it is integrally fixed, to move as a unit freely or until impaired, as by design, both proximally as in tightening of, and distally as in loosening of, the stayed screw 28. The degree of proximal movement of the stayed screw 28 is intentionally limited in design by the contact of the flat dorsal surface of the disk shaped stay 82 with the abutting proximal plantar surface of the round end of the most proximal extreme of the inner cylindrical chamber 102 of the countersunk through hole (CSH), which coincides with the tightening of the stayed screw 28 so its head may be fully flat in that opening in and level with the plantar surface of the outer collar 22, with the stayed screw 28 engaged and fully tightened in the complementary threaded receptacle 29 located in the shoulder 27 of the accommodatingly shaped concave reservoir 9 (not shown herein, but shown in FIGS. 171 and 173) in the shoe bottom/outer sole 5 (not shown herein, but shown in FIGS. 171 and 173). Conversely, as shown in FIG. 151 from a left to right frontal view taken along an arbitrary mid line cross-section of the stayed screw 28 as it remains, as explained, in the countersunk through hole (CSH), the degree of distal movement of the stayed screw 28 is intentionally limited by design by the contact of the flat plantar surface of the disk shaped stay 82 with the abutting distal dorsal surface of the round end at the most distal extreme of the inner cylindrical chamber 102 of the countersunk through hole (CSH), which coincides with the loosening of the stayed screw 28 to the extent of it being free and clear of the complementary threaded receptacle 29 in the shoulder 27 of the concave reservoir 9 in the shoe bottom/outer sole 5, and the head of the stayed screw 28 being beyond and distal to the horizontal level of the opening of the countersunk through hole (CSH) in the outer collar 22 plantar surface, with the stayed screw 28 being fully loosened, yet by design remaining in the countersunk through hole (CSH) due to the described function of the disk shaped stay 82, at which moment the compressible cleaning structure 7 as a whole may be turned, so to disengage all related structures, and fully removed from the concave reservoir 9 in the shoe bottom/outer sole 5. It should be understood by those who familiarize themselves with the text of the present invention in its entirety that FIG. 150 and FIG. 151 are illustrative and exemplary of all compressible cleaning structure 7 designs of the present invention fixated via a screw-notch lock mechanism incorporating a stayed screw 28 of this type in their respective design, with FIG. 150 representative of all such respective designs when the stayed screw 28, and the compressible cleaning structure 7 design as a whole, are fixated in the most secure and locked position in the accommodatingly shaped concave reservoir 9 in the shoe bottom/outer sole 5, and FIG. 151 representative of all such respective designs when the stayed screw 28 is fully loosened, and the compressible cleaning structure 7 design as a whole may be turned, disengaged, and removed from the accommodatingly shaped concave reservoir 9 in the shoe bottom/outer sole 5.

The means by which the stayed screw 28 is to be aligned with the complementary threaded receptacle 29 located in the plantar surface of the shoulder 27 of the concave reservoir 9 is accomplished with the compressible cleaning structure 7, as a whole, first being fitted in the concave reservoir 9 so the male shaped headed clips 25 engage the circular portion of the complementary shaped female notches 26 in the plantar surface of the shoulder 27 of the concave reservoir 9, and then being turned to a maximum fully stopped position, at which point the male shaped headed clips 25 occupy that end range of the rectangular portion of the complementary shaped female notches 26 which are of a smaller width than the diameter of the male shaped headed clips 25, so to ensure the adjacent surfaces of the plantar surface of the shoulder 27 of the concave reservoir 9 and the dorsal surface of the outer collar 22 are in contact with each other. At this point the stayed screw 28 is aligned and fully tightened in the complementary threaded receptacle 29, with the head of the stayed screw 28 now fully flush with the outer collar 22 plantar surface, and the stayed screw 28 maintaining all those male shaped headed clips 25 in their complementary female notches 26 in a locked position.

The inner collar 23, along with the aforementioned structural components of the outer collar 22, coincidingly provides its own additional structural components to the screw-notch lock mechanism, which when engaged furthers the means of its fixation in its entirety. The inner collar 23, secured to and lining the proximal opening of the traction body hole (C) of the compressible cleaning structure 7, is of a conical form, tapered to be gradually wider as moving from a most distal medial border (J) to a most proximal lateral border (Z), with the diameter of its distal medial border (J) just wide enough so to allow it and the compressible cleaning structure 7, as a whole, to be fitted around the base of the traction member 6 so as to have the wider base of its most proximal lateral border (Z) sit on a medial shoulder 33 in the concave reservoir 9 just as the height of its distal medial border (J) plantar surface is of an equal level to the plantar surface of shoe bottom/outer sole 5, with that inner tapered space occupying the entire height within the inner collar 23, referred to as a dorsal cavity (DC), surrounding a traction cylinder (TC), which is that cylinder shaped extension of the shoe bottom/outer sole 5 located in the center of the concave reservoir 9, with its base surrounded by the medial shoulder 33 of that concave reservoir 9 and extending distally to a height equal to that of the plantar surface of the shoe bottom/outer sole 5, all the while being surrounded by the dorsal cavity (DC) of the inner collar 23, with the traction cylinder (TC) serving to be that upon which the base of the traction member 6 attaches to/originates from. Therefore, the most distal height of inner collar 23 in its entirety is of a distal height equal to and at the same level of the shoe bottom/outer sole 5 plantar surface in order to allow full length exposure of that traction member 7 attached to/originated from the traction cylinder (TC) which the inner collar 23 surrounds, with full length exposure being that length measured from the horizontal height of the shoe bottom/outer sole 5 plantar surface, from which the base of that traction member 6 is considered to begin/originate structurally, to the most distal plantar aspect of that traction member 6, when the compressible cleaning structure 7 is fully compressed within the accommodatingly shaped concave reservoir 9 in the shoe bottom/outer sole 5. The inner collar 23 is constructed with a plurality of vertical appendages (VA), equidistant in orientation and projecting from the tapered distal aspect of its dorsal cavity (DC) surface proximally, with the most proximal aspect of the vertical appendages (VA) resting, along with the inner collar 23 itself, on the medial shoulder 33 of the concave reservoir 9, with a horizontal pin 30 protruding from the same one side of each of these vertical appendages (VA), to be aligned and fitted in a complementary receiving hole 31 of a corresponding horizontal orientation to the horizontal pin 30. The complementary receiving holes 31 are located in and completely through a plurality of vertical legs 32 originating from the medial shoulder 33, which are equal in number and correspondingly positioned to the vertical appendages (VA) as they extend the equal and entire vertical length of the lateral aspect of the traction cylinder (TC). Both the vertical appendages (VA) and vertical legs 32, being of the same triangular shape, will be completely superimposed on one another when the compressible cleaning structure 7 as a whole is fitted in the concave reservoir 9, and the horizontal pins 30 of the vertical appendages (VA) are fully engaged in those complementary receiving holes 31 of the vertical legs 32 when turned to the maximum fully stopped position, all of which is simultaneously occurring with the already explained process in which the outer collar 22 male shaped headed clips 25 are being fully engaged with their complementary shaped female notches 26 in the plantar surface of the shoulder 27 of the concave reservoir 9, and maintained in the most secured and locked position by the fully tightened stayed screw 28. Thus, with all the related complementary structures of the compressible cleaning structure 7 as a whole now aligned, secured, and locked by the stayed screw 28 being tightened in its complementary threaded receptacle 29, as explained, all the respective structures and the compressible cleaning structure 7 as a whole will be maintained in the most secured and locked position.

Figure 152:
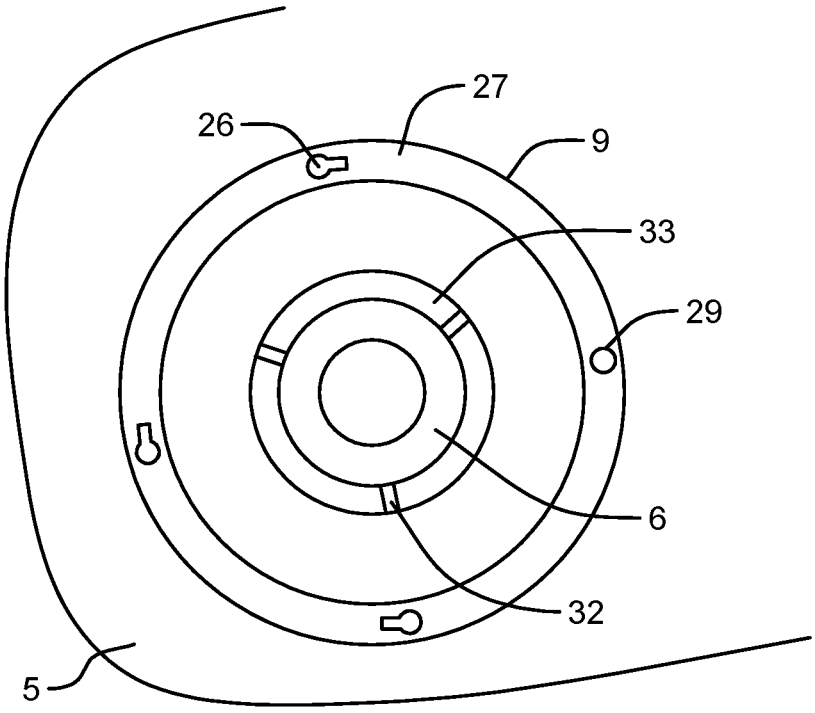
FIG. 152 shows a bottom view of a concave reservoir in the shoe bottom/outer sole with a cleat type traction member, which may be of the removable and/or permanently fixated type, in which a compressible cleaning structure design, shown in FIG. 153 from a top plan view, may be fixated via a screw-notch lock mechanism (such as, for example as shown in FIGS. 150 and 151) incorporating a stayed screw.
Figure 153:
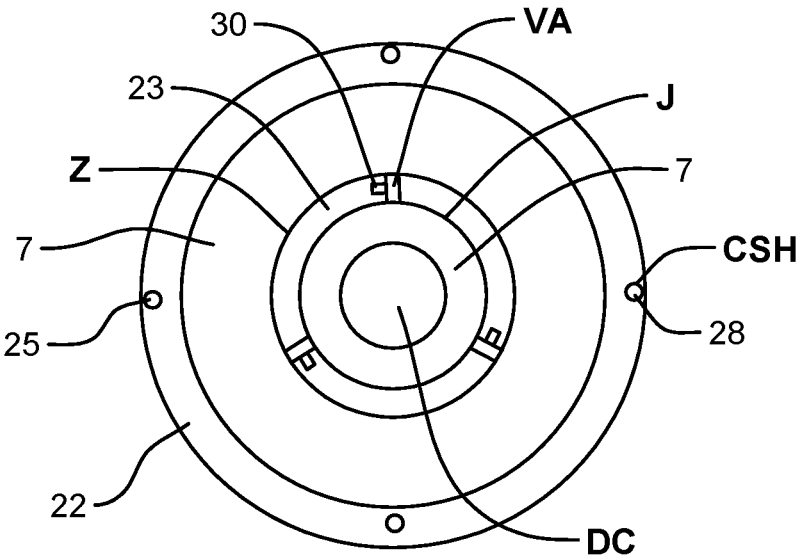

Both the just described accommodatingly shaped concave reservoir 9 in the shoe bottom/outer sole 5, shown in FIG. 152 from a bottom view, and the removable/temporarily fixated compressible cleaning structure 7 design, shown in FIG. 153 from a top plan view, to be fixated in that accommodatingly shaped concave reservoir 9 in the shoe bottom/outer sole 5 via the described screw-notch lock mechanism (such as, for example as shown in FIGS. 150 and 151), may be applicable to a cleat type traction member 6 of the permanently fixated/integrally attached and/or removable/temporarily fixated type, or when altered/modified as required, of a design applicable to a spiked traction member 6 of the permanently fixated/integrally attached and/or removable/temporarily fixated type. The aforementioned structures of this such design shown in FIGS. 152 and 153 are illustrated with a permanently fixated/integrally attached cleat type traction member 6 in FIG. 154 from an exploded perspective view, and in FIG. 155 from a collapsed perspective view with the stayed screw 28 tightened in the complementary threaded receptacle 29, and all the related structures fixated in the most secure and locked position within the accommodatingly shaped concave reservoir 9 via the described screw-notch lock mechanism.

Figure 156:
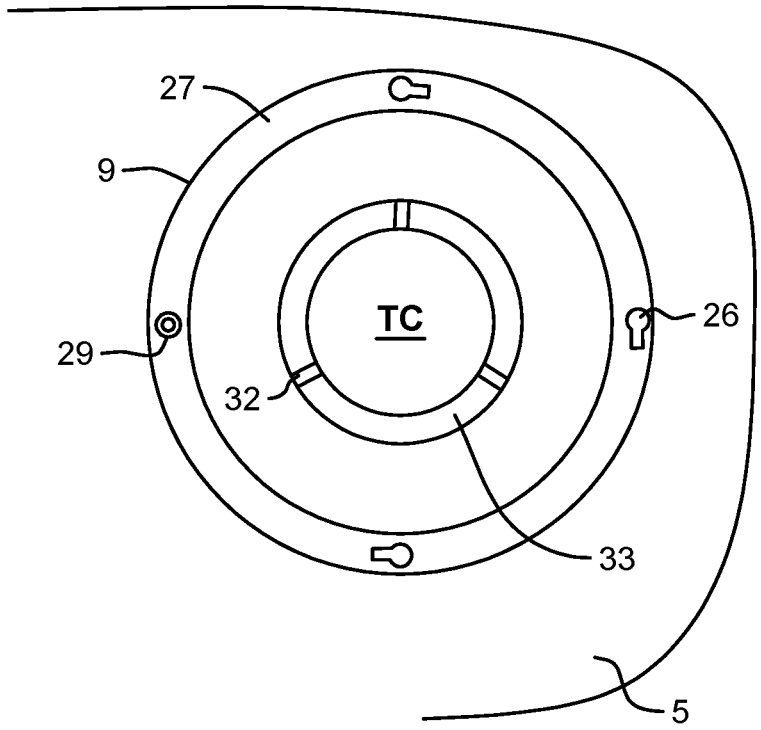
FIG. 156 shows a bottom view of a concave reservoir in the shoe bottom/outer sole in which a compressible cleaning structure design with a permanently/integrally attached cleat type traction member, shown in FIG. 157 from a top plan view, may be fixated via a screw-notch lock mechanism (such as, for example as shown in FIGS. 150 and 151) incorporating a stayed screw.
Figure 157:
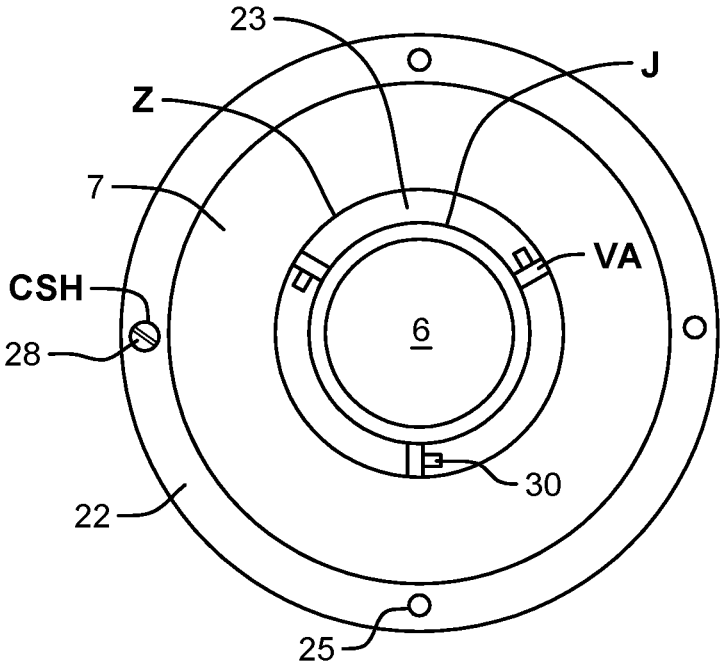

The present invention also conceives of the accommodatingly shaped concave reservoir 9 in the shoe bottom/outer sole 5, shown in FIG. 156 from a bottom view, and the removable/temporarily fixated compressible cleaning structure 7 design, shown in FIG. 157 from a top plan view, to be fixated in that accommodatingly shaped concave reservoir 9 in the shoe bottom/outer sole 5 via the described screw-notch lock mechanism (such as, for example as shown in FIGS. 150 and 151), with the compressible cleaning structure 7 design as a whole constructed with the base of the incorporated traction member 6, be it of the cleat and/or spike type, permanently fixated/integrally attached to the inner collar 23 at that same level of the most distal medial border (J) of the inner collar 23, that being the level at which the base of the respective traction member 6 is considered to begin/originate, which is the same horizontal level as that of the shoe bottom/outer sole 5 plantar surface, with the traction member 6 and inner collar 23 fabricated as one single integral unit cumulatively possessing both of their respective individual components. The aforementioned structures of this such design shown in FIGS. 156 and 157 are illustrated with a permanently fixated cleat type traction member 6 in FIG. 158 from an exploded perspective view, and in FIG. 159 from a collapsed perspective view with the stayed screw 28 tightened in the complementary threaded receptacle 29, and all the related structures fixated in the most secure and locked position within the accommodatingly shaped concave reservoir 9 via the described screw-notch lock mechanism.

Figure 154:
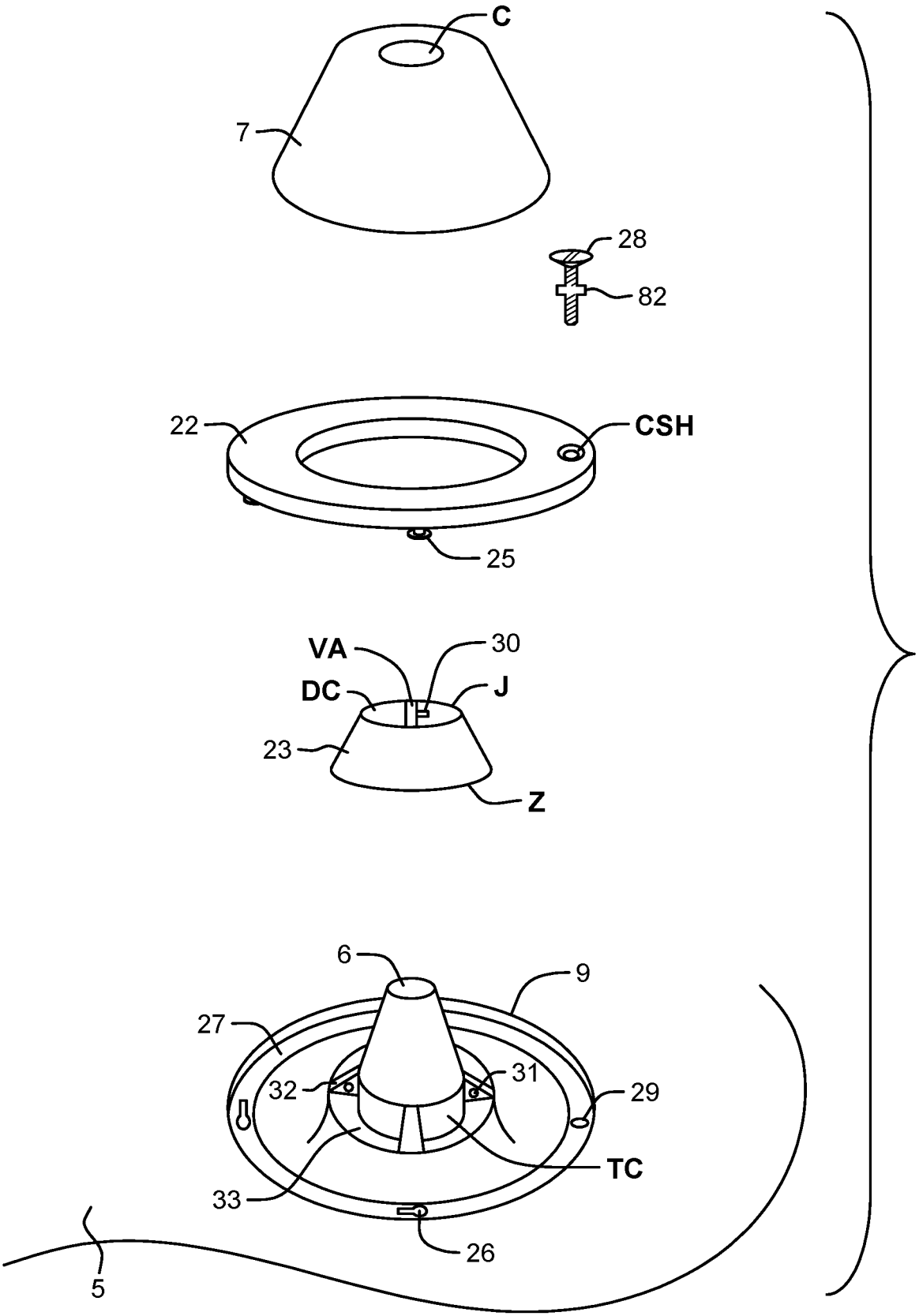
FIG. 154 shows an exploded perspective view of that concave reservoir with the respective traction member shown in FIG. 152 and that compressible cleaning structure shown in FIG. 153, to be fixated to one another via a screw-notch lock mechanism incorporating a stayed screw, as shown in FIG. 155 from a collapsed perspective view, by such being tightened in the complementary threaded receptacle.
Figure 155:
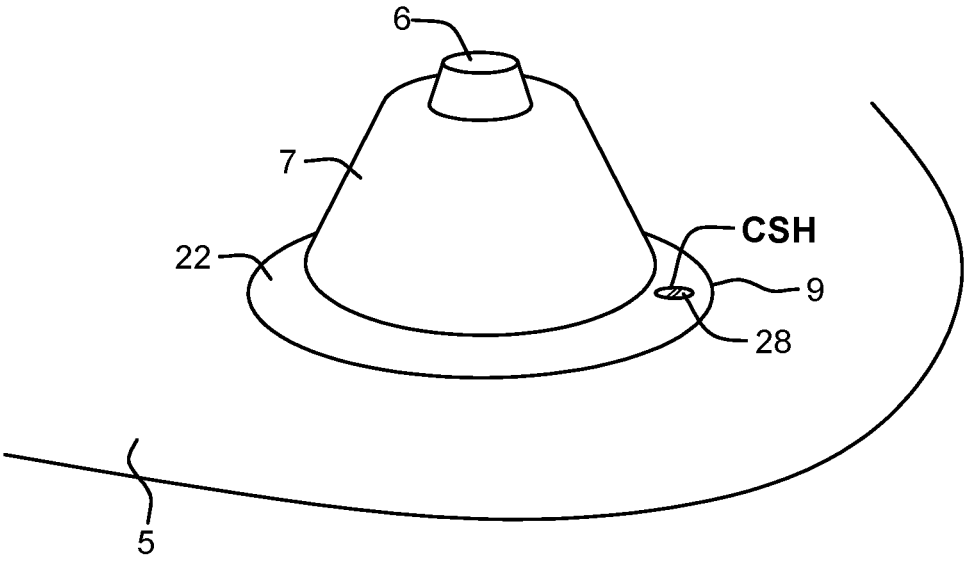
Figure 158:
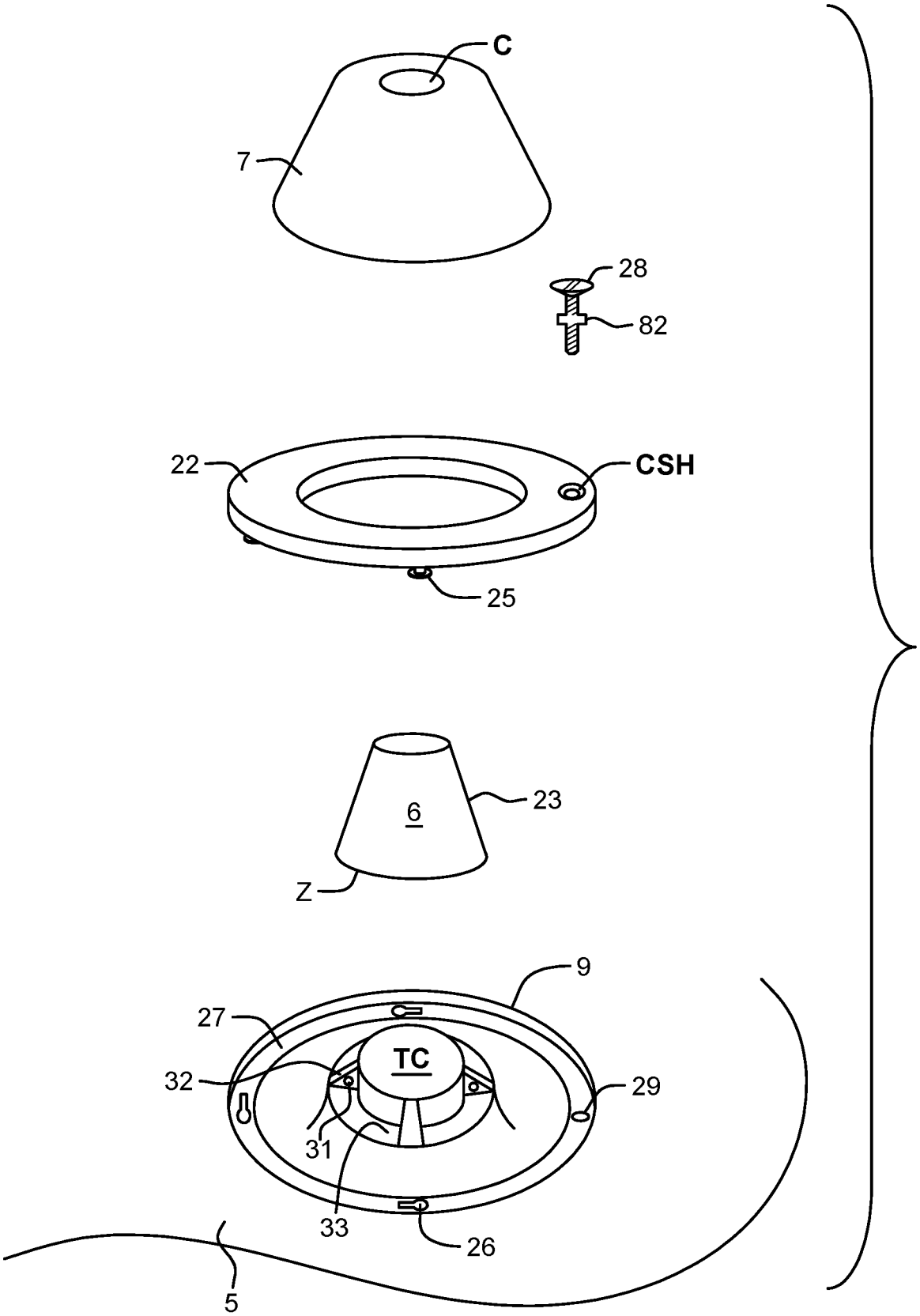
FIG. 158 shows an exploded perspective view of that concave reservoir shown in FIG. 156 and that compressible cleaning structure design with the respective traction member shown in FIG. 157, to be fixated to one another via a screw-notch lock mechanism incorporating a stayed screw, as shown in FIG. 159 from a collapsed perspective view, by such being tightened in the complementary threaded receptacle.
Figure 159:
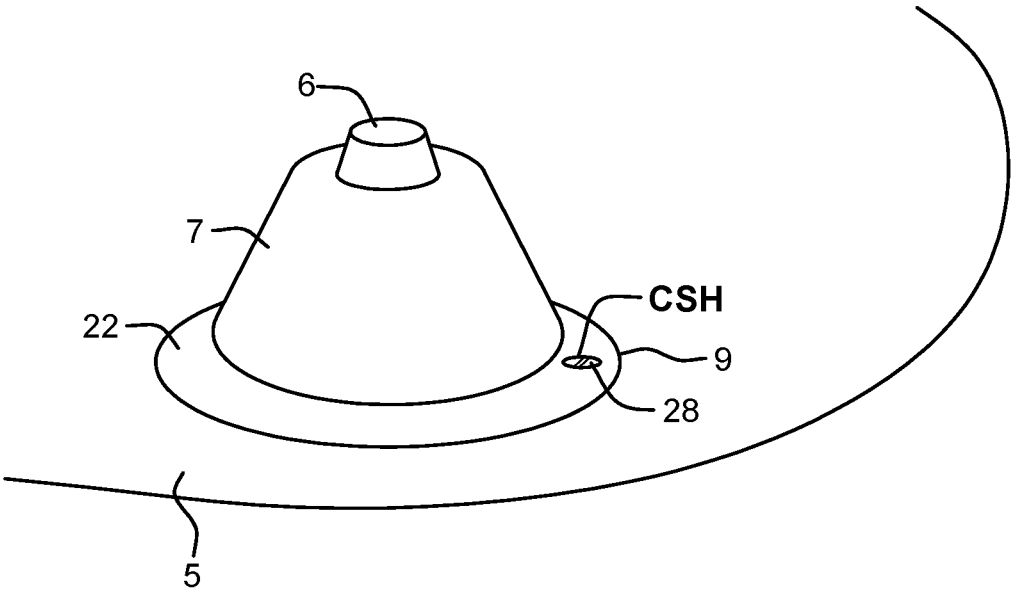

It is also a conception of the present invention that the just described compressible cleaning structure 7 designs illustrated from an exploded perspective view in FIGS. 154 and 158 may be altered/modified, so to be incorporated with a mounting plate component (A) integrally constructed and inclusive of all the structural components of both the outer collar 22 and inner collar 23 in its entirety, possessed by and embodied in, respectively, an outer flange 34, which lies at the outermost periphery of the mounting plate component (A), and an inner flange 35, with its most proximal lateral border (Z) lining the plate hole (D) of that mounting plate component (A), such that the outer flange 34 plantar surface and the inner flange 35 most distal medial border (J) plantar surface are located at that same height equal to that of the shoe bottom/outer sole 5 plantar surface when this compressible cleaning structure 7, secured to the concave surface of this mounting plate component (A) by any suitable means, as a whole is fitted in its accommodatingly shaped concave reservoir (9). Together, the outer flange 34 and the inner flange 35 occupy the same location as and possess the same complementary shaped/complementary components of those previously described in the outer collar 22 and inner collar 23, respectively, that provide the means of fixation for the screw-notch lock mechanism (such as, for example as shown in FIGS. 150 and 151) in this compressible cleaning structure 7 design as a whole, to be fixated within the accommodatingly shaped concave reservoir 9. That previously described removable/temporarily fixated compressible cleaning structure 7 design illustrated in FIG. 153 from a top plan view, is of this altered/modified compressible cleaning structure 9 design, shown in FIG. 160 from a top plan view, by the incorporation of the just described mounting plate component (A), with such fixated via a screw-notch lock mechanism within that same accommodatingly shaped concave reservoir 9 in the shoe bottom/outer sole 5 shown in FIG. 152 from a bottom view, and may be applicable to all those same types of traction members 6 applicable to that design illustrated in FIG. 153.

Figure 160:
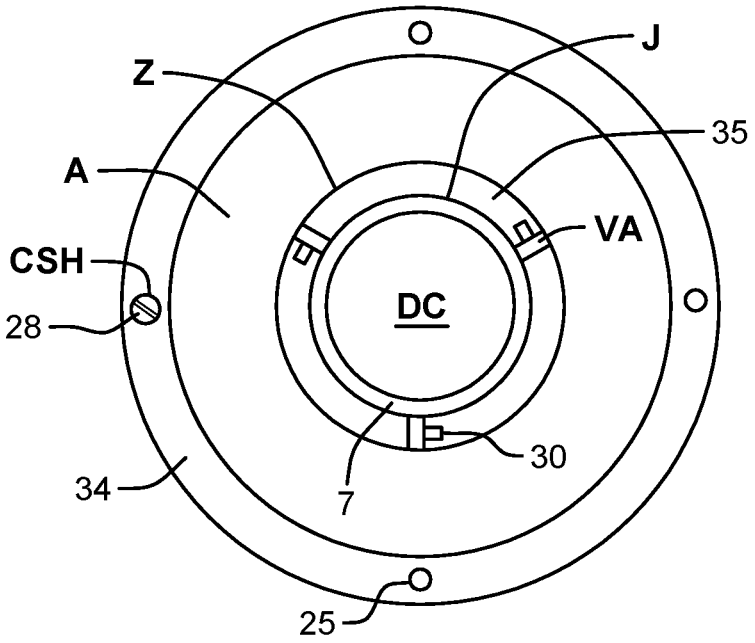
FIG. 160 shows a top plan view of a compressible cleaning structure design as a whole incorporating a mounting plate component in its respective design, which may be fixated via a screw-notch lock mechanism (such as, for example as shown in FIGS. 150 and 151) incorporating a stayed screw in that concave reservoir with the respective traction member shown in FIG. 152.
Figure 161:
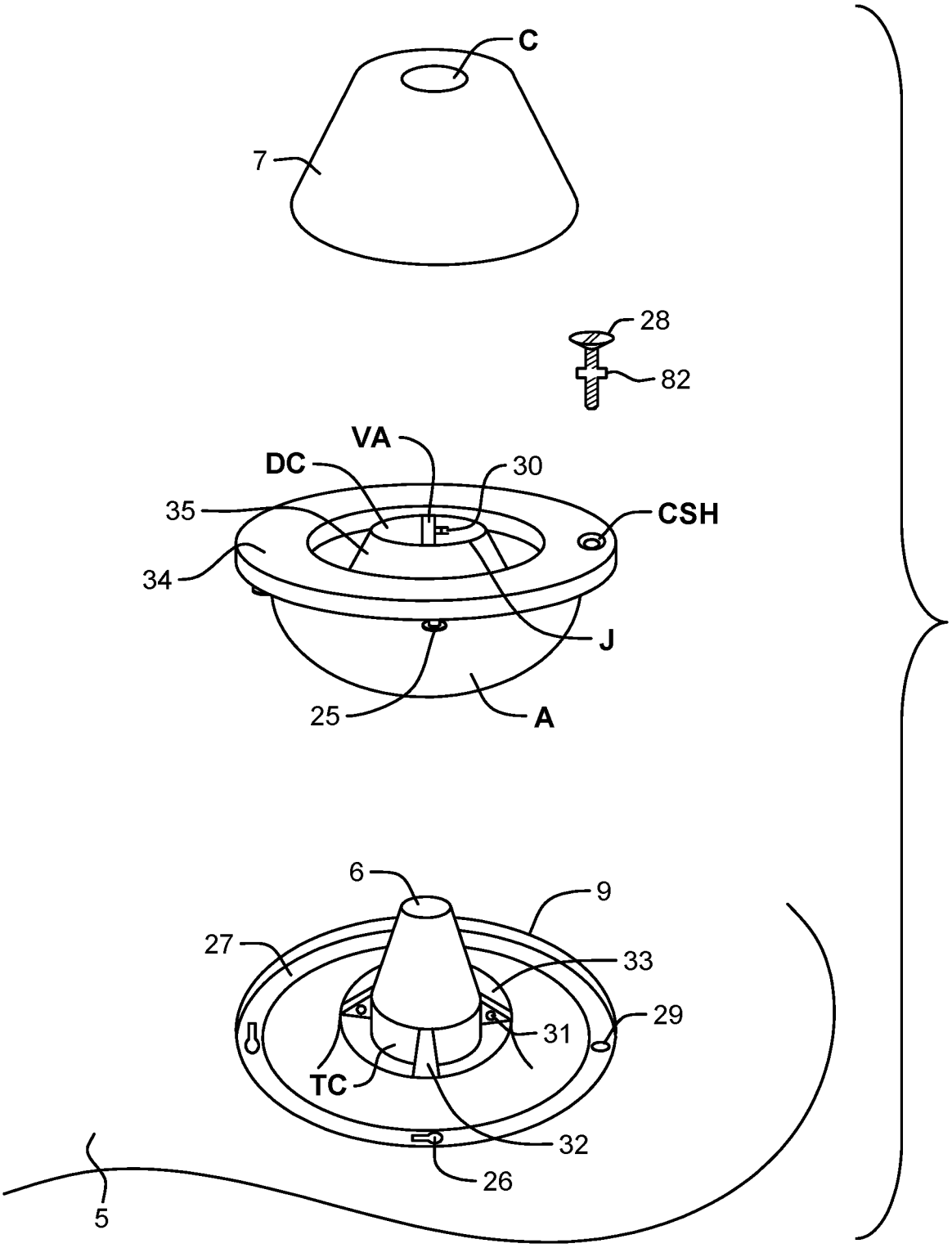
FIG. 161 shows an exploded perspective view of that concave reservoir with the respective traction member shown in FIG. 152 and that compressible cleaning structure design shown in FIG. 160, to be fixated to one another via a screw-notch lock mechanism incorporating a stayed screw, as shown in FIG. 162 from a collapsed perspective view, by such being tightened in the complementary threaded receptacle.
Figure 162:
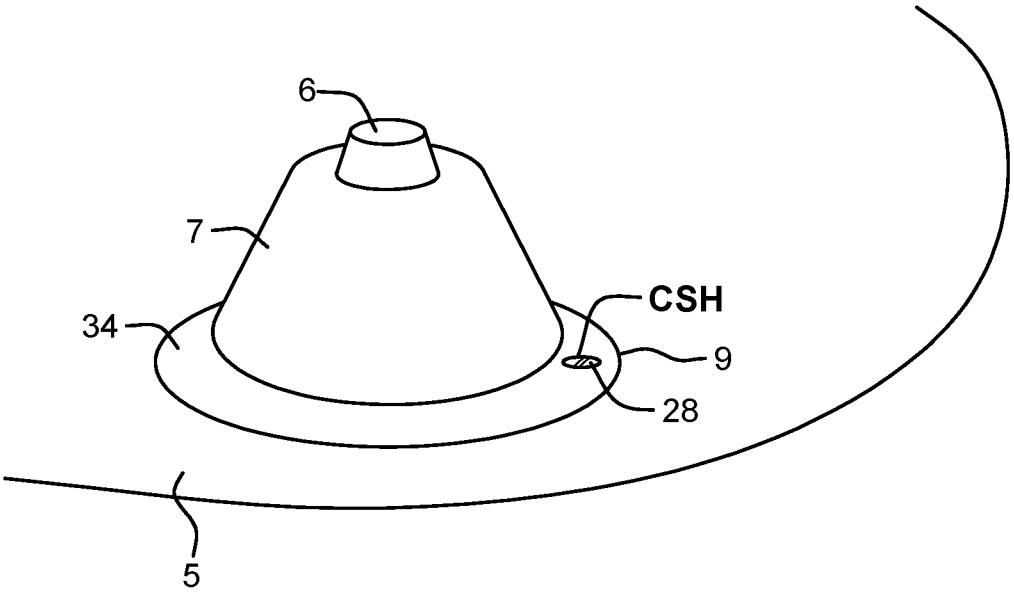
Figure 163:
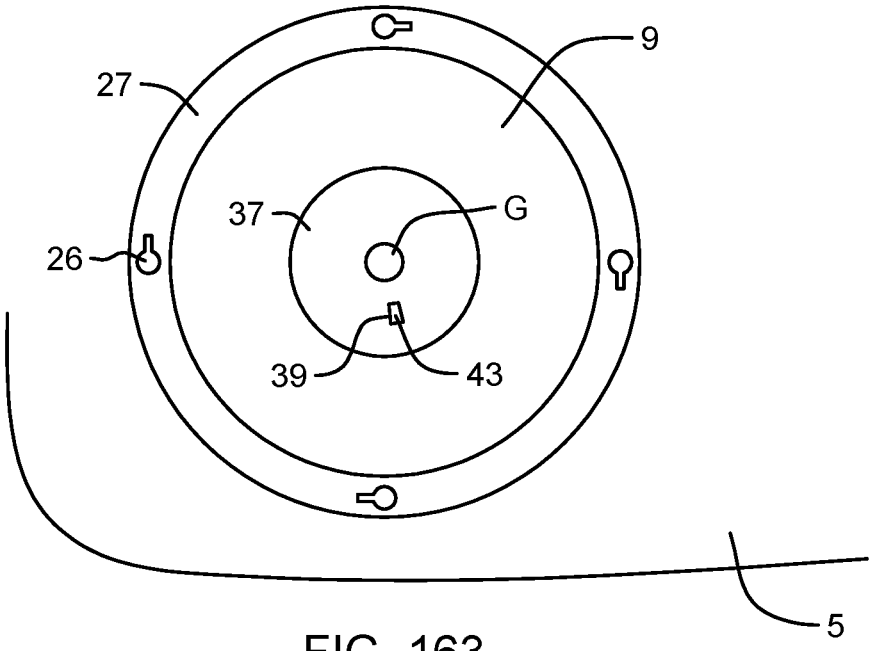
FIG. 163 shows a bottom view of a concave reservoir design containing an L-shaped pin which extends distally from its protruding pedestal to fit in the notch hole located in the inner collar of the removable/temporarily fixated compressible cleaning structure design shown from a top plan view in FIG. 164, with both the compressible cleaning structure and concave reservoir to be fixated via a screw-notch lock mechanism design incorporating a removable/temporarily fixated traction member of the cleat and/or spike type, which when fully tightened in the shoe bottom/outer sole will fixate all the related structures in the most secure and locked position.
Figure 164:
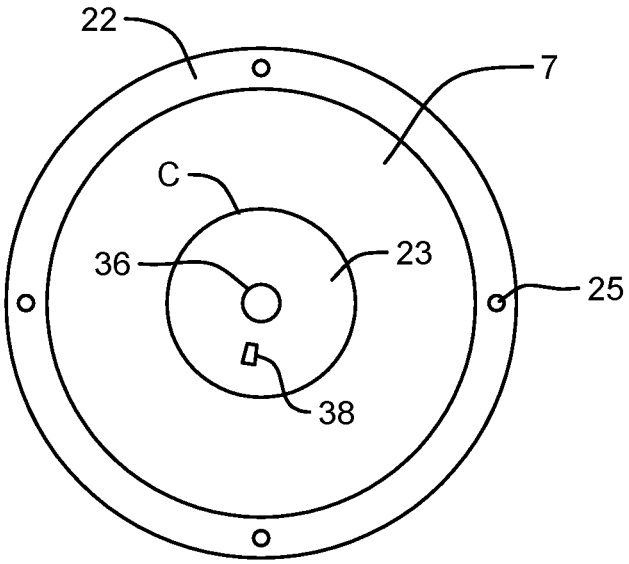

The aforementioned structures of this such design shown in FIGS. 152 and 160 are illustrated with a permanently fixated/integrally attached cleat type traction member 6 in FIG. 161 from an exploded perspective view, and in FIG. 162 from a collapsed perspective view with the stayed screw 28 tightened in the complementary threaded receptacle 29, and all the related structures fixated in the most secure and locked position within the accommodatingly shaped concave reservoir 9 via the described screw-notch lock mechanism. It should be easily understood by those familiar in the present art how that compressible cleaning structure 9 design illustrated in FIG. 157 from a top plan view may also be of this altered/modified design by the incorporation of the just described mounting plate component (A), with such a compressible cleaning structure 7 as a whole incorporated with a stayed screw 28 tightened in the complementary threaded receptacle 29, and all the related structures fixated in the most secure and locked position within that same accommodatingly shaped concave reservoir 9 in the shoe bottom/outer sole 5 shown in FIG. 156 from a bottom view via the same screw-notch lock mechanism described, with this such design applicable to all those same types of traction members 6 applicable to that design illustrated in FIG. 157.

Figure 165:
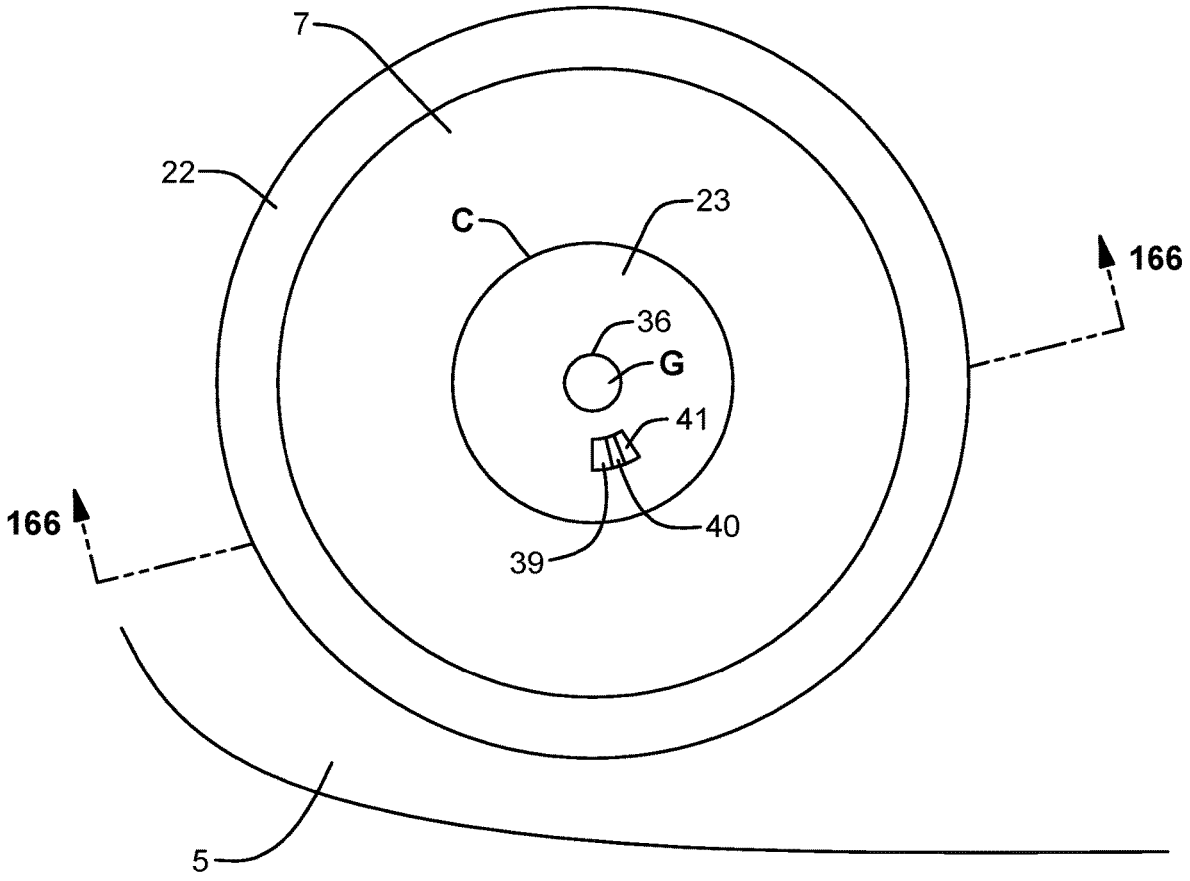
FIG. 165 shows a bottom view of the compressible cleaning structure design shown in FIG. 164, fitted in the accommodatingly shaped concave reservoir in the shoe bottom/outer sole shown in FIG. 163, with a removable/temporarily fixated traction member not present.

The previously presented removable/temporarily fixated compressible cleaning structure 7 designs incorporating a screw-notch lock mechanism may be altered/modified in terms of their outer collar 22 and inner collar 23, along with the altering and modification of several elements in the previously presented accommodatingly shaped concave reservoir 9 to which it was to be fixated in the shoe bottom/outer sole 5, whereby the resulting compressible cleaning structure 7 design as a whole will no longer be applicable to cleats and/or spikes of the permanently fixated type, but rather be exclusively applicable to and incorporated with traction members 6 of the removable/temporarily fixated cleat and/or spike type. Conceived in such a design is an accommodatingly shaped concave reservoir 9, shown in FIG. 163 from a bottom view, and a removable/temporarily fixated compressible cleaning structure 7, shown in FIG. 164 from a top plan view, with a shoulder 27 and an outer collar 22, respectively, which may remain similar in all facets as previously described, except the complementary threaded receptacle 29, located in the shoulder 27 of the concave reservoir 9, and the stayed screw 28, located in the outer collar 22 of the compressible cleaning structure 7, which were previously incorporated, may be replaced in their respective locations by a male shaped headed clip 25 and its complementary shaped female notch 26, which are respectively the same as already described. That function previously provided by the now absent stayed screw 28 and complementary threaded receptacle 29 of the previous designs, in which all the respective male and female complementary shaped structures of the compressible cleaning structure 7 as a whole, the accommodatingly shaped concave reservoir 9, and the shoe bottom/outer sole 5 were all maintained in the most secure and locked position, will now be accomplished in these removable/temporarily fixated compressible cleaning structure 7 designs by the to be described modified components and their dependence on those incorporated traction members 6 of the removable cleat and/or spike type in these such designs having their threaded longitudinal stud (F) being fully tightened in their complementary threaded boss (G). The inner collar 23, as in its prior form, is attached/secured, by any suitable means, to the proximal opening of the fraction body hole (C) of the compressible cleaning structure 7, with that inner collar 23 constructed with a conduit hole 36 located in its center which is just of a large enough diameter so to allow the threaded longitudinal stud (F) of the removable/temporarily fixated spike and/or cleat type to be fitted and pass through so to be turned and fully tightened into the complementary threaded boss (G), so to be fixated to the shoe bottom/outer sole 5. The outer perimeter of the inner collar 23 is of a round shape and equal in diameter to the adjacent round shaped distal surface of a protruding pedestal 37, which emerges and arises from the concavity of its surrounding accommodatingly shaped concave reservoir 9 in the shoe bottom/outer sole 5, and has a complementary threaded boss (G) integrally contained and centrally located in its plantar surface. The protruding pedestal 37 is of a height of an amount below the horizontal level of the shoe bottom/outer sole 5 equal to that of the height of the inner collar 23 itself, for the reason being that with the inner collar 23 dorsal surface contacting the protruding pedestal 37 plantar surface, as when the compressible cleaning structure 7 as a whole is fitted within the accommodatingly shaped concave reservoir 9, as shown in FIG. 165 from a bottom view, the threaded longitudinal stud (F) of the traction member 6 may be turned and fully tightened in the integrally contained complementary threaded boss (G) in the protruding pedestal 37, so that height of the most distal plantar aspect of the inner collar 23, upon which the base of the traction member 6 attaches to when fixated to the shoe bottom/outer sole 5, will be equal to the same level as that of the shoe bottom/outer sole 5 plantar surface, allowing for full length exposure of the traction member 6 when the compressible cleaning structure 7 is fully compressed within the accommodatingly shaped concave reservoir 7. The inner collar 23 will be constructed with a notch hole 38, continuous and through its dorsal to plantar surface, which will allow an L-shaped pin 39 of a complementary shape, originating and extending from the protruding pedestal 37 plantar surface, to be fitted through the notch hole 38 simultaneously as the male shaped headed clips 25 of the outer collar 22 are aligned in those complementary female notches 26 in the plantar surface of the shoulder 27 of the concave reservoir 9 when the compressible cleaning structure 7 as a whole is aligned and fitted in the accommodatingly shaped concave reservoir 9. The notch hole 38, a component in an arcuate assembly, is that opening of the inner collar 23 through which the L-shaped pin 39 will occupy, with the notch hole 38 ending at a common edge it shares with the beginning of the second component of the arcuate assembly, a shelf 40 of a horizontal orientation parallel to, but more proximal than, that level of the plantar surface of the inner collar 23, which continues to that edge it shares with the beginning of the final component of the arcuate assembly, that a lock groove 41 of a triangular shaped depression even more proximal than the shelf 40. A pin clasp 42, with a dorsal surface of a complementary shape to the triangular shaped plantar surface depression of the lock groove 41, is located at the end of the dorsal surface of a short leg 43 component of the L-shaped pin 39 which is that relatively horizontal extension from that vertical component of the L-shaped pin 39 originating from the plantar surface of the protruding pedestal 37. The short leg 43 of the L-shaped pin 39 is constructed in a slightly biased direction such that its plantar aspect is distally angled relative to the horizontal level of the inner collar 23 plantar surface, which is synonymous with the horizontal level of the shoe bottom/outer sole 5 plantar surface, such that when the L-shaped pin 39 is aligned and fitted in the notch hole 38, and the male shaped headed clips 25 are aligned and fitted in the complementary female notches 26 as well, the compressible cleaning structure 7 as a whole may be manually turned so the outer collar 22 male shaped headed clips 25 are then fully engaged in their respective complementary female notches 26, with that pin clasp 42, located on the dorsal surface distal aspect of the short leg 43 of the L-shaped pin 39, aligned, but only partially engaged with the complementary shaped lock groove 41 of the inner collar 23. The previously described function that was provided by the now absent stayed screw 28 of the previous designs in which all the respective complementary shaped male and female structures of the compressible cleaning structure 7 as a whole, the accommodatingly shaped concave reservoir 9, and the shoe bottom/outer sole 5 were maintained in a most secure and locked position, will now be provided by the tightening of the removable/temporarily fixated traction member 6 of the cleat and/or spike type, whereby when the threaded longitudinal stud (F) of the traction member 6 is fitted through the conduit hole 36 of the inner collar 23 and is fully tightened in the complementary threaded boss (G) located in the protruding pedestal 37, the flat dorsal surface of the base of the traction member 6 will now hold that biased adjacent plantar surface of the short leg 43 of the L-shaped pin 39 fully flat so that short leg 43, as alluded to earlier, will be a relative and actual horizontal extension from that vertical component of the L-shaped pin 39, with its now horizontal plantar surface even with the horizontal level of the inner collar 23 plantar surface, with the flat dorsal surface of the base of the traction member 6 serving to apply sufficient pressure to the plantar surface distal aspect, and the plantar surface as a whole, of the short leg 43 of the L-shaped pin 39 such that the pin clasp 42 on the opposite dorsal surface side of the short leg 43 of the L-shaped pin 39 will now be fully engaged in the complementary shaped lock groove 41 of the inner collar 23, where it will be maintained in a locked position by the abutting dorsal surface of the base of the fully tightened traction member 6, and thus locking all the respectively described complementary structures of this design in the most secure and locked position. It should be clearly understood that upon removal of the traction member 6 the respective aforementioned structures may remain aligned, but with a far lesser degree of tension between the pin clasp 42 of the L-shaped pin 39 and lock groove 41, thereby allowing the wearer to manually turn and disengage all the respectively described structures in order to remove the compressible cleaning structure 7 as a whole from the accommodatingly shaped concave reservoir 9 in the shoe bottom/outer sole 5, if and when need be.

Figure 166:
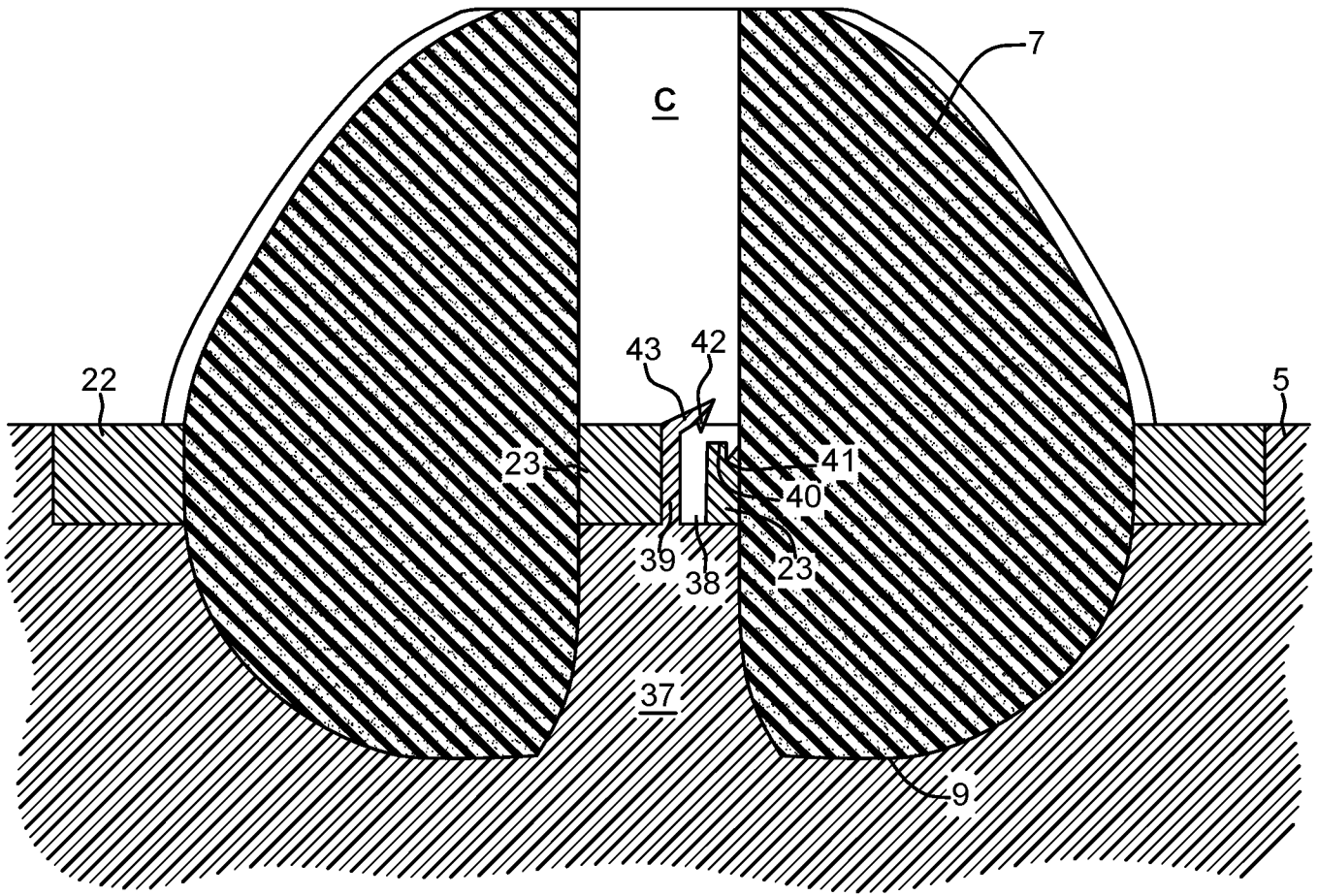
FIG. 166 shows a left to right frontal view in cross-section of FIG. 165 taken along the viewer's view line "166-166" of FIG. 165.
Figure 167:
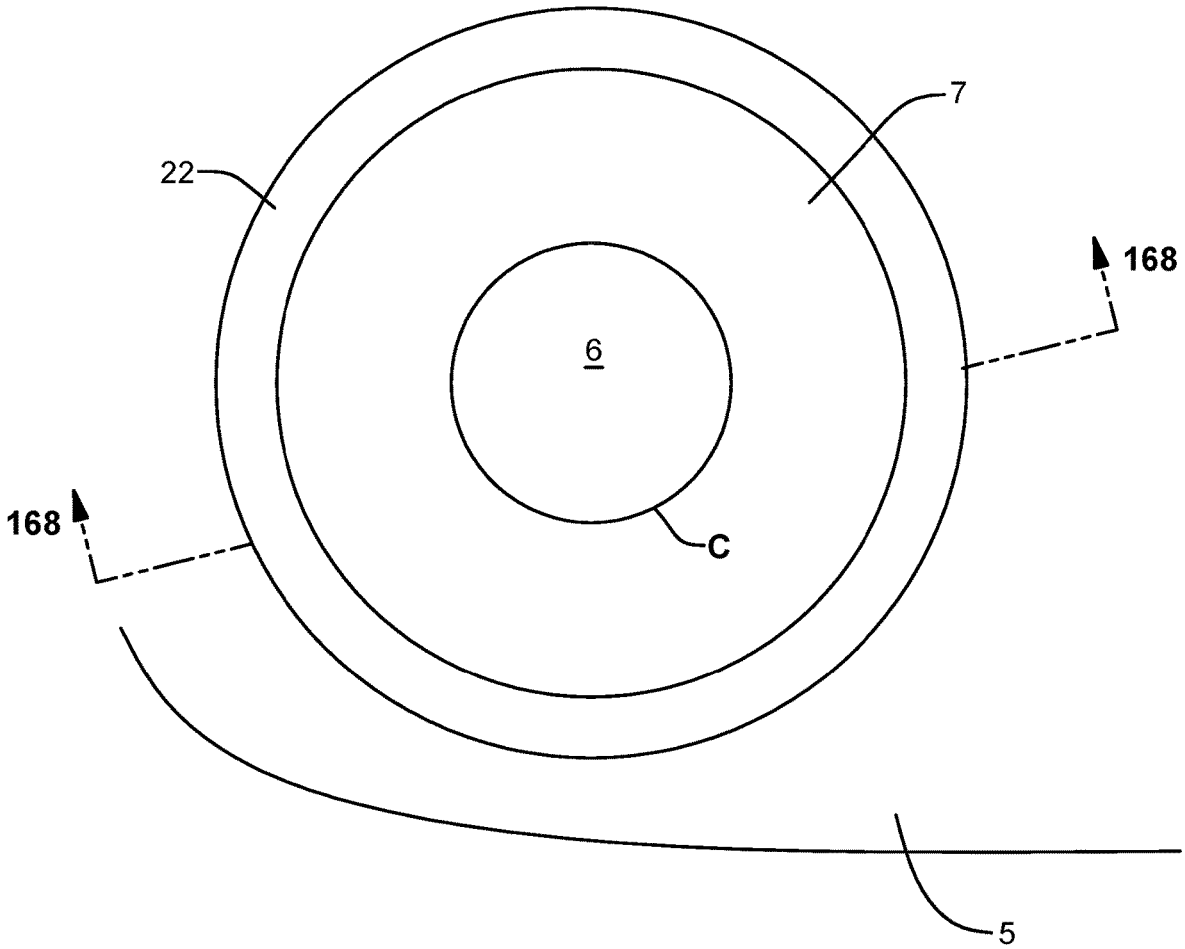
FIG. 167 shows a bottom view of the compressible cleaning structure design in FIG. 166, now with a removable/temporarily fixated cleat type traction member fixated via its threaded longitudinal stud being tightened in the complementary threaded boss in the shoe bottom/outer sole, and all related structures maintained in the most secured and locked position in the accommodatingly shaped concave reservoir in the shoe bottom/outer sole via the described screw-notch lock mechanism.
Figure 168:
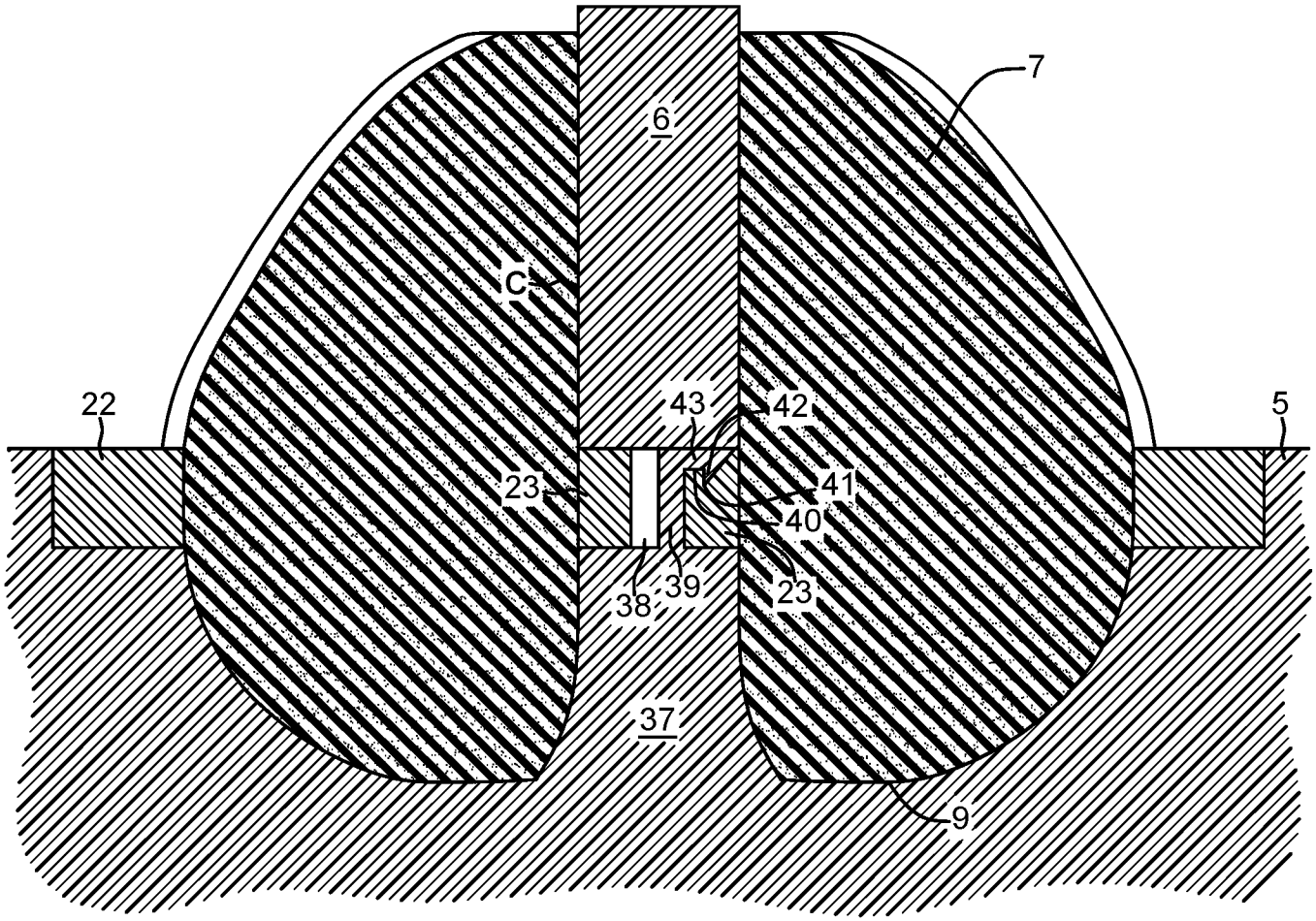
FIG. 168 shows a left to right frontal view in cross-section of FIG. 167 taken along the viewer's view line "168-168" of FIG. 167.

A removable/temporarily fixated compressible cleaning structure 7 design as a whole to be fixated via the just previously described screw-notch lock mechanism, exclusively applicable to a traction member 6 of the removable/temporarily fixated cleat type is shown in FIG. 166 from a left to right frontal view in cross-section of FIG. 165 taken along the viewer's view line "166-166" of FIG. 165, with the compressible cleaning structure 7 occupying, but not yet turned in the accommodatingly shaped concave reservoir 9 in the shoe bottom/outer sole 5, so that the L-shaped pin 39 originating from the protruding pedestal 37, as illustrated, occupying the notch hole 38 of the inner collar 23, is yet to have its pin clasp 42 aligned and engaged with the lock groove 41. FIG. 167 shows a bottom view of that compressible cleaning structure 7 design as a whole in FIG. 166, now with a removable/temporarily fixated cleat type traction member 6 fixated via its threaded longitudinal stud (F) being tightened in the complementary threaded boss (G) in the shoe bottom/outer sole 5 and all the related structures maintained in the most secure and locked position in the accommodatingly shaped concave reservoir 9 in the shoe bottom/outer sole 5 via the described screw-notch lock mechanism, and FIG. 168 shows a left to right frontal view in cross-section of FIG. 167 taken along the viewer's view line "168-168" of FIG. 167, of the compressible cleaning structure 7 design as a whole fully turned in the accommodatingly shaped concave reservoir 9, showing the pin clasp 42 of the L-shaped pin 39 aligned and engaged in the lock groove 41, with all the related structures maintained in the most secure and locked position in the accommodatingly shaped concave reservoir 9 in the shoe bottom/outer sole 5 via the described screw-notch lock mechanism, by the tightening of the threaded longitudinal stud (F) of the removable/temporarily fixated cleat type traction member 6 in its complementary threaded boss (G). It is conceived in the present invention, and should be understood by those familiar in the present art, how a removable/temporarily fixated spiked type traction member 6 may be transposed upon this just described compressible cleaning structure 7 design, and in addition, how a mounting plate component (A) may be incorporated in the same, with all alterations/modifications required made as needed with these such design applications.

As explained earlier in the text of the present invention regarding the incorporation of a mounting plate component (A) to those removable/temporarily fixated compressible cleaning structure 7 designs lacking in such, so too may a mounting plate component (A) be incorporated in all the removable/temporarily fixated compressible cleaning structure 7 designs already described and illustrated as fitted in their accommodatingly shaped concave reservoirs 9 in the shoe bottom/outer sole 5. It should be understood by all those who familiarize themselves in the present art that the concave shaped plantar surface of the mounting plate component (A), when incorporated in the compressible cleaning structure 7 design as a whole, mimics those exact same functions of the concave reservoir 9 in which the mounting plate component (A) is now fitted, and that concave shaped plantar surface of the mounting plate component (A) may be referred to as a concave reservoir 9 as well, providing the same accommodatingly shaped space for the compressible material of the compressible cleaning structure 7, and the compressible cleaning structure 7 as a whole itself, to fully flatten within, so to be level with that horizontal level of the shoe bottom/outer sole 5 plantar surface when fully compressed in the weight bearing mode upon contacting the playing field surface, thereby allowing full exposure of the traction member 6 it respectively surrounds.

Figure 169:
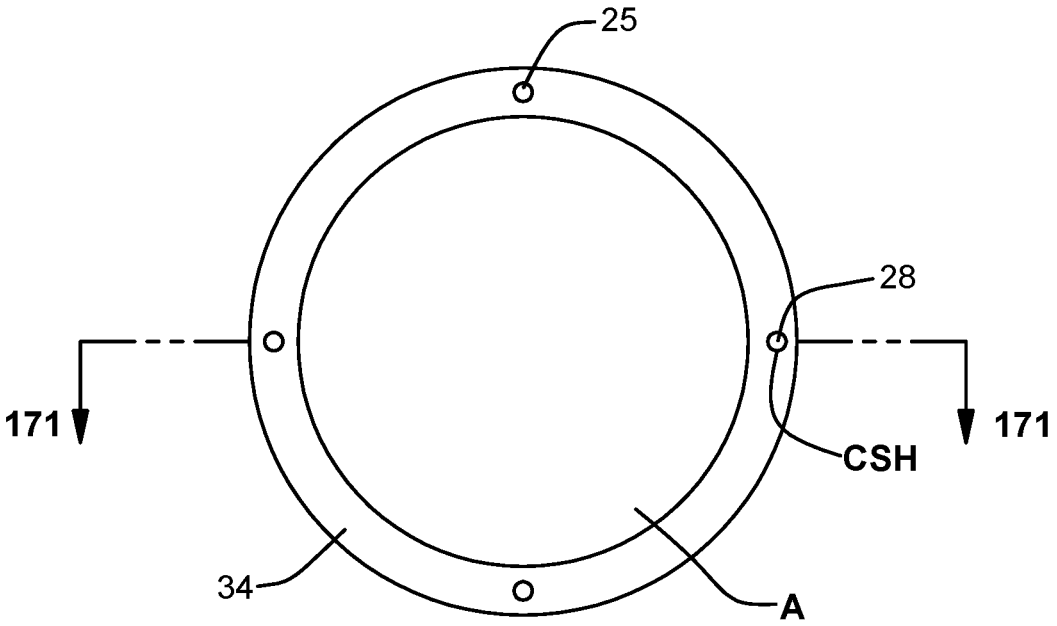
FIG. 169 shows a top plan view of a removable/temporarily fixated compressible cleaning structure design incorporated with a mounting plate component, which may be constructed with a permanently/integrally attached cleat and/or spike type traction member, to be fixated in the accommodatingly shaped concave reservoir, shown in FIG. 170 from a bottom view, via a screw-notch lock mechanism (such as, for example as shown in FIGS. 150 and 151) incorporating a stayed screw.
Figure 170:
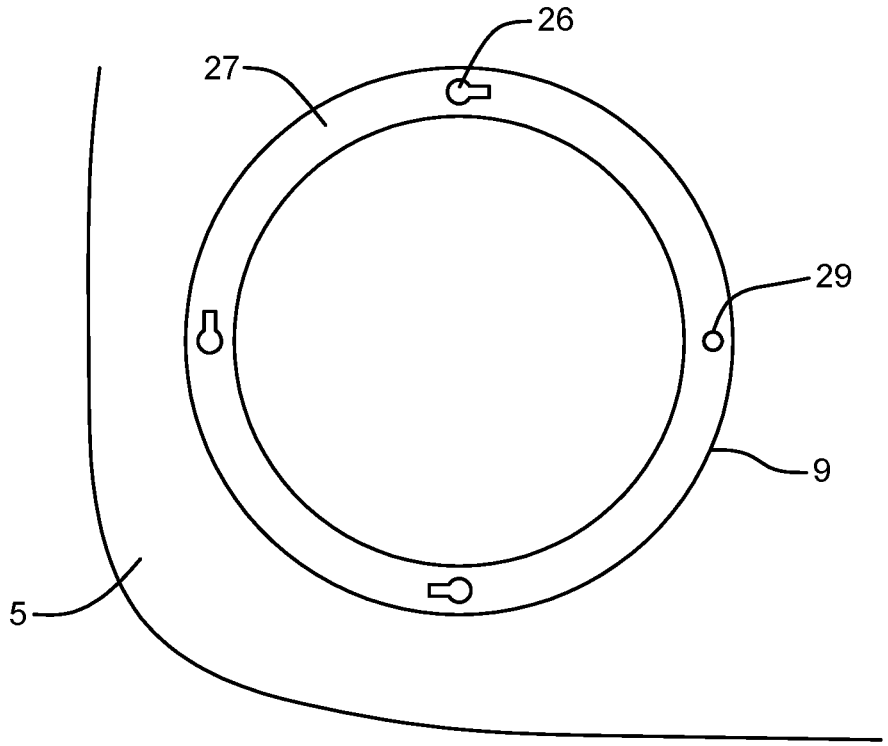
Figure 171:
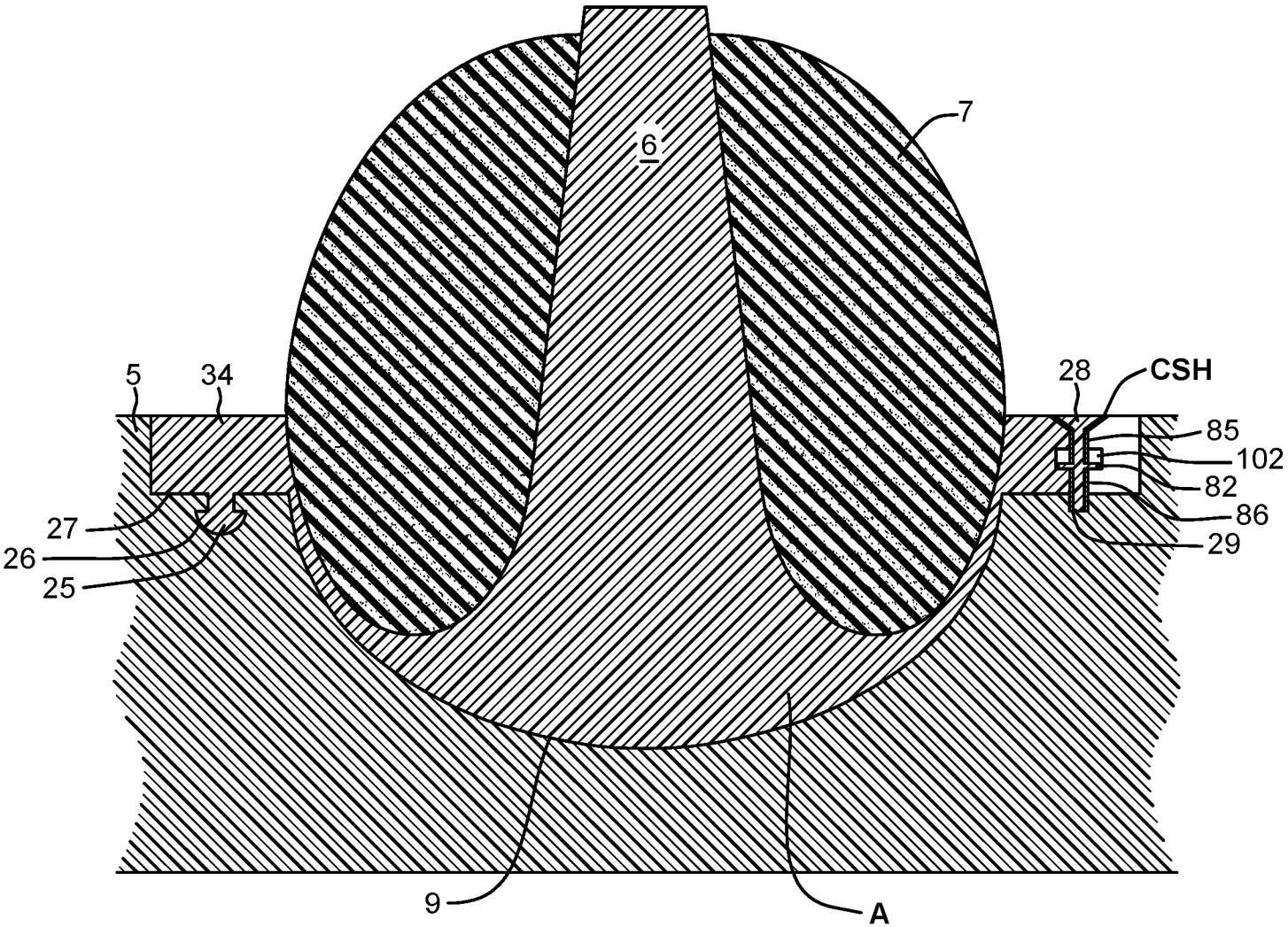
FIG. 171 shows a left to right frontal view in cross-section of FIG. 169 taken along the viewer's view line "171-171" of FIG. 169 of a compressible cleaning structure design with a mounting plate component which incorporates a permanently/integrally attached cleat type traction member, fixated in the accommodatingly shaped concave reservoir in FIG. 170 via a screw-notch lock mechanism in which the incorporated stayed screw is fully tightened in the complementary threaded receptacle, with all the related structures maintained in the most secure and locked position.

As shown in FIG. 169, a removable/temporarily fixated compressible cleaning structure 7 design incorporating a mounting plate component (A) in its design as a whole, in which a screw-notch lock mechanism (such as, for example as shown in FIGS. 150 and 151) which incorporates a stayed screw 28 as the means of fixation within the accommodatingly shaped concave reservoir 9 in the shoe bottom/outer sole 5, is of a design constructed in which a traction member 6 of the cleat and/or spike type is permanently fixated, by any suitable means, and/or an integral part of the mounting plate component (A), and the compressible cleaning structure 7 design as a whole. This removable/temporarily fixated compressible cleaning structure 7 design, shown in FIG. 169 from a top plan view, to be fitted in the accommodatingly shaped concave reservoir 9 in the shoe bottom/outer sole 5 shown from a bottom view in FIG. 170, is incorporated with its screw-notch lock mechanism shown in FIG. 171, in which its mounting plate component (A) is constructed with an outer flange 34, which as described in previous designs, includes the male shaped headed clips 25 projecting from the dorsal surface of that outer flange 34 and a stayed screw 28 contained in its countersunk through hole (CSH) by a disk shaped stay 82, to be aligned and fitted in, respectively, as shown in FIG. 170 from a bottom view, the complementary shaped female notches 26 and the complementary threaded receptacle 29, in the plantar surface of the shoulder 27 surrounding the periphery of the concave reservoir 9 in the shoe bottom/outer sole 5. The compressible cleaning structure 7 in FIG. 169, when fitted in that accommodatingly shaped concave reservoir 9 in the shoe bottom/outer sole 5 in FIG. 170, as shown in FIG. 171 from a left to right frontal view in cross-section of the compressible cleaning structure 7 of FIG. 169 taken along the viewer's view line "171-171" of FIG. 169, incorporating a mounting plate component (A) with a permanently/integrally attached cleat type traction member 6, is turned to a maximum fully stopped position, so all the male shaped headed clips 25 will be fully engaged in their complementary shaped female notches 26, and the stayed screw 28 in the countersunk through hole (CSH) will be aligned with, and fully tightened in the complementary threaded receptacle 29 located in the plantar surface of the shoulder 27 surrounding that concave reservoir 9 in the shoe bottom/outer sole 5, thereby maintaining all those male shaped headed clips 25 in their complementary shaped female notches 26 and the compressible cleaning structure 7 as a whole in the most secure and locked position. For those familiar in the present art, it should be easily understood how a permanently fixated spike type traction member 6 may be transposed appropriately upon this design.

Figure 172:
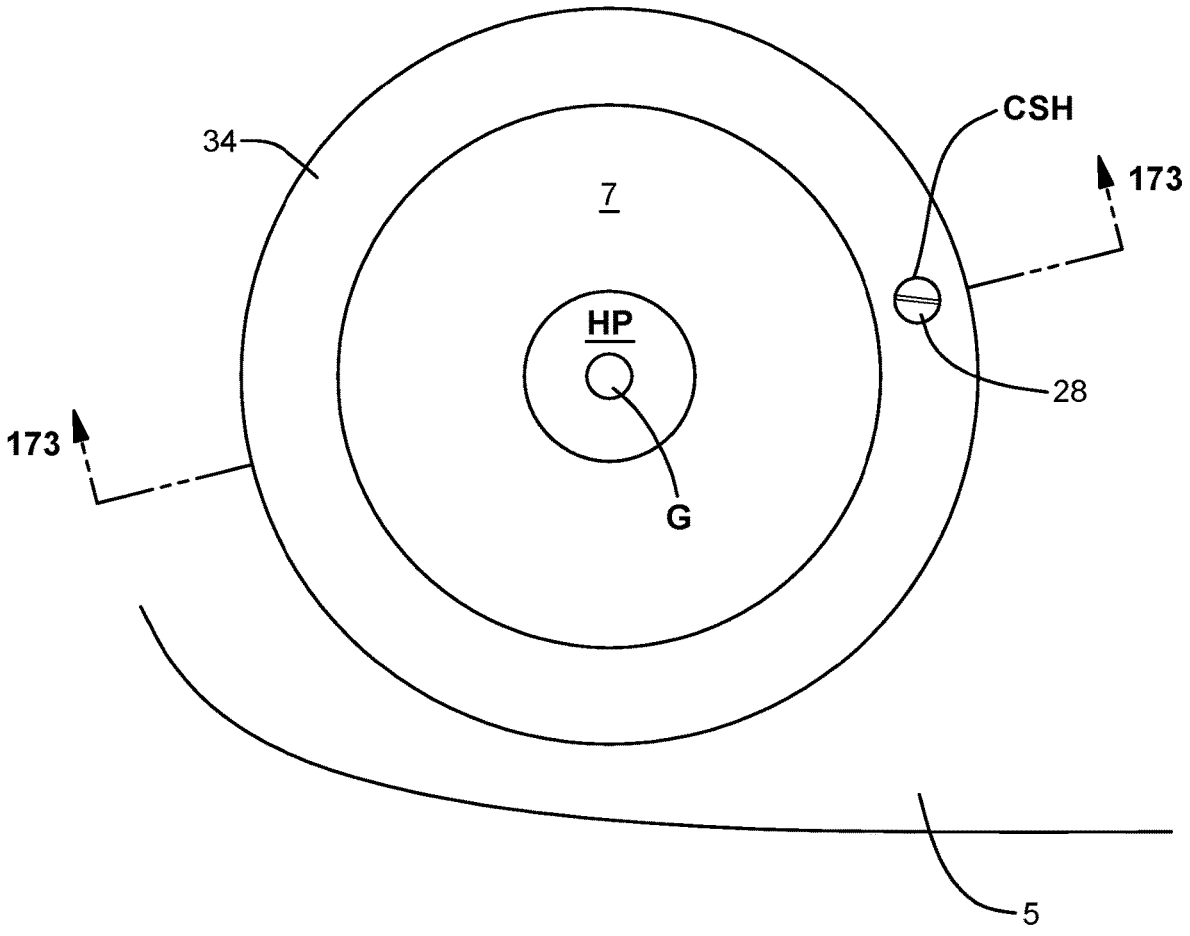
FIG. 172 shows a bottom view of a removable/temporarily fixated compressible cleaning structure design in the shoe bottom/outer sole, incorporating a mounting plate component with its horizontal plateau containing an integral complementary threaded boss, in which the threaded longitudinal stud of a removable/temporarily fixated cleat type traction member may be tightened.
Figure 173:
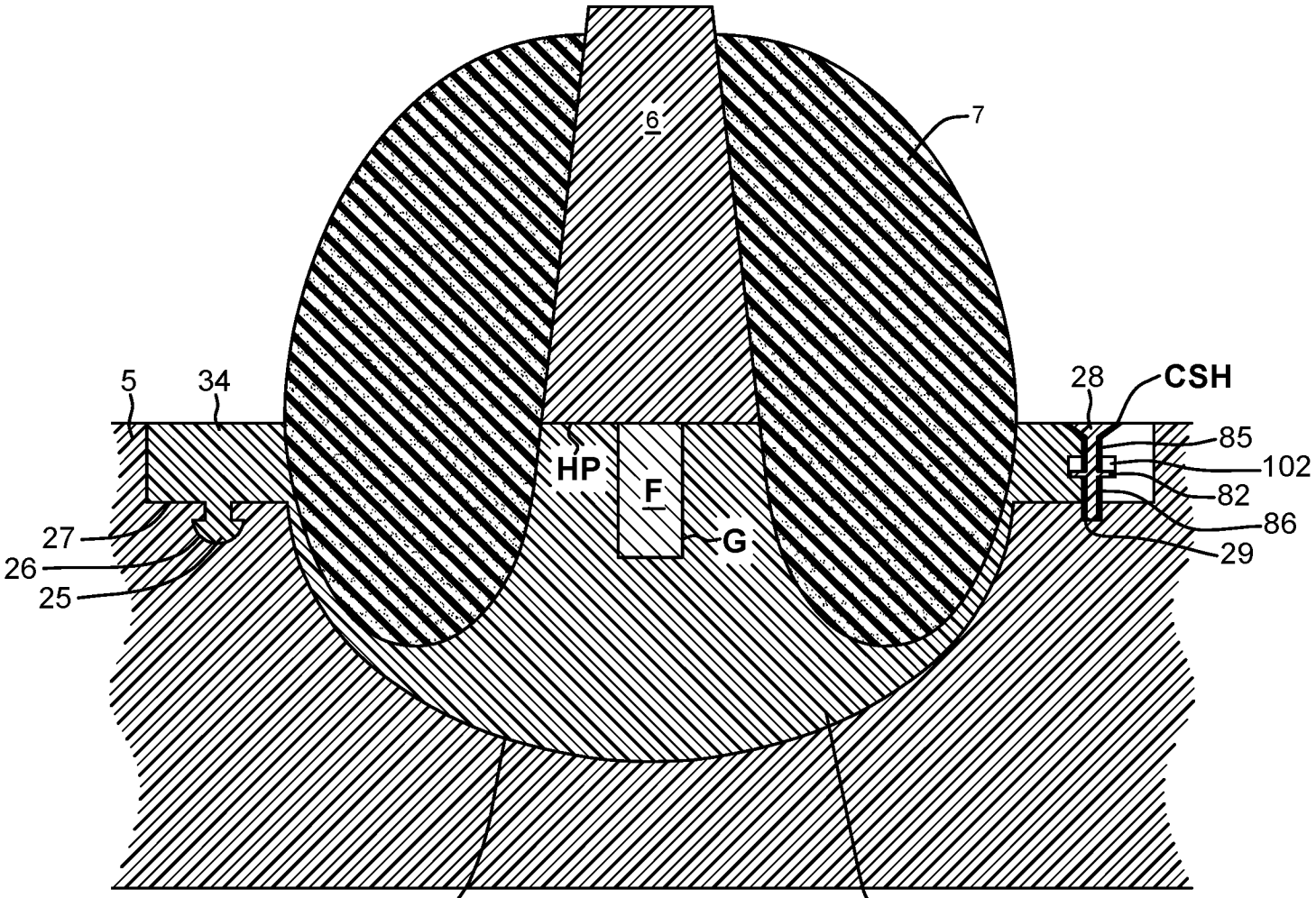
FIG. 173 shows a left to right frontal view in cross-section of FIG. 172 taken along the viewer's view line "173-173" of FIG. 172 of a compressible cleaning structure design with a removable/temporarily fixated cleat type traction member present, and the compressible cleaning structure design as a whole fixated in that accommodatingly shaped concave reservoir in FIG. 170 via the screw-notch lock mechanism (such as, for example as shown in FIGS. 150 and 151) in which the incorporated stayed screw is fully tightened in the complementary threaded receptacle, with all the related structures maintained in the most secure and locked position.

A removable/temporarily fixated compressible cleaning structure 7 design with a mounting plate component (A), shown in FIG. 172 from a bottom view, is incorporated with a screw-notch lock mechanism (such as, for example as shown in FIGS. 150 and 151) with a stayed screw 28 as the means by which the respective compressible cleaning structure 7 design is fixated within that same accommodatingly shaped concave reservoir 9 in the shoe bottom/outer sole 5 previously shown in FIG. 170. The respective compressible cleaning structure 7 is constructed with an integrally incorporated complementary threaded boss (G) located in a horizontal plateau (HP), which is an integral portion of and arising from the center of the plantar surface of the mounting plate component (A) and of the same circular shape as that of the base of the respective removable/temporarily fixated cleat type traction member 6, as shown in FIG. 173 from a left to right frontal view in cross-section of FIG. 172 taken along the viewer's view line "173-173" of FIG. 172, fixated via its threaded longitudinal stud (F) being tightened into that integrally incorporated complementary threaded boss (G) so its base is at the same horizontal level as that of the shoe bottom/outer sole 5 plantar surface, and the respective compressible cleaning structure 7 design as a whole fixated in the accommodatingly shaped concave reservoir 9 in the shoe bottom/outer sole 5 in FIG. 170 with the incorporated stayed screw 28 of the screw-notch lock mechanism fully tightened in the complementary threaded receptacle 29 and all the related structures in the most secure and locked position. Again, it should be simple for the those familiar in the present art how a removable/temporarily fixated spike type traction member 6 may be transposed upon this such design.

Figure 174:
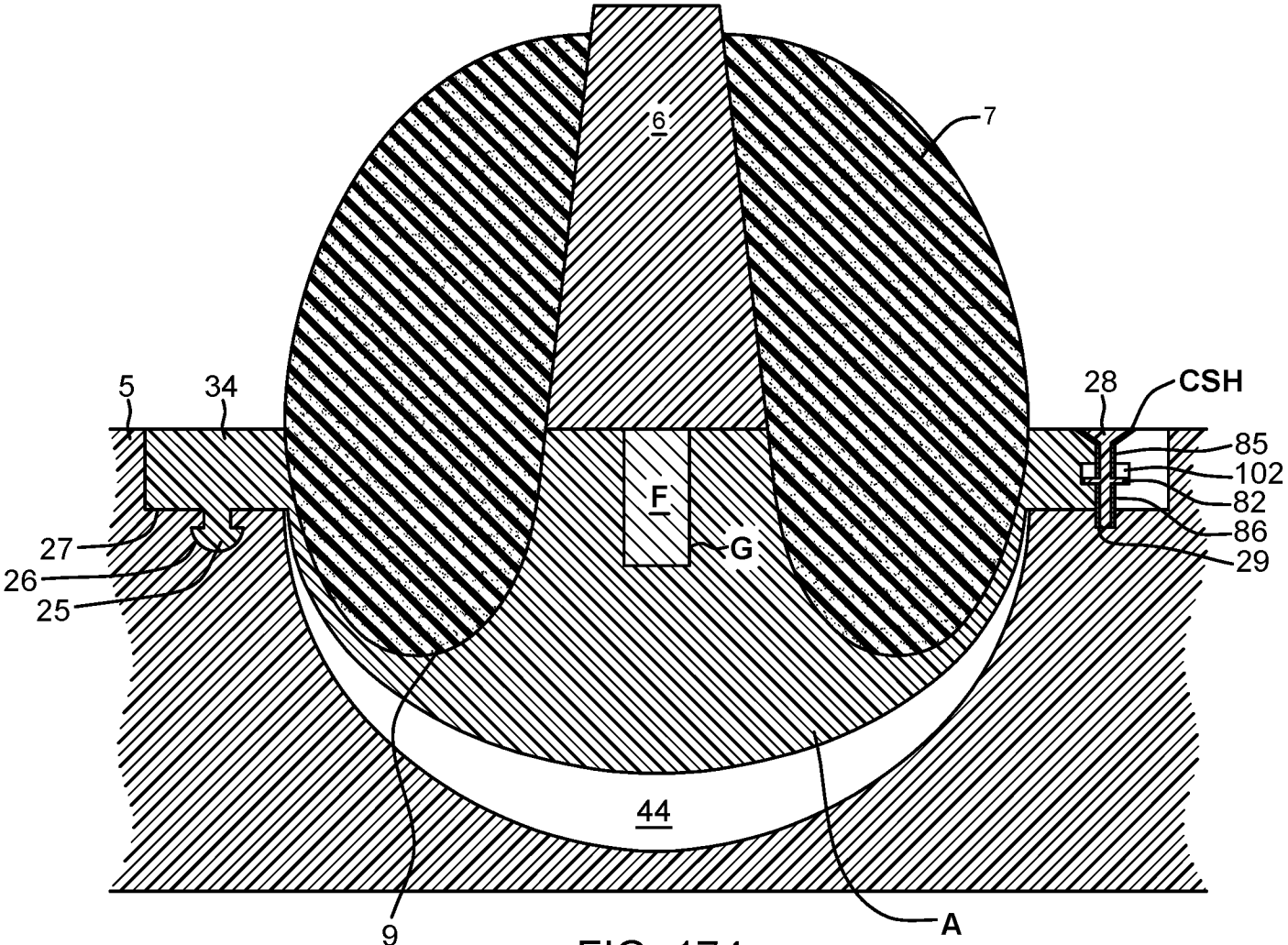
FIG. 174 shows a left to right frontal view taken along an arbitrary mid line cross-section of a void in space in the shoe bottom/outer sole, which is the same peripheral configuration/shape as that of the entire dorsal convex side of the mounting plate component it is directly proximal and adjacent to, which is opposite the concave side of this mounting plate component in which the distal structures in the shoe bottom/outer sole, including the accommodatingly shaped concave reservoir, the removable/temporarily fixated cleat type traction member, and the compressible cleaning structure, are located.
Figure 175:
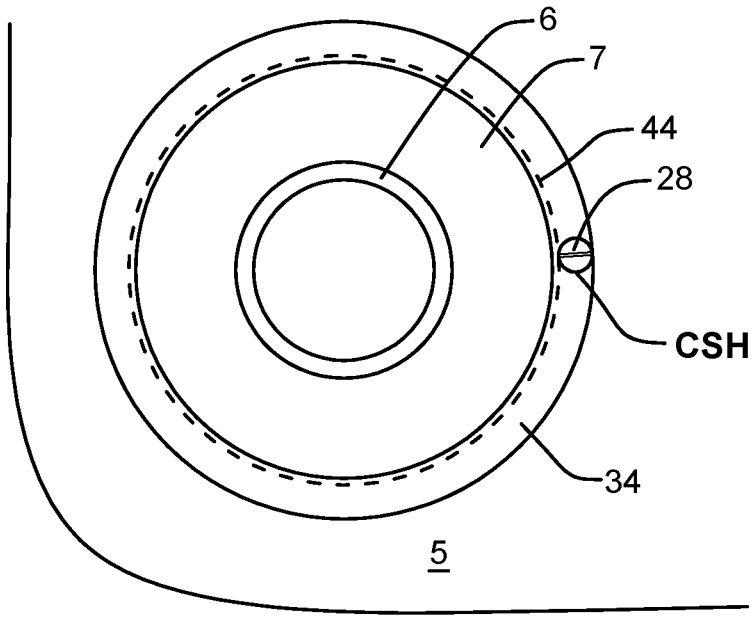
FIG. 175 shows a bottom view of FIG. 174, with the peripheral configuration/shape of the void in space now demarcated by that illustrated dashed line, identifying the location of the void in space relative to all the other illustrated distal structures shown.

Another modified design conceived in the present invention incorporates a void in space 44, particular to those removable/temporarily fixated compressible cleaning structure 7 designs incorporating a mounting plate component (A) as a whole, fixated via some form of the screw-notch lock mechanism of the present invention in its accommodatingly shaped concave reservoir 9, with a cleat and/or spike type traction member 6 permanently fixated/integrally attached to the mounting plate component (A), and/or of a removable/temporarily fixated cleat and/or spike type traction member 6 fixated via its threaded longitudinal stud (F) in a complementary threaded boss (G) integrally incorporated/located in the mounting plate component (A). Shown in FIG. 174, is such a void in space 44, seen from the same view as and now incorporated in that same compressible cleaning structure 7 design previously shown in FIG. 173. The void in space 44 in this particular design is an open concave space in the shoe bottom/outer sole 5 plantar surface of the same peripheral configuration/shape of and directly proximal and adjacent to the entire dorsal convex side of the mounting plate component (A), and in which that mounting plate component (A), and its respective compressible cleaning structure 7 as a whole, will be fixated to the shoe bottom/outer sole 5 by those same means as already described and illustrated in FIG. 173. That void in space 44 will be of a large enough depth so to be that space that remains between the dorsal convex side of that mounting plate component (A) and the shoe bottom/outer sole 5 plantar concave surface, which itself is that void in space 44, when the compressible cleaning structure 7 as a whole is attached/fixated to the shoe bottom/outer sole 5. The same compressible cleaning structure 7 design shown in FIG. 174 is shown in FIG. 175 from a bottom view, with all those relatively distal structures to the void in space 44 seen from a bottom view shown, with the peripheral configuration/shape of that more proximal void in space 44 demarcated by that illustrated dashed line representing that void in space 44, so to allow those who familiarize themselves in the present art to fully grasp the perspective of the location of the void in space 44 relative to the illustrated distal structures.

While the aforementioned described voids in space 44, by design, are of the same peripheral configuration/shape and mirror that peripheral configuration/shape of the concave reservoir 9, their configuration/shape may even be larger than that of the periphery of the concave reservoir 9, with any and all such voids in space 44 of an adequate height throughout such that the adjacent aspects of the two respective structural surfaces which enclose and comprise these voids in space 44 will not contact each other except at the extreme periphery of the void in space 44, which is that only interface at which these two adjacent structural surfaces meet to contact each other so to enclose these voids in space 44. Designs incorporating such voids in space 44, due to the directly related void in contact between the entire dorsal convex aspect of the concave reservoir 9, or when applicable, the entire dorsal convex aspect of the mounting plate component (A), and the adjacent more proximal plantar aspect of the void in space 44 they are adjacent to in the shoe bottom/outer sole 5, allow those designs adjacent plantar and dorsal surfaces of the voids in space 44 to contact and connect with each other at their peripheral interface so to comprise those voids in space 44 in their respective designs, and provide a comparably larger base of support than those designs lacking in the incorporation of such voids in space 44. Thus, with this comparably larger base of support the ground reaction force the foot of the wearer is subjected to upon contacting the playing field surface during the weight bearing mode is dispersed/distributed over a larger base of support, and that ground reaction force is comparably less than that force axially loaded and translated directly above and proximally to the traction members 6, compressible cleaning structures 7, and to the mounting plate components (A), if and when present, in those designs which do not incorporate such voids in space 44, with this dispersal/distribution of the ground reaction force over a larger base of support providing the wearer with increased comfort and a decreased likelihood of pressure related injuries to their feet and/or body. It should be understood by all those who have familiarized themselves in the present art that the examples of these modified designs incorporating such voids in space 44 are conceived to be applicable to all those respectively described compressible cleaning structure 7 designs, traction member 6 types, mounting plate components (A), etc., of the present invention, be it if such designs do and/or don't incorporate all in their respective designs, with all such designs incorporating such described voids in space 44 when applicable, and the previously illustrated examples only that, examples of such, and in no way limiting the conceived scope by which these voids in space 44 may be applied/applicable to any and all such designs of the present invention when appropriate, including those designs of the alternative embodiments to be discussed.

The preferred embodiments of the present invention are those which have been described in the prior text, with them respectively illustrated in their accompanying figures. As explained, those embodiments incorporate a retractable/compressible cleaning structure 7 whose extension biasing activity is enacted when the force applied to these said structures is reduced. Such is the case when the shoe of the wearer breaks contact with the playing field surface, and/or any solid object for that matter, and is fully realized when there is no force upon and/or contact with the retractable/compressible cleaning structure 7, as when in the non-weight bearing mode, thereby providing an optimally cleaned traction member 6 at such a moment. This such ability has a clear and apparent advantage over those following alternative embodiments of the present invention.

The advantages of the preferred embodiments in their ability to clean their traction members 6 as described over the alternative embodiments which follow should be understood by those individuals familiar in the present art. The preferred embodiments, via that described cleaning ability of their retractable/compressible cleaning structures 7, are able to provide relatively clean and dirt free traction members 6 of a constant and full length protruding from the shoe bottom/outer sole 5, with these traction members 6 always being of their full maximum length due to the shoe bottom/outer sole 5 to which they attach to/originate from being fixed and stationary. With such a maximum length constant and guaranteed, and independent of the presence of their respectively surrounding compressible cleaning structures 7, which may or may not be retracted/compressed, those traction members 6 upon contacting the playing field surface at their full guaranteed length will function to grasp and traction that playing field surface at their full length, which is the most preferred and ideal length and superior to any degree of traction member 6 exposure less than that of the full length, as may be the case in any of those traction members 6 which attach to/originate from the mobile layer 14 in the alternative embodiments of the present invention, which are of a varying length, making the alternative embodiments of lesser abilities due to such. In addition, there are other reasons, to be explained later in this text, associated with the mobile layer 14 of the alternative embodiments, and the alternative embodiments as a whole, which make the alternative embodiments of lesser abilities than the preferred embodiments of the present invention.

The alternative embodiments of this invention, along with their accompanying structural design, employ an extension biasing mechanism method different than that of the preferred embodiments, whereby all must rely to some degree on an extension biasing mechanism/force produced by the wearer of the shoe when bearing weight on the inner sole 3 of the shoe in order to enable their mobile layer 14, and those traction members 6 which attach to/originate from that mobile layer 14 in these alternative embodiments, to coincidingly move inferiorly, so as to extend these traction members 6 so they may emerge through their complementary shaped female holes (I) which exit the shoe bottom/outer sole 5 plantar surface, and for that mobile layer 14 to reduce a transient space 15, located between its own plantar surface and the outer sole 5 dorsal surface, by coincidingly compressing those compressible cleaning structures 7 lying in that same transient space 15, against the dorsal surface of the stationary outer sole 5, upon the shoe bottom/outer sole 5, and/or any other part of the compressible cleaning structures 7, contacting the playing field surface. It should be understood that as the shoe as a whole breaks contact with the playing field surface and progresses towards the non-weight bearing mode the biasing mechanism/force exerted by the wearers foot on the inner sole 3 of the shoe which extended those traction members 6 will be reduced, with those traction members 6 and the mobile layer 14 to which they attach to/originate from now moving superiorly as a result of those compressible cleaning structures 7 expanding within, and opening that transient space 15 in which they are located, with the traction members 6 exposure reduced and shortened, and the result ultimately being a continuous change in the length of the traction members 6 of the alternative embodiments during all phases of wear/play.

The mobile layer 14 is located below the inner sole 3 and that layer upon which the inner sole 3 will sit, constructed of durable materials to withstand those repeated stresses encountered by the shoe when contacting the playing field surface, so it may continue to carry out its described mobility, as intended, in the alternative embodiments. Such materials of construction may be, but not limited to, any and/or a combination of carbon fiber, plastic, rubber, polyurethane, elastomers, fiberglass, and/or any other suitable materials, etc., allowing the mobile layer 14 to continue to perform its designed function. The mobile layer 14 is located superior to the outer sole 5, with its mobile layer 14 plantar surface opposite the outer sole 5 dorsal surface and of a shape/configuration mirroring, albeit perhaps slightly smaller, than the outer sole 5 dorsal surface, with a transient space 15 between that mobile layer 14 plantar surface and the dorsal surface of the outer sole 5. This transient space 15 will progress from a closed to a more opened position as the mobile layer 14 transitions, respectively, from the weight bearing to the non-weight bearing mode of the shoe, which will coincide with those structures, which have their base aspect attached to/originated from the mobile layer 14 plantar surface, moving from an inferior position to a more superior position, and vice versa, as follows: the transient space 15 will transition from an opened to a more closed position as the mobile layer 14 transitions, respectively, from the non-weight bearing to the weight bearing mode of the shoe, which will coincide with those same aforementioned structures of the mobile layer 14 plantar surface moving from a superior position to a more inferior position.

This mobile layer 14, located as is the mid sole 4 of the preferred embodiments, that being between the inner sole 3 and outer sole 5, will serve in much the same capacity as that mid sole 4, in its dispersal of weight and in its providing stability to the foot upon contacting the playing field surface, albeit to a lesser degree of stability than that of the comparatively stationary mid sole 4 of the preferred embodiments due to the inherently less stable design of that mobile layer 14, which is purposely designed for that required functional mobility which serves as that extension biasing mechanism of the alternative embodiments. Therefore, regardless of the degree to which the mobility of that mobile layer 14 may be required and particularly advantageous to these designs of the alternative embodiments, it should and will be clear, for those reasons cited later in this text, that these alternative embodiments are of a lesser self-cleaning and traction ability, and are of a lesser design in terms of a shoe as a whole, than the preferred embodiments, due to those to be explained inherent flaws directly attributable to the mobility of such a mobile layer 14.

The compressible cleaning structures 7 in the alternative embodiments, being to some degree, if not all, located in that described transient space 15, be it with and/or without an accommodatingly shaped concave reservoir 9 in any layer/level described, is that structure which provides the ability for the mobile layer 14, and its attached structures, to reciprocate back and forth, from a superior position, when the compressible cleaning structures 7 in the transient space 15 are expanded during the non-weight bearing mode, to an inferior position, when those compressible cleaning structures 7 in the transient space 15 are compressed during the weight bearing mode. The compressible cleaning structures 7 will be located in that transient space 15 of these embodiments, with their respective protective membrane layer 10 and accommodatingly shaped concave reservoirs 9, if and when present, being fully, partially, and/or not at all surrounding of and adjacent to their respective traction members 6, and their complementary shaped female holes (I) these traction members 6 exit through in their shoe bottom/outer sole 5 plantar surface.

In all the alternative embodiments their complementary shaped female holes (I) will be closed and contained from their transient space 15, regardless if they and their traction members 6 are fully, partially, and/or not at all surrounded by their compressible cleaning structures 7, and when present, their protective membrane layer 10 and/or accommodatingly shaped concave reservoirs 9. In those alternative embodiments with fully surrounding compressible cleaning structures 7 the complementary shaped female holes (I) may be comprised of any and/or all those adjacent structural surfaces/layers including, but not limited to, the outer sole 5, the mobile layer 14, and the compressible cleaning structure 7 itself, and when present, their protective membrane layer 10. In those alternative embodiments in which the compressible cleaning structures 7, and when present, their protective membrane layer 10, only partially and/or do not at all surround their complementary shaped female holes (I), those complementary shaped female holes (I) may be comprised and/or inclusive of a sheath barrier sleeve 16, in addition to those adjacent structural surfaces/layers of the shoe bottom/outer sole 5, mobile layer 14, and any and/or all other adjacent structural surfaces/layers including those only partially surrounding compressible cleaning structures 9, and when present, their protective membrane layer 10, with the sheath barrier sleeve 16 constructed of a durable, flexible, resilient material which lines the complementary shaped female holes (I), able to compress during the weight bearing mode, and expand during the ensuing non-weight bearing mode of the shoe, with it and all those other adjacent structural surfaces/layers which may comprise, in any inclusive combination, these complementary shaped female holes (I) in their entirety, eventually returning to their full height. It is in all designs of the alternative embodiments that all those adjacent structural surfaces/layers which, in any combination, comprise these embodiments respective complementary shaped female holes (I) in their entirety which surround their respective traction members 6, be adhered, secured, fixated, attached, etc., by any suitable means, whereby such complementary shaped female holes (I) are prohibitive of any passage and/or penetration of debris and/or materials through any and all those same comprising surfaces/layers, and thus particularly prohibitive of such to pass and/or penetrate into the transient space 15 of these alternative embodiments. All the comprising structural surfaces/layers of those complementary shaped female holes (I) as described and illustrated in these alternative embodiments are only examples of the conceived combination of all such structures/layers comprising those complementary shaped female holes (I), and in no way limit the conceived comprising combinations of such in any way, with any and all combinations considered and conceived the intellectual property of the present invention.

The complementary shaped female holes (I) in these alternative embodiments, being comprised of those adjacent structural surfaces/layers surrounding their respective traction members 6, by design, are in such close proximity to, and may actually physically contact these traction members 6 they surround, so as to physically remove and/or limit the debris and/or materials adhered/attached to these traction members 6 by the actual physical contact, and/or limiting of space to be occupied between any and/or all of these surrounding adjacent structural surfaces/layers which comprise those complementary shaped female holes (I) in their entirety, thereby cleaning the traction members 6 upon their retraction back into their complementary shaped female holes (I) as the shoe transitions into its non-weight bearing mode, ready and waiting to once again extend and traction the playing field surface upon contact in the ensuing weight bearing mode.

It should be clearly understood by those familiar in the present art, that regardless of the illustrations of the alternative embodiments which follow, the present invention is conceived as to offer any and all types of traction members 6, be they cleats and/or spikes of the permanent and/or removable type, to be transposed upon any and all of the following alternative embodiments, with any and all such resulting embodiments, even with the transposition of their respective traction members 6, still remaining a conceived alternative embodiment and intellectual property of the present invention, regardless if such are not described and/or illustrated.

Figure 176:
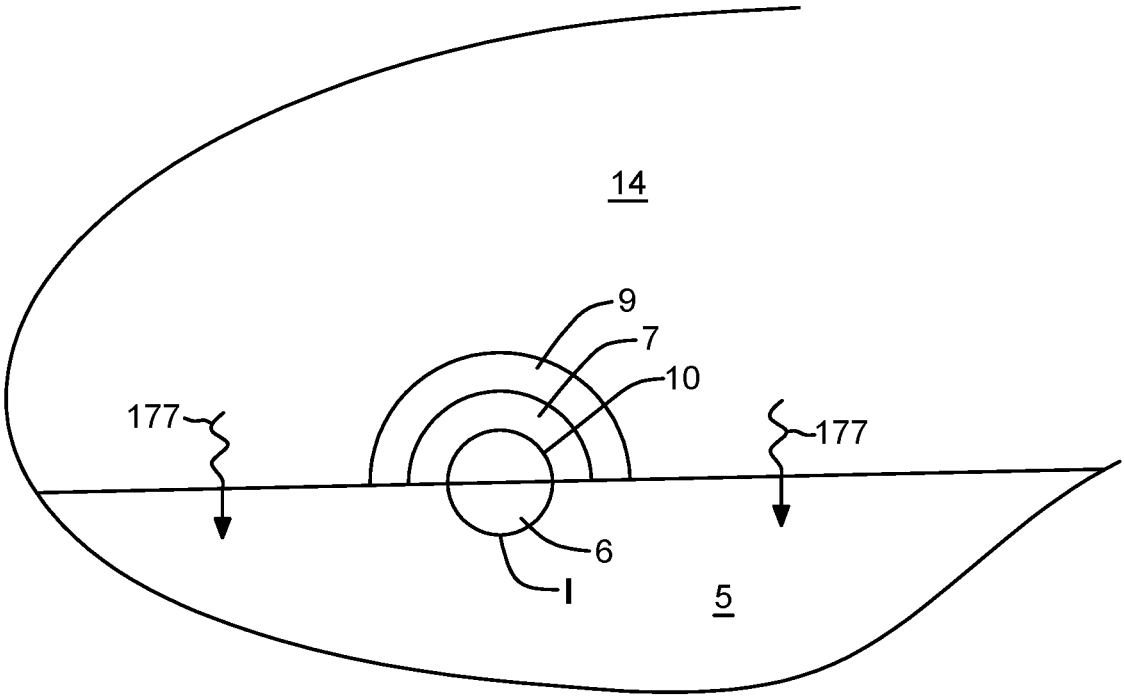
FIG. 176 shows a bottom view of a self-cleaning sport shoe of the first alternative embodiment of the present invention, showing the mobile layer plantar surface which contains the accommodatingly shaped concave reservoir and the compressible cleaning structure occupying and attached to it, which along with its protective membrane surrounds a permanently/integrally attached cleat type traction member, with the inferior structures, including the shoe bottom/outer sole and complementary shaped female hole partially removed.
Figure 177:
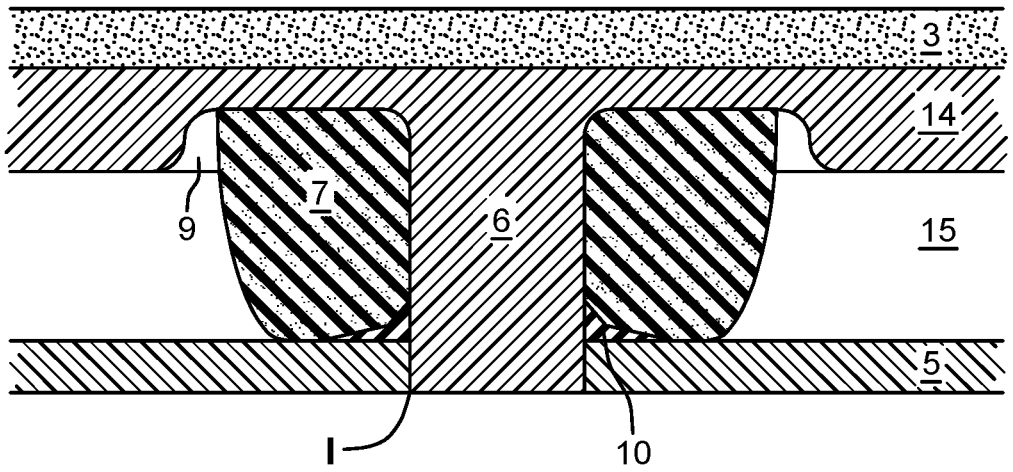
FIG. 177 shows a left to right frontal view in cross-section of FIG. 176 taken along the viewer's view line "177-177" of FIG. 176 in the non-weight bearing mode, with the mobile layer and its permanently/integrally attached cleat type fraction member yet to move inferiorly, the compressible cleaning structure not compressed and transient space open, with the fraction member refracted and yet to emerge from the complementary shaped female hole.
Figure 178:
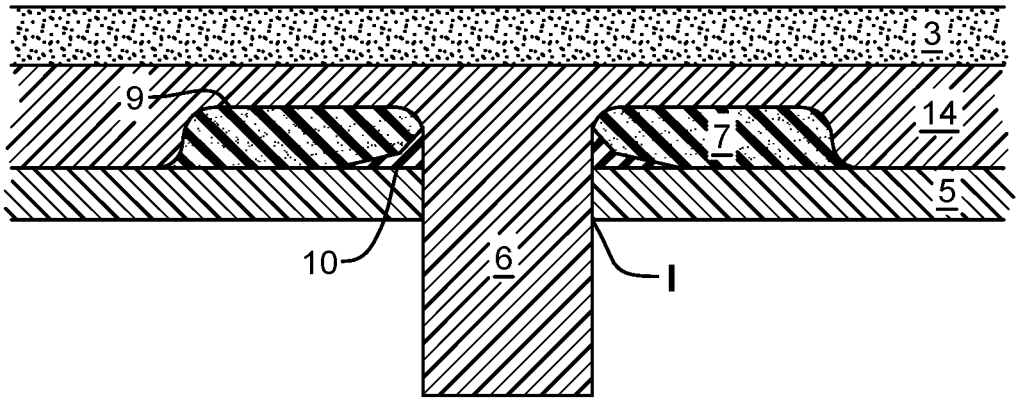
FIG. 178 shows the same view of all shown in FIG. 177 now in the weight bearing mode, with the mobile layer and the respectively attached fraction member moving inferiorly, the compressible cleaning structure fully compressed in the accommodatingly shaped concave reservoir and transient space closed, with the traction member emerged from and fully extended through the complementary shaped female hole.

The first alternative embodiment design of the present invention employs a design in which the concave reservoirs 9 are incorporated into the same mobile layer 14 plantar surface from which their traction members 6 attach to/originate from, and their compressible cleaning structures 7, which surround those traction members 6, are attached to/originated from the same, and/or that outer sole 5 dorsal surface directly below, thereby allowing these compressible cleaning structures 7 to fully flatten within their accommodatingly shaped concave reservoir 9 when such conditions may be enabled, as when in the weight bearing mode, so to allow for the coinciding contact between the mobile layer 14 plantar surface and the outer sole 5 dorsal surface to occur. This first alternative embodiment is illustrated in FIG. 176 and shows a bottom view of the mobile layer 14 plantar surface with the compressible cleaning structure 7 within the accommodatingly shaped concave reservoir 9 in the mobile layer 14 plantar surface, which it attaches to/originates from, surrounding, along with the protective membrane layer 10, a permanently fixated cleat type traction member 6, with all the inferior structures/layers, including the shown shoe bottom/outer sole 5 and complementary shaped female hole (I) in the shoe bottom/outer sole 5, partially removed, and FIG. 177 shows a left to right frontal view in cross-section of FIG. 176 taken along the viewer's view line "177-177" of FIG. 176 of a shoe of this first alternative embodiment in the non-weight bearing mode, at which moment the mobile layer 14 and its attached to/originated from cleat traction members 6 have yet to be enacted upon by that extension biasing mechanism which moves the mobile layer 14 and the proximal aspects of and/or the respectively attached and/or contacting structures themselves inferiorly. Thus, all of those attached male shaped traction members 6 are retracted, with their respectively surrounding compressible cleaning structures 7 non-compressed, and the traction members 6 yet to emerge through their complementary shaped female holes (I) which exit through the fixed outer sole 5 plantar surface, with that transient space 15, which is that space between the mobile layer 14 plantar surface and the opposite and adjacent dorsal surface of the outer sole 5, fully open. FIG. 178 shows the same view of all shown in FIG. 177, now in the weight bearing mode, during which the shoe bottom/outer sole 5 in contacting the playing field surface results in the foot of the wearer driving the inner sole 3, upon which the foot sits, inferiorly, thereby enacting that extension biasing mechanism which translates into that inferior movement of the underlying mobile layer 14, with the resulting extension of those attached male shaped traction members 6 through their complementary shaped female holes (I) exiting the shoe bottom/outer sole plantar surface 5 in order to traction the playing field surface below upon contact, with the traction members 6 respectively surrounding compressible cleaning structures 7 coincidingly compressed and fully flattened within their accommodatingly shaped concave reservoirs 9 located in their mobile layer 14 plantar surface, with the mobile layer 14 plantar surface and outer sole 5 dorsal surface contacting each other, and the transient space 15 fully closed, at which moment the fraction members 6 are fully extended. As the wearer lifts the shoe from the playing field surface and the shoe transitions back to the non-weight bearing mode, that extension biasing mechanism which drove the mobile layer 14 inferiorly, so as to extend and expose its attached traction members 6, is now reduced and ultimately removed, with those previously compressed surrounding compressible cleaning structures 7 within that transient space 15 between the mobile layer 14 plantar surface and fixed outer sole 5 dorsal surface coincidingly expanding, and thus exerting a superiorly directed force upon the mobile layer 14 plantar surface so as to drive it and its attached fraction members 6 superiorly along with it, with those traction members 6 eventually fully refracted and the transient space 15 fully open, as previously shown in FIG. 177, upon full return to the non-weight bearing mode.

Figure 179:
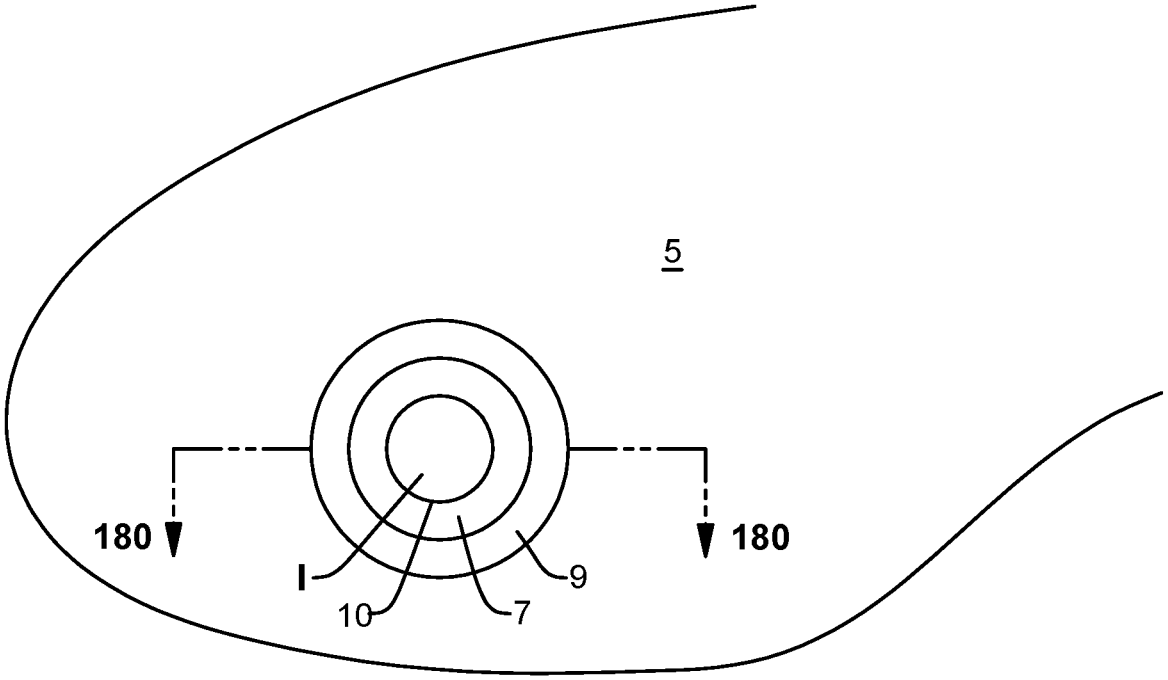
FIG. 179 shows a top plan view of a self-cleaning sport shoe of the second alternative embodiment of the present invention, showing the outer sole dorsal surface which contains the respectively located accommodatingly shaped concave reservoir and the compressible cleaning structure occupying and attached to it, which along with its protective membrane layer surrounds the complementary shaped female hole, with all the superior structures/layers to such removed/not shown.
Figure 180:
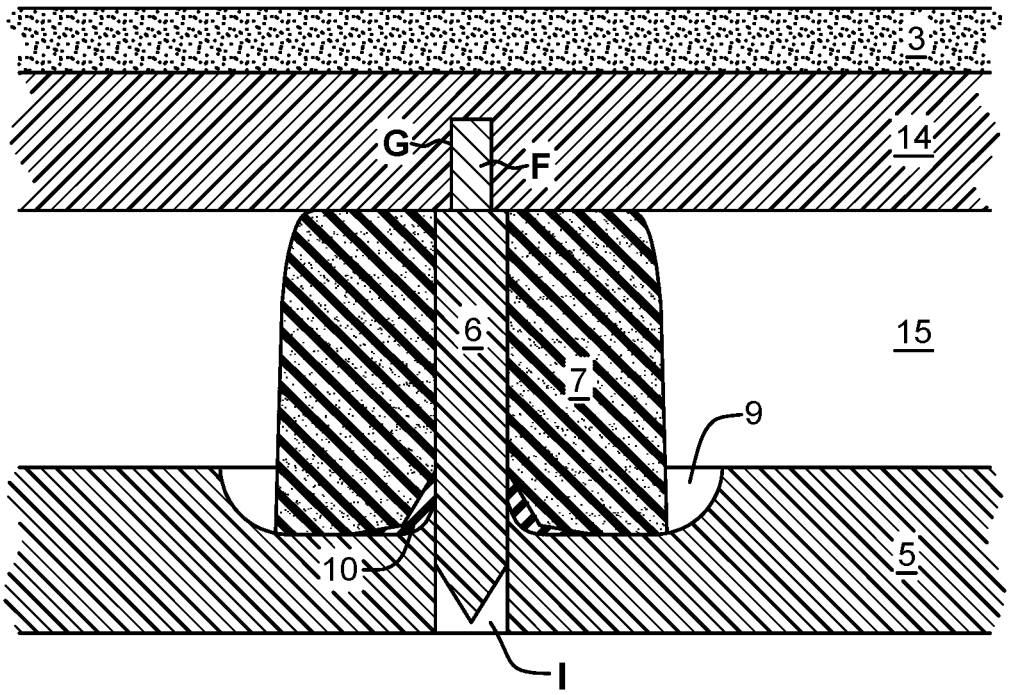
FIG. 180 shows a left to right frontal view in cross-section of all the respective structures in FIG. 179 taken along the viewer's view line "180-180" of FIG. 179 with a removable/temporarily fixated spiked type fraction member and all the superior structures/layers previously removed/not shown now present, in the non-weight bearing mode, with the mobile layer and the respectively attached fraction member yet to move inferiorly, the compressible cleaning structure not compressed and transient space open, with the traction member retracted and yet to emerge from the complementary shaped female hole.
Figure 181:
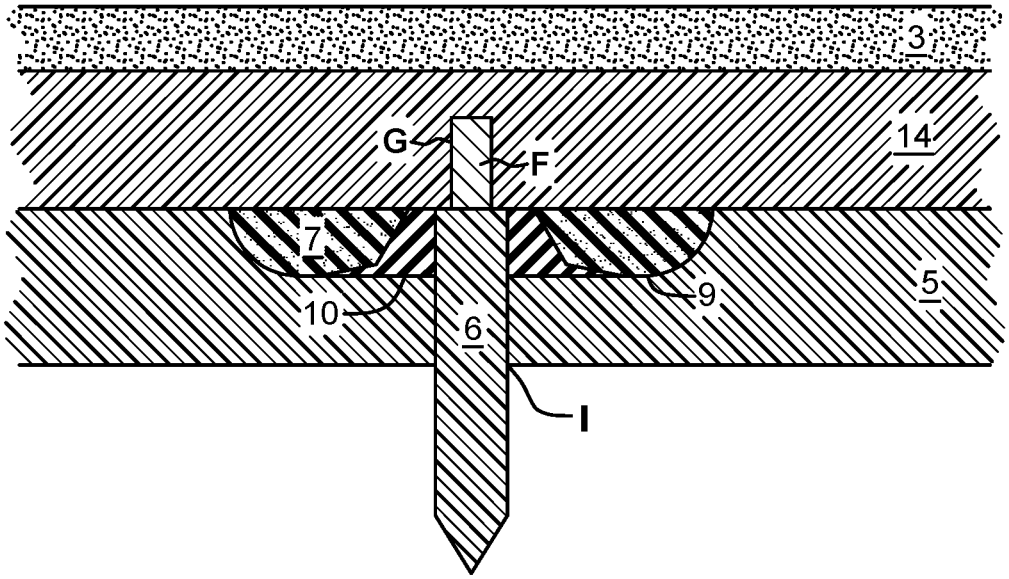
FIG. 181 shows the same view of all shown in FIG. 180 now in the weight bearing mode, with the mobile layer and the respectively attached fraction member moving inferiorly, the compressible cleaning structure fully compressed in the accommodatingly shaped concave reservoir and the transient space closed, with the traction member emerged from and fully extended through the complementary shaped female hole.

The second alternative embodiment design of the present invention employs a design in which the fraction members 6 attach to/originate from their mobile layer 14 plantar surface and their compressible cleaning structures 7, which surround those fraction members 6, are attached to/originated from the mobile layer 14 plantar surface and/or the outer sole 5 dorsal surface directly below, and mated to their accommodatingly shaped concave reservoirs 9 incorporated into that same outer sole 5 dorsal surface. The accommodatingly shaped concave reservoirs 9 will allow for the compressible cleaning structures 7 to fully flatten when such conditions may enable such, as when in the weight bearing mode, so as to allow for the coinciding contact between the mobile layer 14 plantar surface and outer sole 5 dorsal surface to occur. The second alternative embodiment is shown in FIG. 179 from a top plan view of the outer sole 5 dorsal surface with the compressible cleaning structure 7 within the accommodatingly shaped concave reservoir 9 in the same outer sole 5 dorsal surface, which it attaches/originates from, surrounding, along with its protective membrane layer 10, the complementary shaped female hole (I), with all the superior structures/layers to such removed/not shown, and FIG. 180 shows a left to right frontal view in cross-section of all the respective structures shown in FIG. 179 taken along the viewer's view line "180-180" of FIG. 179 with a spiked traction member 6 of the removable/temporarily fixated type and all the superior structures/layers previously removed/not shown now restored and present, in the non-weight bearing mode, at which time the mobile layer 14 and its attached to/originated from spiked traction members 6 have yet to be enacted upon by that extension biasing mechanism which moves the mobile layer 14 and the respectively attached and/or contacting structures themselves inferiorly. Thus, all of those attached male shaped traction members 6 are retracted, with their respectively surrounding compressible cleaning structures 7 non-compressed, and the traction members 6 yet to emerge through their complementary shaped female holes (I) which exit through the fixed shoe bottom/outer sole 5 plantar surface, with that transient space 15, which is that space between the mobile layer 14 plantar surface and the opposite and adjacent dorsal surface of the outer sole 5, fully open. FIG. 181 shows the same view of all shown in FIG. 180, now in the weight bearing mode, during which the shoe bottom/outer sole 5 in contacting the playing field surface results in the foot of the wearer driving the inner sole 3, upon which the foot sits, inferiorly, thereby enacting that extension biasing mechanism which translates into the inferior movement of the underlying mobile layer 14, with the resulting extension of those attached male shaped traction members 6 through their complementary shaped female holes (I) exiting the shoe bottom/outer sole 5 plantar surface in order to traction the playing field surface below upon contact, with those traction members 6 respectively surrounding compressible cleaning structures 7 coincidingly fully compressed and flattened within their accommodatingly shaped concave reservoirs 9, as depicted in this such instance, with the mobile layer 14 plantar surface and outer sole 5 dorsal surface contacting each other and the transient space 15 fully closed, at which moment the traction members 6 are fully extended. As the wearer lifts the shoe from the playing field surface and the shoe transitions back to the non-weight bearing mode, that extension biasing mechanism which drove the mobile layer 14 inferiorly, so as to extend and expose its attached traction members 6, is now reduced and ultimately removed, with those previously compressed surrounding compressible cleaning structures 7 within that transient space 15 between the mobile layer 14 plantar surface and fixed outer sole 5 dorsal surface coincidingly expanding, and thus exerting a superiorly directed force exerted upon the mobile layer 14 plantar surface so as to drive it and its attached traction members 6 superiorly, with those traction members 6 eventually fully retracted and the transient space 15 fully open, as previously shown in FIG. 180, upon full return to the non-weight bearing mode.

Figure 182:
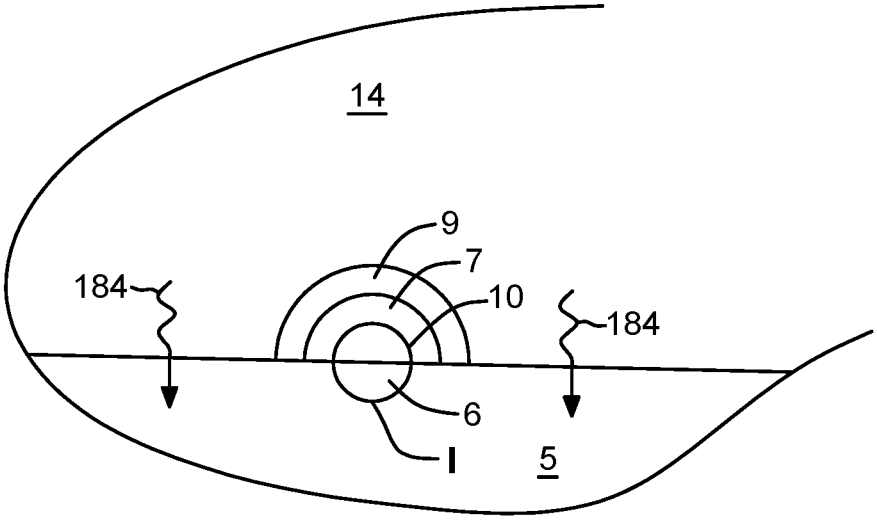
FIG. 182 shows a bottom view of a self-cleaning sport shoe of the third alternative embodiment of the present invention, with its mobile layer plantar surface and the respectively located accommodatingly shaped concave reservoir and the compressible cleaning structure occupying and attached to it, which along with its protective membrane layer surrounds the permanently/integrally attached cleat type fraction member, with all the inferior structures/layers, including the shoe bottom/outer sole and the complementary shaped female hole, partially removed.
Figure 183:
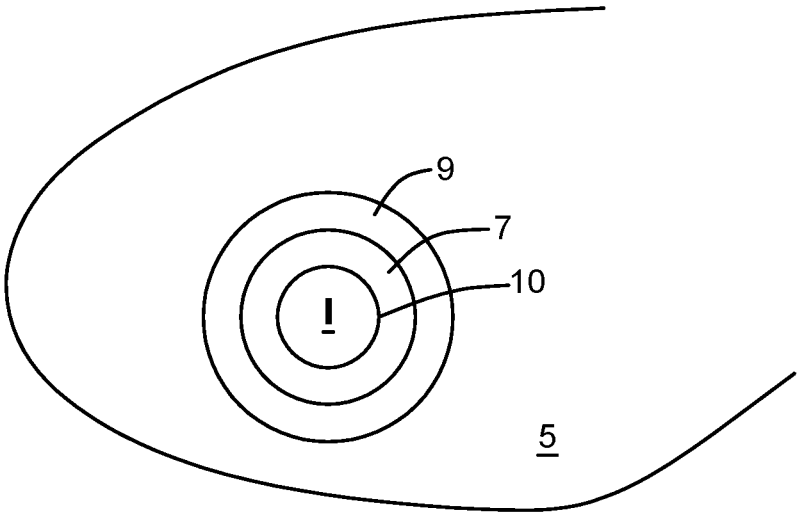
FIG. 183 shows a top plan view of the third alternative embodiment, with the outer sole dorsal surface and its respectively located accommodatingly shaped concave reservoir occupied by that one and the same compressible cleaning structure and protective membrane layer illustrated in FIG. 182, surrounding the complementary shaped female hole, with all the superior structures/layers to such not shown, and it to be understood that there is only one compressible cleaning structure that simultaneously occupies both the accommodatingly shaped concave reservoir shown in the mobile layer plantar surface in FIG. 182 and the accommodatingly shaped concave reservoir in the shoe bottom/outer sole dorsal surface shown in this FIG.
Figure 184:
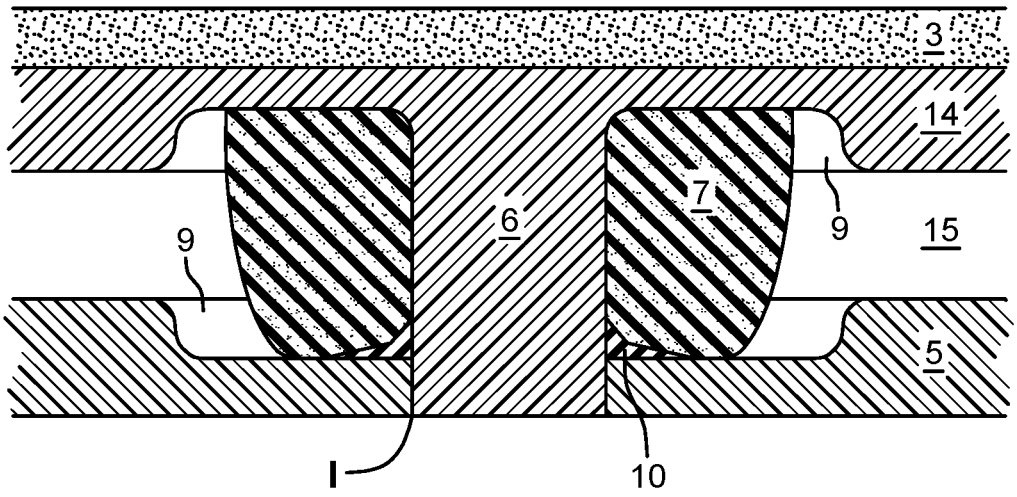
FIG. 184 shows a left to right frontal view in cross-section of FIG. 182 taken along the viewer's view line "184-184" of FIG. 182 in the non-weight bearing mode, with the mobile layer and its permanently/integrally attached cleat type traction member yet to move inferiorly, the compressible cleaning structure not compressed and transient space open, with the traction member retracted and yet to emerge from the complementary shaped female hole.
Figure 185:
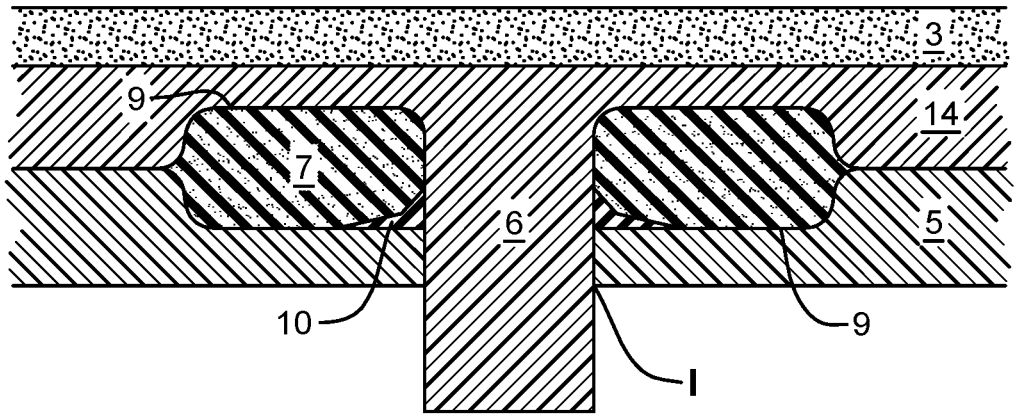
FIG. 185 shows the same view of all shown in FIG. 184 now in the weight bearing mode, with the mobile layer and the respectively attached traction member moving inferiorly, the compressible cleaning structure fully compressed in the accommodatingly shaped concave reservoirs in the mobile layer plantar surface and the outer sole dorsal surface, simultaneously, and the transient space closed, with the traction member emerged from and fully extended through the complementary shaped female hole.

A third alternative embodiment design of the present invention is offered which employs a design in which the traction members 6 attach to/originate from the mobile layer 14 plantar surface and their surrounding compressible cleaning structures 7 are attached to/originate from the mobile layer 14 plantar and/or the opposite adjacent outer sole 5 dorsal surface, within their respectively accommodatingly shaped concave reservoirs 9 incorporated into both the mobile layer 14 plantar surface above and the adjacent outer sole 5 dorsal surface below, for the one and the same compressible cleaning structure 7, thereby allowing these compressible cleaning structures 7 to fully flatten within their accommodatingly shaped concave reservoirs 9 when such conditions may enable such, as when in the weight bearing mode, as to allow for the coinciding contact between the mobile layer 14 plantar surface and the outer sole 5 dorsal surface to occur. FIG. 182 illustrates a bottom view of the mobile layer 14 plantar surface of this particular design and its accommodatingly shaped concave reservoir 9 occupied by the compressible cleaning structure 7 surrounding, along with the protective membrane layer 10, the permanently fixated/integrally attached cleat type traction member 6, with all the inferior structures/layers, including the shown shoe bottom/outer sole 5 and complementary shaped female hole (I) in the shoe bottom/outer sole 5, partially removed, and FIG. 183 shows a top plan view of the outer sole 5 dorsal surface of this particular design and its accommodatingly shaped concave reservoir 9 occupied by the compressible cleaning structure 7 surrounding, along with the protective membrane layer 10, the complementary shaped female hole (I), with all the superior structures/layers to such removed and not shown. The compressible cleaning structure 7 shown accommodated for and occupying the concave reservoir 9 in FIG. 182 and FIG. 183 is that one and the same compressible cleaning structure 7, and representative of that one compressible cleaning structure 7 occupying both the concave reservoirs 9, as shown in those respective figures, located in the mobile layer 14 plantar surface and the outer sole 5 dorsal surface, simultaneously. FIG. 184 shows a left to right frontal view in cross-section of FIG. 182 taken along the viewer's view line "184-184" of FIG. 182 of this embodiment in the non-weight bearing mode, with a cleat traction member 6 of the permanently fixated/integrally attached type, at which moment the mobile layer 14 and its attached/originating cleat type traction members 6 have yet to be enacted upon by that extension biasing mechanism which moves the mobile layer 14 and the respectively attached and/or contacting structures themselves inferiorly. Thus, all of those attached male shaped fraction members 6 are retracted, with their respectively surrounding compressible cleaning structures 7 non-compressed, and the fraction members 6 yet to emerge through their complementary shaped female holes (I) which exit through the fixed shoe bottom/outer sole 5 plantar surface, with that transient space 15, which is that space between the mobile layer 14 plantar surface and the opposite and adjacent dorsal surface of the shoe bottom/outer sole 5, fully open. FIG. 185 shows the same view of all shown in FIG. 184, now in the weight bearing mode, during which the shoe bottom/outer sole 5 in contacting the playing field surface results in the foot of the wearer driving the inner sole 3, upon which the foot sits, inferiorly, thereby enacting that extension biasing mechanism which translates into the inferior movement of the underlying mobile layer 14, with the resulting extension of those attached male shaped traction members 6 through their complementary shaped female holes (I) exiting the shoe bottom/outer sole 5 plantar surface in order to fraction the playing field surface below upon contact, with those fraction members 6 respectively surrounding compressible cleaning structures 7 coincidingly fully compressed and flattened within their accommodatingly shaped concave reservoirs 9, as depicted in this such instance, with the mobile layer 14 plantar surface and outer sole 5 dorsal surface contacting each other and the transient space 15 fully closed, at which moment the fraction members 6 are fully extended. As the wearer lifts the shoe from the playing field surface and the shoe transitions back to the non-weight bearing mode, that extension biasing mechanism which drove the mobile layer 14 inferiorly, so as to extend and expose its attached fraction members 6, is now reduced and ultimately removed, with the previously compressed surrounding compressible cleaning structures 7 within that transient space 15 between the mobile layer 14 plantar surface and fixed outer sole 5 dorsal surface coincidingly expanding, and thus exerting a superiorly directed force upon the mobile layer 14 plantar surface so as to drive it and its attached fraction members 6 superiorly, with those traction members 6 eventually fully retracted and the transient space 15 fully open, as previously illustrated in FIG. 184, upon full return to the non-weight bearing mode.

Figure 186:
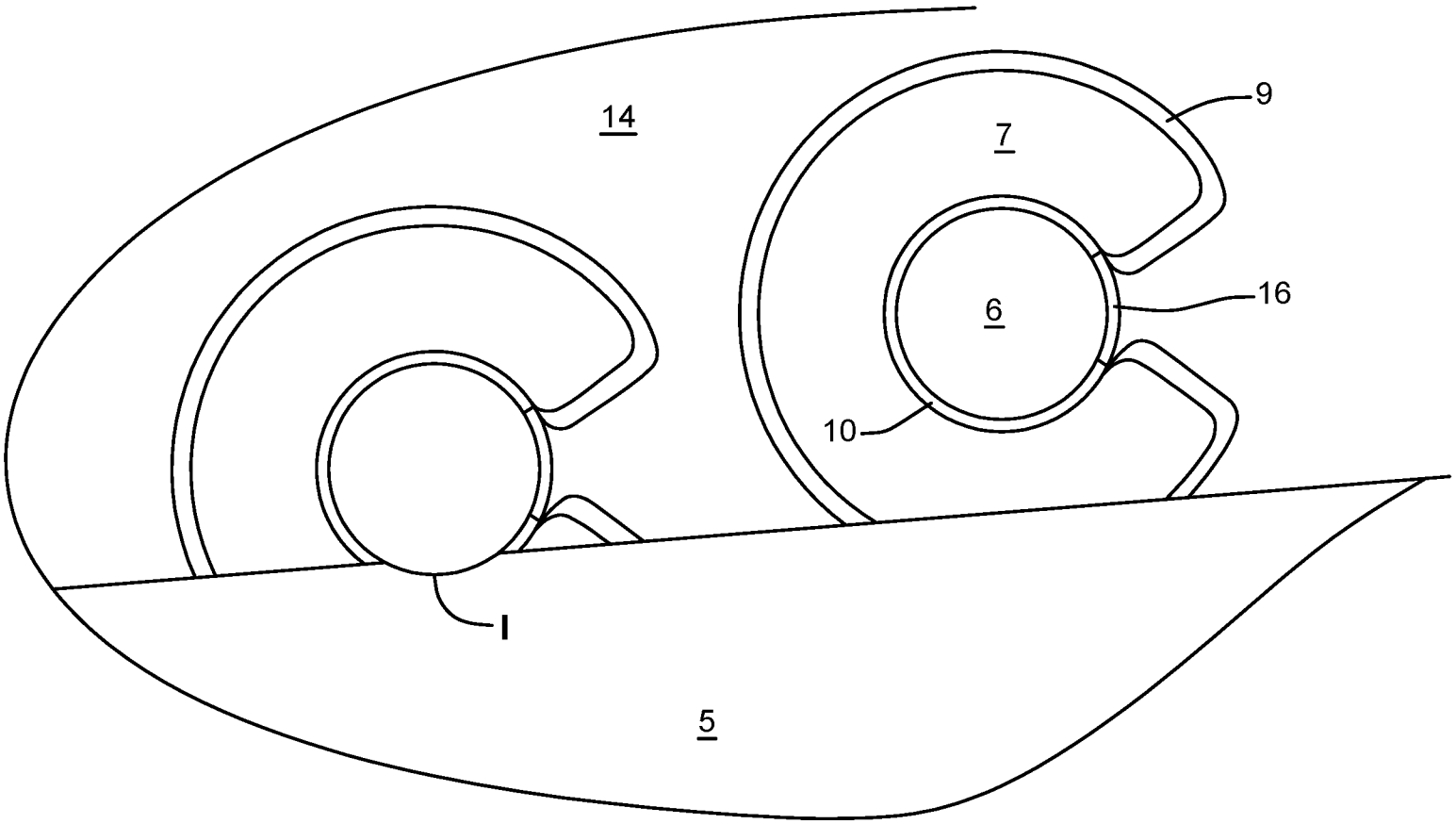
FIG. 186 shows a bottom view, with the shoe bottom/outer sole partially removed, of a shoe incorporating a compressible cleaning structure of a shape/configuration partially surrounding of the complementary shaped female hole, lined by both a protective membrane layer and a sheath barrier sleeve.
Figure 187:
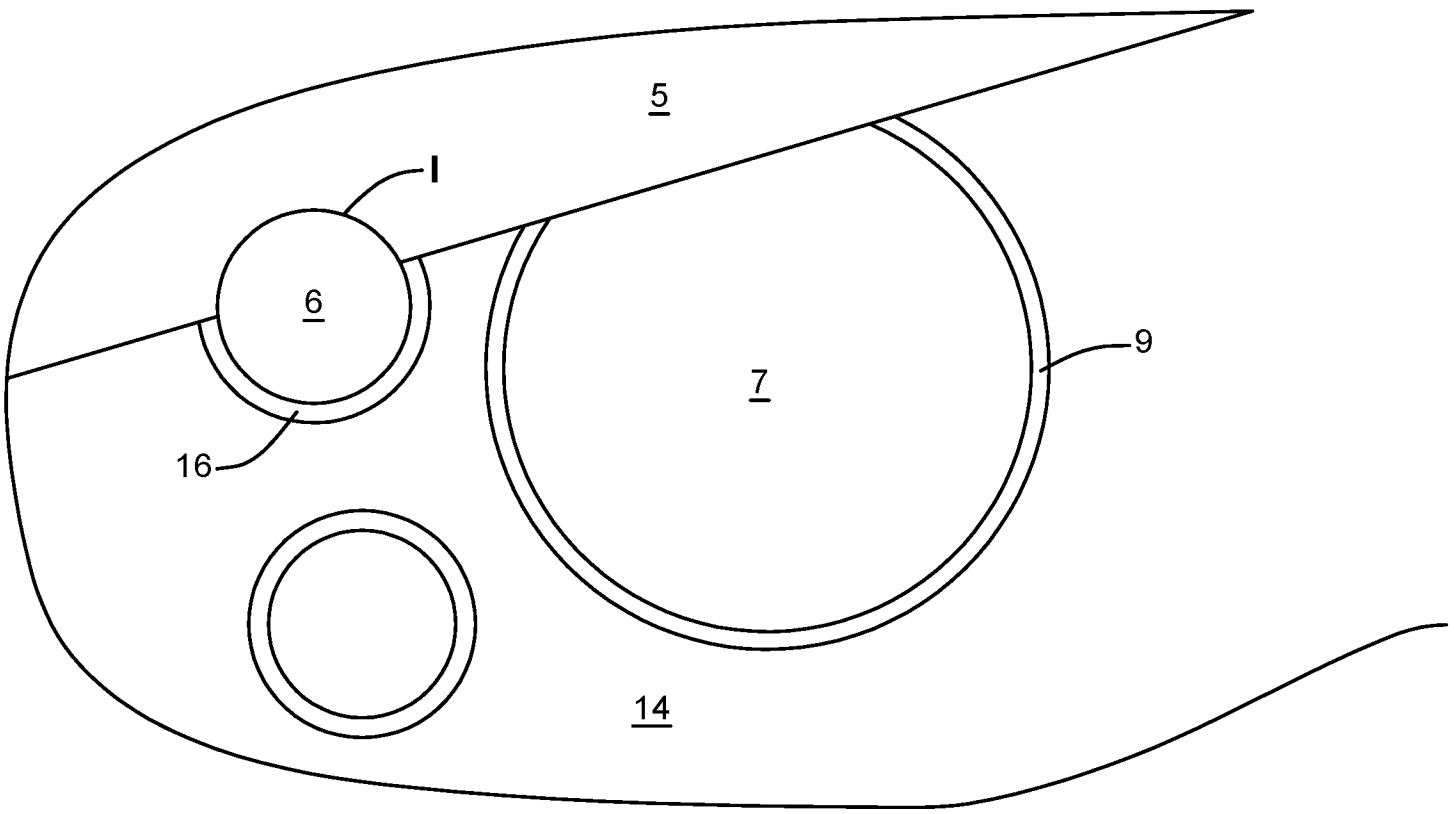
FIG. 187 shows a bottom view, with the shoe bottom/outer sole partially removed, of a shoe incorporating a compressible cleaning structure not at all surrounding of the complementary shaped female holes, which are lined only by the sheath barrier sleeve.

It should be easily understood that the alternative embodiments and the previous descriptions of their transitions back and forth, to and from their weight bearing and non-weight bearing modes, with their compressible cleaning structures 7 fully surrounding their traction members 6, would be applicable and the same in those alternative embodiment designs in which their compressible cleaning structures 7 may be of any shape/configuration, and partially and/or not at all surrounding their traction members 6 which, as in the previously described alternative embodiments, attach to/originate from their mobile layer 14 and exit their complementary shaped female holes (I) through their shoe bottom/outer sole 5 plantar surface. These latter alternative embodiment designs incorporating compressible cleaning structures 7 partially and/or not at all surrounding of their respective traction members 6 would be similar in all ways to the previous alternative embodiment designs which incorporate their respectively described and/or illustrated fully surrounding compressible cleaning structures 7, except that these latter alternative embodiment designs incorporating their compressible cleaning structures 7 of any shape/configuration, which are partially and/or not at all surrounding of their traction members 6, would be of designs inclusive of a sheath barrier sleeve 16 which may line their complementary shaped female holes (I), to some degree, in addition to their partially surrounding compressible cleaning structures 7 and/or protective membrane layer 10, and/or fully line their complementary shaped female holes (I) in those designs which incorporate not at all surrounding compressible cleaning structures 7, which is in contrast to those alternative embodiment designs incorporating fully surrounding compressible cleaning structures 7, as previously described and illustrated, in which their respectively surrounded complementary shaped female holes (I) would be lined by those compressible cleaning structures 7 and/or the protective membrane layer 10, rather than the sheath barrier sleeve 16. FIG. 186 shows a bottom view with the shoe bottom/outer sole 5 partially removed of a shoe incorporating a compressible cleaning structure 7 of a shape/configuration partially surrounding of the complementary shaped female holes (I), lined by both the protective membrane layer 10 and the sheath barrier sleeve 16, and FIG. 187 shows a bottom view with the shoe bottom/outer sole 5 partially removed of a shoe incorporating a compressible cleaning structure 7 not at all surrounding of the complementary shaped female holes (I), lined only by the sheath barrier sleeve 16, with any and all these compressible cleaning structures 7 applicable and easily transposed to any and all alternative embodiment designs of the present invention, along with these designs respective locations of their concave reservoirs 9, with the necessary alterations/modifications made to accommodate for such when need be.

It should be understood that the alternative embodiments have all been conceived with all the structural designs as described, and that the conception of such designs does not differ regardless of the means by which and/or to which structure, if any at all, their compressible cleaning structures 7 may be attached to/originated from/secured to. Therefore, the compressible cleaning structures 7 in any and/or all of the previous alternative embodiments may and/or may not be attached/secured/fixated/originated from temporarily and/or permanently by any suitable means, including, but not limited to, molding, adhesive, stitching, VELCRO® (V), etc., to any and/or all those adjacent surfaces, including the mobile layer 14 plantar surface, outer sole 5 dorsal surface, sheath barrier sleeve 16, and/or any other surface(s) of those structures, and/or other structural surfaces, as seen fit, whereby the location of the compressible cleaning structures 7 is ensured so they will be able to carry out their intended function, and regardless of the means by which and to which surfaces chosen to attach/secure/fixate the compressible cleaning structures 7 to, any and all resulting embodiments are those conceived as and intellectual property of the present invention and inclusive of those of its alternative embodiments.

Figure 188:
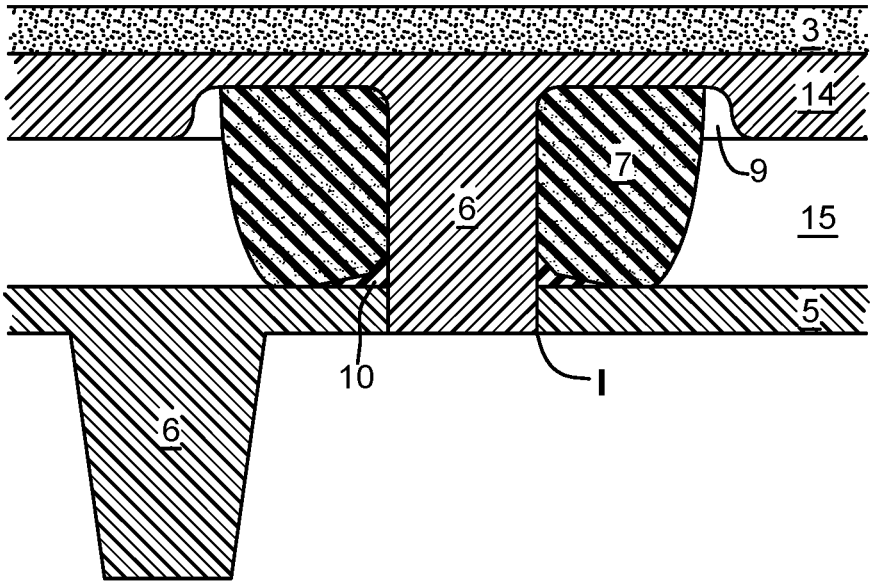
FIG. 188 shows the first alternative embodiment from the same view as shown in FIG. 177, with a cleat type traction member permanently/integrally attached to the shoe bottom/outer sole plantar surface.
Figure 189:
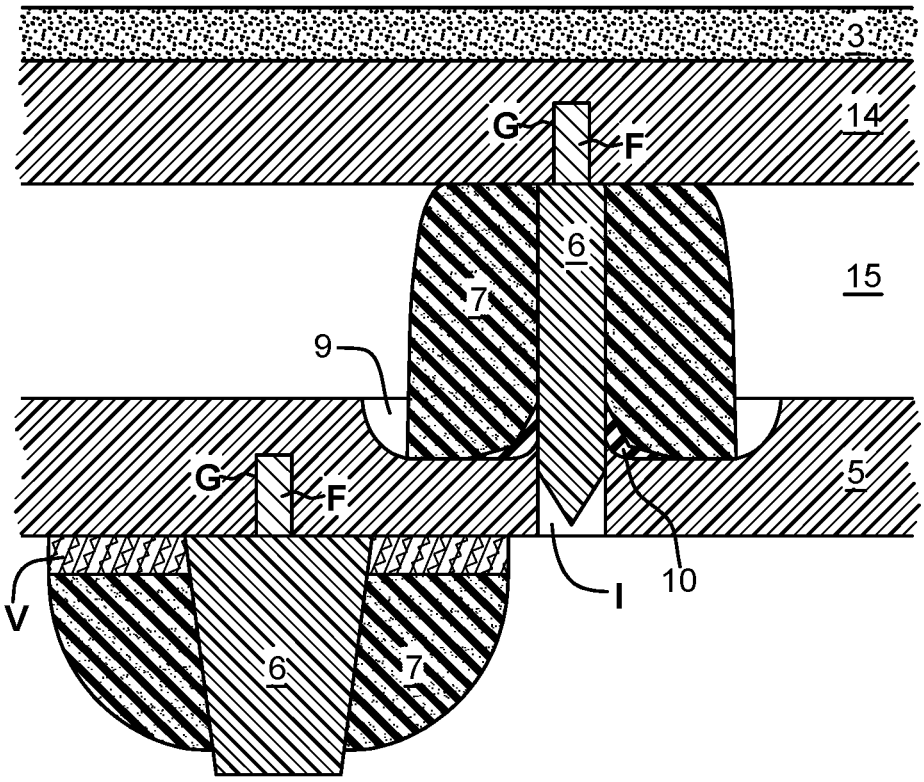
FIG. 189 shows the second alternative embodiment from the same view as shown in FIG. 180, with a removable/temporarily attached cleat type traction member fixated via the tightening of its threaded longitudinal stud in the complementary threaded boss in the shoe bottom/outer sole plantar surface, surrounded by a removable/temporarily fixated compressible cleaning structure secured/fixated to the shoe bottom/outer plantar surface via VELCRO®.
Figure 190:
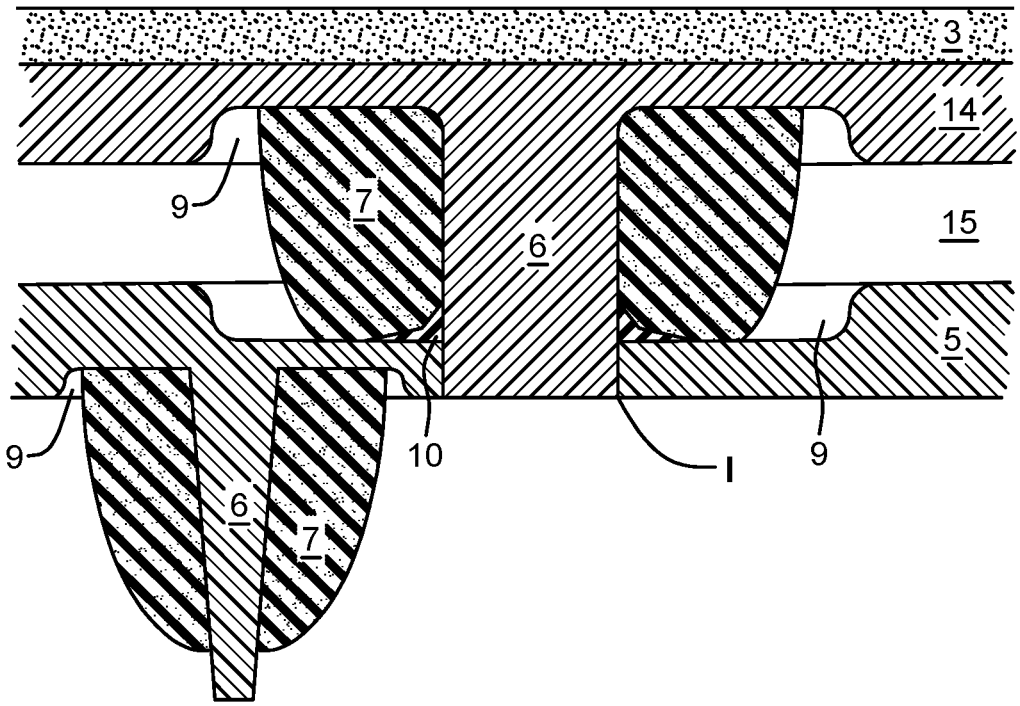
FIG. 190 shows the third alternative embodiment from the same view as shown in FIG. 184, with a spike type traction member permanently/integrally attached to the shoe bottom/outer sole plantar surface, surrounded by a compressible cleaning structure permanently/integrally attached to its accommodatingly shaped concave reservoir in the shoe bottom/outer sole plantar surface.

Considered and conceived in all the alternative embodiments of the present invention is the incorporation of additional traction members 6 of any and/or all types, be they spikes, cleats, etc., of the permanently fixated/integrally attached and/or removable/temporarily fixated type, which attach to/originate from the shoe bottom/outer sole 5 plantar surface, surrounded by compressible cleaning structures 7, if and when such are incorporated to accompany these traction members 6, which attach to/originate from their shoe bottom/outer sole 5 plantar surface as well, temporarily and/or permanently, by any suitable means, and may be mated to their accommodatingly shaped concave reservoirs 9, if and when present, in these alternative embodiments shoe bottom/outer sole 5 plantar surfaces. It should be understood and appreciated by those who have already familiarized themselves with the preferred embodiments of the present invention and all the conceived functions and abilities of their respective structures, particularly those of their traction members 6 which attach to/originate from the plantar surface of their shoe bottom/outer sole 5, their surrounding compressible cleaning structures 7 and concave reservoirs 9, if and when present, that when such like and/or similar structures are incorporated in these alternative embodiments as described in the preferred embodiments, these structures functions and abilities in these alternative embodiments are the same as those structures in the preferred embodiments, whose descriptions of such structures, particularly those traction members 6 which attach to/originate from the plantar surface of their shoe bottom/outer sole 5, their surrounding compressible cleaning structures 7 and concave reservoirs 9, if and when present, are similarly applicable, and more or less the same, when present in these alternative embodiments. Thus, it should be simple and clear how any and all these structures, if and when chosen, may be transposed upon and incorporated into any and all these alternative embodiments for the same reasons of improved function and performance as in the preferred embodiments, if and when seen fit. FIG. 188 shows the first alternative embodiment shown in FIG. 177 from the same view, now with a cleat type traction member 6 of the permanently fixated/integrally attached type originated from the shoe bottom/outer sole 5 plantar surface. FIG. 189 shows the second alternative embodiment shown in FIG. 180 from the same view, now with a removable/temporarily fixated cleat type traction member 6 fixated to the shoe bottom/outer sole 5 plantar surface via the tightening of its threaded longitudinal stud (F) into the complementary threaded boss (G) in the shoe bottom/outer sole 5, which is surrounded by a removable/temporarily fixated compressible cleaning structure 7 secured/fixated to the outer sole 5 plantar surface via VELCRO® (V). FIG. 190 shows the third alternative embodiment shown in FIG. 184 from the same view, now with a permanently fixated/integrally attached spike type traction member 6 attached to/originated from the shoe bottom/outer sole 5 plantar surface, surrounded by a compressible cleaning structure 7 permanently fixated/integrally attached to its accommodatingly shaped concave reservoir 9 in the shoe bottom/outer sole 5 plantar surface as well. As illustrated, those incorporations of the additional traction members 6 in these alternative embodiment designs which attach to/originate from their shoe bottom/outer sole 5 plantar surface, and when present and incorporated, both these traction members 6 surrounding compressible cleaning structures 7, be they with or without a protective membrane layer 10, which attach to/originate from their outer soles 5 plantar surface as well, and those accommodatingly shaped concave reservoirs 9 located in the plantar surface of their shoe bottom/outer sole 5 in which the compressible cleaning structures 7 are fitted, are representative of such incorporations to any and all shoe bottom/outer sole 5 in all the alternative embodiment designs of the present invention, with the incorporations applicable, when suitably chosen, to any and/or all the alternative embodiment designs, and in no way limited by these illustrations.

Figure 191:
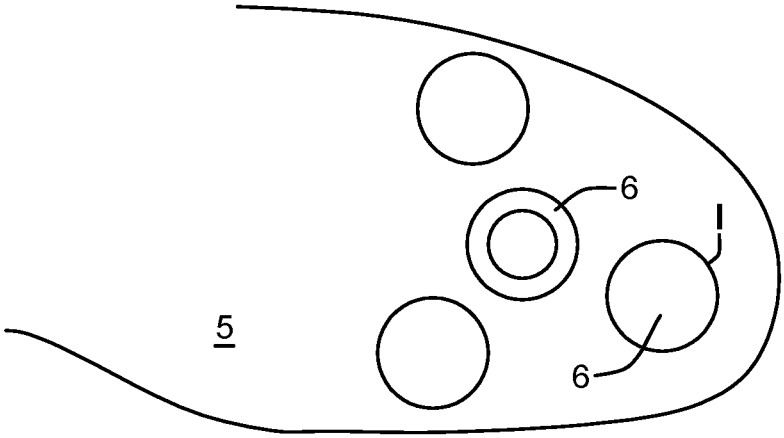
FIGS. 191 and 192 show a bottom and side view, respectively, of an alternative embodiment design with a cleat type traction member permanently/integrally attached to the shoe bottom/outer sole plantar surface, surrounded by male shaped cleat type traction members attached to/originated from the mobile layer plantar surface which emerge through the complementary shaped female holes in the shoe bottom/outer sole during the weight bearing mode, as shown, and are oriented in such close proximity to the respective traction member they surround, so to physically clean/remove any debris from it as they fully extend during the weight bearing mode.
Figure 192:
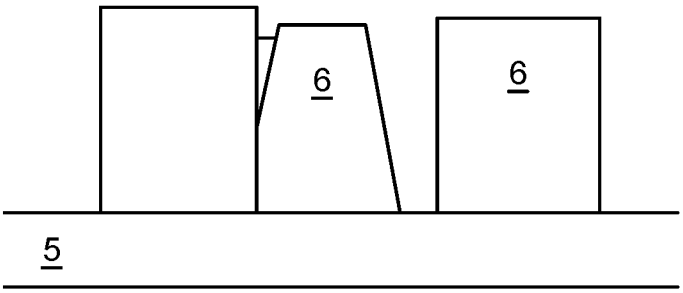

In some instances, these alternative embodiment designs will have those additional traction members 6 attached to/originated from their shoe bottom/outer sole 5 plantar surface incorporated, as shown in FIG. 191 from a bottom view and FIG. 192 from a side view, with a cleat type traction member 6 permanently/integrally attached to the shoe bottom/outer sole 5 plantar surface surrounded by male shaped cleat type traction members 6 attached to/originated from the mobile layer 14 plantar surface, which during the weight bearing mode, as shown, emerge through the complementary shaped female holes (I) in the shoe bottom/outer sole 5 so to extend distally and contact the playing field surface, with it conceived so as to have these additional traction members 6 attached to/originating from the shoe bottom/outer sole 5 plantar surface be oriented in such close proximity to those male shaped traction members 6 of these alternative embodiments which attach to/originate from their mobile layers 14, and the complementary shaped female holes (I) through which these male shaped traction members 6 extend to exit the shoe bottom/outer sole 5 plantar surface and contact the playing field surface in the transition from the non-weight bearing mode to the weight bearing mode, that these extended traction members 6 will serve to physically clean/remove debris and/or materials from those traction members 6 attached to/originated from the shoe bottom/outer sole 5 plantar surface which they surround, regardless of the shape/configuration and/or location of those compressible cleaning structures 7 in the transient space 15 of these alternative embodiments.

Just as in the preferred embodiments, it is conceived and intended that all those described traction members 6 and compressible cleaning structures 7 of the alternative embodiments which are of the temporary type, and/or in those instances in which one of these structures is permanent and the other temporary, those temporary types may be made available to the wearer of such shoes of these alternative embodiments as aftermarket items, so they may, if and when the wearer sees fit, install, remove, repair, replace, etc., these traction members 6 and/or compressible cleaning structures 7, with each being made available, as in the preferred embodiments, separately and/or together, and/or in the applicable "complete set" off-the-shelf item, as a two paired structure set consisting of a traction member 6 and its removable complementary shaped compressible cleaning structure 7, or in a combined form of a readily available single structure which provides the combined abilities of both the removable traction member 6 and the compressible cleaning structure 7. All of these available aftermarket traction members 6 and compressible cleaning structures 7 of the temporary type would be available to the wearer/purchaser in the form just as already described and illustrated for these alternative embodiments, with those illustrations and descriptions of those "complete set" aftermarket items in the preferred embodiments of the present invention to be referenced to and considered, when applicable, to be "complete set" aftermarket items, as a whole, for the alternative embodiments as well.

While many designs of the alternative embodiments are conceived and offered in the present invention, it is the contention of the present invention, for the following reasons and explanations offered as rationale, that any and all of those alternative embodiments are lesser embodiments and of lesser ability than the preferred embodiments of the present invention.

The methodology by which the alternative embodiments extension biasing mechanism is enacted upon their described mobile layers 14 and its attached to/originated from structures, so as to extend and/or lengthen those said structures, is inherently flawed in that it allows for inconsistent movement of varying degrees due to several dependent factors and is therefore a lesser methodology than that extension biasing mechanism of the preferred embodiments. For one, the resulting movement of the mobile layer 14 and all its related structures are directly dependent upon that force exerted upon the mobile layer 14 from which these structures originate from/attach to by the foot of the wearer on the inner sole 3 of the shoe when contacting the playing field surface. Therefore, varying degrees of force will result in varying degrees of movement of those structures, with them being extended to a varying length at various times. Such flawed consequences are particular to traction members 6 being of a varying length. In contrast, fraction members 6 of the preferred embodiments have a distinct advantage over those traction members 6 of the dependent varying length type, in their provision of a fraction member 6 always of a guaranteed constant length, which as explained earlier should be recognized and understood to be a qualified advantage over those fraction members 6 of a varying length, because at no time, under any circumstances, would one equate a shorter length fraction member 6 being a better length for itself, or better relative to the length of any other fraction member 6 in terms of its fraction ability.

Further flaws exist in these alternative embodiments possessing a mobile layer 14 and its associated structures operating under the described conditions in that their degree of movement not only depends on the softness and/or hardness of the playing field surface, but the presence of any debris or materials which the attached and/or extending structures may physically encounter between themselves and that same playing field surface. Firstly, in instances where softness and/or hardness of the playing field surface differs under one or more fraction members 6 of the same one shoe at the same moment of ground contact, those respective fraction members 6 may extend lesser or more at that same moment. Secondly, the same results exist when one fraction member's 6 ability to contact the playing field surface is physically impaired by its encountering of any debris or materials between itself and its path to the ground and any other fraction member 6 of that same shoe at that same moment is more or less physically impaired by its own debris or materials which it encounters, with each of these respective traction members 6 more or less extended at that same moment relative to one another.

As in the previously described moments in which those structures are more or less extended relative to one another, one should recognize that further fault in such design lies in the directly correlated like movement of the mobile layer 14 from which these extending structures originate and/or attach. It is firstly paramount to understand that any such movement of the mobile layer 14 results in a continuously repeated change in volume of the space surrounding the foot of the wearer contained in the chamber which encloses the foot, with such chamber volume increasing in the weight bearing and decreasing in the non-weight bearing modes, respectively. Such is contrary, as explained earlier in the text, to the advantages of a relatively constant volume as in the preferred embodiments. As alluded to earlier, these continuous changes of increasing and decreasing volume increase the potential of the foot to shift in its surrounding chamber during play, thus increasing potential friction, abrasion, and associated discomfort between the foot and surrounding chamber surface. In addition, it could potentially lead to uneven wear of those involved shoe surfaces and the shoe as a whole, with further potential for foot and/or bodily injuries to occur secondary to such shifting of the foot which would be highly prevalent with those accompanying changes in volume.

Another important aspect distinguishing the alternative embodiments inferior designs is their lesser ability than that of the preferred embodiments to evenly disperse and distribute that force impacting the foot of the wearer upon the shoe contacting the playing field surface. In these alternative embodiments, with any or even all of its mobile layers 14 described attached structures extending and contacting the playing field surface, that acting extension bias force which propels the mobile layer 14 and its attached structures downward upon contacting the playing field surface is met with an equal and opposite upward force, commonly termed the ground reaction force, applied to each of those respective structures and ultimately their attached mobile layer 14 upon contacting the playing field surface. Thus, it should be clear from prior explanation that regardless of the underlying cause of any length discrepancies in each of the alternative embodiments traction members 6 and/or other structures attached to the mobile layer 14 relative to said selves, and/or each other in the same shoe, that the movement of the mobile layer 14 itself from which those structures originate from and/or attach to is identical in mimicking any and all discrepancies in movement of those structures. Therefore, it is simple to understand that any movement of the mobile layer 14 has the always present potential to be uneven with discrepancies throughout that mobile layer 14. Along with such uneven movement of the mobile layer 14 lies its accompanying failure to uniformly distribute and disperse those applied ground reaction forces across itself upon the shoe contacting the playing field surface, ultimately subjecting the bottom of the wearer's foot unevenly to points of excessive impact, pressure, discomfort, and risks of injury, all of which is avoided in the preferred embodiments. The preferred embodiments, whose absence of a mobile layer 14 and its aforementioned movement discrepancies, coupled with a relatively stationary inner sole 3, mid sole 4, outer sole 5, and all of its attached structures, including the compressible cleaning structures 7, which serve to dampen and absorb those ground reaction forces exerted upon the wearer's foot, as well as the voids in space 44 when incorporated, inherently make the preferred embodiments in their entirety superior to the alternative embodiments and better suited to enable the foot of the wearer to exercise its biomechanically designed abilities correctly in order to distribute and disperse those ground reaction forces to which the plantar surface of the foot is subjected to upon the shoe contacting the playing field surface, so those forces may be transmitted accordingly across the appropriate structural itinerary of the entire surface of the stationary shoe bottom/outer sole 5, translating above to the stationary mid sole 4 and inner sole 3, and ultimately to the foot of the wearer as the foot progresses through the stance phase, from heel strike to toe off, or any other manner, during the weight bearing mode.

Figure 193:
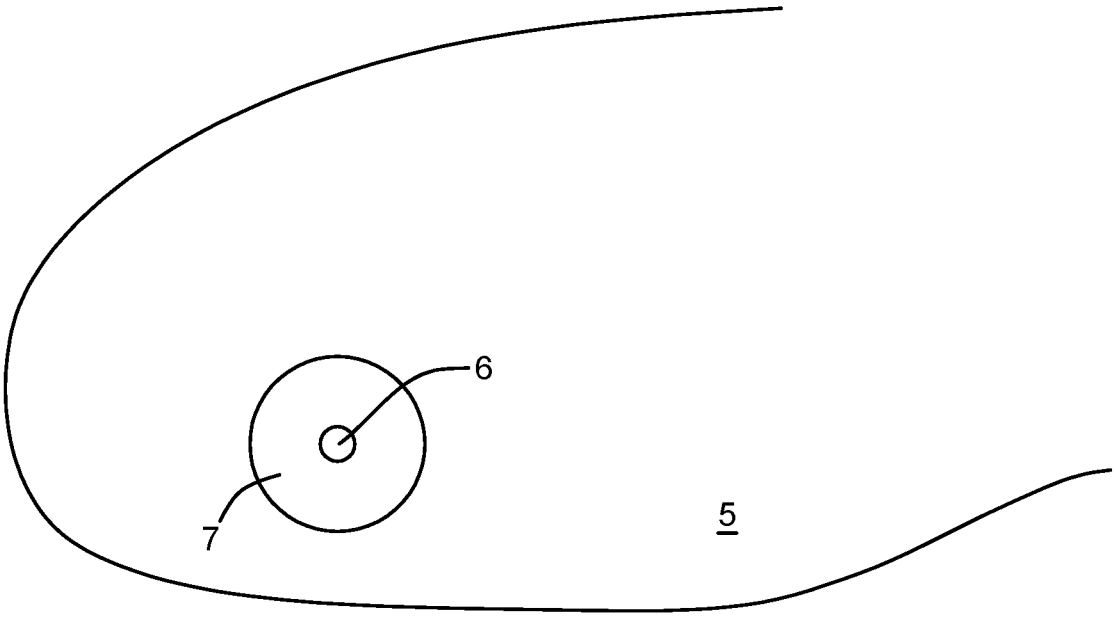
FIG. 193 shows a bottom view of a spike type traction member located in the middle regions of the shoe bottom/outer sole plantar surface, fully surrounded by a compressible cleaning structure which attaches to/originates from the available plantar surface space of the shoe bottom/outer sole surrounding the respective traction member.
Figure 194:
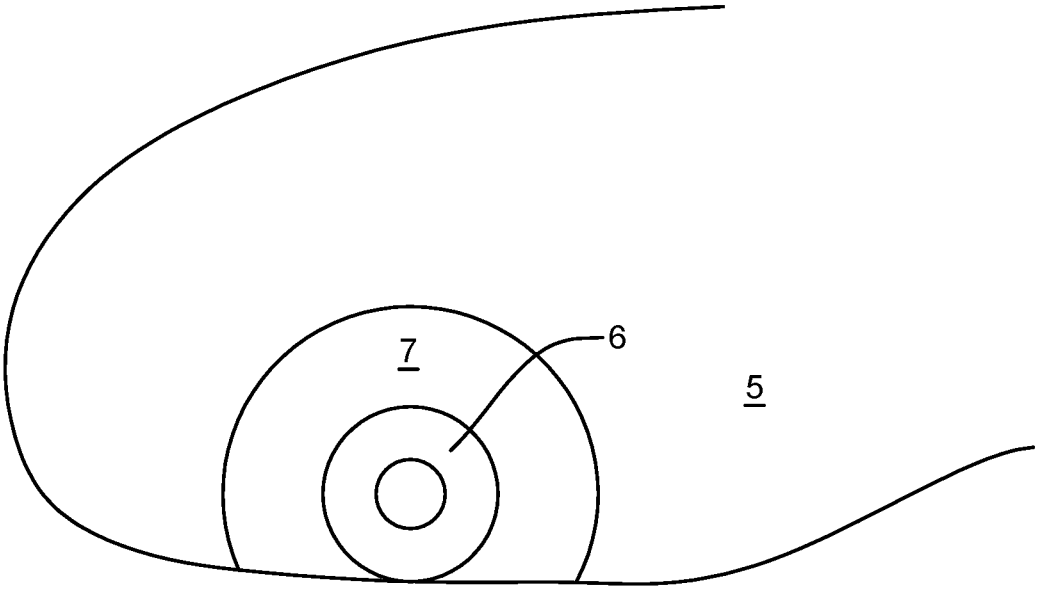
FIG. 194 shows a bottom view of a cleat type traction member located at the extreme peripheral edge of the shoe bottom/outer sole plantar surface, which is lacking and void so to not be fully surrounded by a compressible cleaning structure which only attaches to/originates from the limited available plantar surface space of the shoe bottom/outer sole, and is only partially surrounding of the respective traction member.
Figure 195:
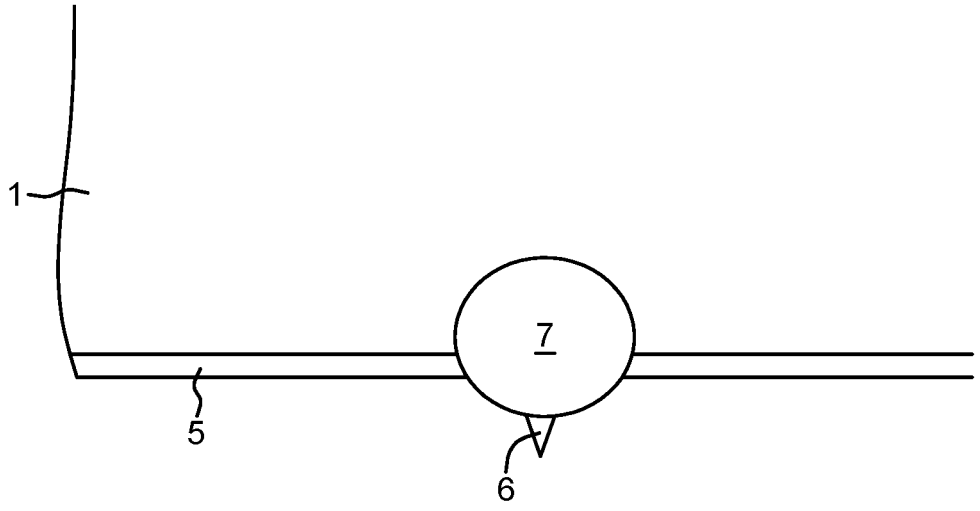
FIG. 195 shows a side view, FIG. 196 a bottom view rotated, and FIG. 197 a left to right frontal view in cross-section of FIG. 196 taken along the viewer's view line "197-197" of FIG. 196, of a compressible cleaning structure fully surrounding a permanently/integrally attached spike type traction member located at the extreme peripheral edge of the shoe bottom/outer sole.
Figure 196:
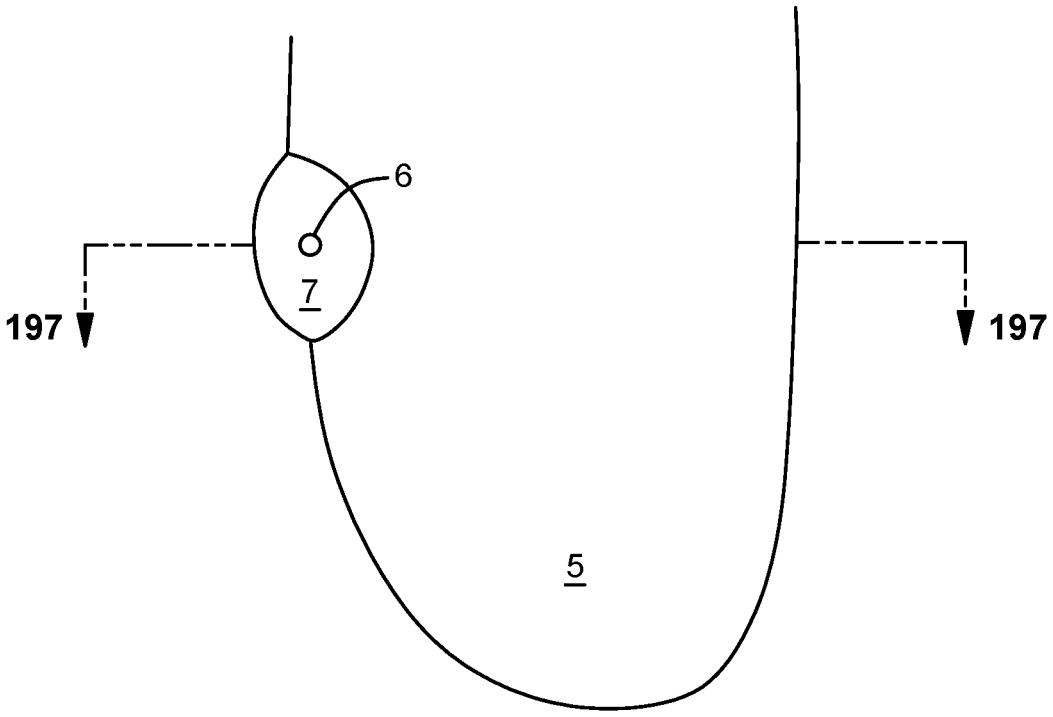
Figure 197:
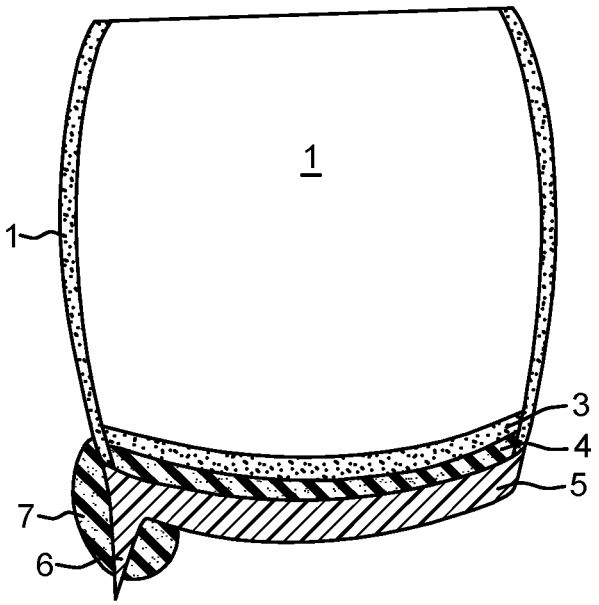
Figure 198:
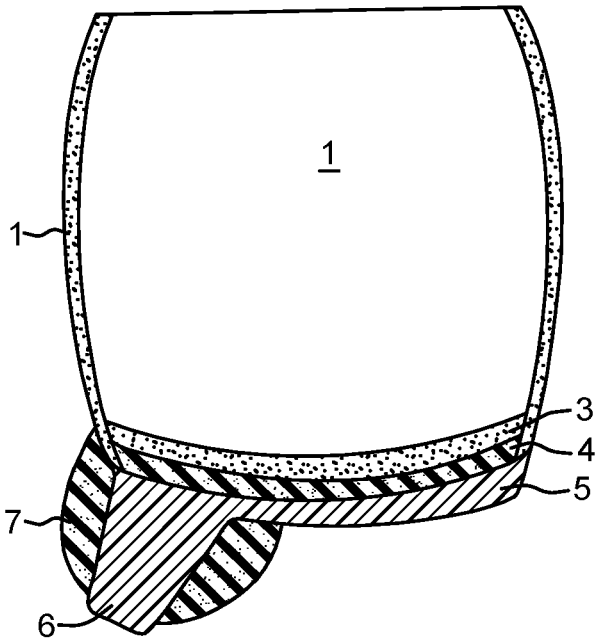
FIG. 198 which is similar to and shows the same view as FIG. 197, but where the traction member in FIG. 198 is oriented angularly and of the permanently/integrally attached cleat type.

For those who have read and appreciate those claims of the present invention, it is of the utmost importance to realize that regardless of the embodiments chosen, choice of materials in structure construction, from which level and/or the means by which they were originated from/secured to those levels, or how their force may be exerted in order to have their compressible cleaning structures 7 clean their traction members 6, it should be understood that the structural design of this invention provides for the ability to potentially clean the most surface area possible of those traction members 6. Therefore, it is conceivable that the compressible cleaning structures 7 would be of a design in which they surround those surfaces of the traction members 6 as best possible, without interfering with the traction members 6 ability to be physically exposed and clean when contacting the playing field surface. For instance, as shown in FIG. 193 from a bottom view with a spike type traction member 6 located in the more middle regions of the shoe bottom/outer sole 5 plantar surface, a traction member 6 of this location is surrounded fully by a compressible cleaning structure 7 attached to/originated from the fully available surrounding plantar surface space of the shoe bottom/outer sole 5 so to be of a configuration/shape that fully surrounds the traction member 6. Shown in FIG. 194 from a bottom view, is a design in which a cleat type traction member 6 is attached to/originated from the extreme peripheral edge of the shoe bottom/outer sole 5 plantar surface which is lacking and void so not to completely surround the traction member 6, with such a traction member 6 surrounded by a compressible cleaning structure 7 design of a configuration/shape limited by the extent to which the shoe bottom/outer sole 5 plantar surface which it attaches to/originates from does exist, thus the compressible cleaning structure 7 is only partially surrounding of the traction member 6, with such a design relying on the intrinsic ability of the peripheral surface of such traction members 6 to be free and clear of debris and/or materials due to the inability of such to adhere to that void of a surrounding plantar surface of the shoe bottom/outer sole 5. As shown in FIGS. 195, 196, and 197, compressible cleaning structure 7 configurations may still fully surround the traction members 6, just as those described as being located in the more middle regions of the shoe bottom/outer sole 5, even when those traction members 6 may be located at the extreme peripheral edge of the shoe bottom/outer sole 5, as shown in FIG. 195 from a side view, FIG. 196 from a bottom view rotated, and FIG. 197 from a left to right frontal view in cross-section of FIG. 196 taken along the viewer's view line "197-197" of FIG. 196, with the respective compressible cleaning structure 7 fully surrounding a spike type traction member 6 of the permanently fixated/integrally attached type, regardless of the void in the surrounding plantar surface of the shoe bottom/outer sole 5. The materials of construction of these compressible cleaning structures 7 of such configurations fully surrounding those traction members 6 located at the extreme shoe bottom/outer sole 5 peripheral plantar surface may extend proximally from the shoe bottom/outer sole 5 and attach to, by any suitable means, the more lateral and/or vertical side aspects and/or layers of the shoe, such as the upper 1 as shown in FIGS. 195 and 197, and/or any other of those structures of the shoe more proximal to the shoe bottom/outer sole 5. In terms of those traction members 6 located at the extreme peripheral edge of the shoe bottom/outer sole 5, as shown in FIG. 198 which is similar to and from the same view as FIG. 197, but where the traction member 6 in FIG. 198 oriented angularly with a permanently fixated/integrally attached cleat type traction member 6, it is conceived that they may be oriented in a biased angular direction away from the shoe bottom/outer sole 5 plantar surface as they extend and project laterally beyond the peripheral aspect of the shoe bottom/outer sole 5 from which they attach/originate from in order to enable them to better contact and traction the playing field surface when that contact between the shoe bottom/outer sole 5 may not, and/or never at all, be fully parallel to that playing field surface, with the understanding that any and all traction member 6 types and their respective compressible cleaning structures 7 may be transposed and oriented in this manner.

It should be clear that the present invention's described abilities and methodologies in the self-cleaning of its traction members 6 in no way infringes upon prior patents, particularly U.S. Pat. Nos. 8,079,160 B2 and 8,256,145 B2, both of which are of the same inventors, Baucom et al., with both assigned to Nike, Inc., and make no claim of any self-cleaning features or provisions, only those of retractable traction elements/members which provide traction upon their extension and contact with the ground. In addition, prior U.S. Pat. No. 8,677,655 B2 by Chen, who also fails to claim any self-cleaning features in his invention, describes his invention as being with that flexible pad and spike set flush with the underside of the out sole part of the shoe when the shoes are not in use, with the spikes hidden in the flexible pads, which is synonymous with as when the shoe is worn in the non-weight bearing mode in which the spikes and flexible pad are both retracted, which just as U.S. Pat. Nos. 8,079,160 B2 and 8,256,145 B2, is different than the preferred embodiments of the present invention in which the traction members 6 and compressible cleaning structures 7 are fully extended when the shoe, as Chen referred to, is not in use, which is synonymous with the shoe not contacting the playing field surface as when being in the non-weight bearing mode. Such prior inventions, regardless of their respective structural designs having been void of such claims in their abilities in the cleaning of their traction elements/members, in no way should be able to claim such. Furthermore, even if such claims were to be made in hindsight, the text affirming the superior abilities of this invention's preferred embodiments is rational proof that these prior patents respective extension biasing mechanism methods employed and their accompanying claims, which if were to be made at any time, are of inferior methods and abilities than those of the preferred embodiments of the present invention for the same reasons and common similarities they share with this invention's argued lesser alternative embodiments. Additionally, however, the alternative embodiments of the present invention are superior to those prior patents, as well as all patents of similar likes, due to the alternative embodiments of the present invention's incorporation of a concave reservoir 9 in their design, for all those same aforementioned reasons associated with the incorporation of a concave reservoir 9 in the preferred embodiments of this invention, and applicably shared too in these alternative embodiments. These alternative embodiments should be further appreciated as superior by those familiar in the art due to their structural designs in which those spaces, referred to as the complementary shaped female holes (I) in these alternative embodiments, which surround those traction members 6 attached to/originated from their mobile layers 14, are a closed space, as explained earlier in the text of the present invention, prohibitive of any debris and/or materials from passing and/or penetrating through the complementary shaped female holes (I) and into that transient space 15 which lies between the mobile layer 14 plantar surface and outer sole 5 dorsal surface in these alternative embodiments.

It should be plainly understood that in their designs lacking in such a closed space design as those of the complementary shaped female holes (I) in the alternative embodiments of the present invention, that those embodiments of prior U.S. Pat. Nos. 8,079,160 B2 and 8,256,145 B2, and other patents of their likes, would be highly prevalent to the presence of any such debris and/or materials infiltrating their "transient space" or their likes of, resulting in the likely obstruction and impairment of both the movement of their "mobile layer" or their likes of, and all its respectively attached structures, ultimately resulting in the lesser abilities and overall compromise in the performance and function in shoes of these such or like designs as a whole. Thus, the preferred embodiments of the present invention, being void of a mobile layer 14 and a transient space 15, and the alternative embodiments of the present invention, the designs of which incorporate their complementary shaped female holes (I) of a closed space with the employment of their mobile layers 14, are both prohibitive in their designs to allow such a detriment to occur.

Beyond this invention's already thoroughly explained sport shoe applications is the further conceptual considerations it offers for its compressible cleaning structures 7 applications adaptable to multiple types of footwear. For instance, it is simple to grasp how those attributes of a compressible cleaning structure 7 and its provision of a clean shoe bottom/outer sole 5 translates to like comparable benefits for those types of footwear commonly worn for hiking, walking, gardening, snow, work, leisure, etc., and/or worn for use on almost any and all other types of venues or terrains, with all such benefits provided to those footwear types to which is applied. All wearers would benefit from the improved traction of the ground surface common to their respective footwear as provided by a compressible cleaning structure 7 in some form or another. In addition, with such a compressible cleaning structure 7, it is simple to appreciate the cleanliness provided to all such footwear by ridding itself of dirt and debris from its shoe bottom/outer sole 5 tread surface, thereby conveniently reducing the likelihood of the carrying, tracking, and dirtying of those preferably clean kept ground surfaces on which that footwear is worn, with less effort required on the part of the wearer, both in upkeep and maintenance of those ground surfaces, as compared to those efforts required if footwear without such a compressible cleaning structure 7 were to be worn on those same surfaces.

Figure 199:
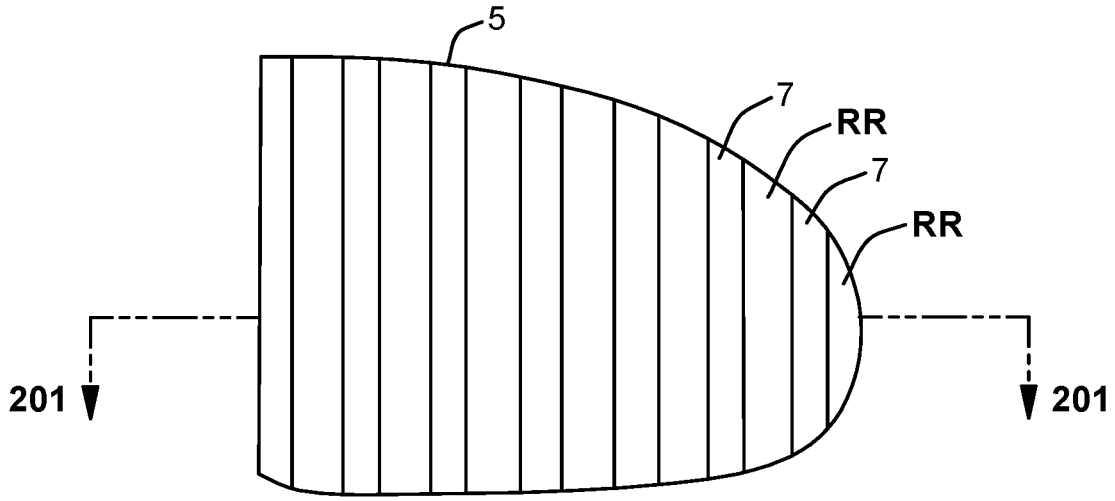
FIGS. 199,200, and 201, show a bottom, side, and left to right frontal view in cross-section of FIG. 199 taken along the viewer's view line "201-201" of FIG. 199, respectively, of a self-cleaning footwear design beyond those sport shoe applications of the present invention, with a shoe bottom/outer sole tread configuration of a parallel raised rib pattern, and the concave reservoir of this design synonymous with the most extreme depth of the depressed concave space between the parallel raised ribs, which is occupied by the respective compressible cleaning structure.
Figure 200:
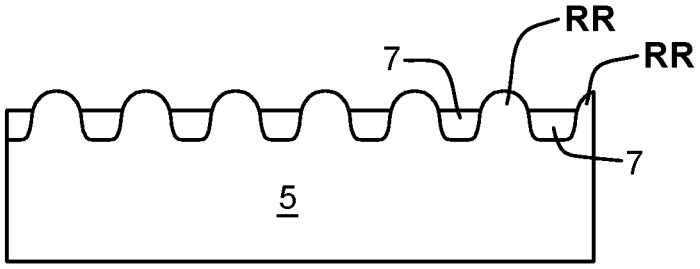
Figure 201:
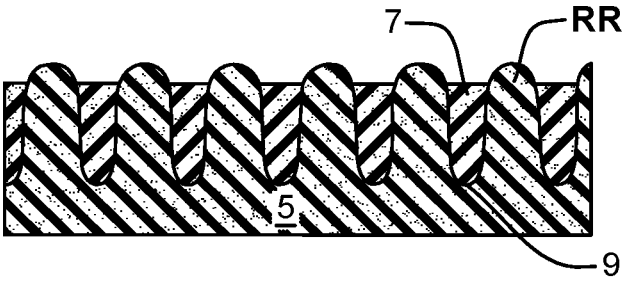
Figure 202:
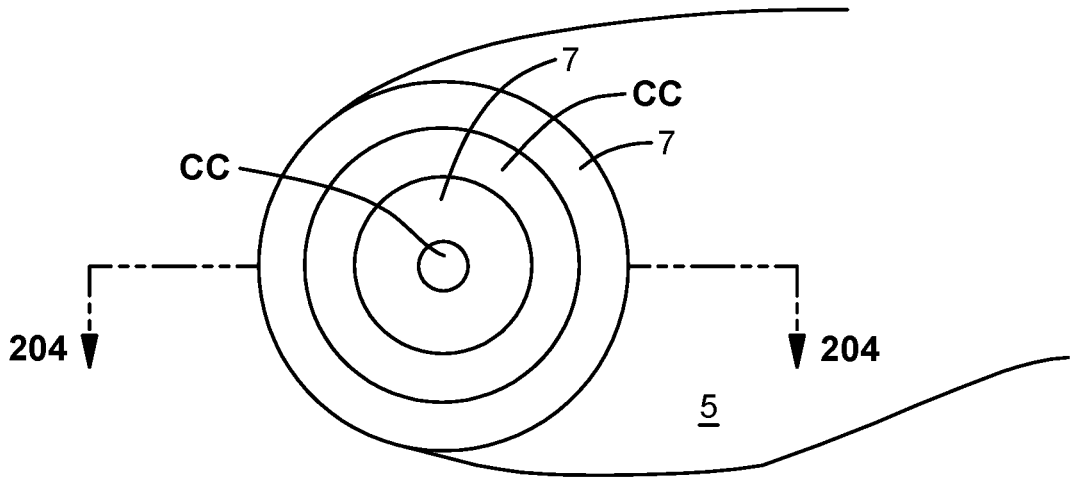
FIGS. 202, 203, and 204, show a bottom, side, and left to right frontal view in cross-section of FIG. 202 taken along the viewer's view line "204-204" of FIG. 202, respectively, of a self-cleaning footwear design beyond those sport shoe applications of the present invention, with a shoe bottom/outer sole tread configuration of a concentric circle pattern, and the concave reservoir of this design synonymous with the most extreme depth of the depressed concave space between the concentric circles, which is occupied by the respective compressible cleaning structure.
Figure 203:
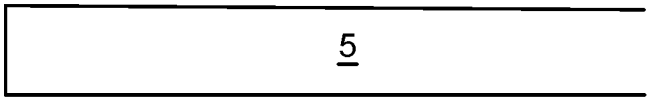
Figure 204:
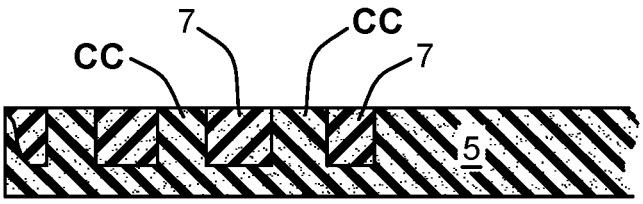

Examples of such types of self-cleaning footwear beyond those sport shoe applications in the present invention may be as, but not limited to, that of a shoe with a shoe bottom/outer sole 5 tread configuration of a parallel raised rib (RR) pattern, as shown in FIG. 199 from a bottom view, FIG. 200 from a side view, and FIG. 201 from a left to right frontal view in cross-section of FIG. 199 taken along the viewer's view line "201-201" of FIG. 199, with the compressible cleaning structure 7 occupying that depressed concave space formed adjacent to and/or between the parallel raised ribs (RR), with the concave reservoir 9 in this such design being synonymous with that space occupied by the compressible cleaning structure 7 adjacent to and/or between the parallel raised ribs (RR) in the shoe bottom/outer sole 5, and a shoe with a shoe bottom/outer sole 5 tread configuration of a concentric circle (CC) pattern, as shown in FIG. 202 from a bottom view, FIG. 203 from a side view, and FIG. 204 from a left to right frontal view in cross-section of FIG. 202 taken along the viewer's view line "204-204" of FIG. 202, with the compressible cleaning structure 7 fully occupying that depressed concave space formed adjacent to and/or between the concentric circles (CC), which have their most distal plantar surfaces at that same level as that of the most distal aspect of the shoe bottom/outer sole 5 plantar surface, so to be a shoe of a relatively flat bottom when in the non-weight bearing mode, with the concave reservoir 9 in this such design being synonymous with that space occupied by the compressible cleaning structure 7 adjacent to and/or between the concentric circles (CC) in the shoe bottom/outer sole 5. Those who have read the prior text and familiarized themselves in the art of the present invention should fully grasp how its concepts and abilities are capably shared and embodied in these two examples. These examples physical designs, as illustrated in their respective figures, should be appreciated as embodiments whose employment of their respective compressible cleaning structures 7 are representative of those concepts of the present invention, and when actually constructed and applied as shown, capably share and embody its same conceived abilities and attributes in their designs. If one does fail to comprehend the workings of the compressible cleaning structures 7 as employed in these two examples, they may reference all other embodiments throughout this text and the pertinent information regarding the explanation of their respectively employed compressible cleaning structures 7, which when determined most appropriate for a particular tread design, could be applied and mated in some form to any one of these types of footwear and their respective tread, so to carry out their cleaning function in that already same referred to and described manner. It should be made clear that these two examples presented along with their accompanying figures are just that, only examples, and that this invention's concept remains the same and is applicable to treads of all shapes and configurations, even those with or without heels. The present invention's unique concept and ability to offer a compressible cleaning structure 6 as an entity which can be applicable to multiple types of footwear with their multiple tread configurations, in one form or another, along with, if and when applicable, its symbiotic mating to its uniquely conceived concave reservoir 9, with the compressible cleaning structure 7 of the permanent and/or temporary type, with and/or without an accommodatingly shaped concave reservoir 9, and attached/secured/fixated by any suitable means chosen, applicable in some appropriate form to any, if not all types of footwear and their respective tread types, should be appreciated by all those who have read and familiarized themselves with the present art.

Any descriptions set forth herein above in the singular tense may be construed to be plural and vice versa, wherever applicable.

In the foregoing description, certain terms and visual depictions are used to illustrate the preferred embodiment and the alternative embodiment designs of the present invention. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing from the scope of the present invention, as noted in the appended Claims.

I claim:

1. A self-cleaning sport shoe, comprising:

a shoe bottom/outer sole having an outer sole surface;

an upper shoe body attached to the shoe bottom/outer sole and configured with an opening for receiving a wearer's foot;

a plurality of traction members attached to the shoe bottom/outer sole surface;

said plurality of traction members being attached to the shoe bottom/outer sole by an attachment selected from the group consisting of a permanent non-removable fastening means and of a removable fastening means;

at least one compressible cleaning structure made of compressible material;

contacting at one end to the shoe bottom/outer sole surface; and at least one traction member of said plurality of traction members attached to said one end of the shoe bottom/outer sole surface;

wherein said compressible cleaning structure, when fully expanded, surrounds said traction member, and wherein a most distal plantar surface of said compressible cleaning structure is selected from the group consisting of being slightly proximal, even with, or slightly distal to a most distal plantar surface of said traction member;

wherein during intended use, the at least one compressible cleaning structure is pressed by some part of the wearer's weight against a surface, and compressed thereby;

wherein said at least one compressible cleaning structure serves to lessen the impact of and disperse a force applied to the sports shoe when said sports shoe contacts a playing field surface, providing cushioning thereto, and ultimately comfort to the foot of the wearer of the sports shoe;

wherein upon releasing the weight pressing the at least one compressible cleaning structure against the surface, the at least one compressible cleaning structure expands to its original shape; and wherein a cycle of compression and then expansion back to its original, non-compressed shape effects the cleaning of the said at least one traction member;

thereby said self-cleaning is provided with the ability to ensure optimal traction, footing, safety and overall athletic performance for the wearer of the sports shoe with each and every step on a sports playing surface; and, said compressible material of said compressible cleaning structure, regardless of materials of construction, is of a lesser durometer relative to that of said traction member surrounded by said compressible cleaning structure;

wherein the at least one compressible cleaning structure comprises a sleeve surrounding the traction members;

wherein the shoe bottom/outer sole surface includes a concave reservoir and wherein an adjacent end of the sleeve of said compressible cleaning structure, of a removable or permanent type, is positioned within the concave reservoir;

said concave reservoir located in at least one of said shoe bottom/outer sole, and/or being continuous with at least one of proximal layers of said self-cleaning sports shoe;

said concave reservoir providing accommodatingly ample room in which said compressible cleaning structure and said traction member of a removable or permanent type, are located, with said compressible cleaning structure is fully compressed in a weight bearing mode with a relatively flat plantar surface of said shoe bottom/outer sole, thereby protecting said compressible cleaning structure when fully compressed in said concave reservoir from exposure to lateral and shearing forces encountered during wear; and, wherein said relatively flat plantar surface of said shoe bottom/outer sole allows for maximum exposure between said plantar surface and the most distal plantar surface of said traction member in the weight bearing mode.

2. The self-cleaning sports shoe of claim 1, further comprising:

whereby when said compressible cleaning structure is attached/fixated and fully tightened via a form of a screw-notch lock mechanism, an area remains between a dorsal convex side of said compressible cleaning structure and an open concave space in the plantar surface of said shoe bottom/outer sole in which it is attached/fixated, said open concave space being a void in space, thereby dispersing and distributing a ground reaction force or other force encountered by the foot of the wearer during the weight bearing mode of wear/play over a larger area than all as described without the incorporated said void in space, providing said wearer with increased comfort and a decreased likelihood of pressure related injuries to the wearer's feet and/or body.

3. The self-cleaning sports shoe of claim 1 further comprising said removable traction member fixated via the tightening of a threaded longitudinal stud in the complementary threaded boss in the shoe bottom/outer sole, incorporated within said concave reservoir, said concave reservoir having an outermost periphery of a height equal to a height of the most distal aspect of said shoe bottom/outer sole at which respective base of, and said traction member begins with the most proximal/deepest aspect of said concave reservoir, at a height equal to a proximal aspect of said shoe bottom/outer sole plantar surface surrounding said concave reservoir.

4. The self-cleaning shoe as in claim 1 further comprising said permanently attached traction member is fixated in a complementary threaded boss, in the shoe bottom/outer sole, incorporated within an accommodatingly shaped concave reservoir, said concave reservoir having an outermost periphery of a height proximal to a height of a respective distal aspect of said shoe bottom/outer sole at which the base of, and the respective traction member begins with the most proximal aspect of the concave reservoir being more proximal and deeper than all other respective aspects of said shoe bottom/outer sole plantar surface.

5. The self-cleaning sports shoe of claim 2, further comprising:

a second concavity being provided in said self-cleaning sports shoe, in addition to said concave reservoir, said second concavity comprising a second open concave space, said second open concave space being located in the plantar surface in said shoe bottom/outer sole of said self-cleaning sports shoe, said second open concave space being of a shape/configuration congruent with the dorsal convex surface/side of said mounting plate component incorporated in said compressible cleaning structure, with said mounting plate component constructed with said concave reservoir, said concave reservoir being said concave space in the plantar surface of said mounting plate component accommodatingly shaped for and to be occupied by said attached, compressible cleaning structure, whereby, when said mounting plate component incorporated in said compressible cleaning structure is attached/fixated and fully tightened via a form of said screw-notch lock mechanism, in said second open concave space, the said compressible cleaning structure and said concave reservoir it occupies and attaches to, fully surround a traction member of the respective type, with respectively congruent surfaces of said dorsal convex surface/side of said mounting plate component being incorporated in said compressible cleaning structure and said plantar surface of said second open concave space touching each other.

6. The self-cleaning sports shoe of claim 5, further comprising:

said second open concave space being an area of volume such that when said mounting plate component incorporated in said compressible cleaning structure is attached/fixated and fully tightened via a form of a screw-notch lock mechanism, in said second open concave space, an open void area will remain located between said dorsal convex surface of said mounting plate component incorporated in said compressible cleanings structure and said plantar surface of said second open concave space in the shoe bottom/outer sole, referred to as said open void area being a void in space, with respective surfaces thereof not touching each other than at a predetermined point shared by their respective congruently shared peripheral shapes/configurations, thereby dispersing and distributing said ground reaction force encountered by the foot of the wearer during the weight bearing mode, and/or any other force encountered during wear/play over a larger area than all those applicably described respective ground force reaction force or other forces in a self-cleaning sports shoe without said void in space, thereby providing said wearer with increased comfort and a decreased likelihood of pressure related injuries to the feet and/or body of the wearer.

7. The self-cleaning sports shoe of claim 1, further comprising:

whereby when said compressible cleaning structure is attached/fixated and fully tightened via a fastener, an area remains between a dorsal convex side of said compressible cleaning structure and said open concave space in the plantar surface of said shoe bottom/outer sole in which said compressible cleaning structure is attached/fixated, and said open concave space being a void in space, with respective surfaces thereof not touching other than at a predetermined point shared by their said same peripheral shape/configurations, thereby dispersing and distributing a ground reaction force encountered by the foot of the wearer during the weight bearing mode, and/or and/or any other force encountered during wear/play over a larger area than all as described without said void in space, providing said wearer with increased comfort and a decreased likelihood of pressure related injuries to the wearer's feet and/or body.

* * * * *